US010133235B2

(12) United States Patent
Ikeda et al.

(10) Patent No.: US 10,133,235 B2
(45) Date of Patent: Nov. 20, 2018

(54) SHAFT MEMBER, END MEMBER, PHOTORECEPTOR DRUM UNIT, DEVELOPING ROLLER UNIT, AND PROCESS CARTRIDGE

(71) Applicant: Mitsubishi Chemical Corporation, Chiyoda-ku (JP)

(72) Inventors: Shuichi Ikeda, Kanagawa (JP); Yohei Matsuoka, Kanagawa (JP); Shinichi Iijima, Glendale, CA (US); Teruyuki Mitsumori, Tokyo (JP); Daishi Kato, Kanagawa (JP); Hiroshi Takata, Kanagawa (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 0 days.

(21) Appl. No.: 15/674,731

(22) Filed: Aug. 11, 2017

(65) Prior Publication Data

US 2017/0371297 A1 Dec. 28, 2017

Related U.S. Application Data

(63) Continuation of application No. PCT/JP2016/054021, filed on Feb. 10, 2016.

(30) Foreign Application Priority Data

Feb. 12, 2015 (JP) ..... 2015-025819

(51) Int. Cl.
*G03G 21/18* (2006.01)
*G03G 21/16* (2006.01)

(52) U.S. Cl.
CPC ..... *G03G 21/1842* (2013.01); *G03G 21/1647* (2013.01)

(58) Field of Classification Search
CPC ..... G03G 21/1842; G03G 21/1647; G03G 15/757
See application file for complete search history.

(56) References Cited

U.S. PATENT DOCUMENTS

2005/0163526 A1 7/2005 Kawai et al.
2006/0133850 A1 6/2006 Nishimura
(Continued)

FOREIGN PATENT DOCUMENTS

JP 2875203 B2 3/1999
JP 2000-98711 A 4/2000
(Continued)

OTHER PUBLICATIONS

Written Opinion dated Mar. 8, 2016 in PCT/JP2016/054021 (with English language translation).
(Continued)

*Primary Examiner* — Erika J Villaluna
(74) *Attorney, Agent, or Firm* — Oblon, McClelland, Maier & Neustadt, L.L.P.

(57) ABSTRACT

There is provided an end member which is disposed in an end portion of a columnar rotating body mounted on an image forming apparatus main body, comprising: a tubular bearing member; and a shaft member held by the bearing member, in which the shaft member includes a rotating shaft which oscillates within a range of 18° or less with respect to a direction along an axis of the bearing member, a rotating force receiving member which is disposed in one end portion of the rotating shaft and is provided with an engaging member which is engaged with a driving shaft of the image forming apparatus main body, and a regulating member which is engaged with or disengaged from the rotating shaft or the rotating force receiving member by pressing, and switches a posture in which the engaging member is
(Continued)

engaged with the driving shaft and a posture in which the engaging member is not engaged with the driving shaft.

17 Claims, 90 Drawing Sheets

(56) References Cited

U.S. PATENT DOCUMENTS

| | | | | |
|---|---|---|---|---|
| 2008/0260428 | A1 | 10/2008 | Ueno et al. | |
| 2011/0158685 | A1 | 6/2011 | Takagi et al. | |
| 2015/0338817 | A1* | 11/2015 | Huang | G03G 15/757 399/167 |

FOREIGN PATENT DOCUMENTS

| | | | |
|---|---|---|---|
| JP | 2008-233868 | A | 10/2008 |
| JP | 2009-169433 | A | 7/2009 |
| JP | 2012-181559 | A | 9/2012 |
| WO | WO 2012/113289 | A1 | 8/2012 |
| WO | WO 2012/152203 | A1 | 11/2012 |

OTHER PUBLICATIONS

International Search Report dated Mar. 8, 2016 in PCT/JP2016/054021 (with English language translation).
Journal of technical disclosure No. 2010-502197, published Apr. 22, 2010 by Japan Institute of Invention and Innovation.

* cited by examiner

SHAFT MEMBER, END MEMBER, PHOTORECEPTOR DRUM UNIT, DEVELOPING ROLLER UNIT, AND PROCESS CARTRIDGE

TECHNICAL FIELD

The present invention relates to a process cartridge which is mounted on an image forming apparatus, such as a laser printer or a copying machine, a photoreceptor drum unit, a developing roller unit, an end member and a shaft member, which are disposed in the process cartridge.

BACKGROUND ART

In an image forming apparatus which is represented by a laser printer or a copying machine, a process cartridge which is attachable to and detachable from a main body (hereinafter, referred to as an "apparatus main body") of the image forming apparatus is provided. The process cartridge is a member which forms contents to be expressed by letters or figures and transfers the contents to a recording medium, such as a paper sheet. Therefore, in the process cartridge, the photoreceptor drum in which the transferred contents are formed is included, and various means for forming the contents to be transferred by acting on the photoreceptor drum are disposed together. Examples of these means include a developing roller unit, a charging roller unit, and means for performing cleaning.

The process cartridge attaches and detaches the same process cartridge to and from the apparatus main body for maintenance, or mounts a new process cartridge on the apparatus main body instead of disengaging an old process cartridge from the apparatus main body. Attaching and detaching the process cartridge in this manner is performed by users of the image forming apparatus themselves, and it is desirable to perform attaching and detaching as easily as possible.

Meanwhile, it is necessary that the photoreceptor drum included in the process cartridge is rotated around an axis during the operation thereof. Therefore, the photoreceptor drum is configured to be engaged with a driving shaft of the apparatus main body directly or via another member at least during the operation, to receive a rotating force from the driving shaft, and to rotate. Therefore, in order to attach and detach the process cartridge to and from the apparatus main body, it is necessary to release (disengage) the engagement between the driving shaft of the apparatus main body and the photoreceptor drum every time attaching and detaching occur, and to mount the process cartridge again.

Here, if it is possible to move the photoreceptor drum (process cartridge) in the axial direction of the driving shaft of the apparatus main body, and to attach and detach the photoreceptor drum, the above-described structure for attaching and detaching is relatively simple. However, from the viewpoint of reducing the image forming apparatus in size or ensuring an attachment and detachment space of the process cartridge, it is preferable to disengage the process cartridge from the apparatus main body to be pulled out in the direction which is different from the axial direction of the driving shaft, and to mount the process cartridge on the apparatus main body to be pushed from this direction.

In PTL 1, a technology in which the driving force from the apparatus main body side is transferred to the photoreceptor drum when a cover of the apparatus main body is closed, and movement to be separated is performed so that the driving force is not transferred to the photoreceptor drum when the cover is opened, is disclosed. Accordingly, the process cartridge can be attached to and detached from the apparatus main body in the direction which is different from the axial direction of the driving shaft.

In addition, there is a technology in which a gear is provided in the photoreceptor drum and the photoreceptor drum rotates by meshing the gear to a gear driven by the apparatus main body.

In addition, in PTL 2, an invention in which the driving shaft of the apparatus main body and the photoreceptor drum unit are engaged with each other via a rotating force transmission component having a trunnion structure attached to the photoreceptor drum, and the photoreceptor drum is rotated, is disclosed. Since the rotating force transmission component can change an angle with respect to the axis of the photoreceptor drum by the trunnion structure, engagement and disengagement between the driving shaft of the apparatus main body and the photoreceptor drum unit are easily performed.

In PTL 3, a technology in which a claw member disposed in a bearing member engaged with the driving shaft is provided to be movable in a radial direction by an elastic member, such as a spring, is disclosed. Accordingly, since the bearing member and the driving shaft are reliably engaged with each other, transmission of a rotating force is appropriately performed, the claw member is movable when attaching and detaching the bearing member and the driving shaft, and thus, the attachment and detachment are smoothly performed.

Furthermore, in PTL 4, a technology in which a claw member provided in the shaft member engaged with the driving shaft rises up by pressing a projection at the center of the shaft member, is disclosed. Accordingly, since the bearing member and the driving shaft are reliably engaged with each other, transmission of a rotating force is appropriately performed, the claw member is movable when attaching and detaching the bearing member and the driving shaft, and thus, the attachment and detachment are smoothly performed.

In NPL 1, a technology in which a bearing member engaged with the driving shaft is provided to be movable in the axial direction by an elastic member, such as a spring, is disclosed. Accordingly, while the bearing member is biased by the elastic member when attaching and detaching the bearing member and the driving shaft, the attachment and detachment are smoothly performed by moving and retreating in the axial direction.

CITATION LIST

Patent Literature

[PTL 1] Japanese Patent No. 2875203
[PTL 2] JP-A-2008-233868
[PTL 3] International Publication No. 2012/113289
[PTL 4] International Publication No. 2012/152203

Non Patent Literature

[NPL 1] Journal of technical disclosure No. 2010-502197, published by Japan Institute of Invention and Innovation

SUMMARY OF INVENTION

Technical Problem

However, in the invention described in PTL 1, when attaching and detaching the process cartridge, a process of moving a rotating body in the axial direction of the rotating body by interlocking the rotating body with the opening and closing of a lid, is included, and a mechanism therefor is necessary. In addition, in the technology in which a gear is provided in the photoreceptor drum, it is possible to directly move the process cartridge in the direction different from the axial direction of the photoreceptor drum, but from the viewpoint of properties of the gear, there is a case where unevenness of rotation of the photoreceptor drum is generated.

In the invention according to PTL 2, it is possible to directly move the process cartridge in the direction (substantially orthogonal direction) which is different from the axial direction of the photoreceptor drum, but a configuration which freely inclines the rotating force transmission component is necessary, and the structure becomes complicated. Accordingly, there is a case where it is difficult to match the axis of a driving transmission shaft and the axis of a driven transmission shaft.

In the invention described in PTL 3 and PTL 4, the driving shaft is smoothly attached and detached in the direction in which the claw member is movable, but meanwhile, since the claw member is not movable in the attachment and detachment in the perpendicular direction, there is a case where the attachment and detachment are difficult. In addition, a failure is likely to be generated in assemblability, and reusability of configuration members is not considered.

In the invention according to NPL 1, there is also a case where the engagement between a groove of the rotating force transmission portion and the rotating force transmission portion on the driving shaft side is weak only when the shaft member is movable in the axial direction, a tapered part is provided and the transmission of the rotating force is not appropriately performed. In addition, when attaching and detaching the process cartridge, there is also a case where a hooked state is generated according to the posture in the rotational direction of the shaft member, and the attachment and detachment are difficult.

Here, in consideration of the above-described problems, an object of the present invention is to provide an end member which can transmit an appropriate rotating force and can be smoothly attached to and detached from an apparatus main body. In addition, the present invention is to provide a photoreceptor drum unit provided with the end member, a process cartridge, and a shaft member provided in the end member.

Solution to Problem

Hereinafter, the present invention will be described.

The present invention is an end member which is disposed in an end portion of a columnar rotating body mounted on an image forming apparatus main body, comprising: a tubular bearing member; and a shaft member held by the bearing member, wherein the shaft member comprises: a rotating shaft which oscillates within a range of 18° or less with respect to a direction along an axis of the bearing member; a rotating force receiving member which is disposed in one end portion of the rotating shaft and is provided with an engaging member which is engaged with a driving shaft of the image forming apparatus main body; and a regulating member which is engaged with or disengaged from the rotating shaft or the rotating force receiving member by pressing, and switches a posture in which the engaging member is engaged with the driving shaft and a posture in which the engaging member is not engaged with the driving shaft.

Here, "columnar rotating body" is a concept including a rotating body which rotates around the axis in a shape of a so-called solid round bar, and a rotating body which rotates around the axis in a so-called hollow cylindrical shape.

As an aspect of the end member of the present invention, for example, the rotating shaft and the rotating force receiving member have a shape of a tube, and at least a part of the regulating member is disposed on an inner side of the shape of a tube of the rotating shaft and the rotating force receiving member.

As an aspect of the end member of the present invention, for example, a posture in which relative rotation with respect to the bearing member is freely performed and a posture in which relative rotation with respect to the bearing member is regulated, are switched to each other in the rotating force receiving member by the regulating member.

As an aspect of the end member of the present invention, for example, a posture in which the engaging member of the rotating force receiving member protrudes and a posture in which the engaging member of the rotating force receiving member is caved are switched to each other by the regulating member.

A photoreceptor drum unit includes: a photoreceptor drum which is a columnar rotating body; and the end member which is attached to at least one end portion in the axial direction of the photoreceptor drum.

A developing roller unit includes: a developing roller which is a columnar rotating body; and the end member which is attached to at least one end portion in the axial direction of the developing roller.

A process cartridge of the present invention includes: a housing; and the photoreceptor drum unit which is held by the housing.

A process cartridge of the present invention includes: a housing; and the developing roller unit which is held by the housing.

As an aspect of the process cartridge of the present invention, for example, incliningly pulling means which is means for inclining the housing with respect to the pulling-out direction when pulling out the housing is provided in the housing.

As an aspect of the process cartridge of the present invention, for example, the incliningly pulling means is means disposed being deviated to a side opposite to the end member to be engaged with the driving shaft of the image forming apparatus main body, from the center in a width direction of the housing.

As an aspect of the process cartridge of the present invention, for example, the incliningly pulling means, which is disposed being deviated to the side opposite to the side on which the end member to be engaged with the driving shaft of the image forming apparatus main body, from the center in the width direction of the housing, is a recessed operating portion provided in the housing.

As an aspect of the process cartridge of the present invention, for example, the incliningly pulling means is means which is disposed being deviated to the same side as the end member to be engaged with the driving shaft of the image forming apparatus main body, from the center in the width direction of the housing.

As an aspect of the process cartridge of the present invention, for example, the incliningly pulling means is means which blocks a part of the recessed operating portion provided in the housing.

As an aspect of the process cartridge of the present invention, for example, the incliningly pulling means is a mark which encourages to operate a part to be operated and is provided in the housing.

As an aspect of the process cartridge of the present invention, for example, the incliningly pulling means in which a surface which is for operating when pulling out the housing and is inclined with respect to the width direction of the housing.

The present invention is a shaft member which is provided in an end member disposed in an end portion of a columnar rotating body mounted on an image forming apparatus main body, the shaft member comprising: a rotating shaft; a rotating force receiving member which is disposed in one end portion of the rotating shaft and is provided with an engaging member which is engaged with a driving shaft of the image forming apparatus main body; and a regulating member which is engaged with or disengaged from the rotating shaft or the rotating force receiving member by pressing, and switches a posture in which the engaging member is engaged with the driving shaft and a posture in which the engaging member is not engaged with the driving shaft.

As an aspect of the shaft member of the present invention, for example, the rotating shaft and the rotating force receiving member have a shape of a tube, and at least a part of the regulating member is disposed on an inner side of the shape of a tube of the rotating shaft and the rotating force receiving member.

As an aspect of the shaft member of the present invention, for example, a posture in which relative rotation with respect to the regulating member is freely performed and a posture in which relative rotation with respect to the regulating member is regulated, are switched to each other in the rotating force receiving member by the regulating member.

As an aspect of the shaft member of the present invention, for example, a posture in which the engaging member of the rotating force receiving member protrudes and a posture in which the engaging member of the rotating force receiving member is caved are switched to each other by the regulating member.

The present invention is a process cartridge which is mounted on an image forming apparatus main body, comprising: a housing; and a photoreceptor drum unit which is disposed in the housing, wherein the photoreceptor drum unit includes a photoreceptor drum and an end member disposed in at least one end portion of the photoreceptor drum, wherein the end member includes a tubular bearing member and a shaft member held by the bearing member, wherein the shaft member includes a rotating shaft which oscillates within a range of 18° or less with respect to a direction along an axis of the bearing member, and is movable in the axial direction, wherein the housing includes a recessed operating portion which is used when a user pulls out the process cartridge from the image forming apparatus main body, and wherein the operating portion includes incliningly pulling means.

The present invention is a process cartridge which is mounted on an image forming apparatus main body, comprising: a housing; and a photoreceptor drum unit which is disposed in the housing, wherein the photoreceptor drum unit includes a photoreceptor drum and an end member disposed in at least one end portion of the photoreceptor drum, wherein the end member includes a tubular bearing member and a shaft member held by the bearing member, wherein the shaft member includes a rotating shaft which oscillates within a range of 18° or less with respect to a direction along an axis of the bearing member, and is movable in the axial direction, wherein the housing includes a recessed operating portion which is used when a user pulls out the process cartridge from the image forming apparatus main body, and wherein the operating portion includes incliningly pulling means which is disposed being deviated to a side opposite to the end member side to be engaged with a driving shaft of the image forming apparatus main body, from the center in a width direction that is a direction in which the axis of the photoreceptor drum unit extends.

The present invention is a process cartridge which is mounted on an image forming apparatus main body, comprising: a housing; and a photoreceptor drum unit which is disposed in the housing, wherein the photoreceptor drum unit includes a photoreceptor drum and an end member disposed in at least one end portion of the photoreceptor drum, wherein the end member includes a tubular bearing member and a shaft member held by the bearing member, wherein the shaft member includes a rotating shaft which oscillates within a range of 18° or less with respect to a direction along an axis of the bearing member, and is movable in the axial direction, wherein the housing includes a recessed operating portion which is used when a user pulls out the process cartridge from the image forming apparatus main body, and wherein the operating portion includes incliningly pulling means, which blocks a part of the recessed operating portion which is the end member side to be engaged with a driving shaft of the image forming apparatus main body, rather than the center in a width direction that is a direction in which the axis of the photoreceptor drum unit extends.

The present invention is a process cartridge which is mounted on an image forming apparatus main body, comprising: a housing; and a photoreceptor drum unit which is disposed in the housing, wherein the photoreceptor drum unit includes a photoreceptor drum and an end member disposed in at least one end portion of the photoreceptor drum, wherein the end member includes a tubular bearing member and a shaft member held by the bearing member, wherein the shaft member includes a rotating shaft which oscillates within a range of 18° or less with respect to a direction along an axis of the bearing member, and is movable in the axial direction, wherein the housing includes a recessed operating portion which is used when a user pulls out the process cartridge from the image forming apparatus main body, and wherein the operating portion is provided being deviated to a side opposite to the end member side to be engaged with a driving shaft of the image forming apparatus main body, from the center in a width direction that is a direction in which the axis of the photoreceptor drum unit extends.

The present invention is a process cartridge which is mounted on an image forming apparatus main body, comprising: a housing; and a photoreceptor drum unit which is disposed in the housing, wherein the photoreceptor drum unit includes a photoreceptor drum and an end member disposed in at least one end portion of the photoreceptor drum, wherein the end member includes a tubular bearing member and a shaft member held by the bearing member, wherein the shaft member includes a rotating shaft which oscillates within a range of 18° or less with respect to a direction along an axis of the bearing member, and is movable in the axial direction, wherein the housing includes a recessed operating portion which is used when a user pulls out the process cartridge from the image forming apparatus main body, and wherein the operating portion is provided while blocking a part of the recessed operating portion which is the end member side to be engaged with a driving shaft of the image forming apparatus main body rather than the center in a width direction that is a direction in which the axis of the photoreceptor drum unit extends.

The present invention is a process cartridge which is mounted on an image forming apparatus main body, comprising: a housing; and a photoreceptor drum unit which is disposed in the housing, wherein the photoreceptor drum unit includes a photoreceptor drum and an end member disposed in at least one end portion of the photoreceptor drum, wherein the end member includes a tubular bearing member and a shaft member held by the bearing member, wherein the shaft member includes a rotating shaft which oscillates within a range of 18° or less with respect to a direction along an axis of the bearing member, and is movable in the axial direction, wherein the housing includes a recessed operating portion which is used when a user pulls out the process cartridge from the image forming apparatus main body, and wherein a mark is provided in the operating portion on a side opposite to the end member side to be engaged with a driving shaft of the image forming apparatus main body than the center in a width direction that is a direction in which the axis of the photoreceptor drum unit extends.

As an aspect of the process cartridge of the present invention, for example, the shaft member includes a rotating force receiving member which is disposed in one end portion of the rotating shaft and includes an engaging member engaged with the driving shaft of the image forming apparatus main body.

As an aspect of the process cartridge of the present invention, for example, the shaft member includes a regulating member which is engaged with or disengaged from the rotating shaft or the rotating force receiving member by pressing, and switches a posture in which the engaging member is engaged with the driving shaft and a posture in which the engaging member is not engaged with the driving shaft.

As an aspect of the process cartridge of the present invention, for example, the rotating shaft moves in the axial direction by rotating around the axis.

Advantageous Effects of Invention

According to the present invention, it is possible to transmit a rotating force equivalent to that of the related art, and attachment to and detachment from the apparatus main body can be more smoothly performed.

DESCRIPTION OF EMBODIMENTS

Figure 1:
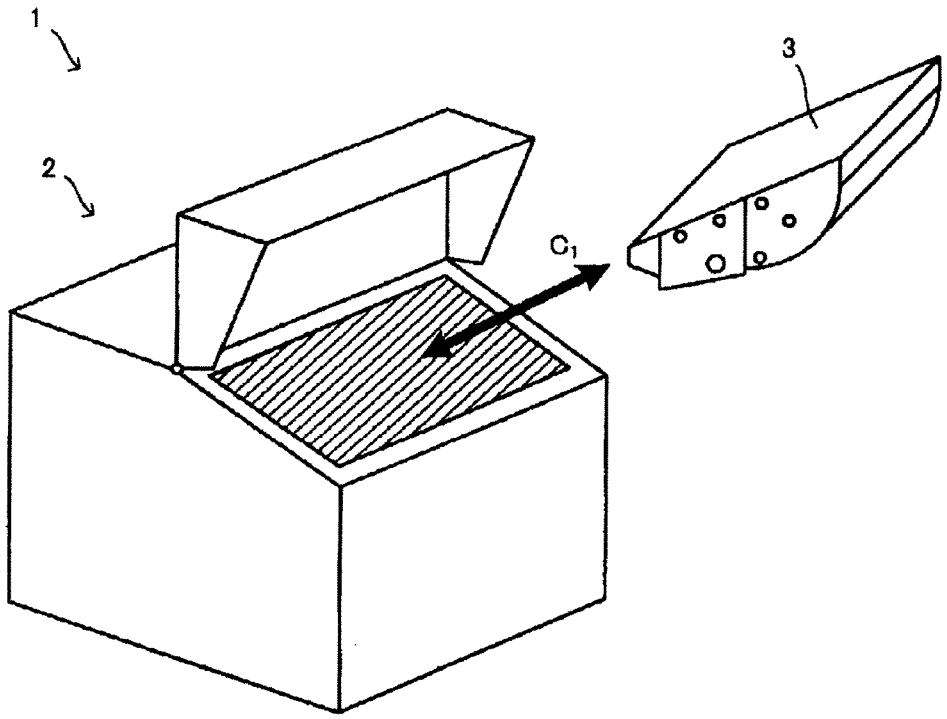
FIG. 1 is a schematic view of an image forming apparatus main body and a process cartridge.

Hereinafter, the present invention will be described based on aspects illustrated in the drawings. However, the present invention is not limited to the aspects.

FIG. 1 is a view illustrating an aspect, and is a perspective view schematically illustrating an image forming apparatus 1 including a process cartridge 3 and an image forming apparatus main body 2 (hereinafter, there is a case of being written as "apparatus main body 2") which mounts and uses the process cartridge 3. The process cartridge 3 can be mounted on and disengaged from the apparatus main body 2 by moving in the direction illustrated by $C_1$ in FIG. 1.

Figure 2:
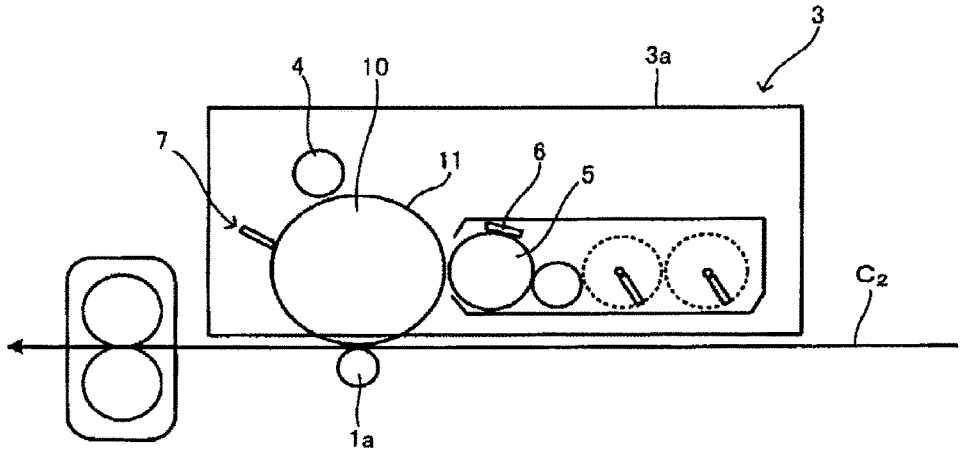
FIG. 2 is a schematic view illustrating a configuration of the process cartridge.

In FIG. 2, a structure of the process cartridge 3 is schematically illustrated. As can be ascertained from FIG. 2, the process cartridge 3 includes a photoreceptor drum unit 10 (refer to FIG. 3) on the inner side of a housing 3*a*, a charging roller unit 4, a developing roller unit 5, a regulating member 6, and a cleaning blade 7. In a posture in which the process cartridge 3 is mounted on the apparatus main body 2, as a recording medium, such as a paper sheet, moves along line illustrated by $C_2$ in FIG. 2, an image is transferred to the recording medium.

In addition, the attachment and detachment of the process cartridge 3 to and from the apparatus main body 2 is generally performed as follows. As the photoreceptor drum unit 10 provided in the process cartridge 3 receives a rotation driving force from the apparatus main body 2, and rotates, a state where a driving shaft 70 (refer to FIG. 16A) of the apparatus main body 2 and an end member 30 (refer to FIG. 4) of the photoreceptor drum unit 10 are engaged with each other at least during the operation, and the rotating force can be transmitted, is achieved (refer to FIG. 17). Meanwhile, when attaching and detaching the process cartridge 3 to and from the apparatus main body 2, it is necessary that the driving shaft 70 and the end member 30 are promptly engaged and disengaged not to interrupt the movement each other regardless of the posture. In this manner, the end member 30 of the photoreceptor drum unit 10 is appropriately engaged with the driving shaft 70 of the apparatus main body 2, and the rotation driving force is transmitted.

Hereinafter, each of the configurations will be described.

In the process cartridge 3, the charging roller unit 4, the developing roller unit 5, the regulating member 6, the cleaning blade 7, and the photoreceptor drum unit 10 are provided, and these members are included on the inner side of the housing 3*a*. Each of these are as follows.

The charging roller unit 4 charges a photoreceptor drum 11 of the photoreceptor drum unit 10 by applying voltage from the apparatus main body 2. The charging is performed as the charging roller unit 4 rotates following the photoreceptor drum 11, and comes into contact with an outer circumferential surface of the photoreceptor drum 11. The developing roller unit 5 is provided with a developing roller which supplies a developer to the photoreceptor drum 11. In addition, an electrostatic latent image formed on the photoreceptor drum 11 is developed by the developing roller unit 5. In addition, in the developing roller unit 5, a fixed magnet is embedded. The regulating member 6 is a member which adjusts an amount of developer that adheres onto the outer circumferential surface of the developing roller of the above-described developing roller unit 5, and imparts a frictional electrification charge to the developer itself.

The cleaning blade 7 is a blade which comes into contact with the outer circumferential surface of the photoreceptor drum 11, and removes the developer remaining after the transfer by a tip end thereof.

Figure 3:
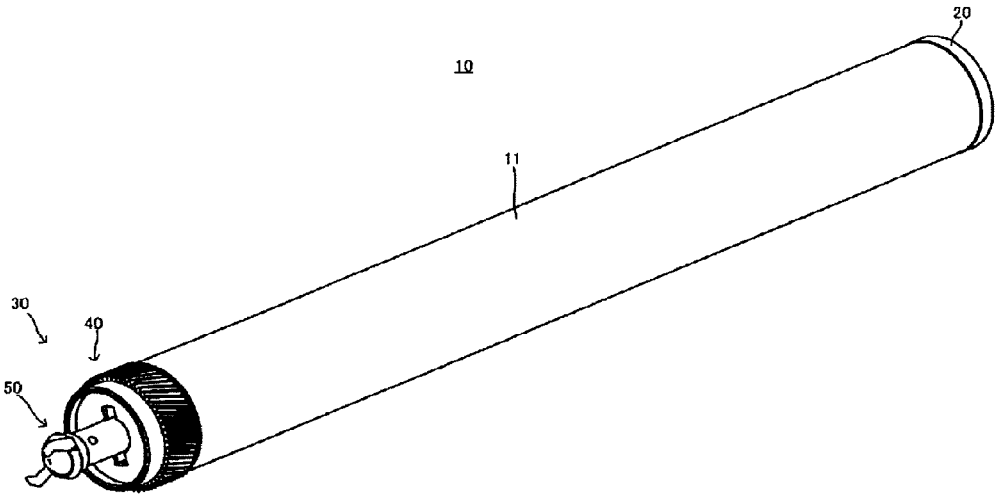
FIG. 3 is an appearance perspective view of a photoreceptor drum unit 10.

The photoreceptor drum unit 10 is provided with the photoreceptor drum 11, and here, letters or figures to be transferred to the recording medium are formed. FIG. 3 is an appearance perspective view of the photoreceptor drum unit 10. As can be ascertained from FIG. 3, the photoreceptor drum unit 10 is provided with the photoreceptor drum 11, a lid member 20, and the end member 30.

The photoreceptor drum 11 is a member which covers a photoreceptor layer on the outer circumferential surface of a base body which is a columnar rotating body. On the photoreceptor layer, characters or figures to be transferred to the recording medium, such as a paper sheet, are formed.

The base body is a member in which a conductive material made of aluminum or aluminum alloy is formed in a cylindrical shape. A type of the aluminum alloy used in the base body is not particularly limited, but 6000 series, 5000 series, and 3000 series aluminum alloys which are defined by JIS standard (JIS H 4140) and are used as the base body of the photoreceptor drum in many cases, are preferable. In addition, the photoreceptor layer formed on the outer circumferential surface of the base body is not particularly limited, and a known material can be employed according to the purpose. It is possible to manufacture the base body by forming the cylindrical shape by a cutting process, an extrusion processing, or a drawing processing. In addition, it is possible to manufacture the photoreceptor drum 11 by laminating by coating the outer circumferential surface of the base body with the photoreceptor layer.

In order to rotate the photoreceptor drum 11 around the axis as will be described later, at least two end members are attached to one end of the photoreceptor drum 11. One end member is the lid member 20, and the other end member is the end member 30.

The lid member 20 is an end member which is disposed in an end portion on a side on which the driving shaft 70 of the apparatus main body 2 is not engaged, among the end portions in the axial direction of the photoreceptor drum 11. The lid member 20 is formed of a resin, and a fitting portion fitted to the cylindrical inner side of the photoreceptor drum 11, and a bearing portion disposed to cover one end surface of the photoreceptor drum 11 are coaxially formed. The bearing portion has a shape of a disk which covers the end surface of the photoreceptor drum 11, and is provided at a part which receives a shaft provided in the housing 3*a*. In addition, in the lid member 20, an earth plate made of a conductive material is disposed, and accordingly, the photoreceptor drum 11 and the apparatus main body 2 are electrically connected to each other. In addition, in the aspect, an example of the lid member is illustrated, but the invention is not limited thereto, and it is also possible to employ a lid member of another aspect which can be generally obtained. For example, a gear for transmitting the rotating force to the lid member may be disposed. In addition, the above-described conductive material may be provided on the end member 30 side.

Figure 4:
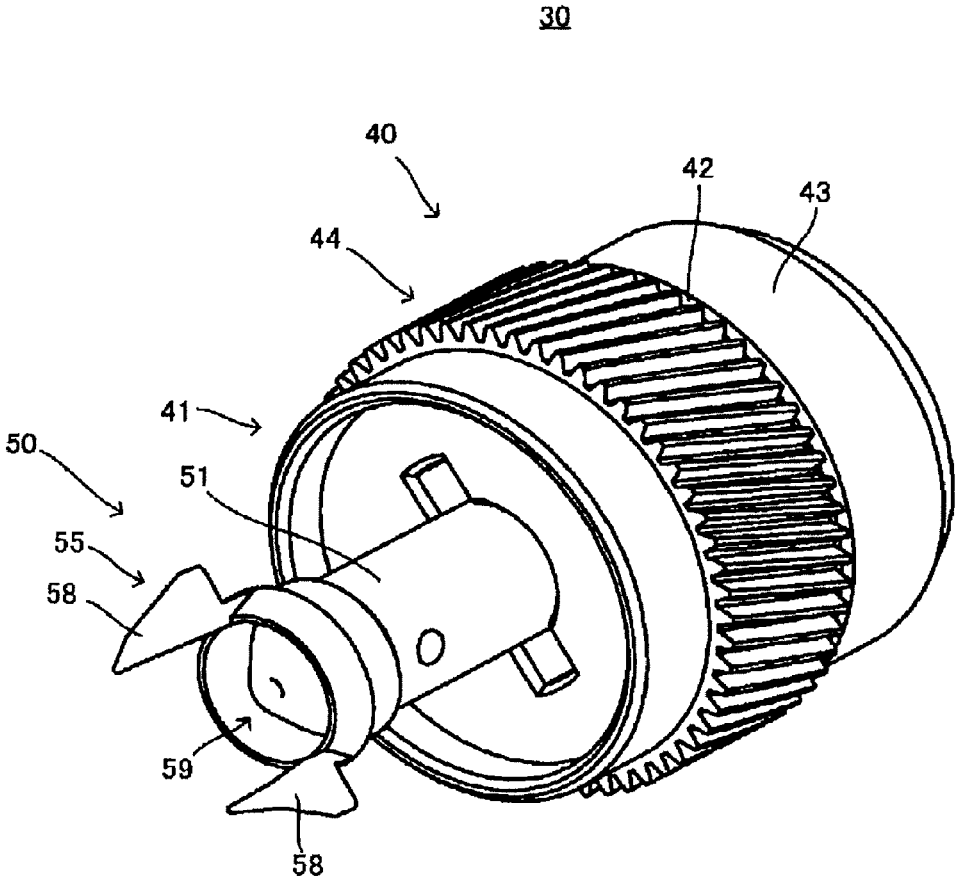
FIG. 4 is a perspective view of an end member 30.
Figure 5:
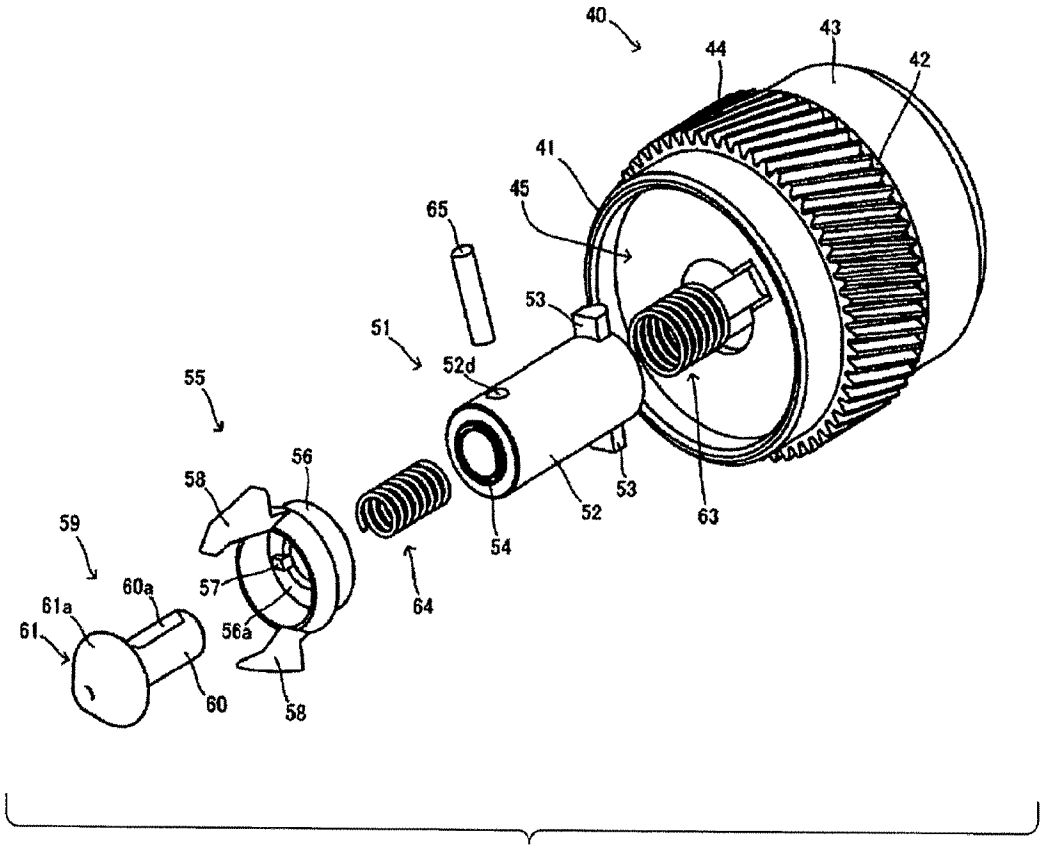
FIG. 5 is an exploded perspective view of the end member 30.

The end member 30 is a member which is attached to the end portion opposite to the lid member 20 among the end portions of the photoreceptor drum 11, and is provided with a bearing member 40 and a shaft member 50. FIG. 4 is a perspective view of the end member 30, and FIG. 5 is an exploded perspective view of the end member 30.

Figure 6A:
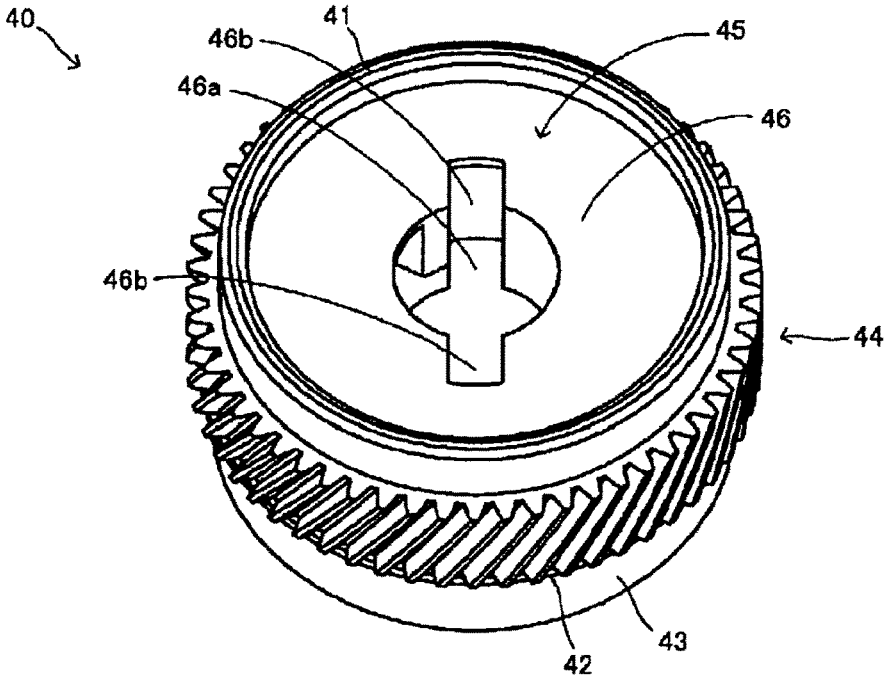
FIG. 6A is a perspective view of a bearing member 40.
Figure 6B:
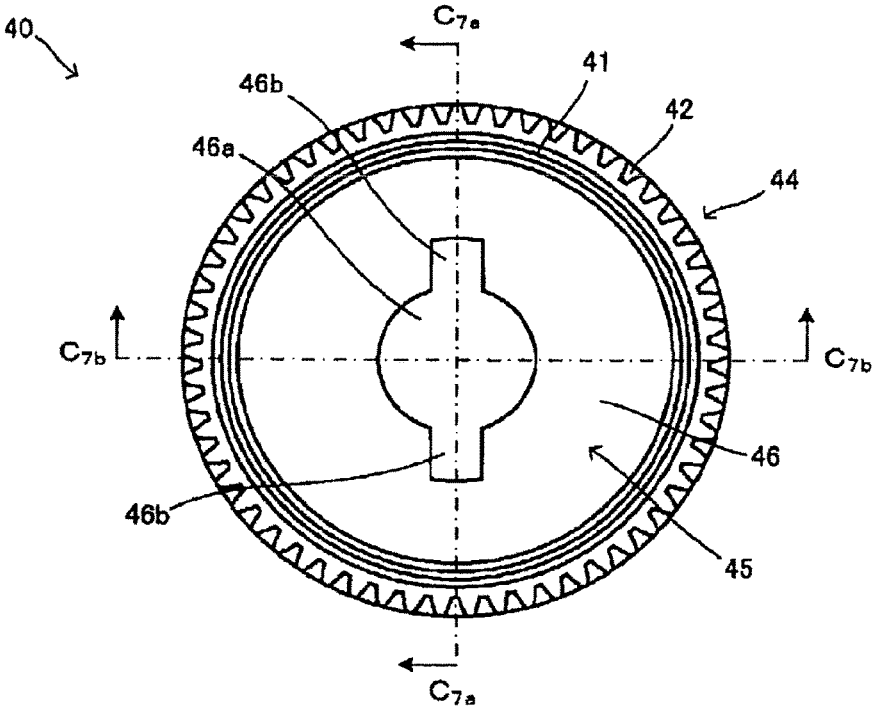
FIG. 6B is a plan view of the bearing member 40.
Figure 7A:
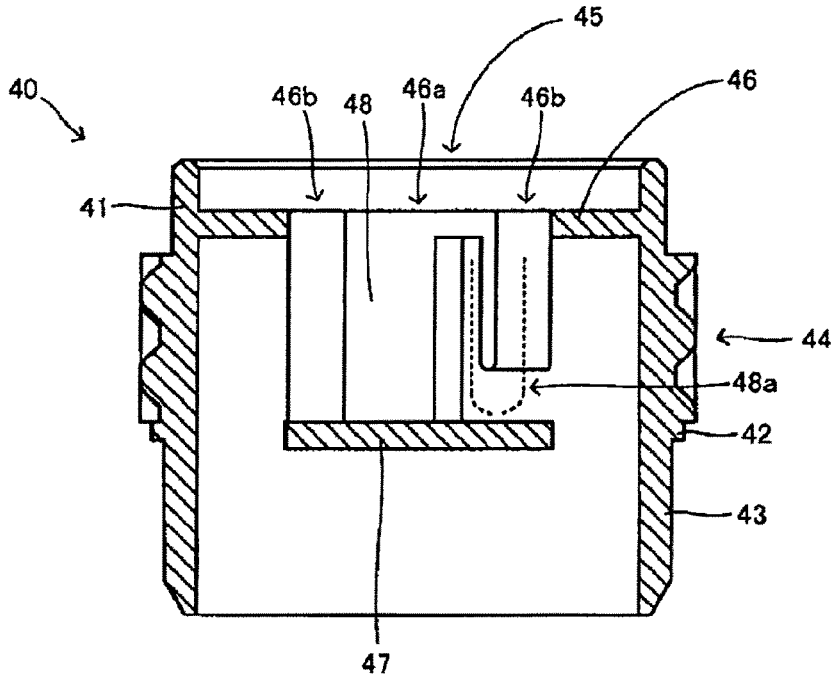
FIG. 7A is a sectional view of the bearing member 40.
Figure 7B:
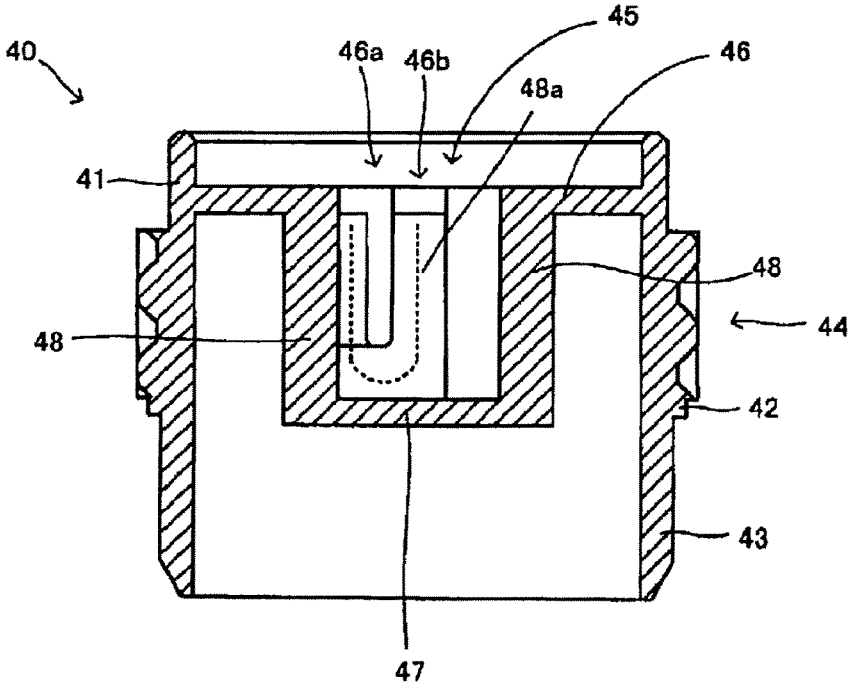
FIG. 7B is another sectional view of the bearing member 40.

The bearing member 40 is a member bonded to the end portion of the photoreceptor drum 11 in the end member 30. FIG. 6A is a perspective view of the bearing member 40, and FIG. 6B is a plan view when viewed from a side on which the shaft member 50 is inserted in the bearing member 40. Furthermore, FIG. 7A is a sectional view along line illustrated by $C_{7a}$-$C_{7a}$ in FIG. 6B, and FIG. 7B is a sectional view along line illustrated by $C_{7b}$-$C_{7b}$ in FIG. 6B. In addition, in each of the drawings illustrated below, there is a case where the end surface (cut surface) is illustrated being hatched in the sectional views.

As can be ascertained from FIGS. 4 to 7, the bearing member 40 is configured to include a tubular body 41, a contact wall 42, a fitting portion 43, a gear portion 44, and a shaft member holding portion 45.

The tubular body 41 is a cylindrical member as a whole, the contact wall 42 and the gear portion 44 are disposed on the outer side thereof, and the shaft member holding portion 45 is formed on the inner side thereof.

The contact wall 42 which comes into contact with and is locked to the end surface of the photoreceptor drum 11 stands from a part of the outer circumferential surface of the tubular body 41. Accordingly, in a posture in which the end member 30 is mounted on the photoreceptor drum 11, the insertion depth of the end member 30 into the photoreceptor drum 11 is regulated. In addition, the fitting portion 43 of which one side is inserted into the inner side of the photoreceptor drum 11 nipping the contact wall 42 of the tubular body 41, is achieved. The fitting portion 43 is inserted into the inner side of the photoreceptor drum 11, and is fixed to the inner surface of the photoreceptor drum 11 by an adhesive. Accordingly, the end member 30 is fixed to the end portion of the photoreceptor drum 11. Therefore, the outer diameter of the fitting portion 43 is substantially the same as the inner diameter of the photoreceptor drum 11 within a range that can be inserted into the inner side of the cylindrical shape of the photoreceptor drum 11. A groove may be formed on the outer circumferential surface in the fitting portion 43. Accordingly, the groove is filled with the adhesive, and adhesiveness between the tubular body 41 (end member 30) and the photoreceptor drum 11 is improved by an anchor effect or the like.

The gear portion 44 is formed on the outer circumferential surface of the tubular body 41 opposite to the fitting portion 43 nipping the contact wall 42. The gear portion 44 is a gear which transmits the rotating force to another member, such as the developing roller unit, and in the aspect, a helical gear is disposed. However, the type of the gear is not particularly limited, and a spur gear may be disposed, and both of the helical gear and the spur gear may be disposed to be aligned in the axial direction of the tubular body. In addition, it is not necessary to provide the gear.

The shaft member holding portion 45 is a part which is formed on the inner side of the tubular body 41, and which has a function of holding the shaft member 50 in the bearing member 40. The shaft member holding portion 45 includes a rotating shaft holding member 46, a support member 47, and a guide wall 48, as can be ascertained from FIGS. 6A to 7B.

The rotating shaft holding member 46 is a plate-like member formed to block the inner side of the tubular body 41, but a hole 46*a* is formed coaxially to an axis of the tubular body 41. As will be described later, since the rotating shaft 51 (refer to FIG. 8) penetrates the hole 46*a*, the hole 46*a* has a size and a shape by which the rotating shaft 51 penetrates. However, in order to prevent the rotating shaft 51 from falling out, the hole 46*a* is formed to be capable of penetrating only a main body 52 of the rotating shaft 51, but not to penetrate a part at which a projection 53 is disposed. From the viewpoint of stable movement of the rotating shaft 51, it is preferable that the hole 46*a* has substantially the same shape and the size as those of the outer circumference of the main body 52 of the rotating shaft 51 within a range that does not largely interrupt the movement of the rotating shaft 51 in the axial direction. In addition, in the rotating shaft holding member 46, two slits 46*b* extend from the hole 46*a*. The two slits 46*b* are provided at a symmetric position nipping the axis of the hole 46*a*. In addition, the size and the shape of the slit 46*b* are formed such that the projection 53 of the rotating shaft 51 (refer to FIG. 8) can penetrate the slit 46*b*.

The support member 47 is a plate-like member which is provided further on the fitting portion 43 side than the rotating shaft holding member 46, and which is formed to block at least a part of the inner side of the tubular body 41. The support member 47 is formed to have a size which can support at least a rotating shaft elastic member 63 that will be described later.

The guide wall 48 is a tubular member which extends parallel to the axial direction of the tubular body 41 from an edge of the hole 46*a* of the rotating shaft holding member 46, and in which an end portion thereof is connected to the support member 47. In the aspect, the sectional shape of the inner side of the guide wall 48 is the same as that of the hole 46*a*. However, as will be described later, since the main body 52 of the rotating shaft 51 is inserted into the inner side of the guide wall 48 and the rotating shaft 51 moves in the axial direction, the shape and the size by which the movement is possible are formed. In addition, in the guide wall 48, a slit 48*a* is formed. In FIGS. 7A and 7B, in order to make it easy to understand, a direction in which the slit 48*a* extends is illustrated by a dotted line. After one end side of the slit 48*a* in the longitudinal direction passes through the slit 46*b* of the rotating shaft holding member 46, extends parallel to the axis of the tubular body 41, and reaches the support member 47, the slit 48*a* extends parallel to the axial direction to make a U-turn, and the end portion (the other end side) reaches the rotating shaft holding member 46. Therefore, the other end side is blocked by the rotating shaft holding member 46. The slit width of the slit 48*a* is formed such that the projection 53 of the rotating shaft 51 (refer to FIG. 8) can move in the slit 48*a*.

A material which configures the bearing member 40 is not particularly limited, but a resin, such as polyacetal, polycarbonate, or PPS, or metal can be used. Here, in order to improve the rigidity of the member in a case of using a resin, glass fibers or carbon fibers may be mixed into the resin in accordance with the load torque. In addition, in order to make the attachment or the movement of the shaft member smooth, sliding properties may be improved by containing at least one type of a fluororesin, polyethylene, and silicon rubber in the resin. In addition, the resin may be coated with fluororesin or lubricant. In a case of making the member by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

Returning to FIGS. 4 and 5, the shaft member 50 of the end member 30 will be described. As can be ascertained from FIG. 5, the shaft member 50 is provided with the rotating shaft 51, a rotating force receiving member 55, and a regulating member 59. Furthermore, the shaft member 50 is provided with the rotating shaft elastic member 63, a regulating member elastic member 64, and a pin 65. Any of the rotating shaft elastic member 63 and the regulating member elastic member 64 in the aspect is a coiled spring. Hereinafter, each of the members will be described.

Figure 8A:
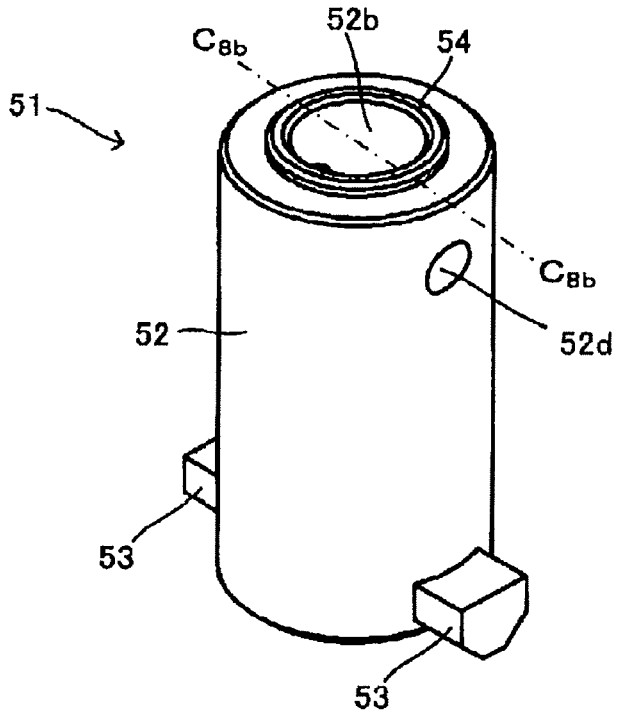
FIG. 8A is a perspective view of a rotating shaft 51.

The rotating shaft 51 is a shaft-like member which functions as a rotating force transmission portion which transmits the rotating force received by the rotating force receiving member 55 to the bearing member 40. FIG. 8A is a perspective view of the rotating shaft 51, and FIG. 8B is a sectional view in the axial direction including line illustrated by $C_{8b}$-$C_{8b}$ in FIG. 8A, respectively.

Figure 8B:
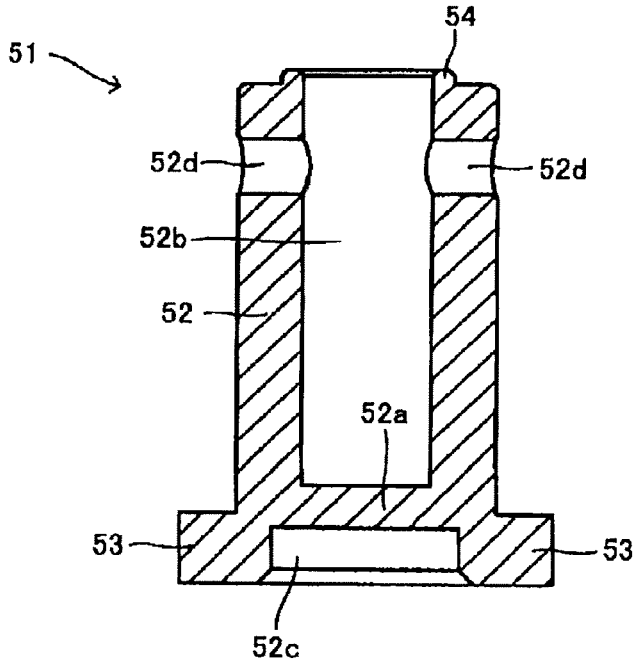
FIG. 8B is a sectional view of the rotating shaft 51.

As can be ascertained from FIGS. 8A and 8B, the rotating shaft 51 includes the cylindrical main body 52, and a partition portion 52*a* is provided to close the inner portion on the inside of the cylinder. Therefore, recessed portions 52*b* and 52*c* are formed on one side and on the other side nipping the partition portion 52*a* on the inner side of the main body 52. Two projections 53 are disposed on the outer side in one end portion of the main body 52. Two projections 53 are provided on the same line in one diameter direction of the cylinder of the main body 52 to be on the opposite sides nipping the axis. The two projections 53 have a function of holding the rotating shaft 51 by the bearing member 40 and regulating the movement of the main body 52, as will be described later. In addition, in the rotating shaft 51, two holes 52*d* which are disposed in one diameter direction of the cylinder being orthogonal to the axis of the cylinder, and penetrate the inside and the outside, are formed. As will be described later, the pin 65 (refer to FIG. 5) passes through the hole 52*d*, and the pin 65 holds the regulating member 59 and regulates the movement of the regulating member 59. Furthermore, on the end surface (end surface formed on the side opposite to the projection 53 side) on the recessed portion 52*b* side among the end surfaces of the main body 52, an annular rail projection 54 which protrudes in the direction (direction parallel to the axis) in which the cylinder extends to frame an opening portion of the recessed portion 52*b*, is provided. As will be described later, the rail projection 54 functions as a rail that guides rotation of the rotating force receiving member 55.

Here, one example of the rotating shaft 51 is described, but the shape of the rotating shaft is not limited to the rotating shaft 51 as long as the rotating shaft acts and achieves the functions as will be described later. For example, the partition portion 52*a* of the rotating shaft 51 becomes unnecessary by forming the rotating shaft elastic member 63 and the regulating member elastic member 64 by a two-stepped spring. In addition, as will be described later, since rotation of the rotating force receiving member 55 around the axis is basically ensured by the regulating member 59, and the rail projection 54 is not necessarily provided.

Figure 9A:
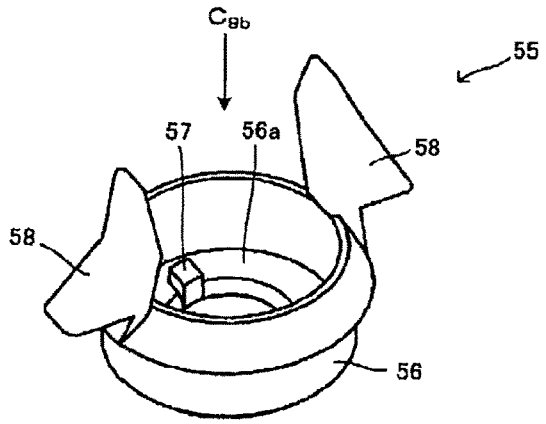
FIG. 9A is a perspective view of a rotating force receiving member 55.
Figure 9B:
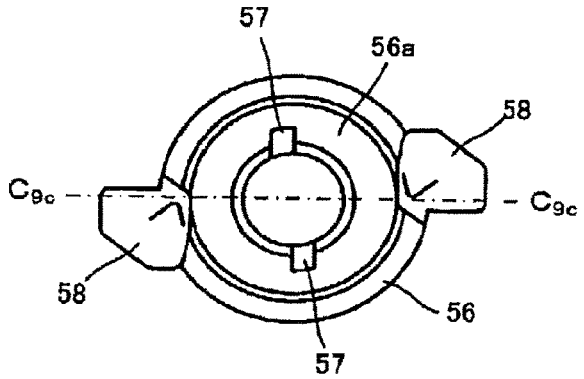
FIG. 9B is a plan view of the rotating force receiving member 55.
Figure 9C:
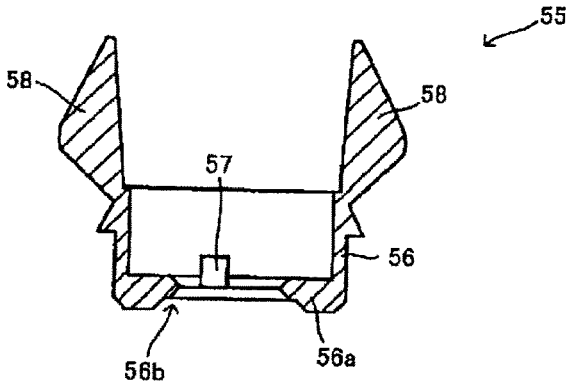
FIG. 9C is a sectional view of the rotating force receiving member 55.

The rotating force receiving member 55 is a member which receives the rotation driving force from the apparatus main body 2 (refer to FIG. 1) and transmits the driving force to the rotating shaft 51 when the end member 30 is in a predetermined posture. FIG. 9A is a perspective view of the rotating force receiving member 55, FIG. 9B is a plan view of the rotating force receiving member 55 when viewed from a direction illustrated by an arrow $C_{9b}$ in FIG. 9A, and FIG. 9C is a sectional view cut by line illustrated by $C_{9c}$-$C_{9c}$ in FIG. 9B, respectively.

As can be ascertained from FIGS. 4, 5, and 9A to 9C, the rotating force receiving member 55 is configured to include a cylindrical base portion 56 and two engaging members 58 which stand from one end portion of the base portion 56. The base portion 56 is cylindrical, and an annular piece 56*a* is provided such that the opening portion is nipped in the opening portion on one end side. A guide 56*b* which is an annular cavity is formed on a surface opposite to the base portion 56 of the piece 56*a*. The guide 56*b* guides rotation of the base portion 56 being loaded on the rail projection 54 (refer to FIG. 8B) of the above-described rotating shaft 51. In addition, two projections 57 are provided to oppose each other on a surface on the inner side of the base portion 56 of the piece 56*a*. Here, an example in which two projections 57 are provided is illustrated, but at least two projections may be provided, and three or more projections may be provided. In addition, it is preferable to provide the projections at an equivalent interval around the axis. In addition, in the rail projection 54, the guide 56*b* is not necessarily provided as described.

Two engaging members 58 are disposed in an end portion on the side opposite to the side on which the piece 56*a* of the base portion 56 is provided, and are apart from the axis of the base portion 56 by the same distance, and both of the engaging members 58 are disposed at a symmetric position nipping the axis. An interval between two engaging members 58 is formed to be substantially the same as or to be slightly greater than the diameter of a shaft portion 71 of the driving shaft 70 (refer to FIG. 16A) which will be described later. The interval between two engaging members 58 is configured such that a tip end portion of a pin 72 (rotating force transmitting member) is hooked to the engaging member 58 in a posture in which the shaft portion 71 of the driving shaft 70 is disposed between the two engaging members 58 as can be ascertained with reference to FIG. 17.

How the rotating force can be received from the driving shaft 70 will be described later.

Figure 10A:
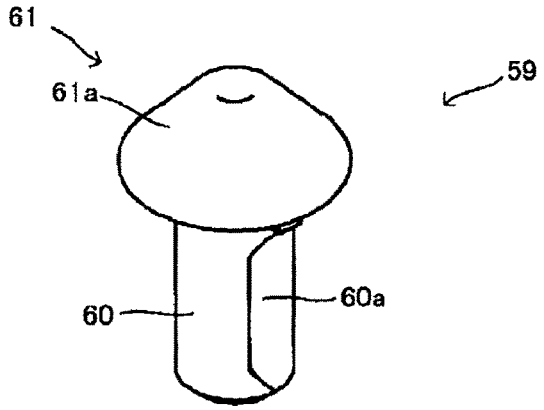
FIG. 10A is a perspective view of a regulating member 59.

The regulating member 59 is a member which switches a state where the engaging member 58 of the rotating force receiving member 55 can transmit the driving force from the driving shaft 70 to the bearing member 40 and a state where the engaging member 58 cannot transmit the driving force and freely rotates, to each other. In other words, a posture in which the engaging member 58 is engaged with the driving shaft 70 and can transmit the rotating force and a posture in which the engagement is regulated (not engaged) and the engaging member 58 cannot transmit the rotating force, are switched to each other. FIG. 10A is a perspective view of the regulating member 59, FIG. 10B is a front view of the regulating member 59, and FIG. 10C is a side view of the regulating member 59, respectively.

Figure 10B:
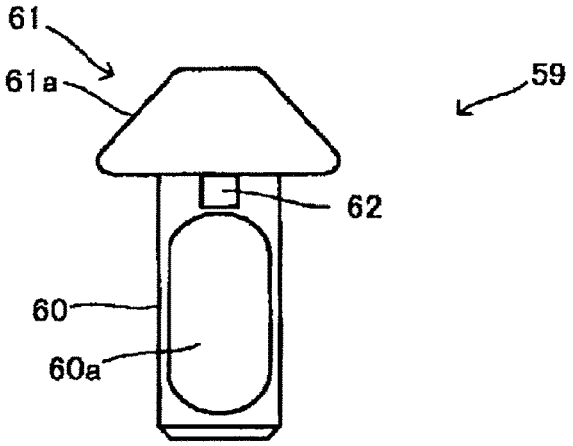
FIG. 10B is a front view of the regulating member 59.
Figure 10C:
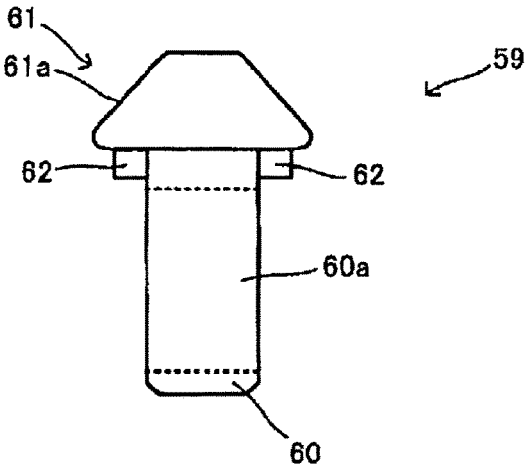
FIG. 10C is a side view of the regulating member 59.

As can be ascertained from FIGS. 10A to 10C, the regulating member 59 includes a columnar regulating shaft 60, in which a long hole 60*a* that penetrates in a direction orthogonal to the axis of the regulating shaft 60 and is a long hole in the axial direction, is provided.

In addition, a contact portion 61 formed to be thicker than the regulating shaft 60 is provided on one end side of the regulating shaft 60. As can be ascertained from FIGS. 10B and 10C, the contact portion 61 includes an inclined surface 61*a* which is the thickest on the regulating shaft 60 side and becomes thin as being apart from the regulating shaft 60. Furthermore, in the end portion of the regulating shaft 60, two projections 62 are disposed on an outer circumferential portion on the side on which the contact portion 61 is disposed. The two projections 62 are disposed on the opposite sides nipping the axis in a column of the regulating shaft 60, and are provided on the same line in one diameter direction. Two projections 62 regulate the rotating force receiving member 55 as will be described later. In addition, in the aspect, two projections 62 are described as an example, but at least two projections may be provided, or three or more projections may be provided.

Returning to FIG. 5, other configuration elements provided in the shaft member 50 will be described. The rotating shaft elastic member 63 and the regulating member elastic member 64 are so-called elastic members, and are coiled springs in the aspect. In addition, the pin 65 is a rod-like member. The dispositions and the actions of each of the members will be described later.

A material which configures each member of the shaft member 50 is not particularly limited, but a resin, such as polyacetal, polycarbonate, or PPS can be used. However, in order to improve the rigidity of the member, glass fibers or carbon fibers may be mixed into the resin in accordance with the load torque. In addition, the rigidity may further be improved by inserting metal into the resin, or the entire body may be manufactured by metal. In a case of making the member by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating. In addition, from the viewpoint of having elasticity, the shaft member 50 and any member included in the shaft member 50, may be made by bending a metal plate, or may be made by making the metal, glass, or carbon fiber infiltrate into the resin.

By combining the bearing member 40 and the shaft member 50 with each other as described above, the end member 30 is made. In addition, by describing the combination, the size of each member and part, the structure, or the relationship of the sizes of the members and parts, are further understood.

Figure 11A:
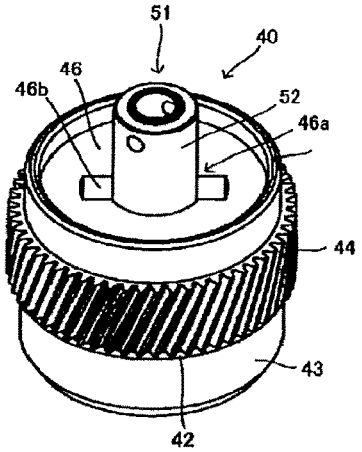
FIG. 11A is a perspective view illustrating that the bearing member 40 and the rotating shaft 51 are combined with each other.

First, a combination of the bearing member 40 and the rotating shaft 51 will be described. FIG. 11A is a perspective view in which the rotating shaft 51 is combined with the bearing member 40, FIG. 11B is a plan view thereof, and FIG. 11C is an arrow sectional view illustrated by $C_{11c}$-$C_{11c}$ in FIG. 11B.

Figure 11B:
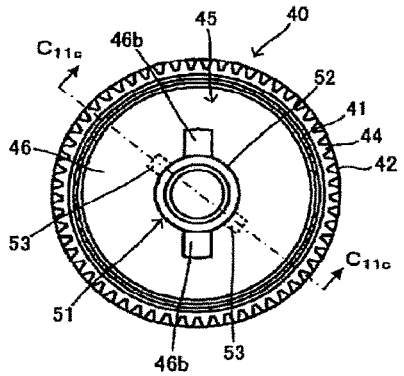
FIG. 11B is a plan view illustrating that the bearing member 40 and the rotating shaft 51 are combined with each other.
Figure 11C:
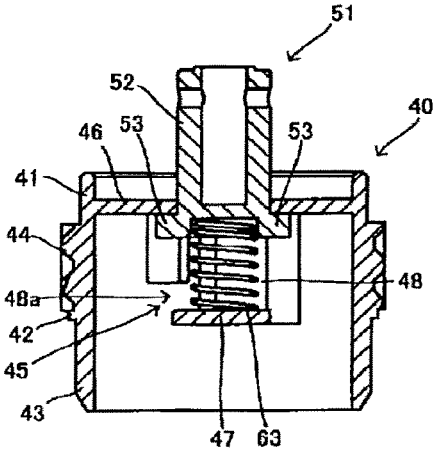
FIG. 11C is a sectional view illustrating that the bearing member 40 and the rotating shaft 51 are combined with each other.

As can be ascertained from FIGS. 11A to 11C, the rotating shaft 51 passes through the hole 46*a* of the rotating shaft holding member 46 of the bearing member 40, and the end portion on the side on which the projection 53 is disposed on the inner side of the shaft member holding portion 45 and the end portion on the side opposite thereto is disposed to protrude from the bearing member 40. At this time, as the projection 53 is disposed in the end portion on the side blocked by the rotating shaft holding member 46 among the end portions of the slit 48*a* provided in the guide wall 48, and is hooked to the rotating shaft holding member 46, the rotating shaft 51 is configured not to fall out from the bearing member 40. In addition, as can be ascertained from FIG. 11C, the rotating shaft elastic member 63 is disposed between the rotating shaft 51 and the support member 47, and the rotating shaft 51 is biased in a direction in which the projection 53 is pressed to the rotating shaft holding member 46.

The attachment of the rotating shaft 51 to the bearing member 40 can be performed by inserting the projection 53 of the rotating shaft 51 into the slit 48*a* from the slit 46*b*, and by moving the projection 53 in the slit 48*a* along a dotted line illustrated in FIGS. 7A and 7B.

Figure 12A:
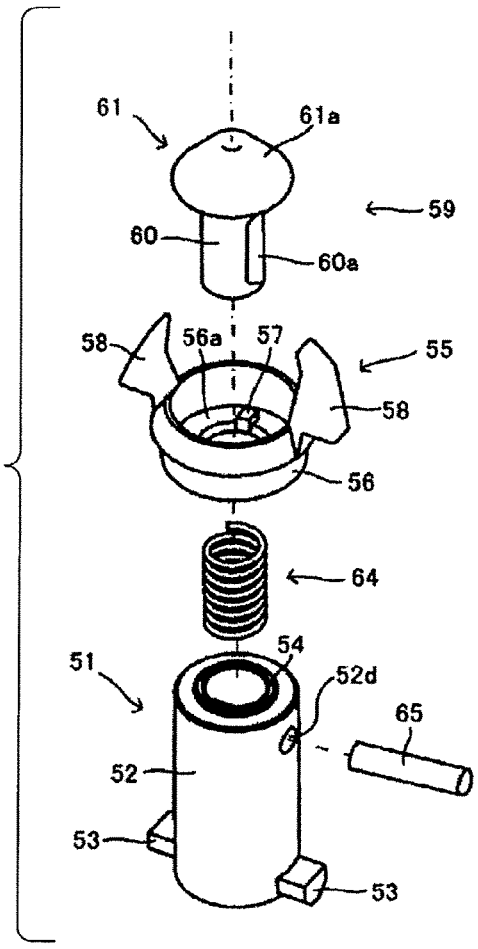
FIG. 12A is an exploded perspective view of a shaft member 50 of FIG. 5.

Next, combination of other members with the rotating shaft 51 in the shaft member 50 will be described. FIG. 12 illustrates a view for describing this. FIG. 12A is an exploded perspective view, and FIG. 12B is a sectional view of the shaft member 50 in a direction along the axis.

Figure 12B:
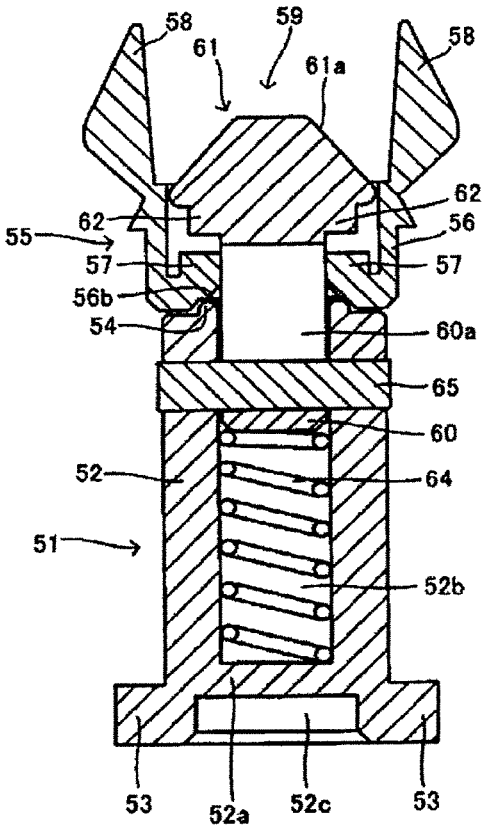
FIG. 12B is a sectional view of the shaft member 50 of FIG. 5.

As can be ascertained from FIG. 12B, the regulating member elastic member 64 is disposed on the inner side of the recessed portion 52*b* of the main body 52 of the rotating shaft 51. Therefore, one end portion of the regulating member elastic member 64 is supported by the partition portion 52*a* of the main body 52. Meanwhile, the end portion of the regulating member 59 on the side on which the contact portion 61 is not disposed in the regulating shaft 60 passes through the base portion 56 of the rotating force receiving member 55, and further, is inserted into the recessed portion 52*b* of the main body 52 of the rotating shaft 51. Accordingly, the rotating force receiving member 55 is disposed on the end surface opposite to the projection 53 in the main body 52 of the rotating shaft 51. At this time, the engaging member 58 of the rotating force receiving member 55 is disposed to protrude to the side opposite to the rotating shaft 51, and the guide 56*b* of the rotating force receiving member 55 is disposed to overlap the rail projection 54 disposed on the end surface of the main body 52 of the rotating shaft 51. In addition, one end of the regulating member 59 is inserted into the recessed portion 52*b* formed in the main body 52 of the rotating shaft 51, and the end surface thereof comes into contact with the other end portion of the regulating member elastic member 64. Accordingly, the regulating member 59 is biased in a direction of protruding from the main body 52. In addition, the other end (that is, end portion on a side on which the contact portion 61 is disposed) of the regulating member 59, and the contact portion 61, are disposed on the inner side of the base portion 56 of the rotating force receiving member 55 and between two engaging members 58.

Furthermore, the pin 65 passes through a long hole 59*a* provided in the regulating shaft 60 of the regulating member 59, and both ends of the pin 65 are disposed to cross over the two holes 52*d* of the rotating shaft 51. Accordingly, falling-out of the regulating member 59 from the main body 52 of the rotating shaft 51 against a biasing force of the rotating shaft elastic member 63 is regulated.

By combining the members as described above, the axes of each of the bearing member 40 and the shaft member 50 are disposed to match each other.

Figure 13:
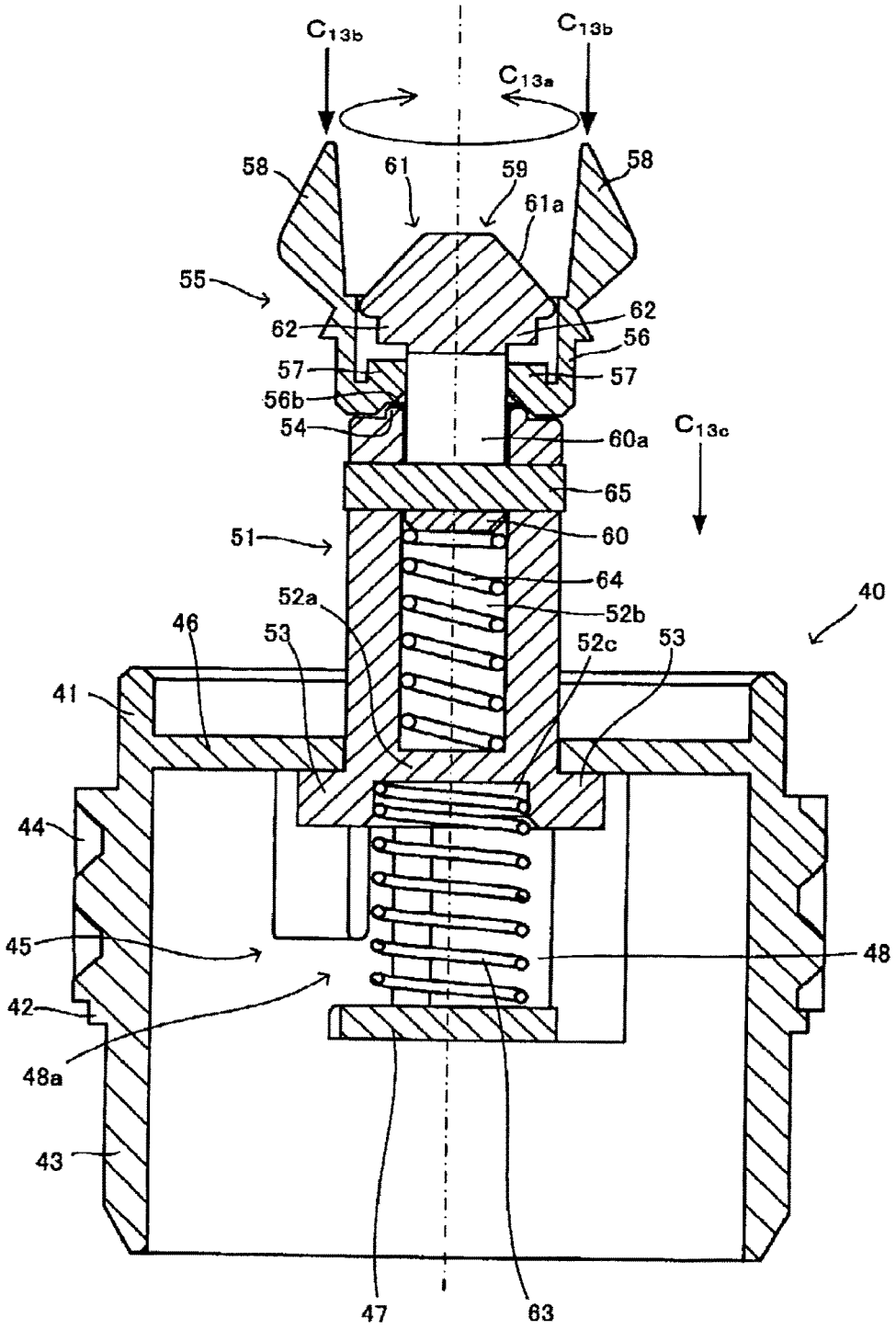
FIG. 13 is a sectional view of the end member 30 of FIG. 4.

Next, how the end member 30 combined as described above can be deformed, move, and rotate, will be described. FIG. 13 is a sectional view in a direction along the axis in one posture of the end member 30. In the posture illustrated in FIG. 13, a posture in which the entire shaft member 50 protrudes from the bearing member 40 the most within a possible range by the rotating shaft elastic member 63, and a posture in which the regulating member 59 protrudes the most from the main body 52 by the regulating member elastic member 64, are achieved. When no external force is applied to the shaft member 50, the end member 30 is in this posture.

From this posture, as can be ascertained from FIG. 13, the projection 57 of the rotating force receiving member 55 and the projection 62 of the regulating member 59 exist at positions different from each other being apart in the axial direction when viewed in a sectional direction of FIG. 13 (when viewed from a front surface). Therefore, in the posture, rotation of the engaging member 58 of the rotating force receiving member 55 is freely performed as illustrated by $C_{13a}$ in FIG. 13. In other words, in the posture, relative rotation of the engaging member 58 with respect to the bearing member 40 and the regulating member 59 is not regulated and is freely performed. In addition, the rotation thereof is performed while the rail projection 54 of the rotating shaft 51 is guided by the guide 56*b* of the rotating force receiving member 55. Therefore, only by rotating the rotating force receiving member 55 even when a rotating force is applied to the rotating force receiving member 55 in this posture, the transmission of the rotating force to other members is not performed, and a posture in which the engaging member 58 is not engaged is achieved. In addition, in the posture, as illustrated by an arrow $C_{13b}$ in FIG. 13, when the engaging member 58 of the rotating force receiving member 55 is pressed to the bearing member 40 side in the axial direction, a force is transmitted to the shaft member 50, and the shaft member 50 can be moved in the direction of being pressed to the bearing member 40 as illustrated by $C_{13c}$ in FIG. 13 against a biasing force of the rotating shaft elastic member 63.

Figure 14:
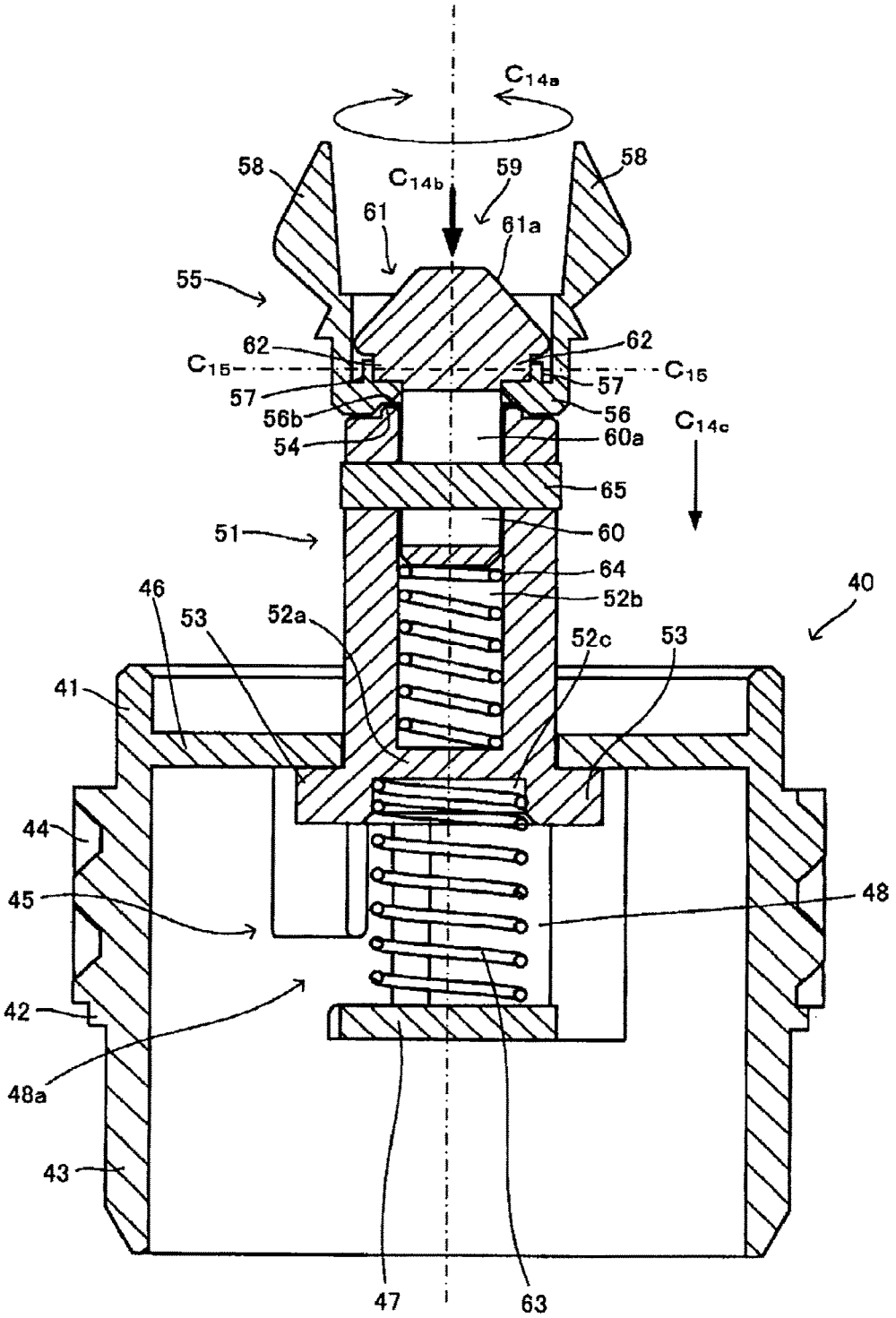
FIG. 14 is a sectional view of the end member 30 of FIG. 4.
Figure 15:
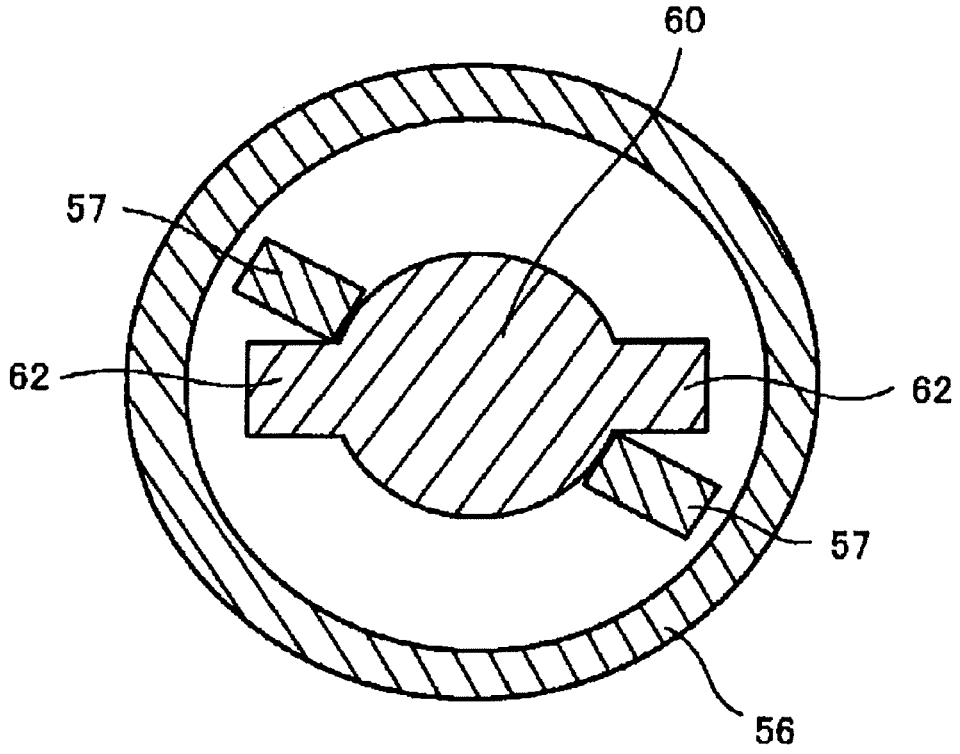
FIG. 15 is a sectional view of the end member 30 of FIG. 4.

Next, from the posture illustrated in FIG. 13, a posture in which the regulating member 59 is moved to be pressed to the main body 52 side of the rotating shaft 51 will be described. FIG. 14 is a view from the same viewpoint as that of FIG. 13 in the posture, and FIG. 15 is an end surface of a part illustrated by $C_{15}$-$C_{15}$ in FIG. 14.

In the posture, as illustrated by $C_{14b}$ in FIG. 14, the regulating member 59 moves to be pressed to the main body 52 of the rotating shaft 51 against the biasing force of the regulating member elastic member 64. Then, the projection 62 of the regulating member 59 is in a posture of going into a track of the rotation of the projection 57 of the rotating force receiving member 55. Accordingly, in the posture, relative rotation of the engaging member 58 of the rotating force receiving member 55 is regulated with respect to the bearing member 40 and the regulating member 59, and the engaging member 58 cannot freely rotate. For example, as illustrated in FIG. 15, when the rotating force receiving member 55 rotates and the projection 57 rotates following the rotation of the rotating force receiving member 55, the projection 57 is engaged with the projection 62 of the regulating member 59 at any part. Therefore, in the posture of being engaged in this manner, when the rotation driving force is applied to the regulating member 59 as illustrated by $C_{14a}$ in FIG. 14, the engaged regulating member 59, the rotating shaft 51 engaged with the regulating member 59 by the pin 65, and the bearing member 40 engaged by the projection 53 of the rotating shaft 51, rotate in the same manner. In other words, the rotation driving force applied to the rotating force receiving member 55 is transmitted to the entire end member 30. In addition, from the posture, when the regulating member 59 is further pressed in a direction illustrated by an arrow $C_{14b}$ in FIG. 14, the force is transmitted to the rotating shaft 51, and the shaft member 50 can move in the direction of being pressed to the bearing member 40 as illustrated by $C_{14c}$ of FIG. 14 against the biasing force of the rotating shaft elastic member 63.

As illustrated in FIG. 3 (also referred to FIG. 17), the above-described end member 30 inserts and makes the fitting portion 43 of the end member 30 adhere to one end portion of the photoreceptor drum 11. In addition, the lid member 20 can be disposed in the other end portion of the photoreceptor drum 11 and this can be considered as the photoreceptor drum unit 10.

Next, the apparatus main body 2 will be described. The apparatus main body 2 in the aspect is a main body of a laser printer. In the laser printer, the above-described process cartridge 3 operates in a mounted posture, and when the image is formed, the photoreceptor drum 11 is rotated, and charging is performed by the charging roller unit. In this state, the photoreceptor drum 11 is irradiated with the laser light which corresponds to image information by using various optical members provided here, and the electrostatic latent image which is based on the image information is obtained. The latent image is developed by the developing roller unit.

Meanwhile, the recording medium, such as a paper sheet, is set in the apparatus main body 2, and is conveyed to a transfer position by a sending roller or a conveying roller, which is provided in the apparatus main body 2. A transfer roller 1*a* (refer to FIG. 2) is disposed at the transfer position, voltage is applied to the transfer roller 1*a* following the passage of the recording medium, and the image is transferred to the recording medium from the photoreceptor drum 11. After this, the image is fixed to the recording medium as heat and voltage are applied to the recording medium. In addition, the recording medium on which the image from the apparatus main body 2 is formed is discharged by a discharge roller.

In this manner, in a posture in which the process cartridge 3 is mounted, the apparatus main body 2 applies the rotation driving force to the photoreceptor drum unit 10. Here, how the rotation driving force is applied to the photoreceptor drum unit 10 from the apparatus main body 2 in a posture in which the process cartridge 3 is mounted, will be described.

Figure 16A:
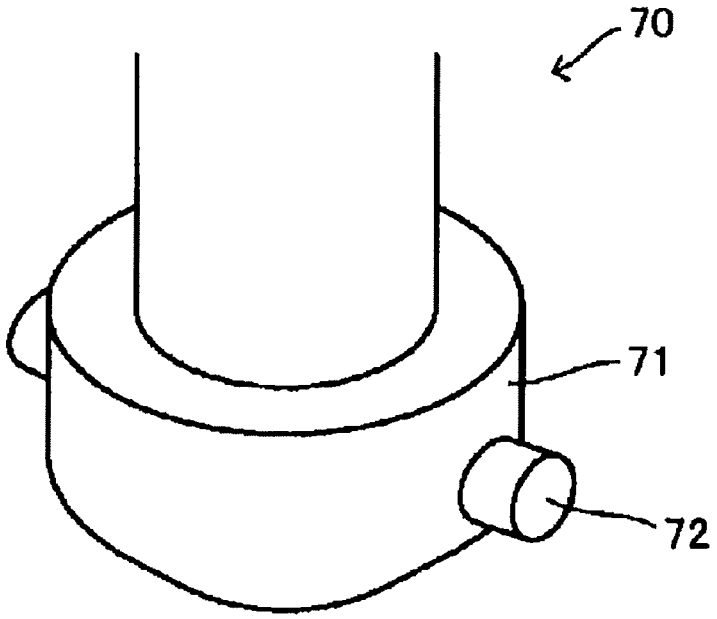
FIG. 16A is a perspective view of a driving shaft 70.
Figure 16B:
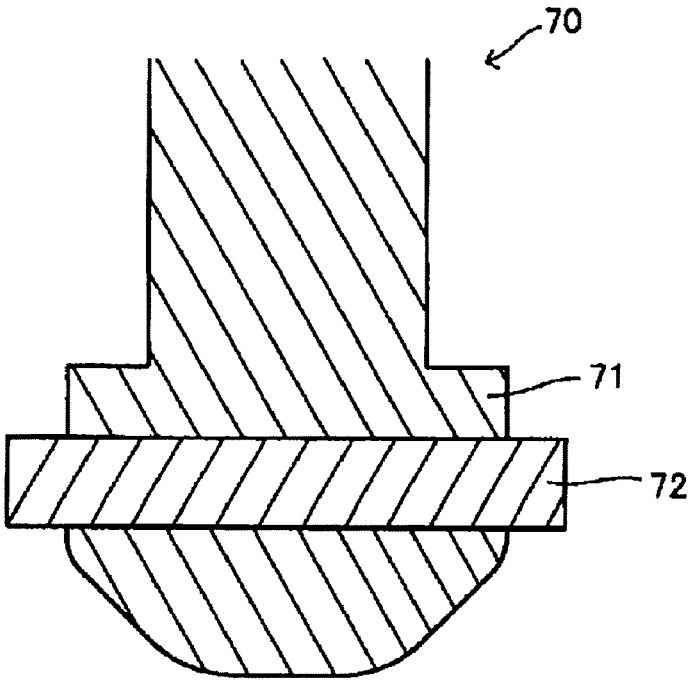
FIG. 16B is a sectional view of the driving shaft 70.

The rotation driving force to the process cartridge 3 is applied by the driving shaft 70 which serves as a rotating force imparting portion of the apparatus main body 2. FIG. 16A is a perspective view of the shape of the tip end portion of the driving shaft 70. In addition, FIG. 16B is a sectional view along the axial direction of the driving shaft 70. As can be ascertained from the drawings, the driving shaft 70 is configured to include the shaft portion 71 and the pin 72.

The shaft portion 71 is a shaft member which rotates around the axis. In the aspect, as can be ascertained from FIGS. 16A and 16B, the tip end thereof is formed to be thick. However, it is not necessarily to form the tip end to be thick, and the shape may have the same diameter in the longitudinal direction, or may have other aspects. However, the tip end portion of the shaft portion 71 has a size to be capable of being disposed between two engaging members 58 (for example, refer to FIG. 4) of the rotating force receiving member 55 of the above-described shaft member 50. In addition, a tip end portion of the shaft portion 71 in which angle portions are removed, that is, so-called chamfering is performed, is preferable. Accordingly, the engagement between the driving shaft 70 and the shaft member 50 is more smoothly performed.

On the side opposite to the tip end side illustrated in FIG. 16A of the shaft portion 71, a gear train is formed to be capable of rotating the shaft portion 71 around the axis, and is connected to a motor which is a driving source via the gear train.

The pin 72 is a column-like member which is provided to be close to the tip end of the shaft portion 71, and extends in the direction orthogonal to the axis of the shaft portion 71. In addition, with respect to the longitudinal direction, the pin 72 is formed to be longer than the diameter of the shaft portion 71, and the both ends from the side surface of the shaft portion 71 protrude across the axis of the shaft portion 71.

Here, the shaft portion 71 of the driving shaft 70 is disposed to protrude substantially perpendicularly to the moving direction for attaching and detaching the process cartridge 3 to and from the apparatus main body 2 illustrated by $C_1$ in FIG. 1. In addition to this, the shaft portion 71 only rotates without moving in the axial direction. Therefore, in attaching and detaching the process cartridge 3, it is necessary to mount and disengage the shaft member 50 to and from the driving shaft 70. In addition, according to the above-described end member 30, it becomes easy to mount and disengage the shaft member 50 to and from the driving shaft 70. A specific aspect of the attachment and detachment will be described later.

Figure 17:
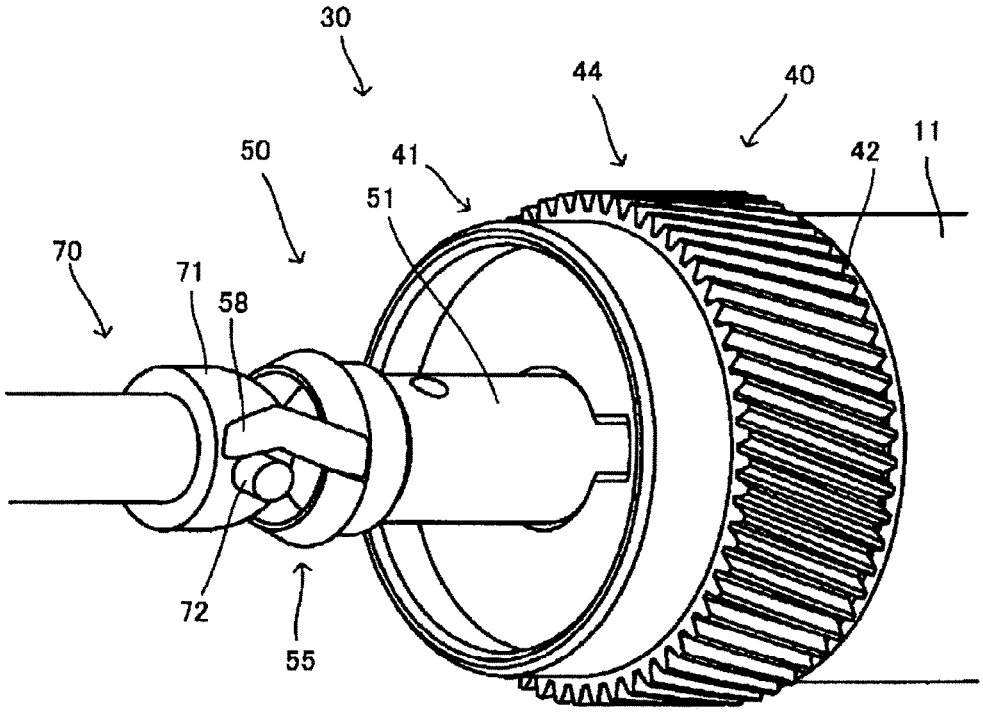
FIG. 17 is a perspective view of a situation in which the driving shaft 70 and the end member 30 are engaged with each other.

In a posture in which the process cartridge 3 is mounted on the apparatus main body 2, the driving shaft 70 and the rotating force receiving member 55 provided in the shaft member 50 of the end member 30 are engaged with each other, and the rotating force is transmitted. FIG. 17 illustrates a situation in which the rotating force receiving member 55 of the end member 30 is engaged with the driving shaft 70. As can be ascertained from FIG. 17, in a posture in which the driving shaft 70 and the rotating force receiving member 55 are engaged with each other, the axis of the driving shaft 70 and the axis of the shaft member 50 are disposed to abut against each other to match each other. At this time, the tip end of the shaft portion 71 of the driving shaft 70 goes into between two engaging members 58 of the rotating force receiving member 55, and the pin 72 of the driving shaft 70 is engaged to be hooked to the engaging member 58 from the side surface. In addition, at this time, the tip end of the shaft portion 71 of the driving shaft 70 presses the contact portion 61 of the regulating member 59, and the end member 30 is in a posture illustrated in FIG. 14. Accordingly, the rotating force receiving member 55 rotates following the rotation of the driving shaft 70, and the end member 30 and the photoreceptor drum 11, that is, the photoreceptor drum unit 10 rotates.

Figure 18A:
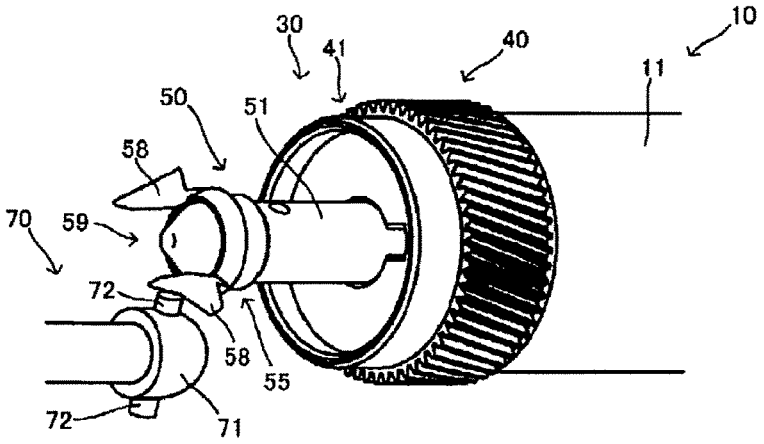
FIG. 18A is a perspective view illustrating a situation in which the driving shaft 70 and the photoreceptor drum unit 10 are engaged with each other.
Figure 18B:
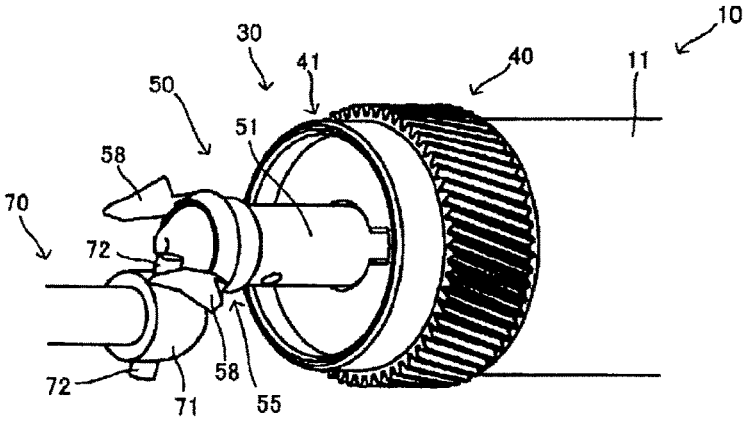
FIG. 18B is a perspective view illustrating another situation in which the driving shaft 70 and the photoreceptor drum unit 10 are engaged with each other.
Figure 18C:
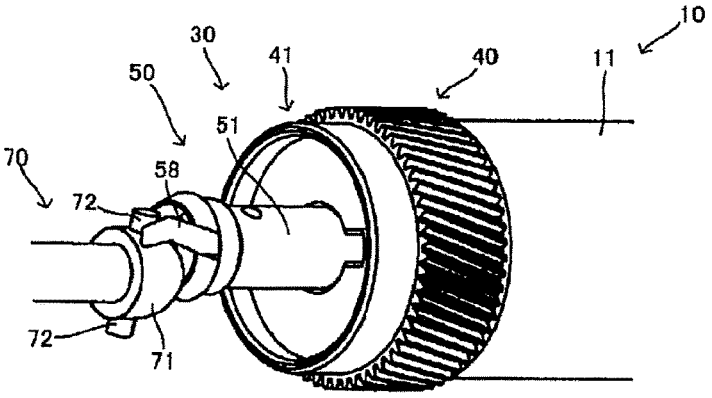
FIG. 18C is a perspective view illustrating still another situation in which the driving shaft 70 and the photoreceptor drum unit 10 are engaged with each other.
Figure 19:
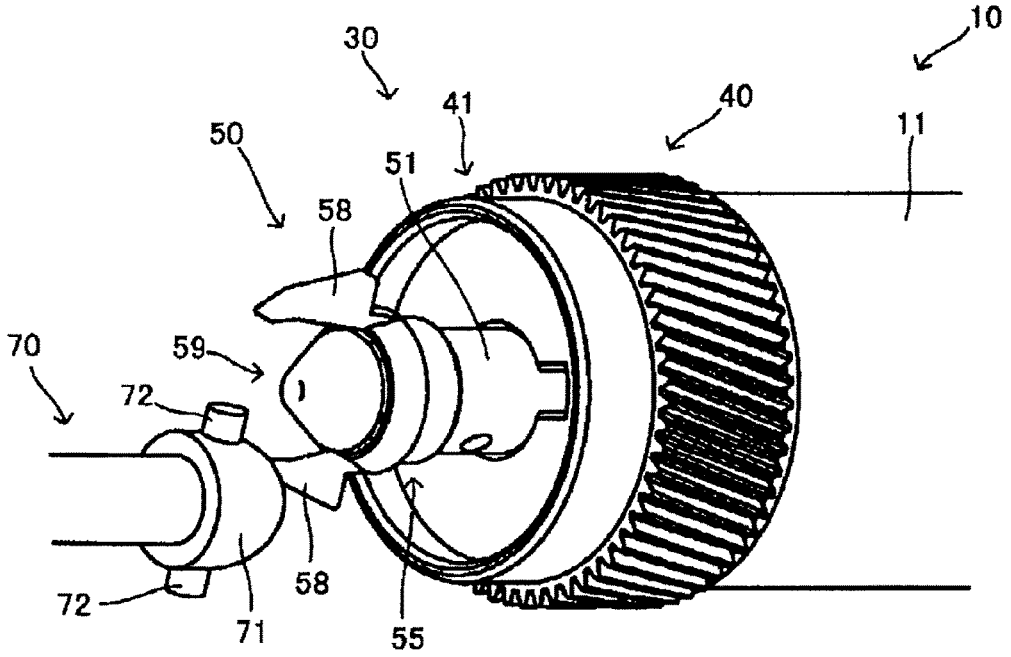
FIG. 19 is a perspective view illustrating a situation in which the driving shaft 70 and the photoreceptor drum unit are engaged with each other.

Next, an example of operations of the driving shaft 70 and the photoreceptor drum unit 10 when the process cartridge 3 is mounted on the apparatus main body 2 and is in a posture illustrated in FIG. 17, will be described. FIGS. 18 and 19 are views for the description. In FIG. 18, FIGS. 18A to 18C illustrate perspective views following an order of a process in which the driving shaft 70 is engaged with the rotating force receiving member 55. FIG. 19 is a perspective view illustrating one situation of engagement according to an example different from FIG. 18.

First, from the direction orthogonal to the axial direction of the driving shaft 70 as illustrated in FIG. 18B from the state illustrated in FIG. 18A, the photoreceptor drum unit 10 approaches. At this time, the end member 30 is oriented toward the driving shaft 70 side, the axis thereof has an orientation parallel to the axis of the driving shaft 70, and the photoreceptor drum unit 10 approaches the driving shaft 70 while moving in the direction orthogonal to the axis. At this time, the shaft member 50 is in a posture illustrated in FIG. 13.

In a situation illustrated in FIG. 18B, the driving shaft 70 comes into contact with the engaging member 58 of the rotating force receiving member 55. However, at this time, as illustrated in FIG. 13, since the shaft member 50 is in a posture illustrated in FIG. 13, the rotating force receiving member 55 freely rotates, and thus, the driving shaft 70 rotates by pressing the rotating force receiving member 55. Accordingly, the driving shaft 70 does not interrupt the engaging member 58 of the rotating force receiving member 55, and can enter between the two engaging members 58 as illustrated in FIG. 18C.

As illustrated in FIG. 18C, when the driving shaft 70 enters between the two engaging members 58, the tip end of the driving shaft 70 presses the contact portion 61 of the regulating member 59. Here, since the contact portion 61 is configured to have the inclined surface 61*a*, the entering is smoothly performed. Accordingly, finally, a posture (posture illustrated in FIG. 14) illustrated in FIG. 17 is achieved, and the rotation driving force from the driving shaft 70 can be transmitted to the photoreceptor drum 11.

Meanwhile, rarely, but in a positional relationship between the driving shaft 70 and the engaging member 58 of the rotating force receiving member 55, a case where the rotating force receiving member 55 is in a posture illustrated in FIG. 13 or a case where the rotating force receiving member 55 does not appropriately rotate, is also considered. However, in the case, as illustrated in FIG. 19, since the driving shaft 70 applies a force illustrated by $C_{13b}$ illustrated in FIG. 13 to the shaft member 50, the entire shaft member 50 is pressed to the bearing member 40 side, the driving shaft 70 climbs over the engaging member 58 and goes into between two engaging members 58, and as illustrated in FIG. 17, a posture in which the rotating force can be transmitted is achieved.

As described above, it is possible to mount the process cartridge 3 onto the apparatus main body 2 to be pressed from the direction different from the axial direction of the driving shaft 70 of the apparatus main body 2. A behavior also varies regarding the disengagement, but similarly, the movement and the rotation of the shaft member 50 are more smoothly performed.

Figure 20B:
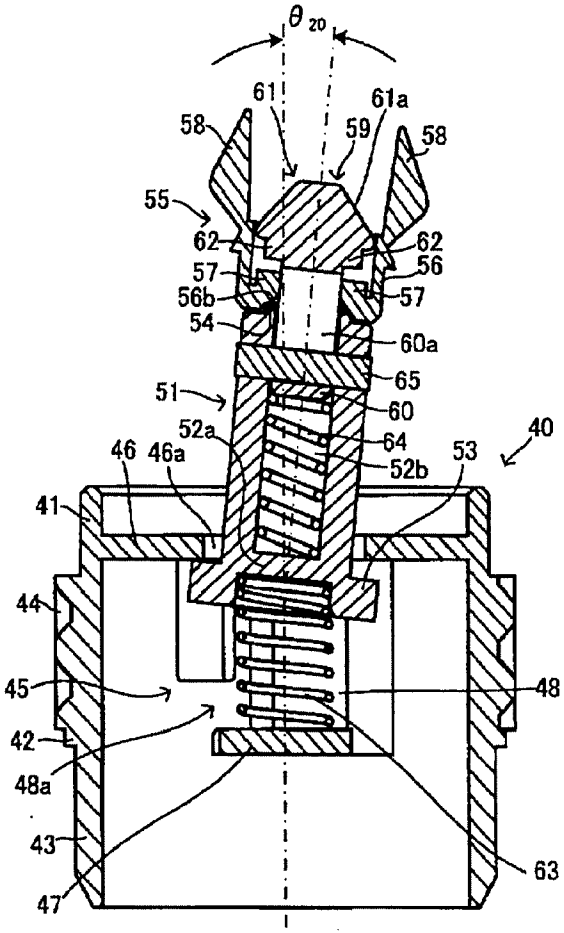
FIG. 20B is a sectional view of the end member 30 illustrating a situation in which the shaft member 50 is inclined.
Figure 20A:
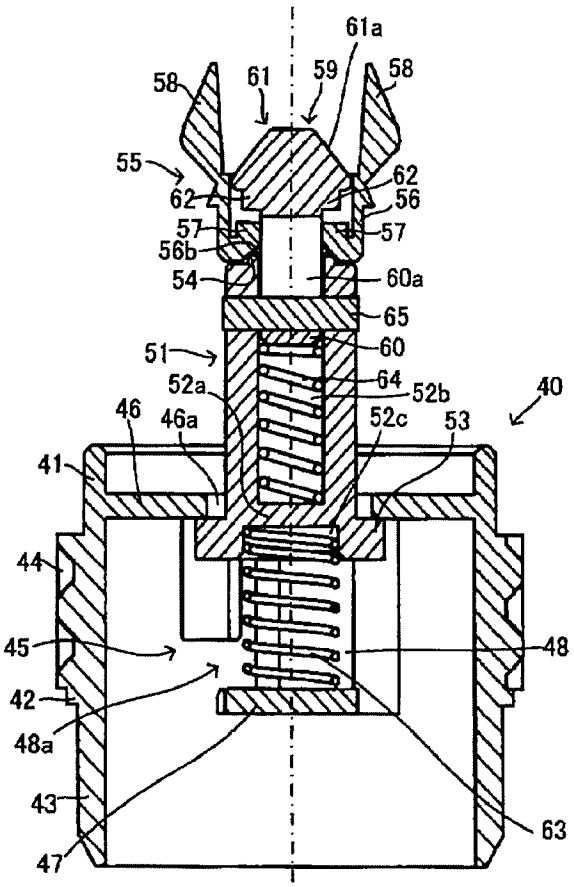
FIG. 20A is a sectional view of the end member 30 of an example in which the shaft member 50 oscillates.

Furthermore, in the end member 30, as illustrated in FIG. 20A, when the diameter of the hole 46*a* provided in the rotating shaft holding member 46 is greater than the diameter of the outer circumference of the rotating shaft 51, a space is formed between the inner circumferential surface of the hole 46*a* and the outer circumferential surface of the rotating shaft 51. Accordingly, as illustrated in FIG. 20B, oscillation is possible such that the axis of the shaft member 50 is inclined by an angle of $\theta_{20}$ with respect to the axis of the bearing member 40. When being inclined in this manner, when attaching and detaching the process cartridge to and from the apparatus main body, it is possible to more smoothly perform engagement and disengagement of the rotating force receiving member 55 and the driving shaft. At this time, the size of the inclination angle $\theta_{20}$ becomes 18° at the maximum. Accordingly, it is possible to reliably and smoothly attach and detach the process cartridge to and from the apparatus main body. In addition, the inclination can be employed following the same concept regarding the end member of each aspect which will be described hereinafter.

In addition, since the state where the engaging member 58 is not engaged with the driving shaft 70 as necessary by the regulating member 59, and the state where the engaging member 58 is engaged with the driving shaft 70, are switched to each other, interruption of the attachment and detachment caused by the member in the middle of the attachment and detachment of the process cartridge is unlikely to be generated, and the attachment and detachment are smoothly performed.

Figure 21:
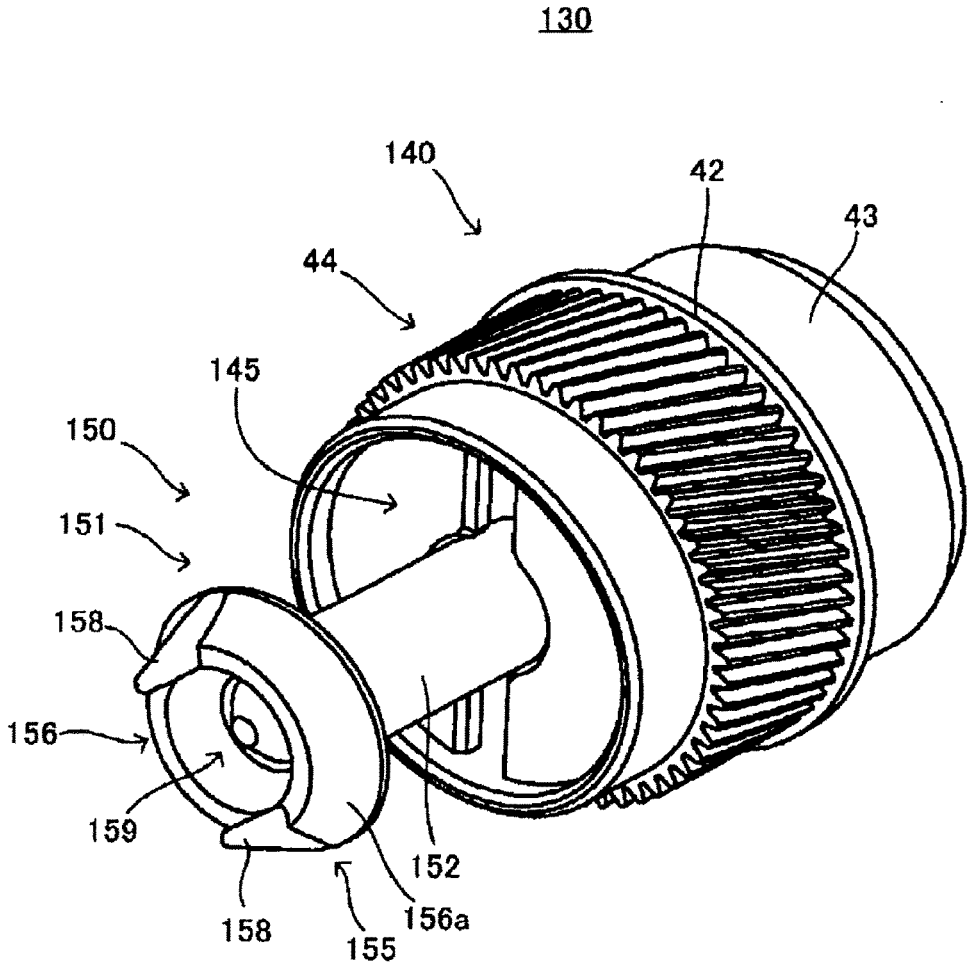
FIG. 21 is a perspective view of an end member 130.
Figure 22:
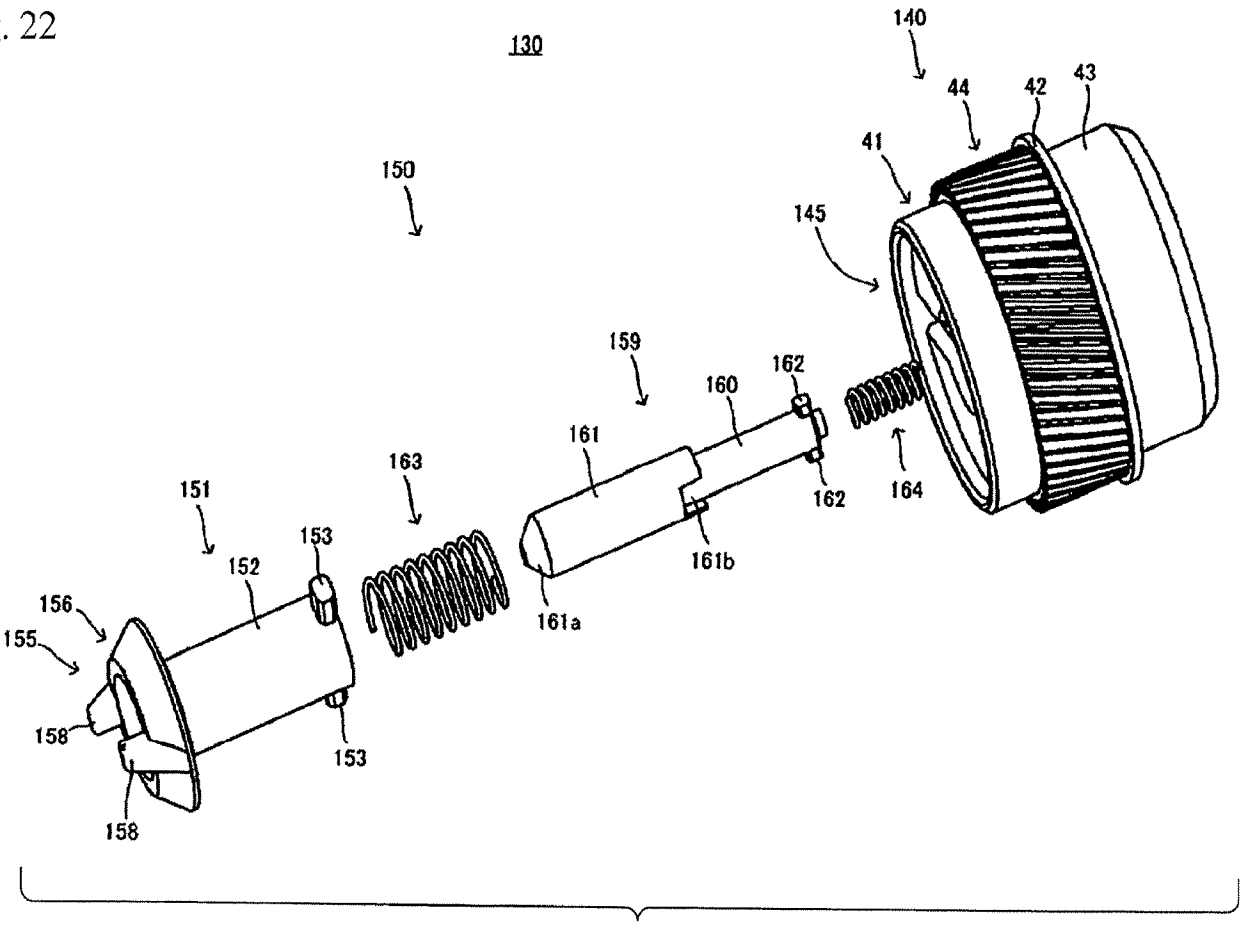
FIG. 22 is an exploded perspective view of the end member 130.

Next, a second aspect will be described. FIG. 21 is a perspective view of an end member 130 in the second aspect, and FIG. 22 is an exploded perspective view of the end member 130. The second aspect is the same as the first aspect except for the end member 130, and the description thereof will be omitted here. In addition, regarding the end member 130, the same parts as those of the above-described end member 30 will be given the same reference numerals, and the description thereof will be omitted.

The end member 130 is also a member attached to the end portion opposite to the lid member 20 among the end portions of the photoreceptor drum 11, and includes a bearing member 140 and a shaft member 150.

Figure 23A:
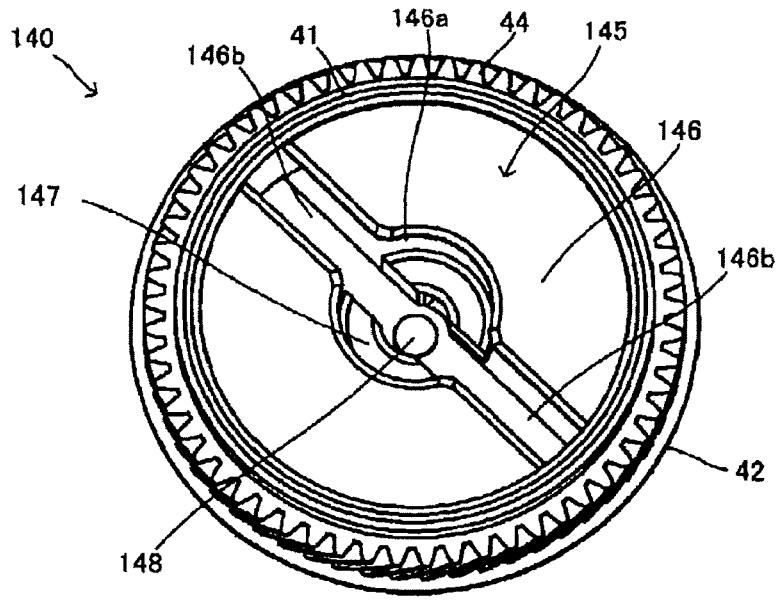
FIG. 23A is a perspective view of a bearing member 140.
Figure 23B:
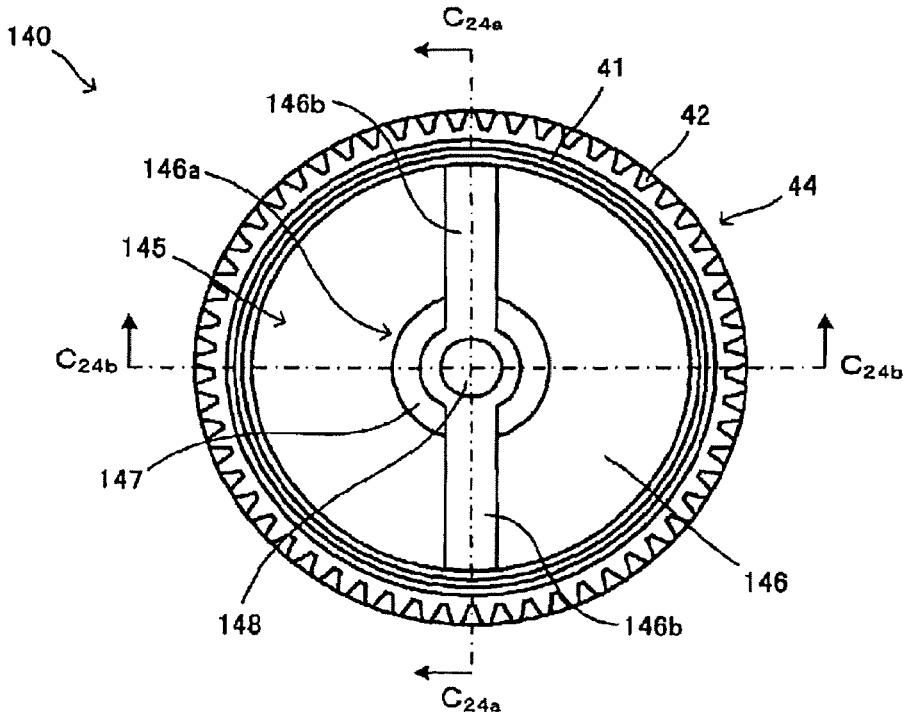
FIG. 23B is a plan view of the bearing member 140.
Figure 24A:
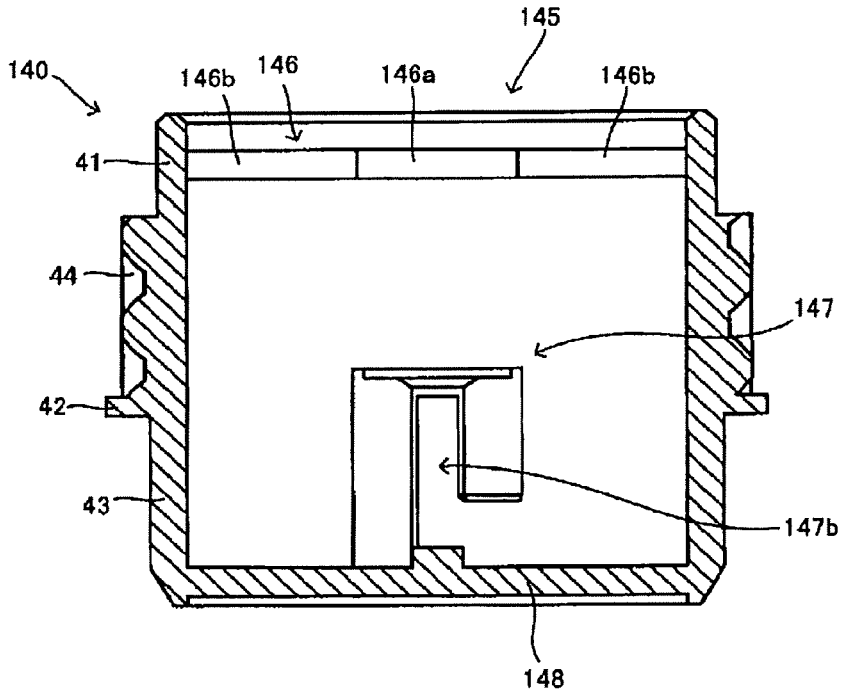
FIG. 24A is a sectional view of the bearing member 140.
Figure 24B:
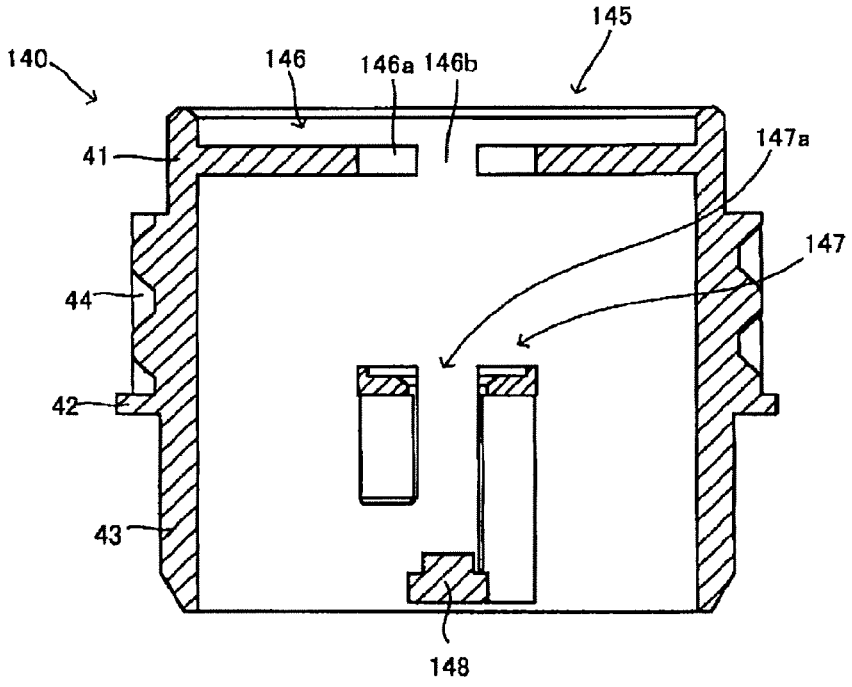
FIG. 24B is another sectional view of the bearing member 140.

The bearing member 140 is a member which is bonded to the end portion of the photoreceptor drum 11 in the end member 130. FIG. 23A is a perspective view of the bearing member 140, and FIG. 23B is a plan view when the shaft member 150 is viewed from the side on which the shaft member 150 is inserted, in the bearing member 140 in FIG. 23B. Furthermore, FIG. 24A is a sectional view along line illustrated by $C_{24a}$-$C_{24a}$ in FIG. 23B, and FIG. 24B is a sectional view along line illustrated by $C_{24b}$-$C_{24b}$ in FIG. 23B.

As can be ascertained from FIGS. 21 to 24, the bearing member 140 is configured to include the tubular body 41, the contact wall 42, the fitting portion 43, the gear portion 44, and a shaft member holding portion 145.

The shaft member holding portion 145 is a part which is formed on the inner side of the tubular body 41 and has a function of holding the shaft member 150 by the bearing member 140. As illustrated in FIGS. 23A to 24B, the shaft member holding portion 145 includes a rotating shaft holding member 146, a rotating shaft support member 147, and a regulating member support member 148.

The rotating shaft holding member 146 is a plate-like member which is formed to block the inner side of the tubular body 41, but a hole 146*a* is formed coaxially to an axis of the tubular body 41. As will be described later, since the rotating shaft 151 penetrates the hole 146*a*, the hole 146*a* has a size and a shape by which the rotating shaft 151 (refer to FIG. 25) penetrates. However, in order to prevent the rotating shaft 151 from falling out, the hole 146*a* is formed to be capable of penetrating only a main body 152 of the rotating shaft 151, but not to penetrate a part at which an outer projection 153 is disposed. From the viewpoint of stable movement of the rotating shaft 151, it is preferable that the hole 146*a* has substantially the same shape and the size as those of the outer circumference of the main body 152 of the rotating shaft 151 within a range that does not interrupt the movement of the rotating shaft 151 in the axial direction. In addition, in the rotating shaft holding member 146, two slits 146*b* extend from the hole 146*a*. The two slits 146*b* are provided at a symmetric position nipping the axis of the hole 146*a*. In addition, the size and the shape of the slit 146*b* are formed such that the outer projection 153 of the rotating shaft 151 (refer to FIG. 25) can penetrate the slit 146*b*.

The rotating shaft support member 147 is a member which is provided further on the fitting portion 43 side than the rotating shaft holding member 146, and which is formed to block at least a part of the inner side of the tubular body 41. The rotating shaft support member 147 is provided with a hole 147*a* or a void through which a first regulating shaft 160 of a regulating member 159 (refer to FIG. 26) penetrates around the axis of the tubular body 41 as illustrated in FIG. 24B. Furthermore, the rotating shaft support member 147 is formed to be capable of holding at least a rotating shaft elastic member 163 which will be described later. In addition, as can be ascertained from FIG. 24A, the rotating shaft support member 147 is provided with a groove 147*b* which extends parallel to the axial direction of the tubular body 41. An end portion of the groove 147*b* on the rotating shaft holding member 146 side is blocked, and the groove 147*b* is open in a circumferential direction of the tubular body 41 on the regulating member support member 148 side which is on the opposite side. On the inner side of the groove 147*b*, a projection 162 of the regulating member 159 (refer to FIG. 26) is disposed to be capable of moving on the inner side thereof.

The regulating member support member 148 is a member which is provided further on the fitting portion 43 side than the rotating shaft support member 147, and which is formed to block at least a part on the inner side of the tubular body 41. The regulating member support member 148 is formed to have a size which can hold at least a regulating member elastic member 164 which will be described later.

Returning to FIGS. 21 and 22, the shaft member 150 in the end member 130 will be described. As can be ascertained from FIG. 22, the shaft member 150 includes the rotating shaft 151, a rotating force receiving member 155, the regulating member 159, the rotating shaft elastic member 163, and the regulating member elastic member 164. Any of the rotating shaft elastic member 163 and the regulating member elastic member 164 in the aspect is a coiled spring. Hereinafter, each of the members will be described.

Figure 25A:
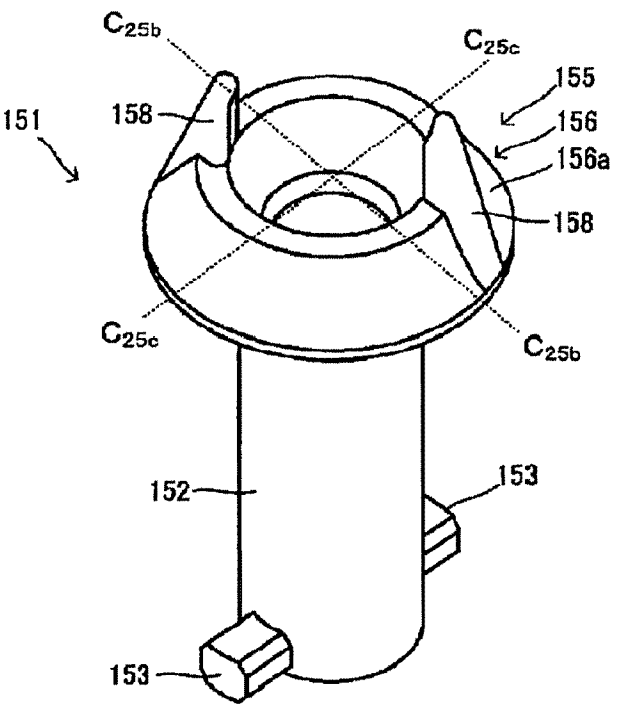
FIG. 25A is a perspective view of a rotating shaft 151 and a rotating force receiving member 155.
Figure 25B:
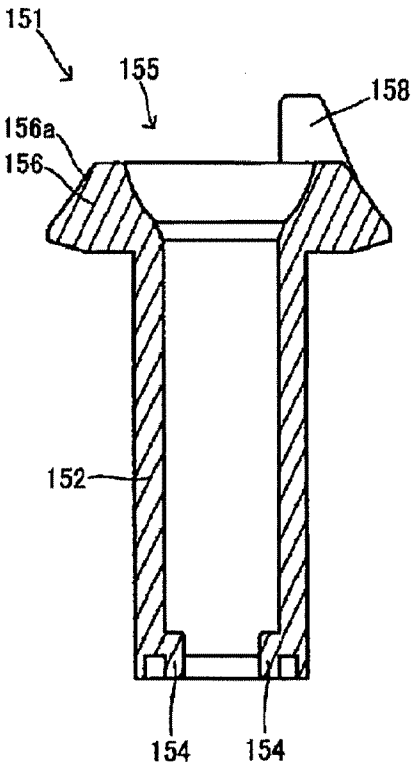
FIG. 25B is a sectional view of the rotating shaft 151 and the rotating force receiving member 155.
Figure 25C:
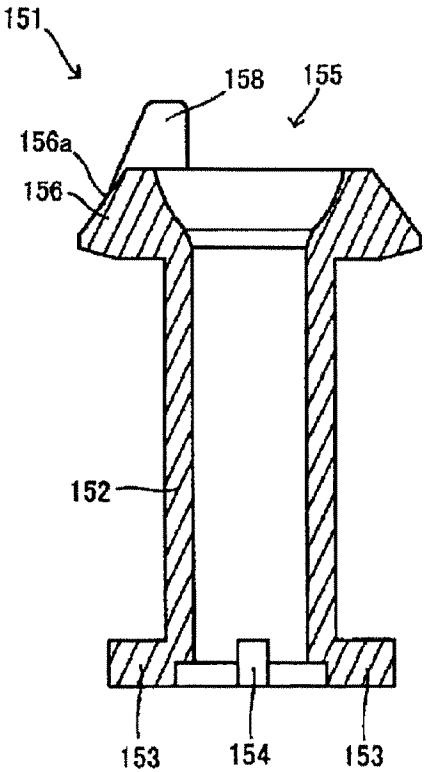
FIG. 25C is another sectional view of the rotating shaft 151 and the rotating force receiving member 155.

FIG. 25A is a perspective view of the rotating shaft 151, FIG. 25B is a sectional view in the axial direction including line illustrated by $C_{25b}$-$C_{25b}$ in FIG. 25A, and FIG. 25C is a sectional view in the axial direction including line illustrated by $C_{25c}$-$C_{25c}$ in FIG. 25A, respectively.

As can be ascertained from FIGS. 25A to 25C, the rotating shaft 151 includes the cylindrical main body 152. In addition, two outer projections 153 are disposed on the outer side in one end portion of the main body 152. Two outer projections 153 are provided on the same line as one diameter direction of the cylinder of the main body 152. The two outer projections 153 hold the main body 152 by the bearing member 140 as will be described later, and have a function of regulating the movement of the main body 152.

In addition, in the main body 152, two inner projections 154 are provided in the end portion provided with the outer projection 153 and on a cylindrical inner surface of the same end portion.

The rotating force receiving member 155 is a member which receives the rotation driving force from the apparatus main body 2 (refer to FIG. 1) and transmits the driving force to the main body 152 when the end member 30 is in a predetermined posture. As can be ascertained from FIGS. 25A to 25C, in the aspect, the rotating force receiving member 155 is configured to be disposed in the end portion opposite to the side on which the outer projection 153 is disposed in the main body 152, and to include a cylindrical base portion 156 and two engaging members 158 which stand from one end portion of the base portion 156.

The base portion 156 is cylindrical, and an outer diameter and an inner diameter thereof are formed to be greater than the main body 152. An outer circumferential portion of the base portion 156 includes an inclined surface 156*a* such that the diameter decreases as being separated from the main body 152 in the axial direction. Accordingly, the driving shaft 70 can smoothly slide in the outer circumferential portion. Meanwhile, the inner circumferential portion of the base portion 156 is reversely inclined such that the diameter increases as being separated from the main body 152 in the axial direction. Accordingly, the tip end of the driving shaft 70 can be stably accommodated.

Two engaging members 158 are provided in an end portion opposite to the side on which the rotating shaft 151 of the base portion 156 is disposed, and are apart from the axis of the base portion 156 by the same distance, and both of the engaging members 158 are disposed at a symmetric position nipping the axis. An interval between two engaging members 158 is formed to be substantially the same as or to be slightly greater than the diameter of the shaft portion 71 of the driving shaft 70 (refer to FIG. 16). The interval between two engaging members 158 is configured such that the pin 72 is hooked to the engaging member 158 in a posture in which the shaft portion 71 of the driving shaft 70 is disposed between the two engaging members 158.

How the rotating force can be received from the driving shaft 70 will be described later.

Figure 26A:
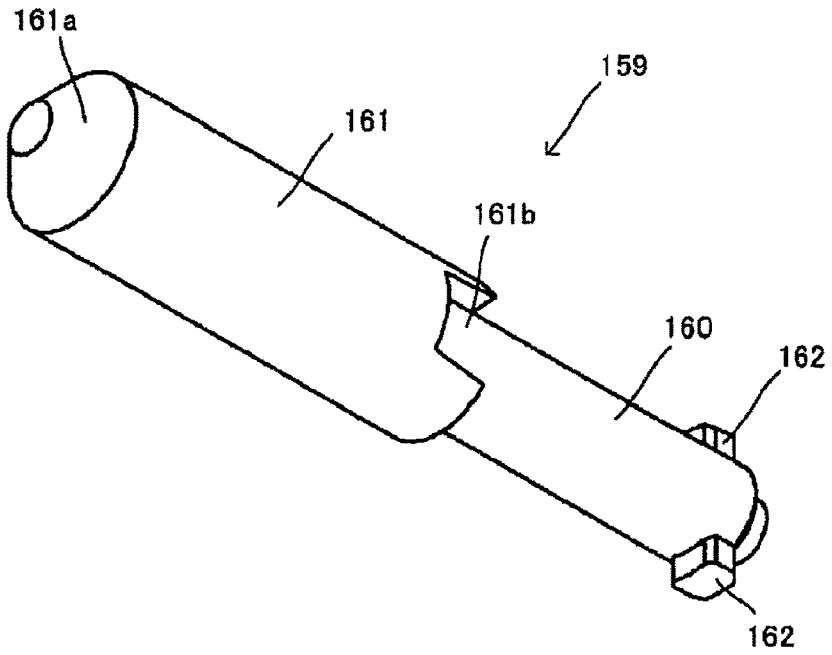
FIG. 26A is a perspective view of a regulating member 159.

The regulating member 159 switches a state where the engaging member 158 of the rotating force receiving member 155 is engaged with the driving shaft 70 and can transmit the driving force to the bearing member 40 and a state where the engaging member 158 of the rotating force receiving member 155 is not engaged with the driving shaft 70, cannot transmit the driving force, and freely rotate, to each other. FIG. 26A is a perspective view of the regulating member 159, and FIG. 26B is a perspective view from another angle of the regulating member 159, respectively.

Figure 26B:
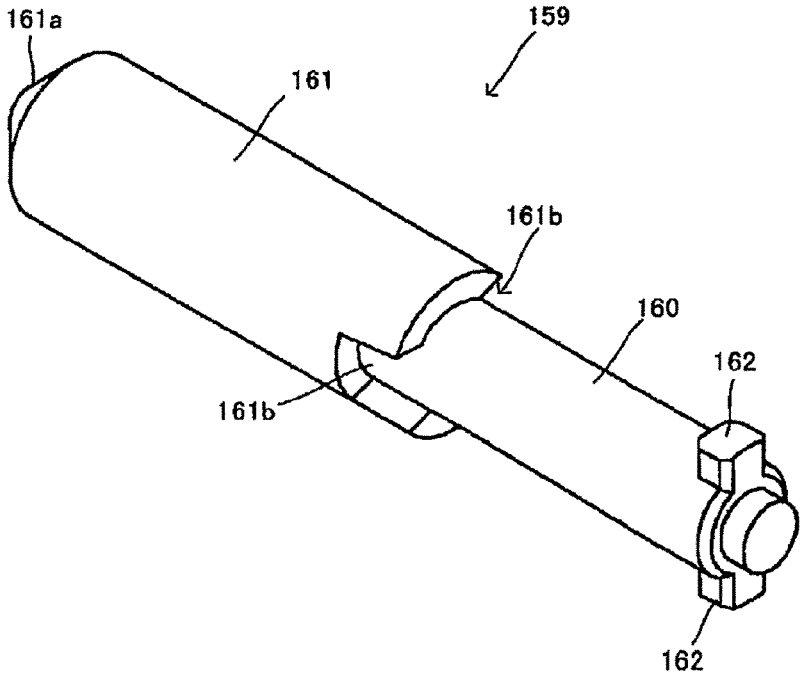
FIG. 26B is another perspective view of the regulating member 159.

As can be ascertained from FIGS. 26A and 26B, the regulating member 159 includes a columnar first regulating shaft 160, and a columnar second regulating shaft 161 of which an outer diameter is greater than that of the first regulating shaft 160, and has a structure in which the two regulating shafts are coaxially aligned and one ends are linked to each other. In the first regulating shaft 160, in the end portion opposite to the side on which the second regulating shaft 161 is disposed, two projections 162 are disposed. Two projections 162 are provided on the same line in one diameter direction of the column of the first regulating shaft 160. As will be described later, the two projections 162 have a function of holding the regulating member 159 by the bearing member 140 and regulating the movement of the regulating member 159.

In the second regulating shaft 161, the end portion opposite to the side on which the first regulating shaft 160 is disposed is a contact portion 161*a* and an inclined surface is formed. In addition, regulating grooves 161*b* which are two grooves that are open to the first regulating shaft 160 side are provided in the end portion in which the first regulating shaft 160 is disposed in the second regulating shaft 161. The two regulating grooves 161*b* are formed on the opposite sides nipping the axis of the second regulating shaft 161.

Figure 27:
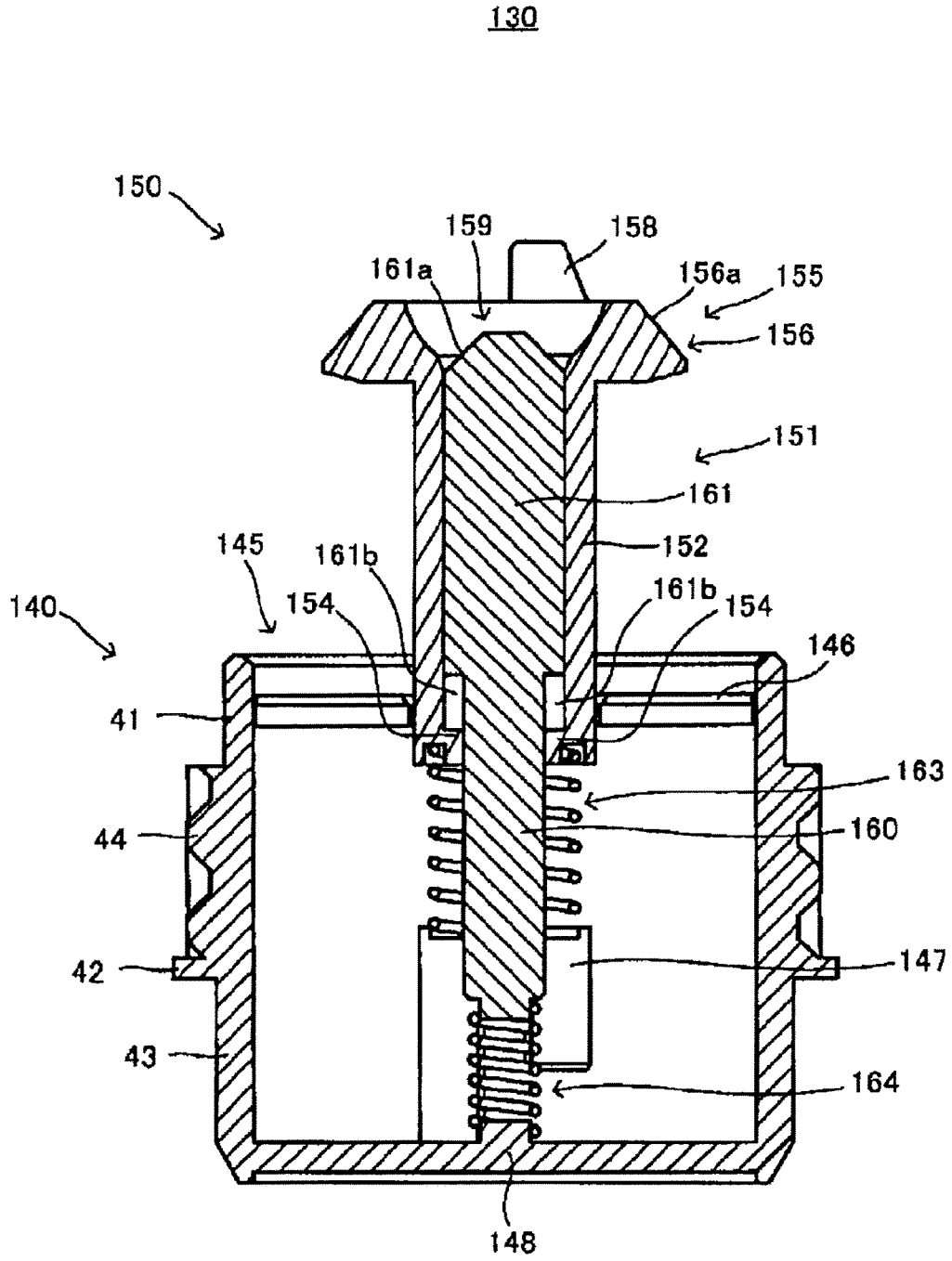
FIG. 27 is a sectional view of the end member 130.

By combining the bearing member 140 and the shaft member 150 with each other as follows, the end member 130 is made. FIG. 27 is a sectional view along the axial direction of the end member 130 in one posture. In addition, by describing the combination, the size of each member and part, the structure, or the relationship of the sizes of the members and parts, are further understood.

As can be ascertained from FIGS. 22 and 27, in the shaft member 150, the regulating member 159 is inserted into the inner side of the main body 152 of the rotating shaft 151. At this time, the second regulating shaft 161 is accommodated in the main body 152, and the end portion on the projection 162 side in the first regulating shaft 160 is disposed to protrude from the side opposite to the rotating force receiving member 155 (that is, the outer projection 153 and the inner projection 154 side). In addition, in the posture of FIG. 27, the inner projection 154 of the rotating shaft 151 is disposed in the regulating groove 161*b* of the regulating member 159.

The rotating shaft 151 and the regulating member 159 which are combined in this manner are held by the bearing member 140 as follows. In other words, the rotating shaft 151 passes through the hole 146*a* of the rotating shaft holding member 146 of the bearing member 140, the end portion on the side on which the outer projection 153 is disposed is disposed on the inner side of the shaft member holding portion 145, and the end portion on the side opposite thereto is disposed to protrude from the bearing member 140. At this time, the rotating shaft 151 is configured not to fall out from the bearing member 140 as the outer projection 153 is hooked to the rotating shaft holding member 146. In addition, as can be ascertained from FIG. 27, the rotating shaft elastic member 163 is disposed between the rotating shaft 151 and the rotating shaft support member 147, and the rotating shaft 151 is biased in the direction of falling out from the bearing member 140. At this time, the first regulating shaft 160 of the regulating member 159 passes through the inner side of the rotating shaft elastic member 163.

The attachment of the rotating shaft 151 to the bearing member 140 may be performed by inserting the outer projection 153 of the rotating shaft 151 into the inner side of the bearing member 140 from the slit 146*b* of the rotating shaft holding member 146, and by rotating the rotating shaft 151 around the axis.

Meanwhile, in the regulating member 159, the first regulating shaft 160 passes through the hole 147*a* (refer to FIG. 24B) of the rotating shaft support member 147. In addition, the projection 162 is accommodated on the inner side of the groove 147*b* (refer to FIG. 24A). Accordingly, the regulating member 159 is prevented from falling out from the bearing member 140 while being capable of moving in the axial direction. In addition, as can be ascertained from FIG. 27, the regulating member elastic member 164 is disposed between the regulating member 159 and the regulating member support member 148, and the regulating member 159 is biased in the direction of falling out from the bearing member 140.

The attachment of the regulating member 159 to the bearing member 140 may be performed by inserting the projection 162 of the regulating member 159 into the inner side of the groove 147*b* from the opening portion of the groove 147*b* of the rotating shaft support member 147.

In a posture of the end member 130 combined in this manner, the rotating shaft 151 and the rotating force receiving member 155 disposed therein are biased in the falling-out direction from the bearing member 140 by the rotating shaft elastic member 163, and are held without falling out as the outer projection 153 is engaged with the shaft member holding portion 145 of the bearing member 140. Meanwhile, the regulating member 159 is biased in the falling-out direction from the bearing member 140 by the regulating member elastic member 164, and is held without falling out as the projection 162 is engaged with the shaft member holding portion 145 of the bearing member 140. In addition, in the posture illustrated in FIG. 27, since the inner projection 154 of the rotating shaft 151 enters the inner side of the regulating groove 161*b* of the regulating member 159, rotation of the rotating shaft 151 and the rotating force receiving member 155 disposed therein around the axis is regulated.

By combining the members as described above, the axes of each of the bearing member 140 and the shaft member 150 are disposed to match each other.

Figure 28:
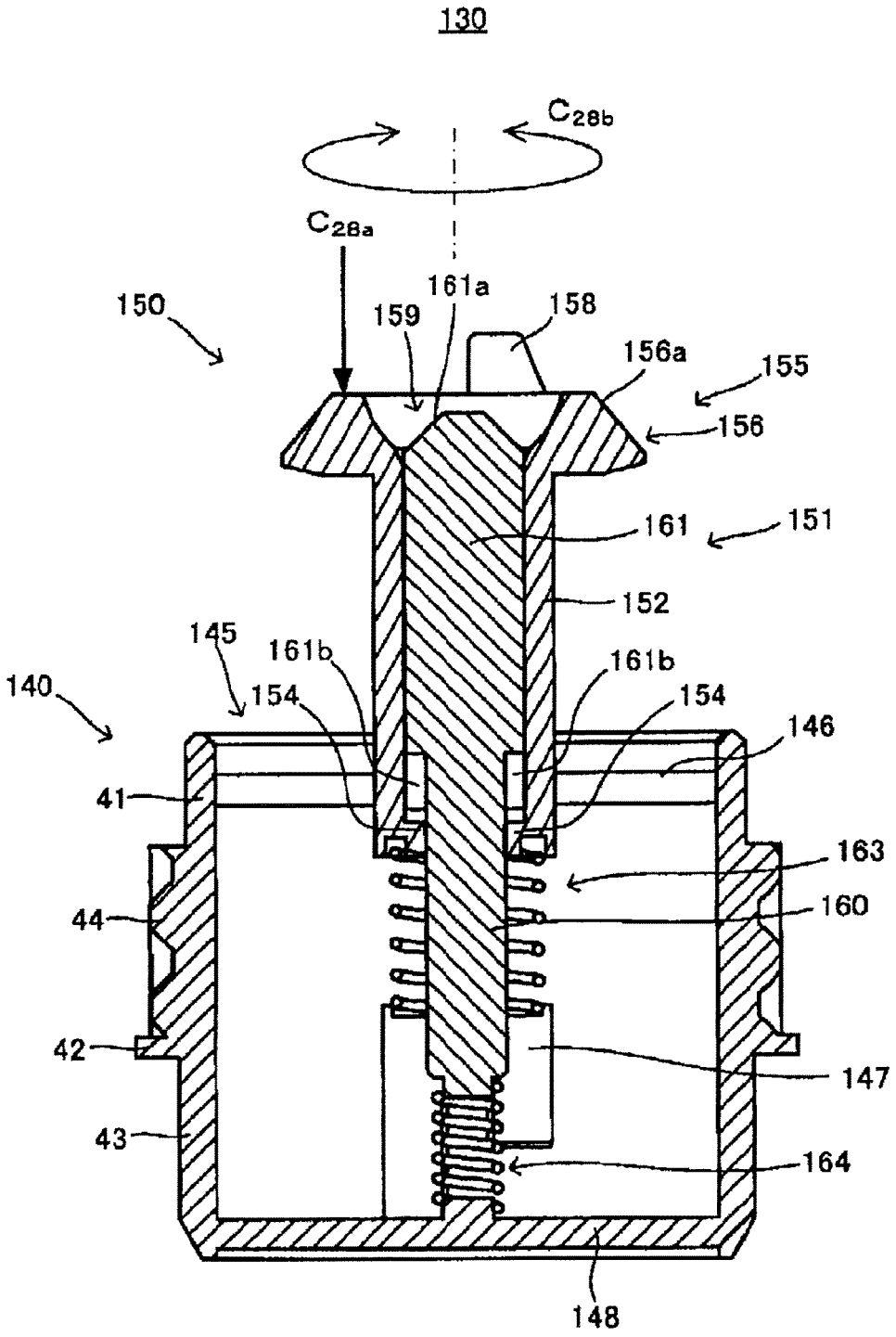
FIG. 28 is a sectional view of the end member 130.
Figure 29:
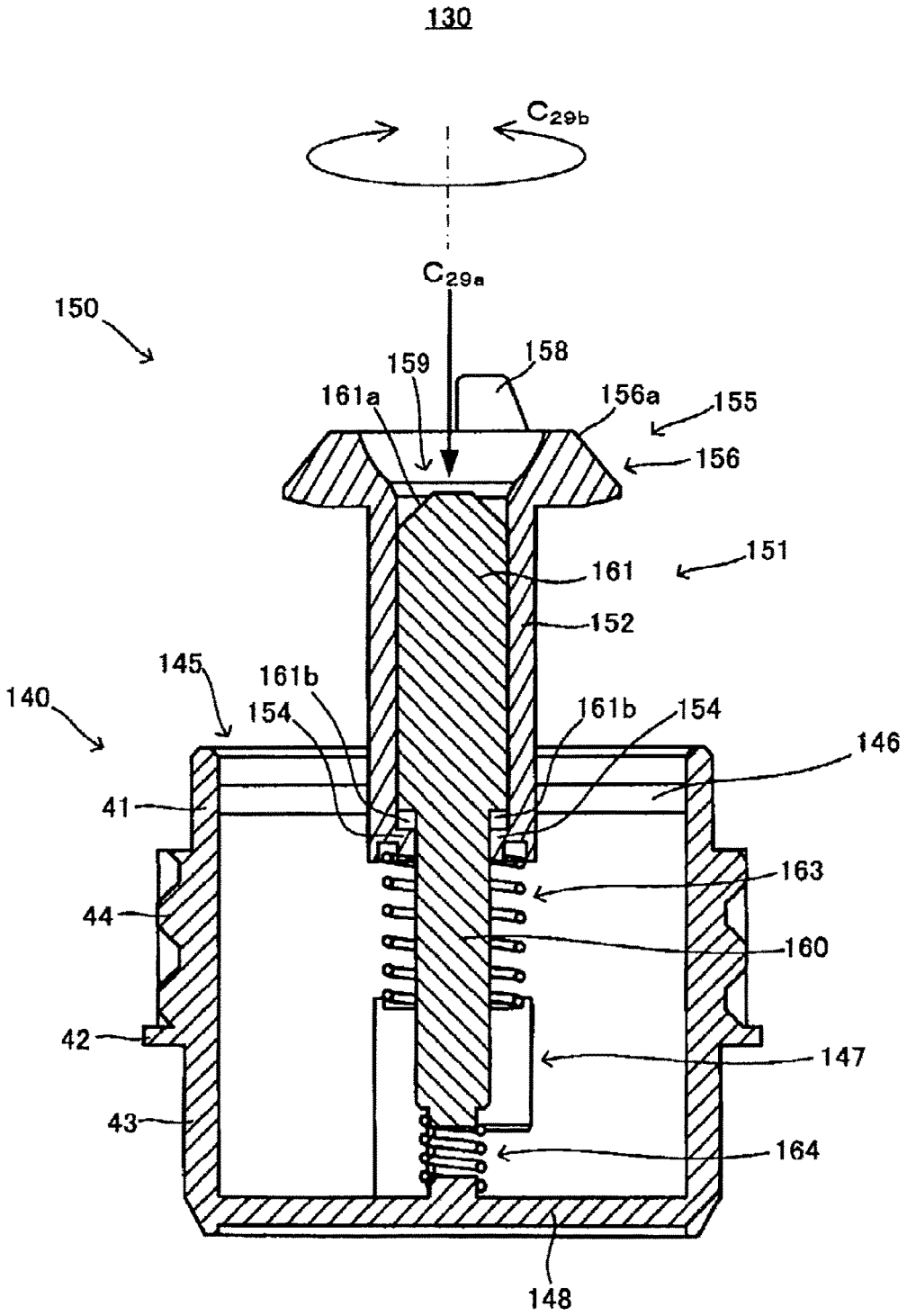
FIG. 29 is a sectional view of the end member 130.

Next, how the end member 130 combined as described above can be deformed, move, and rotate, will be described. FIGS. 28 and 29 are sectional views in a direction along the axis in two different postures of the end member 130.

FIG. 28 illustrates a posture in which the rotating shaft 151 (rotating force receiving member 155) is pressed to the bearing member 140 side against the biasing force of the rotating shaft elastic member 163 as illustrated by an arrow $C_{28a}$ in FIG. 28 from the posture illustrated in FIG. 27. Accordingly, as can be ascertained from FIG. 28, the rotating shaft 151 moves in the axial direction, and thus, the inner projection 154 of the rotating shaft 151 is disengaged from the regulating groove 161*b* of the regulating member 159, and the engagement of both of the inner projection 154 and the regulating groove 161*b* is released. Therefore, the rotating shaft 151 and the rotating force receiving member 155 (engaging member 158) disposed therein freely rotate as illustrated by an arrow $C_{28b}$ in FIG. 28. In other words, in the posture, relative rotation of the engaging member 158 with respect to the bearing member 140 and the regulating member 159 is not regulated and is freely performed as illustrated by an arrow $C_{28b}$ in FIG. 28.

FIG. 29 illustrates a posture in which the regulating member 159 further moves to be pressed to the bearing member 140 side against the biasing force of the regulating member elastic member 164 as illustrated by an arrow $C_{29a}$ in FIG. 29 from the posture illustrated in FIG. 28. Accordingly, as can be ascertained from FIG. 29, since the regulating member 159 moves in the axial direction, the inner projection 154 of the rotating shaft 151 goes into the inner side of the regulating groove 161*b* of the regulating member 159 again, and both of the inner projection 154 and the regulating groove 161*b* are engaged with each other. Therefore, in the posture, relative rotation of the engaging member 158 with respect to the bearing member 140 and the regulating member 159 is regulated, and for example, when the rotating force is imparted as illustrated by an arrow $C_{29b}$ in the rotating force receiving member 155, the rotating force is transmitted to the rotating shaft 151, the regulating member 159, and the bearing member 140, and finally, the end member 130 (photoreceptor drum unit) rotates around the axis.

Figure 30:
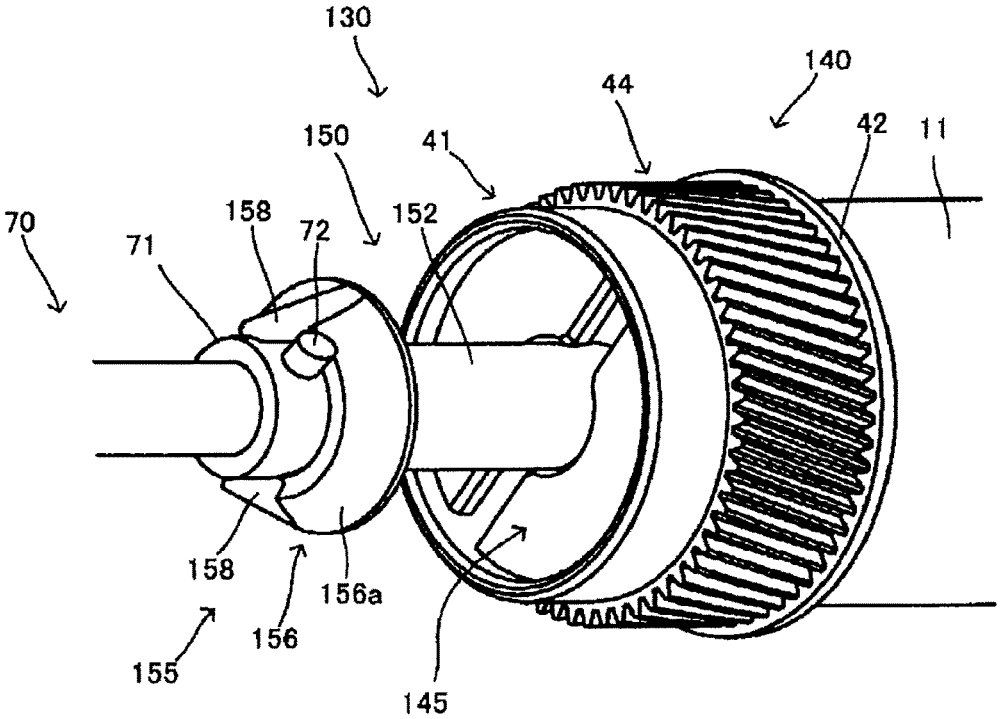
FIG. 30 is a perspective view illustrating a situation in which the driving shaft 70 and the end member 130 are engaged with each other.

In a posture in which the process cartridge provided with the above-described end member 130 is mounted on the apparatus main body, the driving shaft 70 and the rotating force receiving member 155 provided in the shaft member 150 of the end member 130 are engaged with each other, and the rotating force is transmitted. FIG. 30 illustrates a situation in which the rotating force receiving member 155 of the end member 130 is engaged with the driving shaft 70. As can be ascertained from FIG. 30, in a posture in which the driving shaft 70 and the rotating force receiving member 155 are engaged with each other, the axis of the driving shaft 70 and the axis of the shaft member 150 are disposed to abut against each other to match each other. At this time, the tip end of the shaft portion 71 of the driving shaft 70 goes into between two engaging members 158 of the rotating force receiving member 155, and the pin 72 of the driving shaft 70 is engaged to be hooked to the engaging member 158 from the side surface. In addition, at this time, the tip end of the shaft portion 71 of the driving shaft 70 presses the rotating force receiving member 155 and the regulating member 159, and the end member 130 is in a posture illustrated in FIG. 29. Accordingly, the rotating force receiving member 155 rotates following the rotation of the driving shaft 70, and the end member 130 and the photoreceptor drum 11, that is, the photoreceptor drum unit rotates.

Figure 31A:
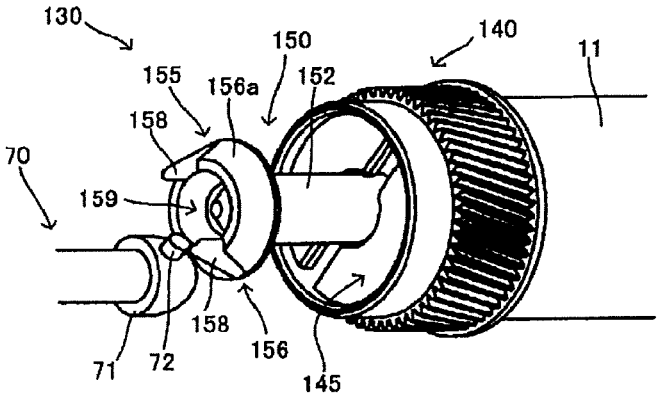
FIG. 31A is a perspective view illustrating a situation in which the driving shaft 70 and the photoreceptor drum unit are engaged with each other.
Figure 31B:
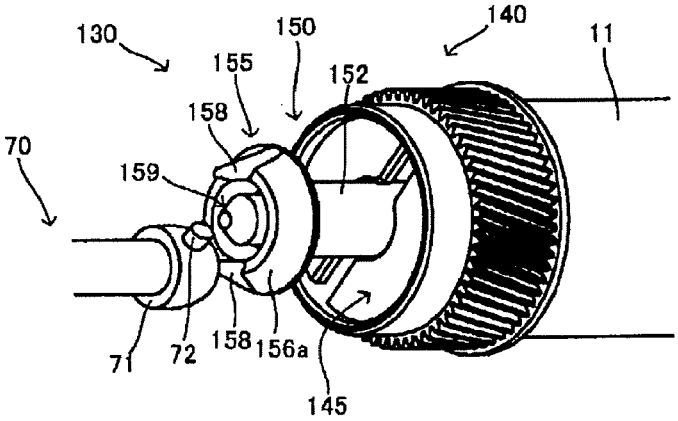
FIG. 31B is a perspective view illustrating another situation in which the driving shaft 70 and the photoreceptor drum unit are engaged with each other.
Figure 31C:
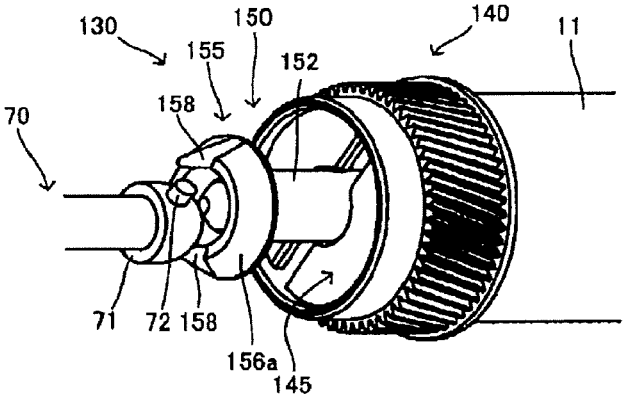
FIG. 31C is a perspective view illustrating still another situation in which the driving shaft 70 and the photoreceptor drum unit are engaged with each other.

Next, an example of operations of the driving shaft 70 and the photoreceptor drum unit when the process cartridge 3 is mounted on the apparatus main body 2 and is in a posture illustrated in FIG. 30, will be described. FIG. 31 is a view for the description. In FIG. 31, FIGS. 31A to 31C illustrate perspective views following an order of a process in which the driving shaft 70 is engaged with the rotating force receiving member 155.

First, from the direction orthogonal to the axial direction of the driving shaft 70 as illustrated in FIG. 31B from the state illustrated in FIG. 31A, the photoreceptor drum unit approaches. At this time, the end member 130 is oriented toward the driving shaft 70 side, the axis thereof has an orientation parallel to the axis of the driving shaft 70, and the photoreceptor drum unit approaches the driving shaft 70 while moving in the direction orthogonal to the axis. At this time, the shaft member 150 is in a posture illustrated in FIG. 27.

In a situation illustrated in FIG. 31B, the tip end of the driving shaft 70 comes into contact with the inclined surface 156*a* in the base portion 156 of the rotating force receiving member 155. Then, the driving shaft 70 presses the rotating force receiving member 155 and the shaft member 150 to the bearing member 140 side. Accordingly, the end member 130 is in a posture illustrated in FIG. 28. In the posture, the rotating force receiving member 155 and the shaft member 150 freely rotate. Therefore, even when the driving shaft 70 comes into contact with the engaging member 158 of the rotating force receiving member 155, the rotating force receiving member 155 freely rotates, and thus, the driving shaft 70 presses and rotates the rotating force receiving member 155. Accordingly, the driving shaft 70 does not interrupt the engaging member 158 of the rotating force receiving member 155, and can enter between the two engaging members 158 as illustrated in FIG. 31C.

As illustrated in FIG. 31C, when the driving shaft 70 enters between the two engaging members 158, the tip end of the driving shaft 70 presses the regulating member 159. Here, since the tip end portion of the regulating member 159 is configured to have an inclined surface at the contact portion 161*a*, the entering is smoothly performed. Accordingly, finally, a posture (posture illustrated in FIG. 29) illustrated in FIG. 30 is achieved, and the rotation driving force from the driving shaft 70 can be transmitted to the photoreceptor drum 11.

In addition, since a state where the engaging member 158 is not engaged with the driving shaft 70 and a state where the engaging member 158 is engaged with the driving shaft 70 are switched to each other as necessary by the regulating member 159, interruption of the attachment and detachment caused by the member in the middle of the attachment and detachment of the process cartridge is unlikely to be generated, and the attachment and detachment are smoothly performed.

Figure 32A:
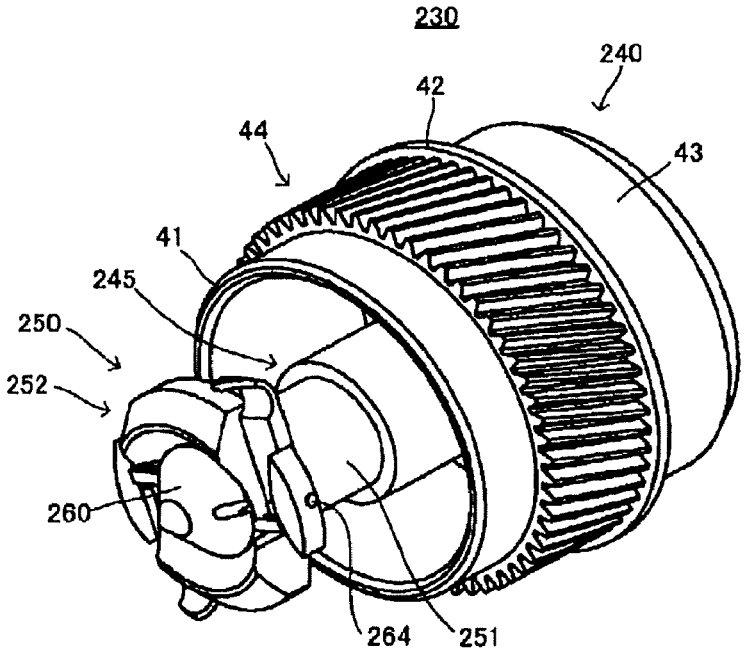
FIG. 32A is a perspective view of an end member 230.
Figure 32B:
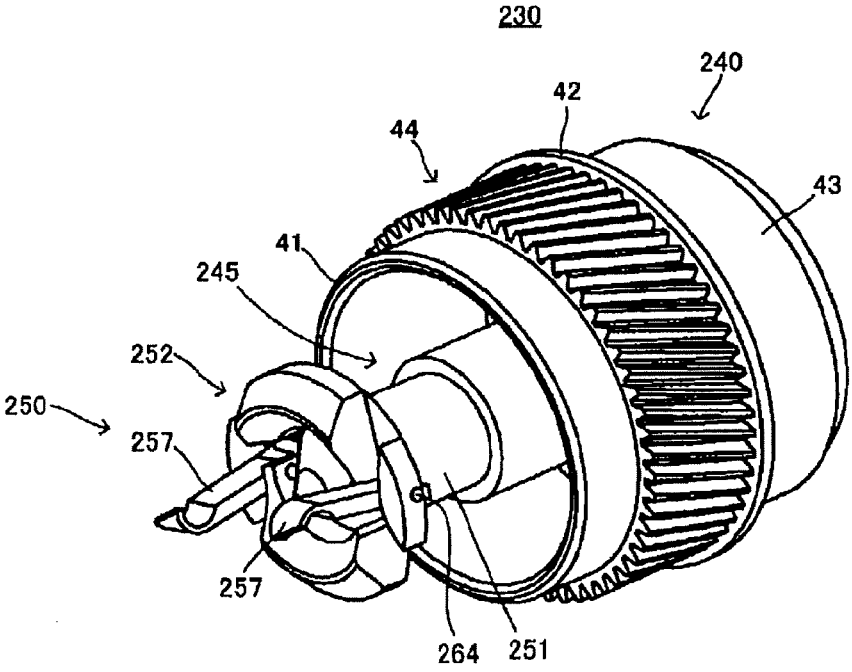
FIG. 32B is another perspective view of the end member 230.
Figure 33:
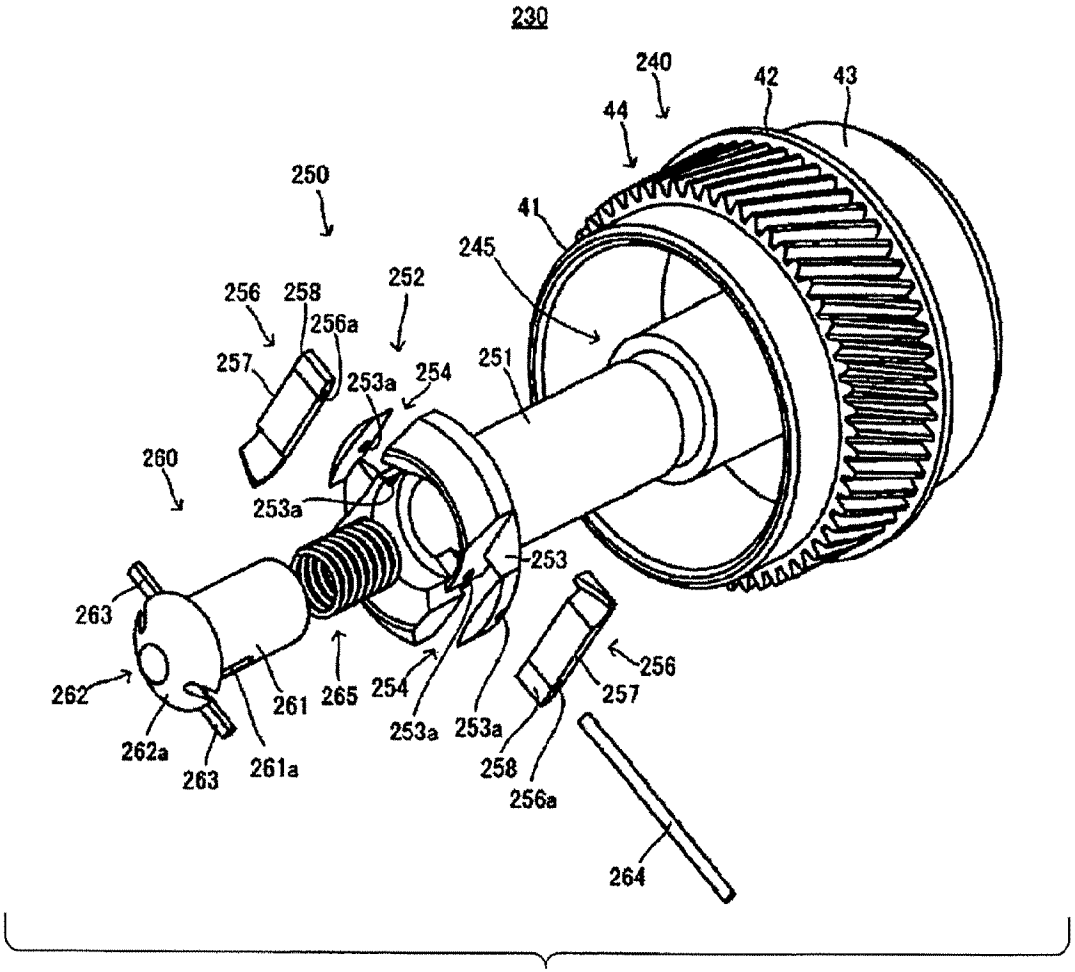
FIG. 33 is an exploded perspective view of the end member 230.

Next, a third aspect will be described. FIG. 32A is a perspective view in one posture of an end member 230 in the third aspect, and FIG. 32B is a perspective view in another posture of the end member 230. In addition, FIG. 33 illustrates an exploded perspective view of the end member 230. The third aspect is the same as the first aspect except for the end member 230, and the description thereof will be omitted here. In addition, regarding the end member 230, the same parts as those of the above-described end member 30 will be given the same reference numerals, and the description thereof will be omitted.

The end member 230 is also a member attached to the end portion opposite to the lid member 20 among the end portions of the photoreceptor drum 11, and includes a bearing member 240 and a shaft member 250.

Figure 34A:
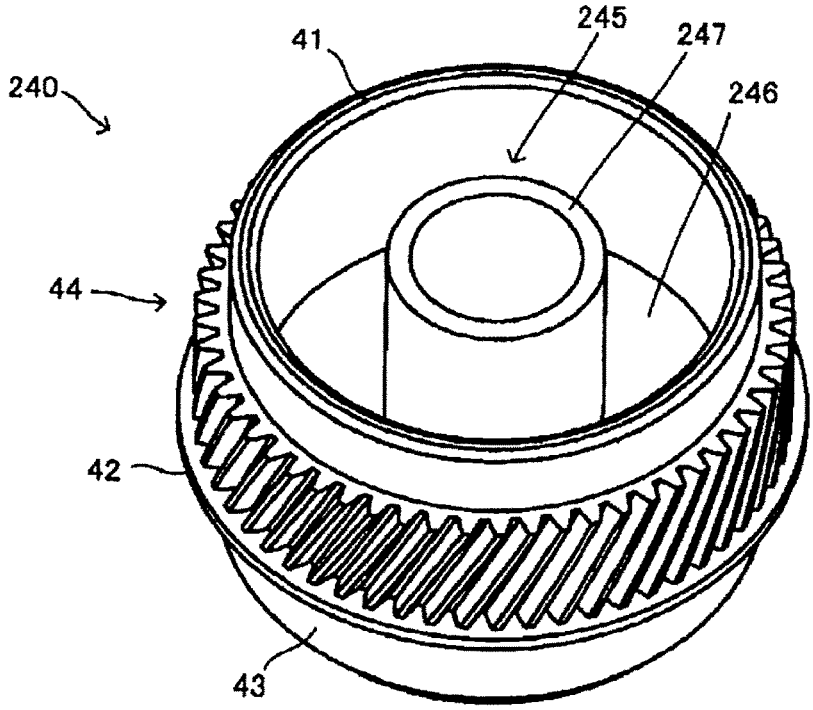
FIG. 34A is a perspective view of a bearing member 240.
Figure 34B:
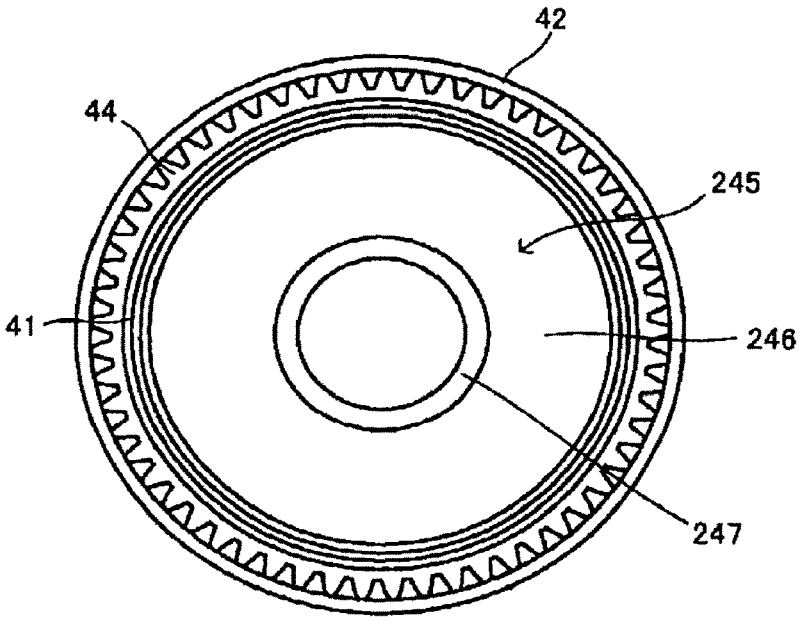
FIG. 34B is a plan view of the bearing member 240.

The bearing member 240 is a member which is bonded to the end portion of the photoreceptor drum 11 in the end member 230. FIG. 34A is a perspective view of the bearing member 240, and FIG. 34B is a plan view when viewed from the side on which the shaft member 250 is inserted, in the bearing member 240 in FIG. 34B.

As can be ascertained from FIGS. 32 to 34, the bearing member 240 is configured to include the tubular body 41, the contact wall 42, the fitting portion 43, the gear portion 44, and a shaft member holding portion 245.

The shaft member holding portion 245 is a part which is formed on the inner side of the tubular body 41 and has a function of holding the shaft member 250 by the bearing member 240. In the aspect, as illustrated in FIGS. 34A to 34B, the shaft member holding portion 245 is configured to include a bottom plate 246 and a holding tube body 247. The bottom plate 246 is a plate-like member disposed to block at least a part of the inner side of the tubular body 41. Meanwhile, the holding tube body 247 is a tubular member which stands on a surface opposite to the fitting portion 43 side on the surface of the bottom plate 246, and the axis thereof is provided to match the axis of the tubular body 41. As will be described later, the holding tube body 247 holds the shaft member 250 as a part of the shaft member 250 is inserted into the inner side thereof.

Figure 35:
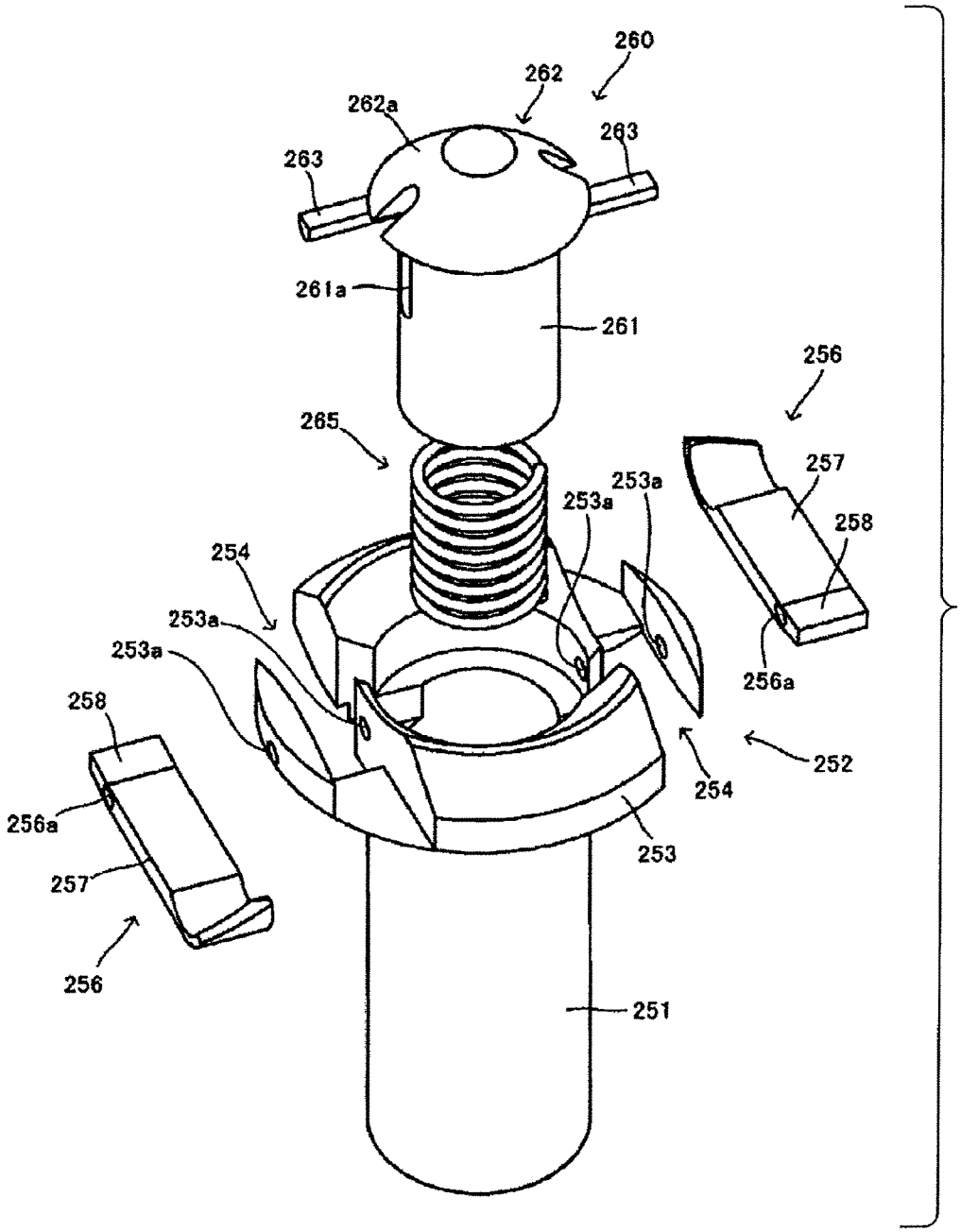
FIG. 35 is an exploded perspective view of a shaft member 250 of FIG. 32.

Returning to FIGS. 32 and 33, the shaft member 250 in the end member 230 will be described. As can be ascertained from FIG. 33, the shaft member 250 is configured to include a rotating shaft 251, a rotating force receiving member 252, a regulating member 260, a pin 264, and an elastic member 265. Here, the pin 264 is a rod-like member. In addition, the elastic member 265 of the aspect is a coiled spring. FIG. 35 illustrates an enlarged exploded perspective view of a part other than the pin 264. Each of the members will be described with reference to FIGS. 33 and 35.

The rotating shaft 251 is a cylindrical member. The outer diameter has a size by which insertion into the inner side of the holding tube body 247 provided in the shaft member holding portion 245 of the above-described bearing member 240 is possible.

The rotating force receiving member 252 is a member which receives the rotation driving force from the apparatus main body 2 (refer to FIG. 1) and transmits the driving force to the rotating shaft 251 when the end member 230 is in a predetermined posture. The rotating force receiving member 252 in the aspect is configured to be disposed in the end portion on one side (a side on which the holding tube body 247 is not inserted) in the rotating shaft 251, and to include a cylindrical base portion 253 and plate-like engaging member 256.

The base portion 253 is a cylindrical member, and is disposed coaxially to the rotating shaft 251 in the end portion on one side (a side on which the holding tube body 247 is not inserted) in the rotating shaft 251. Both of an outer circumference and an inner circumference of the base portion 253 are formed to be greater than the outer circumference and the inner circumference of the rotating shaft 251. In the base portion 253, two engaging member accommodation grooves 254 which are grooves formed substantially parallel to each other nipping the axis are provided. In the aspect, two engaging member accommodation grooves 254 are provided to be parallel at positions having the same distance from the axis nipping the axis, and extend to be at a position of twist with respect to the axis. In addition, the base portion 253 is provided with a hole 253*a* to penetrate in the direction orthogonal to the direction in which two engaging member accommodation grooves 254 extend, along the diameter of the base portion. In the aspect, four holes 253*a* are formed.

The entire engaging member 256 has a shape of a plate, and is formed to have a size that is accommodated in the groove of the above engaging member accommodation groove 254. In the engaging member, a through-hole 256*a* is provided, and one side becomes an engaging portion 257 and the other side becomes an operated portion 258 nipping the through-hole 256*a*. Although not particularly limited, the engaging portion 257 is preferably longer compared to the operated portion 258. In addition, a tip end of the engaging portion 257 may be curved. Accordingly, stable engagement with the pin 72 of the driving shaft 70 is possible.

The regulating member 260 is configured to include a regulating shaft 261, a contact portion 262, and an operating portion 263. The regulating shaft 261 is a columnar member, and an appearance thereof has a size that can be inserted into the inner side of the cylinder of the rotating shaft 251. In addition, a slit 261*a* which penetrates in the diameter direction and extends by a predetermined size in the axial direction is formed in the regulating shaft 261. The contact portion 262 is a member of a conical part (truncated conical) provided coaxially to the side that is not inserted into the rotating shaft 251 on the end surface of the regulating shaft 261, and the diameter thereof becomes greater than that of the regulating shaft 261 on a bottom portion thereof. Therefore, a side surface of the contact portion 262 becomes an inclined surface 262*a*. The operating portion 263 is a rod-like member which extends in the direction of separating from the axis, and two operating portions 263 are disposed similar to the engaging member 256. As will be described later, the operating portion 263 is formed to have a position and a length by which the operated portion 258 of the engaging member 256 can be pressed in the direction parallel to the axial direction.

By combining each of the above-described members with each other as follows, the end member 230 is made. In addition, by describing the combination, the size of each member and part, the structure, or the relationship of the sizes of the members and parts, are further understood.

Figure 36:
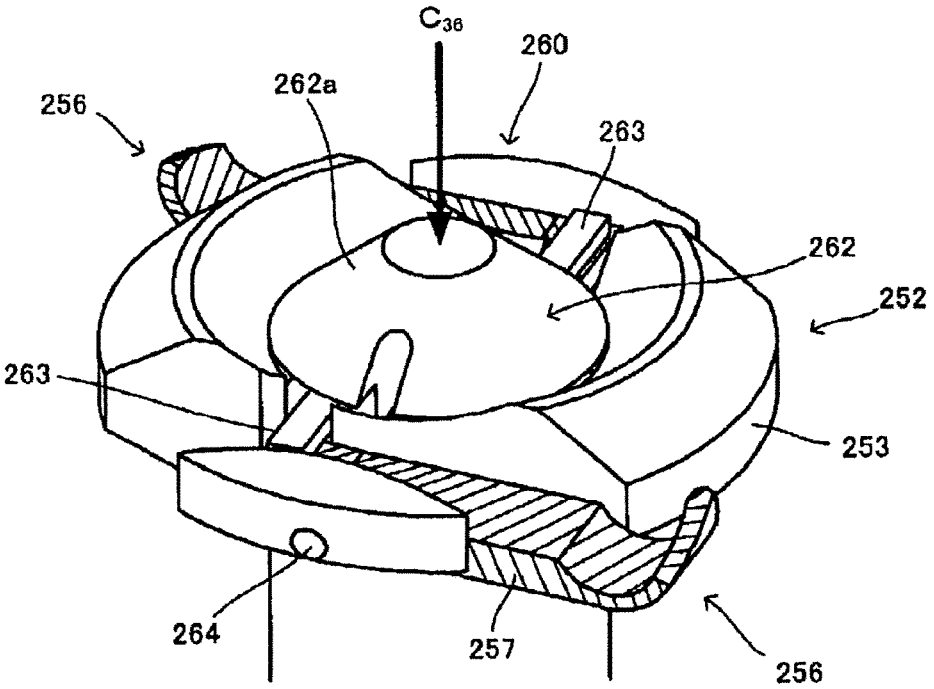
FIG. 36 is an enlarged perspective view of a part of the shaft member 250 of FIG. 32.

First, the shaft member 250 will be described. FIG. 36 is an enlarged appearance perspective view of a part of the rotating force receiving member 252 and the regulating member 260 in one posture in a situation in which each of the members is combined. In addition, in FIG. 36, and in FIG. 37 which will be used later, only the engaging member 256 is illustrated being hatched for making it easy to see. As can be ascertained from FIGS. 32, 33, 35, and 36, the elastic member 265 is inserted into the inner side which is a cylinder of the rotating shaft 251, and further, an end portion on a side on which the contact portion 262 is not disposed in the regulating shaft 261 of the regulating member 260 is also inserted. Accordingly, the regulating member 260 is biased in a direction of falling out from the rotating shaft 251 by a biasing force of the elastic member 265. Meanwhile, the engaging member 256 is disposed in the engaging member accommodation groove 254 provided in the base portion 253 of the rotating force receiving member 252. At this time, the hole 253*a* provided in the base portion 253 and the through-hole 256*a* provided in the engaging member 256 are aligned on one diameter line. In addition, the slit 261*a* provided in the regulating shaft 261 of the regulating member 260 is also disposed to be included in the one diameter line. In addition, the hole 253*a*, the through-hole 256*a*, and the slit 261*a* which are arranged on one diameter line in this manner are inserted to pass through the pin 264. Accordingly, a posture illustrated in FIG. 36 is possible. In addition, at this time, the operating portion 263 of the regulating member 260 is disposed to overlap the operated portion 258 formed in the engaging member 256 of the rotating force receiving member 252.

In addition, as can be apparent from FIG. 33 or the like, the attachment of the bearing member 240 of the shaft member 250 may be performed by inserting and bonding the end portion on the side on which the rotating force receiving member 252 is not disposed to the holding tube body 247 of the bearing member 240, in the rotating shaft 251.

Figure 37:
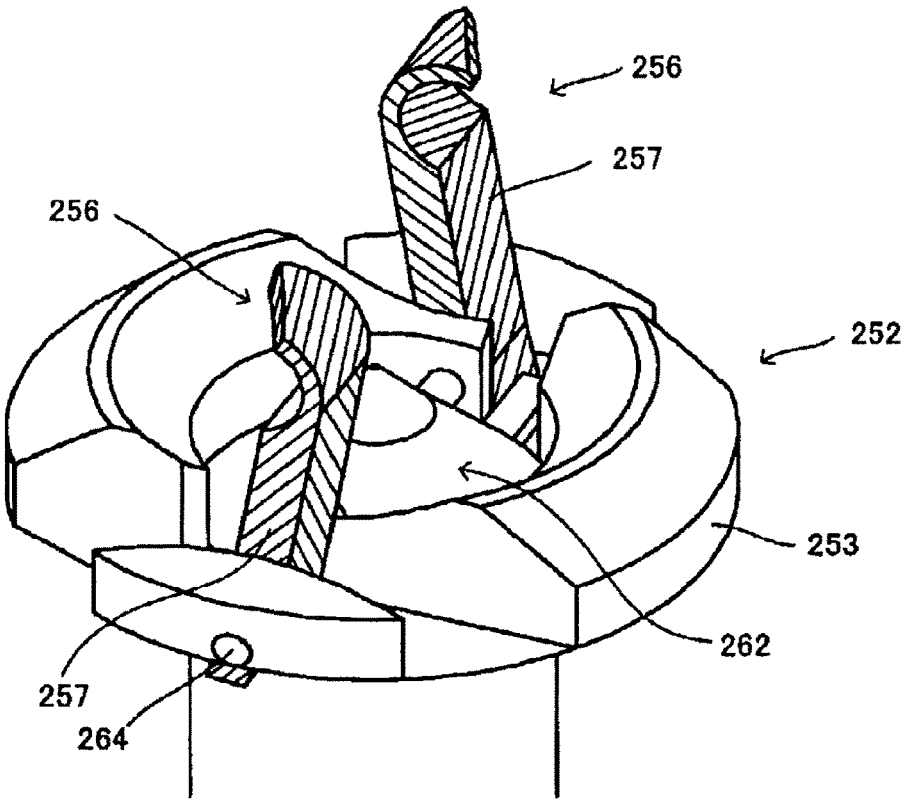
FIG. 37 is an enlarged perspective view of a part of the shaft member 250 of FIG. 32.

The end member 230 combined as described above can obtain an aspect illustrated in FIG. 36 as one posture. In other words, the end member 230 is in a posture in which the engaging member 256 is disposed to across along the inner side of the engaging member accommodation groove 254. Meanwhile, as illustrated by $C_{36}$ in FIG. 36, when pressing the regulating member 260 to the bearing member 240 side (lower part of the paper surface of FIG. 36), the operating portion 263 also moves downward, and the operated portion 258 of the engaging member 256 is moved downward. Then, since the engaging member 256 rotates around the pin 264, as illustrated in FIG. 37, the engaging member 256 rises up to be close to be parallel to the axial direction.

In other words, the end member 230 can switch a posture (protruding posture) in which the engaging member 256 stands and a posture (caved posture) in which the engaging member 256 is inclined.

Figure 38:
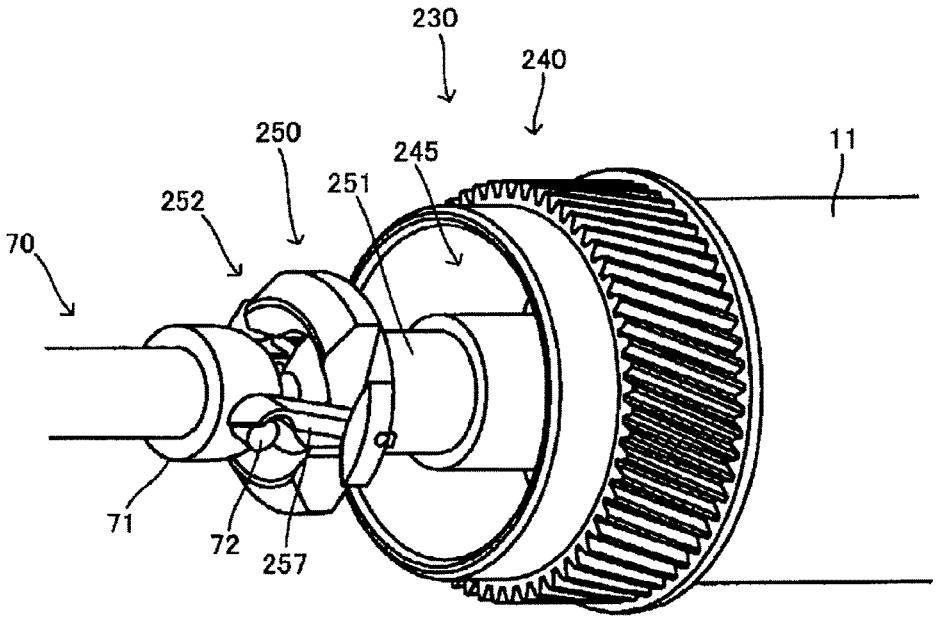
FIG. 38 is a perspective view illustrating a situation in which the driving shaft 70 and the end member 230 are engaged with each other.

In the posture in which the process cartridge provided with the above-described end member 230 is mounted on the apparatus main body, the driving shaft 70 and the rotating force receiving member 252 provided in the shaft member 250 of the end member 230 are engaged with each other, and the rotating force is transmitted. FIG. 38 illustrates a situation in which the rotating force receiving member 252 of the end member 230 is engaged with the driving shaft 70. As can be ascertained from FIG. 38, in a posture in which the driving shaft 70 and the rotating force receiving member 252 are engaged with each other, the axis of the driving shaft 70 and the axis of the shaft member 250 are disposed to abut against each other to match each other. At this time, the tip end of the shaft portion 71 of the driving shaft 70 goes into between two engaging members 256 of the rotating force receiving member 252, and the pin 72 of the driving shaft 70 is engaged to be hooked to the engaging member 256 from the side surface. In other words, at this time, the tip end of the shaft portion 71 of the driving shaft 70 presses the contact portion 262 of the regulating member 260, and the end member 230 is in a posture illustrated in FIG. 37 in which the engaging member 256 stands. Accordingly, the rotating force receiving member 252 rotates following the rotation of the driving shaft 70, and the end member 230 and the photoreceptor drum 11, that is, the photoreceptor drum unit rotates.

Figure 39A:
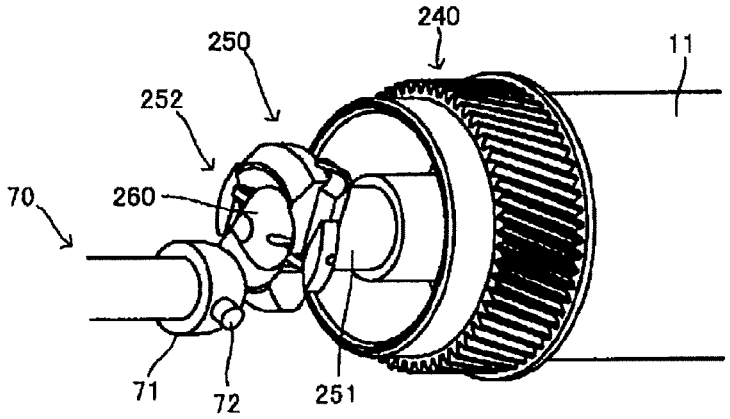
FIG. 39A is a perspective view illustrating a situation in which the driving shaft 70 and the photoreceptor drum unit are engaged with each other.
Figure 39B:
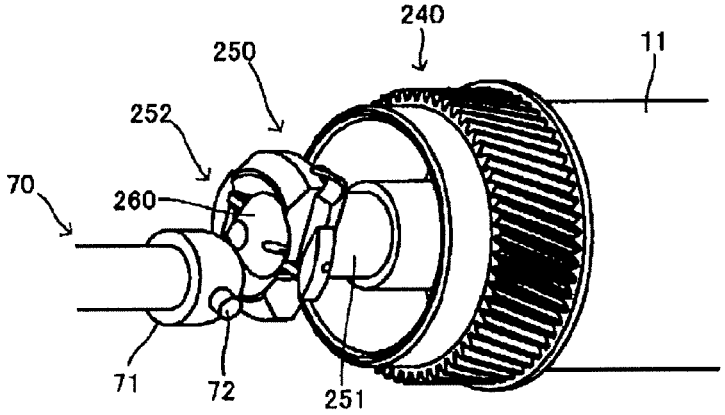
FIG. 39B is a perspective view illustrating another situation in which the driving shaft 70 and the photoreceptor drum unit are engaged with each other.
Figure 39C:
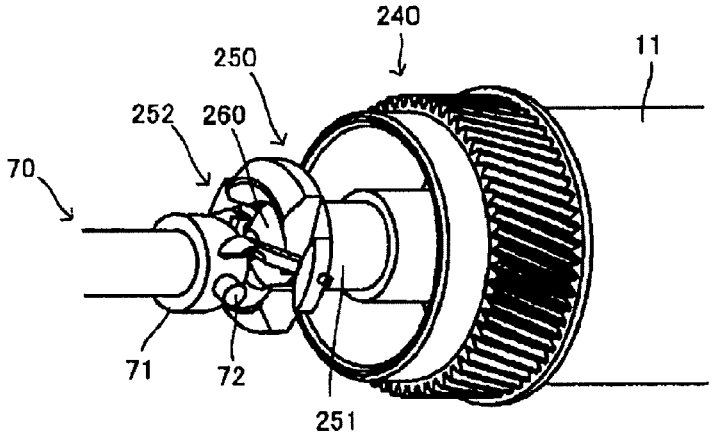
FIG. 39C is a perspective view illustrating still another situation in which the driving shaft 70 and the photoreceptor drum unit are engaged with each other.

Next, an example of operations of the driving shaft 70 and the photoreceptor drum unit when the process cartridge 3 is mounted on the apparatus main body 2 and is in a posture illustrated in FIG. 38, will be described. FIG. 39 is a view for the description. In FIG. 39, FIGS. 39A to 39C illustrate perspective views following an order of a process in which the driving shaft 70 is engaged with the rotating force receiving member 252.

First, from the direction orthogonal to the axial direction of the driving shaft 70 as illustrated in FIG. 39B from the state illustrated in FIG. 39A, the photoreceptor drum unit approaches. At this time, the end member 230 is oriented toward the driving shaft 70 side, the axis thereof has an orientation parallel to the axis of the driving shaft 70, and the photoreceptor drum unit approaches the driving shaft 70 while moving in the direction orthogonal to the axis. At this time, the shaft member 250 is in a posture illustrated in FIG. 36.

In a situation illustrated in FIG. 39B, the tip end of the driving shaft 70 comes into contact with the base portion 253 of the rotating force receiving member 252. However, in the state, since the engaging member 256 of the shaft member 250 is in a posture illustrated in FIG. 36 and is tilted, the driving shaft 70 does not interrupt the engaging member 256 of the rotating force receiving member 252, and can enter between the two engaging members 256 as illustrated in FIG. 39C.

As illustrated in FIG. 39C, when the driving shaft 70 enters until reaching a position of pressing the regulating member 260, the engaging member 256 rises up as described above, and the posture is deformed to a posture illustrated in FIG. 37. Accordingly, finally, a posture illustrated in FIG. 38 is achieved, and the rotation driving force from the driving shaft 70 can be transmitted to the photoreceptor drum 11.

In addition, since a state where the engaging member 256 is not engaged with the driving shaft 70 and a state where the engaging member 256 is engaged with the driving shaft 70 are switched to each other as necessary by the regulating member 260, interruption of the attachment and detachment caused by the member in the middle of the attachment and detachment of the process cartridge is unlikely to be generated, and the attachment and detachment are smoothly performed.

In addition, in the end member 230 of the aspect, more reliable engagement and disengagement are possible compared to the end member 30 and the end member 130 which are described above.

Figure 40:
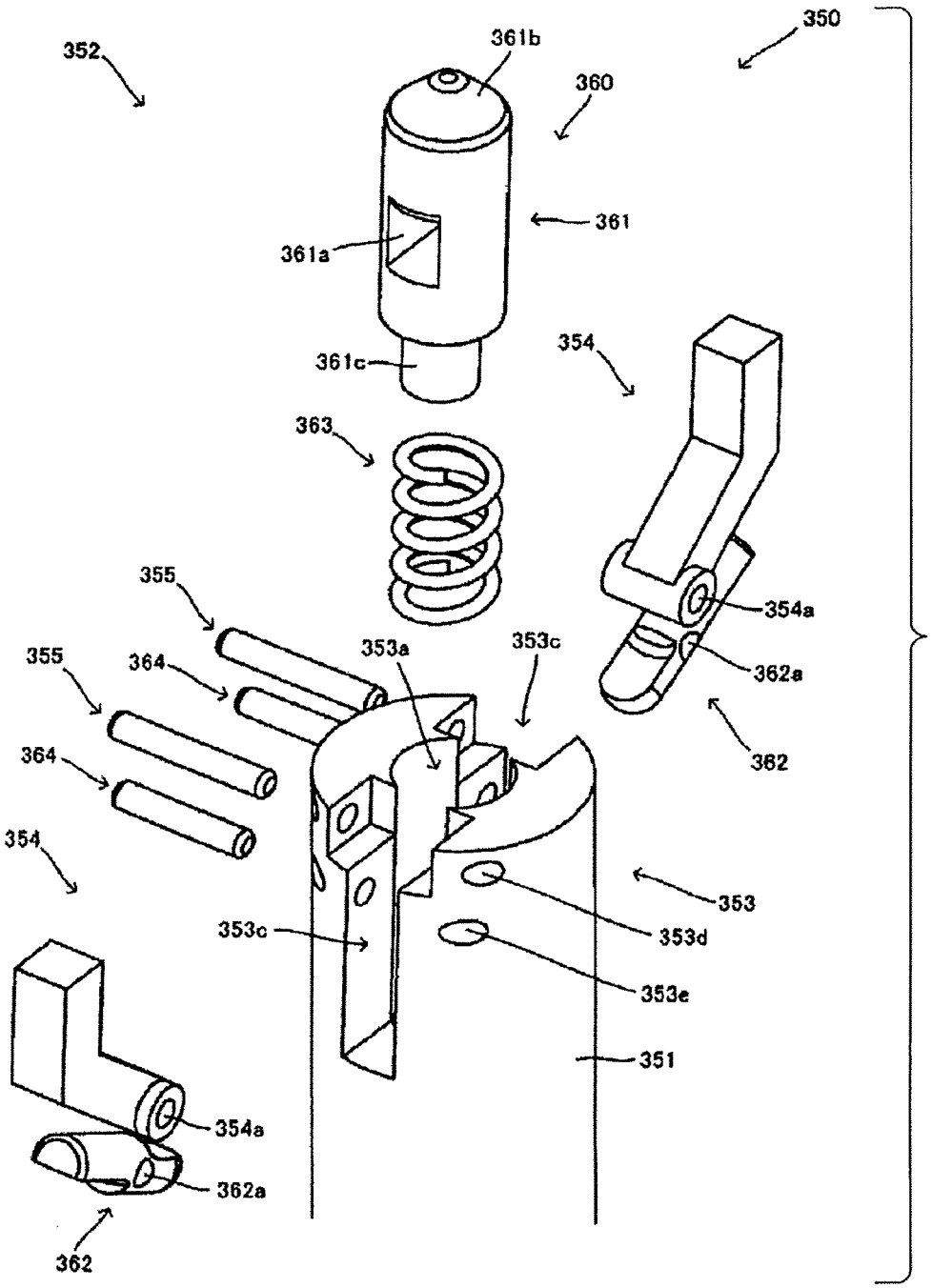
FIG. 40 is an exploded perspective view of a shaft member 350.
Figure 41:
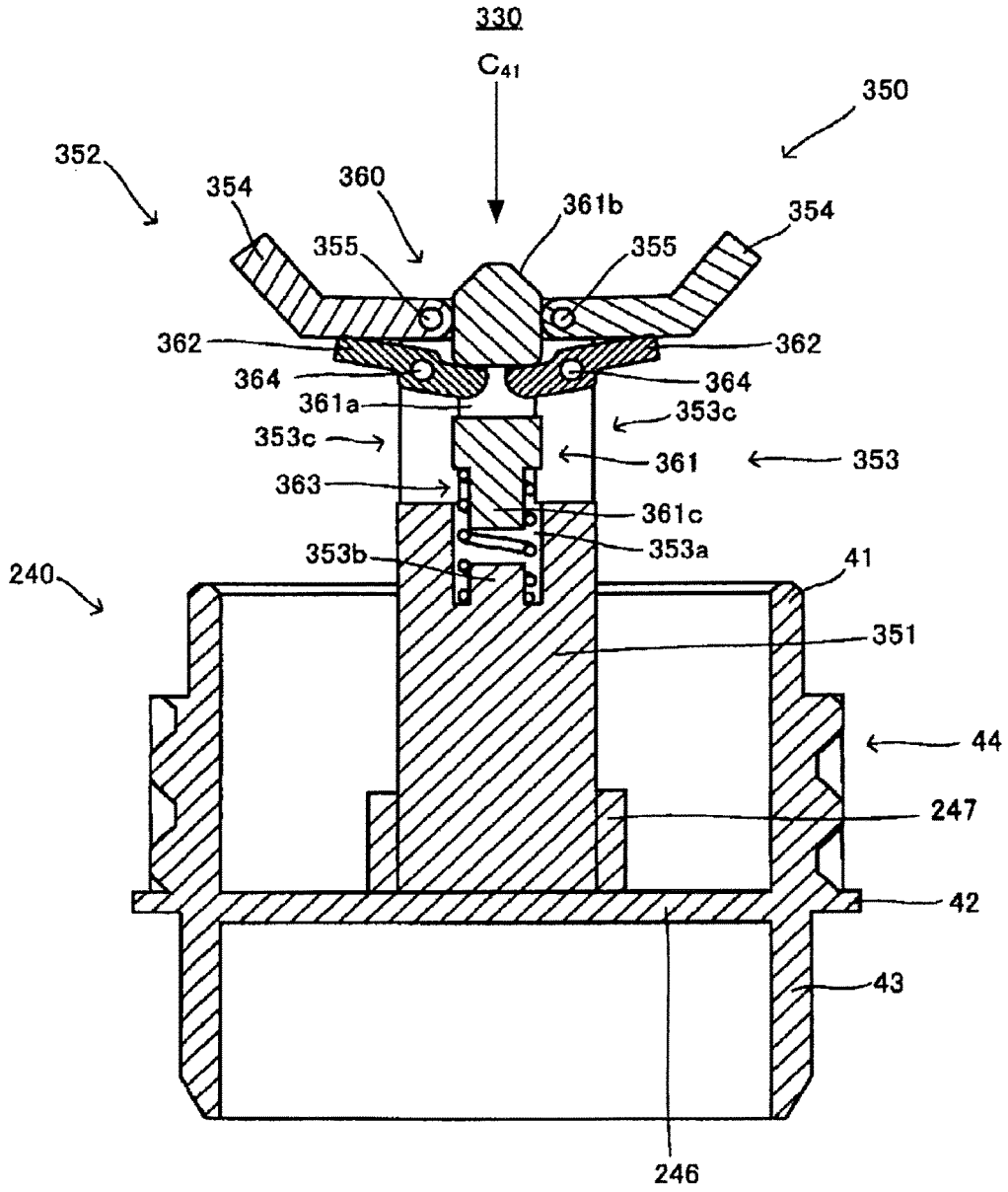
FIG. 41 is a sectional view of an end member 330.

Next, a fourth aspect will be described. FIG. 40 is an exploded perspective view of a tip end part of a shaft member 350, in an end member 330. FIG. 41 is a section along an axis of the end member 330. The end member 330 of the aspect is provided with the bearing member 240 which is the same aspect as that of the end member 230, and the shaft member 350 is employed in the bearing member 240. Here, the shaft member 350 will be described.

As can be ascertained from FIG. 40, the shaft member 350 is configured to include a rotating shaft 351, a rotating force receiving member 352, and a regulating member 360.

The rotating shaft 351 is a cylindrical member. An outer diameter thereof has a size that can be inserted into the inner side of the holding tube body 247 (refer to FIG. 34A) provided in the shaft member holding portion 245 of the bearing member 240. In the aspect, an end portion on one side (a side opposite to the side inserted into the holding tube body 247, and a side opposite to the fitting portion 43) among the end portions of the rotating shaft 351, is configured to function as a part of the rotating force receiving member 352. A specific aspect will be described by the rotating force receiving member 352.

The rotating force receiving member 352 is a member which receives the rotation driving force from the apparatus main body 2 (refer to FIG. 1) and transmits the driving force to the rotating shaft 351 when the end member 330 is in a predetermined posture. The rotating force receiving member 352 in the aspect is configured to be disposed in the end portion on one side (a side opposite to a side on which the holding tube body 247 is inserted, and a side opposite to the fitting portion 43) in the rotating shaft 351, and to include a base portion 353, an engaging member 354, and a pin 355.

The base portion 353 is a part linking the engaging member 354 to the rotating shaft 351 via the pin 355, and is formed in the end portion on one side of the rotating shaft 351 in the aspect, and a part (tip end portion) of the rotating shaft 351 functions as the base portion 353. In the base portion 353, a recessed portion 353*a* is formed along the axis from the end surface on one side of the rotating shaft 351, and as can be ascertained from FIG. 41, a projection 353*b* is provided in a bottom portion thereof. In addition, in the base portion 353, two slits 353*c* which consider a direction along the axial direction from the end surface on one side of the rotating shaft 351 as a length direction, and have a depth by which the side surface of the rotating shaft 351 and the recessed portion 353*a* communicate with each other, are formed. The two slits 353*c* in the aspect are disposed at a position of 180° around the axis to be on one diameter of the rotating shaft 351. Furthermore, in the base portion 353, holes 353*d* and 353*e* which extend in a width direction of the slit 353*c* and penetrate the base portion 353 are formed. The hole 353*d* and the hole 353*e* are disposed to be aligned in the length direction of the slit 353*c*, and the hole 353*d* is on a side close to the end portion on one side of the rotating shaft 351.

The engaging member 354 is a rod-like member, and is bent at one location in the aspect. In addition, in the one end portion, a through-hole 354*a* orthogonal in a direction in which the engaging member 354 extends is provided.

The pin 355 is a round rod-like member.

The regulating member 360 is configured to include a regulating shaft 361, an operating portion 362, an elastic member 363, and a pin 364. The regulating shaft 361 is a columnar member, and an appearance thereof has a size that can be inserted into the inner side of the recessed portion 353*a* provided in the base portion 353. In addition, a slit 361*a* which penetrates the regulating shaft 361 in the diameter direction and extends by a predetermined size in the axial direction is formed in the regulating shaft 361. Among the end portions of the regulating shaft 361, the end portion on the side that is not inserted into the base portion 353 is a conical part (truncated conical), and an inclined surface 361*b* is formed. In addition, among the end portions of the regulating shaft 361, a projection 361*c* is provided on a side opposite to the inclined surface 361*b*. The operating portion 362 is a rod-like member, and two operating portions 362 are disposed similar to the engaging member 354. The operating portion 362 is provided with a through-hole 362*a* orthogonal in the length direction in the vicinity of the center in the length direction. In the aspect, the elastic member 363 is formed by a coiled spring. In addition, the pin 364 is a round rod-like member.

By combining each of the above-described members with each other as follows, the end member 330 is made. In addition, by describing the combination, the size of each member and part, the structure, or the relationship of the sizes of the members and parts, are further understood. As can be ascertained from FIGS. 40 and 41, the elastic member 363 is inserted into the inner side of the recessed portion 353*a* formed in the base portion 353, and further, the end portion on a side on which the projection 361*c* is provided in the regulating shaft 361 of the regulating member 360, is also inserted. One end of the elastic member 363 is inserted and fixed to the projection 353*b* in the recessed portion, and the other end of the elastic member 363 is inserted and fixed to the projection 361*c* of the regulating shaft 361. Accordingly, the regulating shaft 361 is biased in the direction of falling out from the rotating shaft 351 by the biasing force of the elastic member 363. As can be ascertained from FIG. 41, one end side of the operating portion 362 is inserted into the slit 361*a* of the regulating shaft 361 from the slit 353*c*. In addition, the pin 364 is disposed to pass through the hole 353*e* and the through-hole 362*a*. Accordingly, the operating portion 362 can rotate around the pin 364. At this time, in a posture in which no external force is applied, the operating portion 362 is disposed to extend in the direction orthogonal to the axis of the regulating shaft 361.

Meanwhile, one end side of the engaging member 354 is disposed in the slit 361*a*, and the pin 355 is disposed to pass through the hole 353*d* and the through-hole 354*a*. Accordingly, the engaging member 354 can rotate around the pin 355. At this time, in a posture in which no external force is applied, the engaging member 354 extends in the direction orthogonal to the axis of the regulating shaft 361, and is positioned to overlap further the tip end side of the regulating shaft 361 than the operating portion 362. In addition, the engaging member 354 is disposed to come into contact with the tip end on the side that is not inserted into the slit 361*a* in the operating portion 362.

In addition, the attachment of the bearing member 240 of the shaft member 350 may be performed by inserting and bonding the end portion on the side on which the rotating force receiving member 352 is not disposed to the holding tube body 247 of the bearing member 240, in the rotating shaft 351, similar to the example of FIG. 33 or the like.

Figure 42:
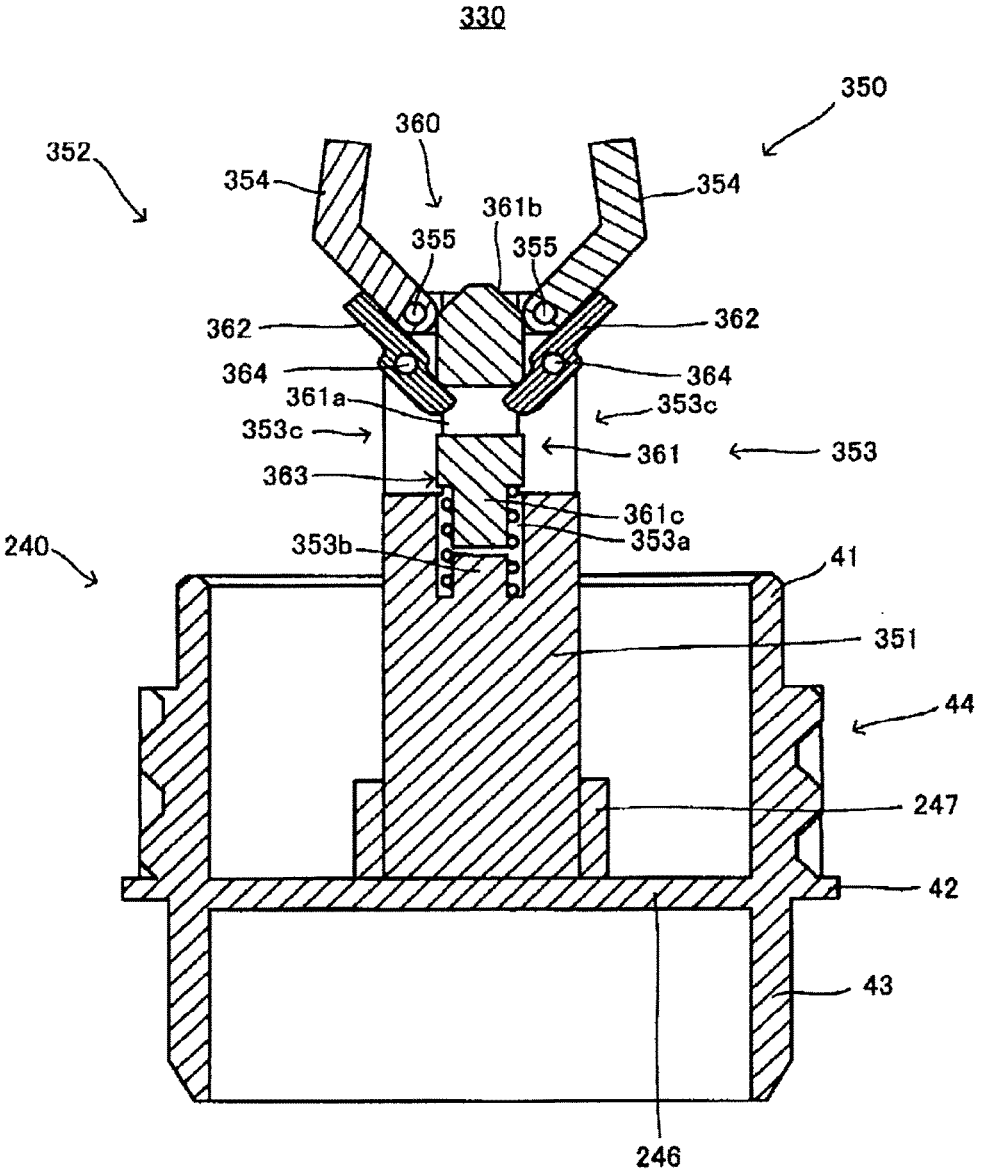
FIG. 42 is a sectional view of a posture in which the end member 330 is deformed.

The end member 330 combined as described above can obtain an aspect illustrated in FIG. 41 as one posture. In other words, the engaging member 356 is in a posture in which the engaging member 356 is disposed to across extending in the radius direction of the rotating shaft 351. Meanwhile, as illustrated by $C_{41}$ in FIG. 41, when pressing the regulating shaft 361 of the regulating member 360 to the bearing member 240 side (lower part of the paper surface of FIG. 41), the regulating shaft 361 moves to the bearing member 240 side, and the end portion inserted into the slit 361*a* of the regulating shaft 361 in the operating portion 362 is also pressed in the same direction. Then, since the operating portion 362 rotates around the pin 364, and the end portion on the opposite side moves to the side opposite to the bearing member 240. Accordingly, since the end portion on the opposite side presses the engaging member 354, and the engaging member 354 rotates around the pin 355, as illustrated in FIG. 42, the engaging member 354 rises up to be close to be parallel to the axial direction.

In other words, the end member 330 can also switch a posture (protruding posture) in which the engaging member 354 stands and a posture (caved posture) in which the engaging member 354 is inclined. Accordingly, the end member 330 can also similarly act similar to the example of the end member 230.

In the aspect, an example in which one type of operating portion directly presses the engaging member is illustrated, but not being limited thereto, an aspect in which the members are interlocked with each other via plural types of operating portions, and finally, the operating portion which is the closest to the engaging member presses the engaging member, may be employed. In addition, the operating portion and the engaging member may be integrated with each other without being distinguished.

Figure 43:
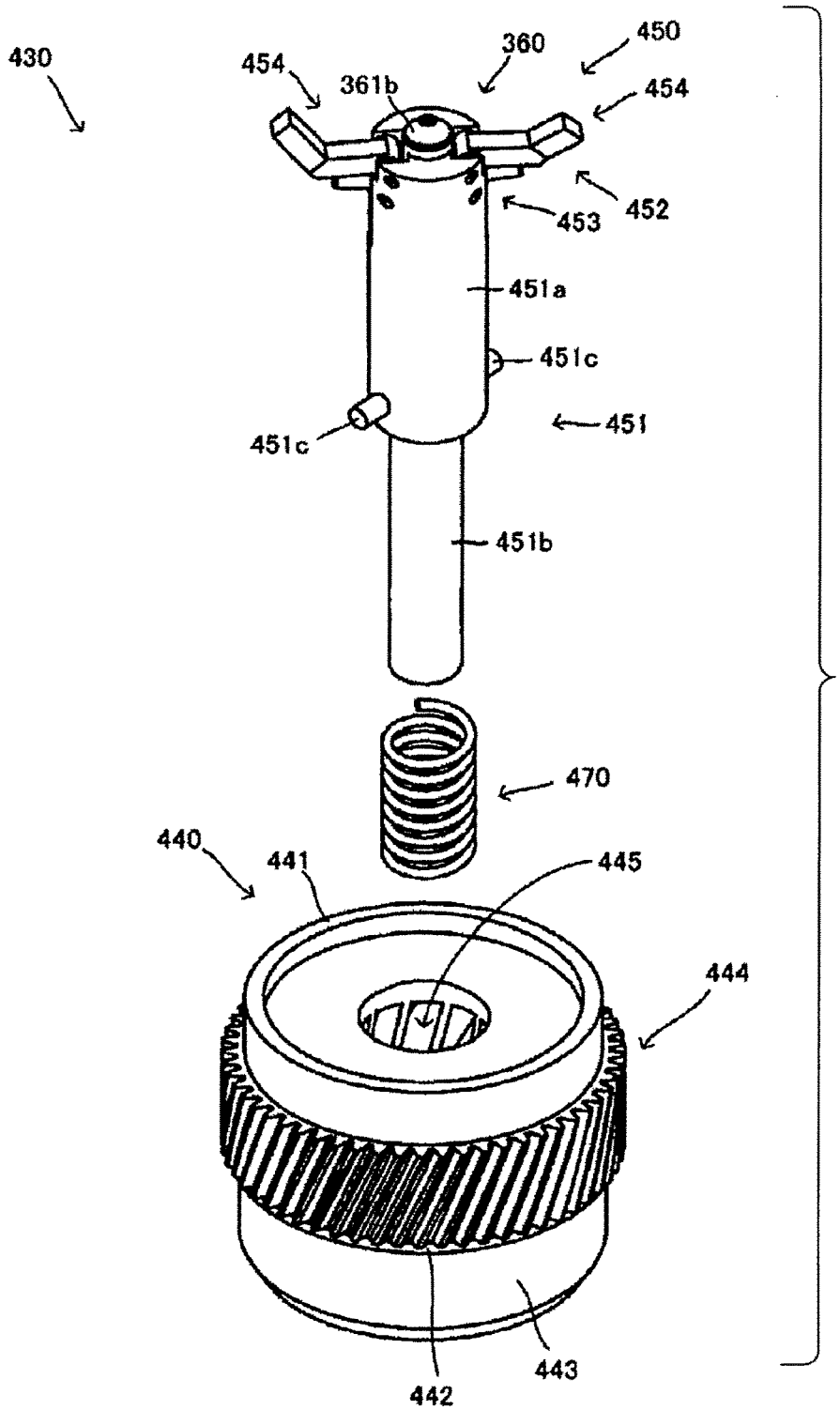
FIG. 43 is an exploded perspective view of an end member 430.

Next, a fifth aspect will be described. FIG. 43 is an exploded perspective view of an end member 430 included in the fifth aspect. Since the fifth aspect is similar to the first aspect except for the end member 430, the description thereof will be omitted here. The end member 430 is configured to include a bearing member 440 and a shaft member 450.

Figure 44A:
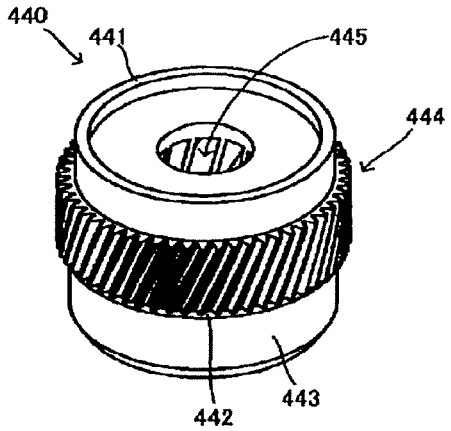
FIG. 44A is a perspective view of a bearing member 440.
Figure 44B:
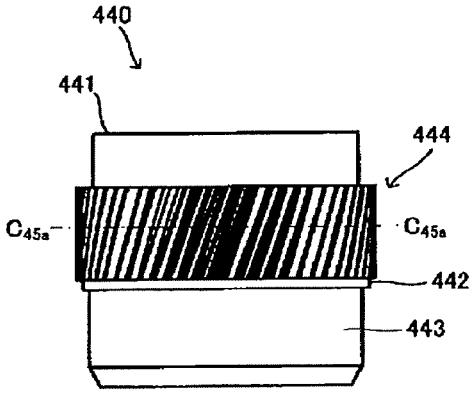
FIG. 44B is a front view of the bearing member 440.
Figure 44C:
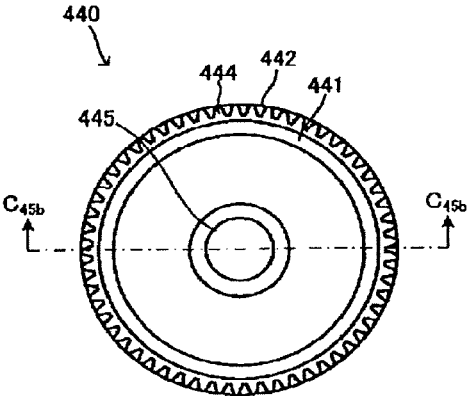
FIG. 44C is a plan view of the bearing member 440.
Figure 45A:
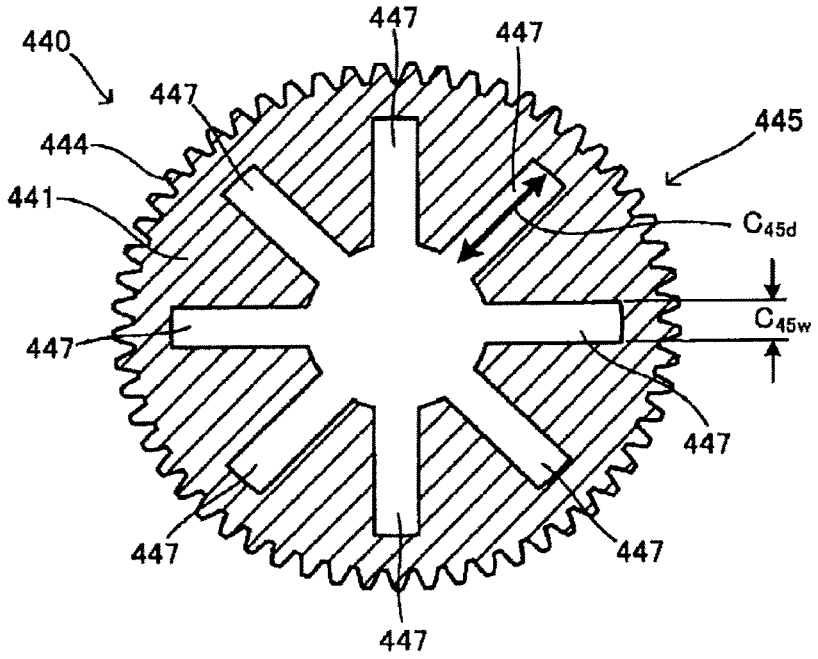
FIG. 45A is an end surface view orthogonal to an axis of the bearing member 440.
Figure 45B:
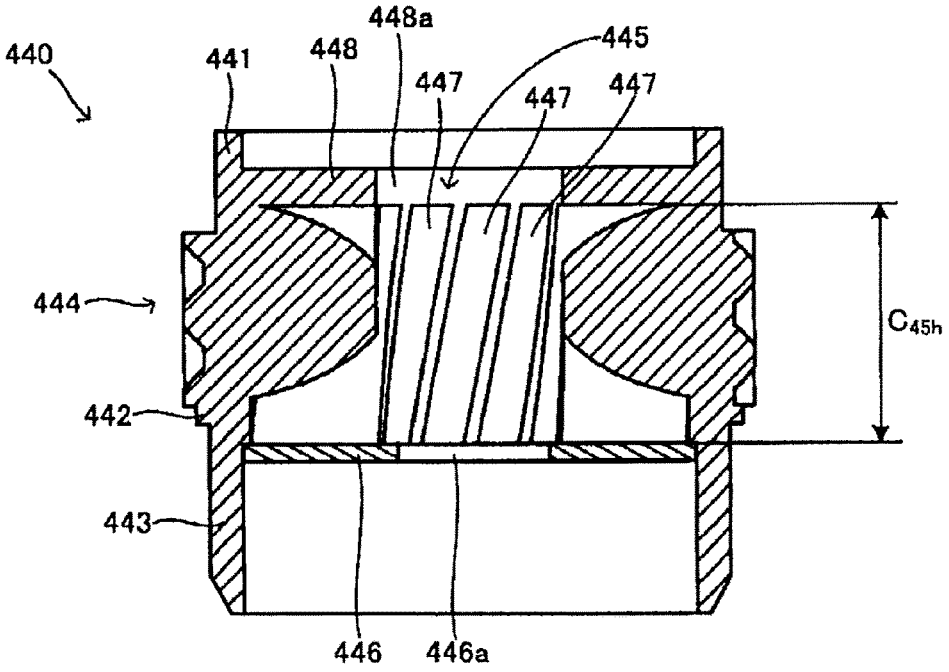
FIG. 45B is a sectional view in a direction along the axis of the bearing member 440.

The bearing member 440 is a member which is bonded to the end portion of the photoreceptor drum 11 in the end member 430. FIG. 44A is a perspective view of the bearing member 440, FIG. 44B is a front view of the bearing member 440, and FIG. 44C is a plan view when viewed from a side on which the shaft member 450 is disposed, in the bearing member 440. Furthermore, FIG. 45A is an end surface view along line illustrated by $C_{45a}$-$C_{45a}$ in FIG. 44B. In other words, FIG. 45A illustrates a surface orthogonal to the axis of the bearing member 440, and an end surface when cutting the bearing member 440. FIG. 45B is a sectional view along line illustrated by $C_{45b}$-$C_{45b}$ in FIG. 44C. In other words, FIG. 45B is a sectional view of the bearing member 440 in the direction along the axis including the axis of the bearing member 440.

The bearing member 440 is configured to include a tubular body 441, a contact wall 442, a fitting portion 443, a gear portion 444, and a shaft member holding portion 445.

The tubular body 441 is a cylindrical member as a whole, the contact wall 442 and the gear portion 444 are disposed on the outer side thereof, and the shaft member holding portion 445 is formed on the inner side thereof. In addition, regarding a part provided with at least the shaft member holding portion 445 on the inner side of the tubular body 441, an inner diameter of the tubular body 441 is formed to be greater than an outer diameter of a first rotating shaft 451*a* such that the first rotating shaft 451*a* and a second rotating shaft 451*b* of a rotating shaft 451 of the shaft member 450 which will be described later smoothly move in the axial direction, rotate around the axis, and can oscillate with respect to the axis of the bearing member 440.

The contact wall 442 which comes into contact with and is locked to the end surface of the photoreceptor drum 11 stands from a part of the outer circumferential surface of the tubular body 441. Accordingly, in a posture in which the end member 430 is mounted on the photoreceptor drum 11, the insertion depth of the end member 430 into the photoreceptor drum 11 is regulated. In addition, the fitting portion 443 of which one side is inserted into the inner side of the photoreceptor drum 11 nipping the contact wall 442 of the tubular body 441, is achieved. The fitting portion 443 is inserted into the inner side of the photoreceptor drum 11, and is fixed to the inner surface of the photoreceptor drum 11 by an adhesive. Accordingly, the end member 430 is fixed to the end portion of the photoreceptor drum 11. Therefore, the outer diameter of the fitting portion 443 is substantially the same as the inner diameter of the photoreceptor drum 11 within a range that can be inserted into the inner side of the cylindrical shape of the photoreceptor drum 11. A groove may be formed on the outer circumferential surface in the fitting portion 443. Accordingly, the groove is filled with the adhesive, and adhesiveness between the tubular body 441 (end member 430) and the photoreceptor drum 11 is improved by an anchor effect or the like.

The gear portion 444 is formed on the outer circumferential surface of the tubular body 441 opposite to the fitting portion 443 nipping the contact wall 442. The gear portion 444 is a gear which transmits the rotating force to another member, such as the developing roller unit, and in the aspect, a helical gear is disposed. However, the type of the gear is not particularly limited, and a spur gear may be disposed, and both of the helical gear and the spur gear may be disposed to be aligned in the axial direction of the tubular body. In addition, it is not necessary to provide the gear.

The shaft member holding portion 445 is a part which is formed on the inner side of the tubular body 441, and has a function of holding the shaft member 450 in the bearing member 440 while ensuring a predetermined operation of the shaft member 450, and functions as one of means for moving and rotating a rotating force receiving member 462. The shaft member holding portion 445 includes a bottom plate 446, a spiral groove 447, and a lid 448.

As illustrated in FIG. 45B, the bottom plate 446 is an annular member and is disposed to block and partition the inner side of the tubular body 441. Therefore, a through-hole 446*a* is provided at the center thereof. The second rotating shaft 451*b* in the rotating shaft 451 is inserted in the through-hole 446*a*. In addition, the through-hole 446*a* is formed to be greater than the appearance of the second rotating shaft 451*b* since the rotating shaft 451 oscillates to be inclined with respect to the axis of the bearing member 440. The attachment of the bottom plate 446 to the tubular body 441 can be performed by adhering or welding. In addition, the tubular body 441 and the bottom plate 446 may be integrally formed.

As illustrated in FIG. 45B, the lid 448 is an annular member disposed at a predetermined interval in the axial direction with respect to the bottom plate 446, and is disposed to block and partition the inner side of the tubular body 441. Therefore, a through-hole 448*a* is provided at the center thereof. The first rotating shaft 451*a* in the rotating shaft 451 is inserted into the through-hole 448*a*. In addition, the through-hole 448*a* is formed to be greater than the appearance of the first rotating shaft 451*a* since the rotating shaft 451 oscillates to be inclined with respect to the axis of the bearing member 440. The spiral groove 447 is disposed between the bottom plate 446 and the lid 448. The attachment of the lid 448 to the tubular body 441 may be performed by being attachable and detachable by a claw or the like, or by fixing by adhering or welding. In addition, the tubular body 441 and the lid 448 may be integrally formed.

The spiral grooves 447 are a plurality of spiral grooves formed on the inner surface of the tubular body 441 and between the bottom plate 446 and the lid 448, and as illustrated by $C_{45d}$ in FIG. 45A, the depth direction is formed in a radial shape (radial direction) around the axis of the tubular body 441. Meanwhile, the longitudinal direction of the spiral groove 447 is the direction along the axis of the tubular body 41 as illustrated in FIG. 45B, and one end side and the other end side are twisted to be deviated in the direction along the inner circumference of the tubular body 441, and are formed in a spiral shape. In addition, as illustrated by $C_{45w}$ in FIG. 45A, the width direction of the spiral groove 447 is formed to be substantially the same as the diameter of a projection 451*c* to the extent that the end portion of the projection 451*c* of the rotating shaft 451 which will be described later is inserted, and the end portion of the projection 451*c* can smoothly move in the groove. In addition, one end of the spiral groove 447 in the longitudinal direction is blocked by the bottom plate 446, and the other end in the longitudinal direction is blocked by the lid 448. In addition, as a standard which illustrates the extent of twisting of the spiral groove 447, "torsion ratio" can be defined. In other words, the "torsion ratio" is defined from the distance (size illustrated by $C_{45h}$ in FIG. 45B) between the spiral grooves in the axial direction, and a total torsion angle which is an angle by which the spiral groove is twisted in the circumferential direction around the axis in the distance, and is expressed by the following equation. Torsion ratio (°/mm)=total torsion angle)(°/distance between spiral grooves in axial direction (mm)

Furthermore, at least one group in which plural spiral grooves 447 face each other nipping the axis of the tubular body 441 is provided. In the aspect, an example in which four groups, that is, a total of eight spiral grooves 447 are formed, is employed, but one group, that is, two spiral grooves may be formed. Meanwhile, two, three, five or more groups of spiral grooves may be provided. When the spiral groove is injection-molded, the injection molding is performed by the releasing while rotating the mold after the injection of the material.

The material which configures the bearing member 440 can be considered similar to the bearing member 40.

Returning to FIG. 43, the shaft member 450 will be described. As can be ascertained from FIG. 43, the shaft member 450 is configured to include the rotating shaft 451, a rotating force receiving member 452, a regulating member 360, and a rotating shaft elastic member 470. Here, the rotating shaft elastic member 470 of the aspect is a coiled spring. Here, since the regulating member 360 is the same as that of the description above, the same reference numerals are given, and the description thereof will be omitted.

Similar to the above-described rotating force receiving member 352, the rotating force receiving member 452 is a member which receives the rotation driving force from the apparatus main body 2 (refer to FIG. 1) and transmits the driving force to the rotating shaft 451 when the end member of the aspect is in a predetermined posture. The rotating force receiving member 452 in the aspect is configured to be disposed in the end portion on one side (a side opposite to a side to which the second rotating shaft 451*b* is linked) in the first rotating shaft 451*a* of the rotating shaft 451, and to include a base portion 453, an engaging member 454, and a pin 455. Here, since the base portion 453 and the pin 455 are the same as the base portion 353 and the pin 355 of the above-described aspect, the description thereof will be omitted here.

The engaging member 454 is a rod-like member, and is bent at one location in the aspect, and a tapered part is provided to have a shape of a hook. In addition, in one end portion, a through-hole 454*a* orthogonal to a direction in which the engaging member 454 extends is provided. The through-hole 454*a* is similar to the through-hole 354*a* in the above-described aspect. By providing a hook-like tapered part in the engaging member 454, as will be described later with reference to FIG. 50, it is possible to generate a force (pulling-in force P) of pulling the shaft member 450 in the direction illustrated by an arrow $C_{50c}$ in FIG. 50, and to achieve stable rotation.

The rotating shaft 451 is a member which transmits the rotating force from the rotating force receiving member 452 to the bearing member 440, and as can be ascertained from FIG. 43, the rotating shaft 451 includes the cylindrical first rotating shaft 451*a* and the columnar second rotating shaft 451*b* having a smaller outer diameter than that of the first rotating shaft 451*a*, and has a structure in which the two rotating shafts are coaxially aligned and one ends are linked to each other. In the first rotating shaft 451*a*, on the side surface of the end portion on a side linked to the second rotating shaft 451*b*, two projections 451*c* are disposed. Two projections 451*c* are provided on the same line in one diameter direction of the cylinder of the first rotating shaft 451*a*.

Figure 46:
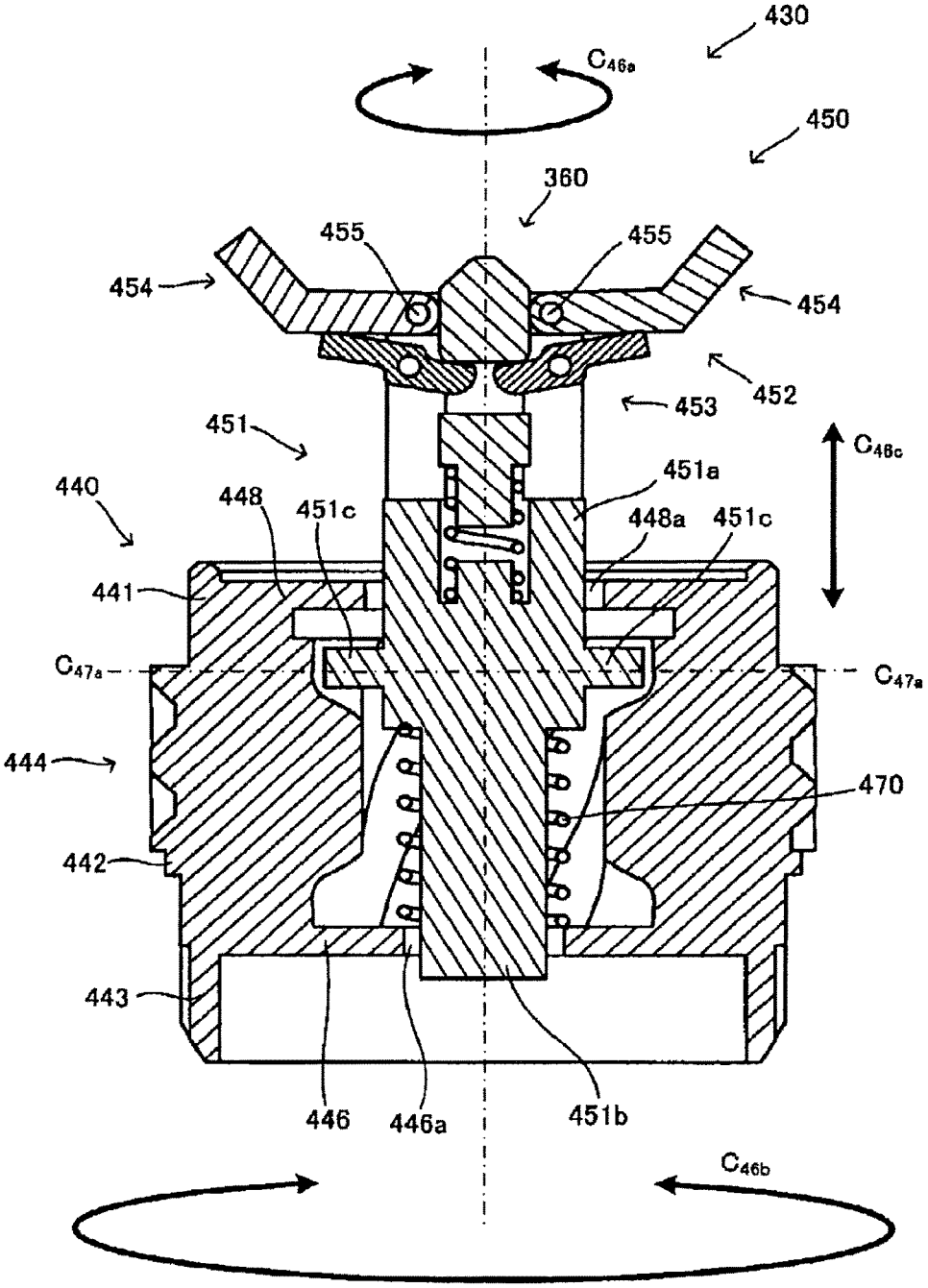
FIG. 46 is a sectional view of the end member 430.
Figure 47A:
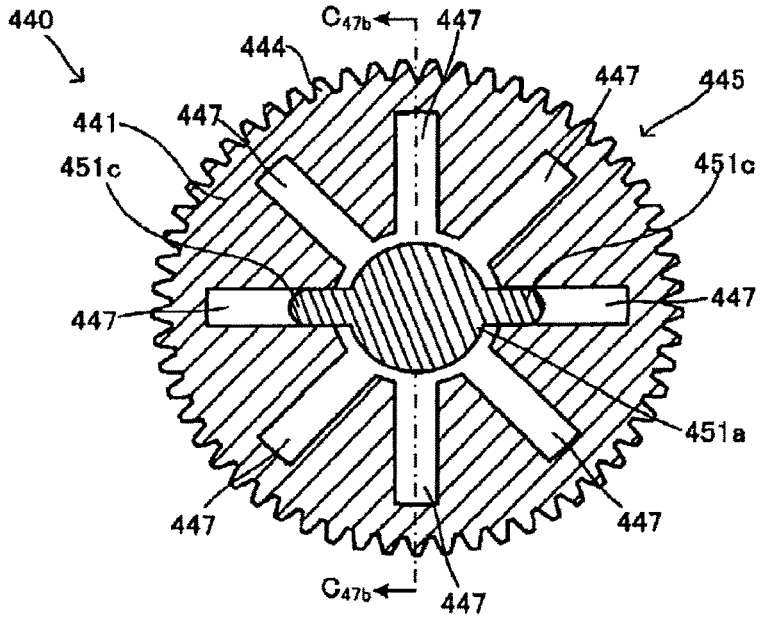
FIG. 47A is an end surface view orthogonal to an axis of the end member 430 of FIG. 46.
Figure 47B:
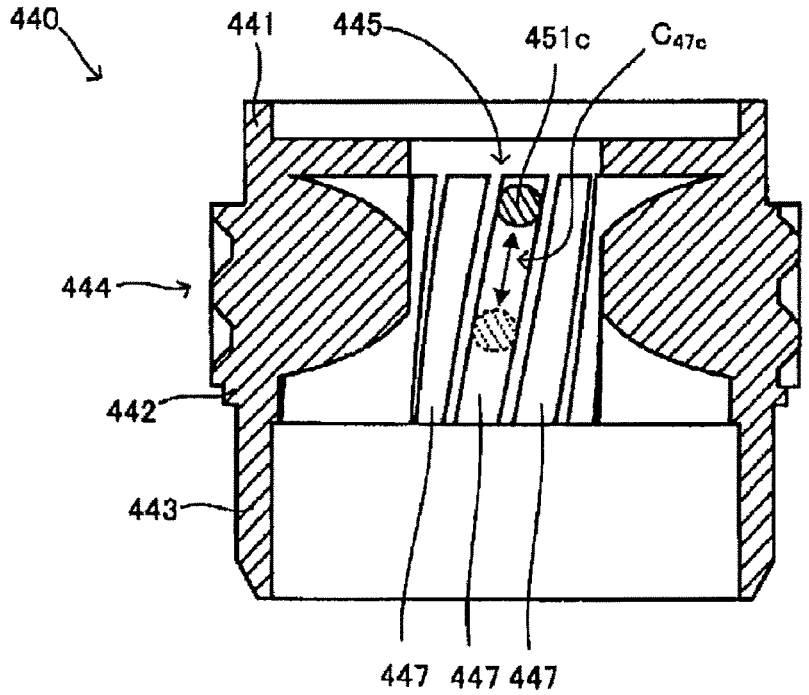
FIG. 47B is a sectional view in the direction along the axis of the end member 430 of FIG. 46.

By combining the bearing member 440 and the shaft member 450 with each other as follows, the end member 430 is made. In addition, by describing the combination, the size of each member and part, the structure, or the relationship of the sizes of the members and parts, are further understood. FIG. 46 is a sectional view along the axial direction of the end member 430. FIG. 47A is an end surface view of the end member 430 along line illustrated by $C_{47a}$-$C_{47a}$ in FIG. 46, and FIG. 47B is a sectional view of the end member 430 along line illustrated by $C_{47b}$-$C_{47b}$ in FIG. 47A. However, in FIG. 47B, only the projection 451*c* is illustrated regarding the shaft member 450 for making it easy to understand.

As can be ascertained from FIG. 46, in the rotating shaft 451, the second rotating shaft 451*b* is inserted toward the bottom plate 446 side of the shaft member holding portion 445 formed on the inner side of the bearing member 440, and passes through the through-hole 446*a*. In addition, the first rotating shaft 451*a* passes through the through-hole 448*a* of the lid 448. At this time, as illustrated in FIGS. 47A and 47B, the projection 451*c* which protrudes from the side surface of the rotating shaft 451 is inserted into the spiral groove 447 formed in the shaft member holding portion 445 of the bearing member 440. In addition, as can be ascertained from FIG. 46, on the inner side of the bearing member 440, the second rotating shaft 451*b* passes through the inner side of the rotating shaft elastic member 470, and the rotating shaft elastic member 470 is disposed between the bottom plate 446 and the first rotating shaft 451*a*. Therefore, one side of the rotating shaft elastic member 470 comes into contact with the first rotating shaft 451*a*, and the other side comes into contact with the bottom plate 446. Accordingly, the rotating shaft elastic member 470 biases the rotating shaft 451, and the rotating shaft 451 is biased in the direction in which the rotating shaft 451 protrudes from the bearing member 440. However, since the projection 451*c* is inserted into the spiral groove 447 of the bearing member 440, and both ends of the spiral groove 447 are blocked by the bottom plate 446 and the lid 448, the rotating shaft 451 is held in a state of being biased without being shifted from the bearing member 440.

Above, in a posture in which each of the members is combined, the axes of the bearing member 440 and the rotating shaft 451 match each other.

Figure 48:
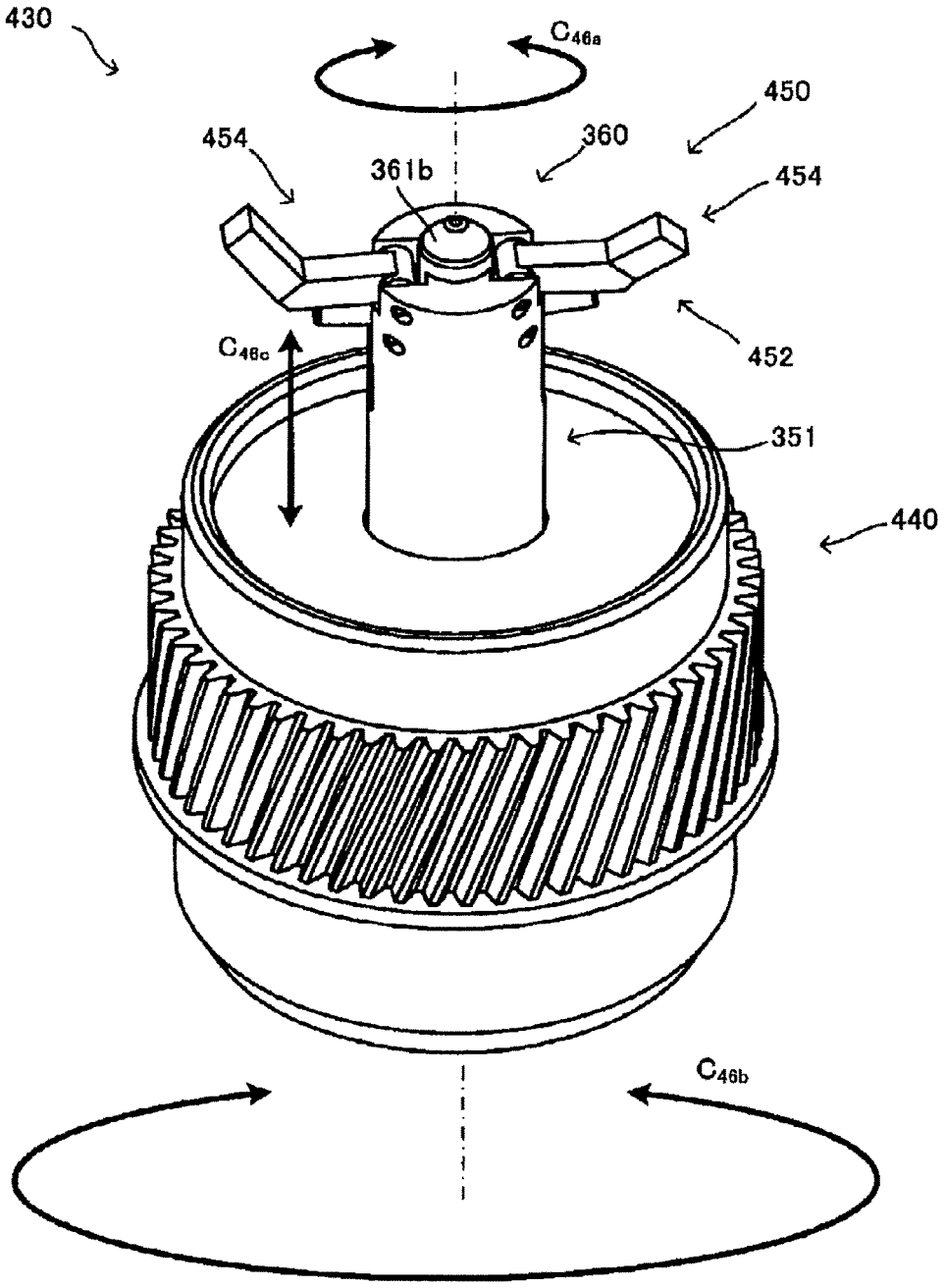
FIG. 48 is a perspective view of the end member 430.

Next, how the end member 430 can be deformed, move, and rotate, will be described. FIG. 48 illustrates a perspective view in one posture of the end member 430. In postures illustrated in FIGS. 46 to 48, the entire shaft member 450 is in a posture of protruding the most from the bearing member 440 within a possible range, by the rotating shaft elastic member 470. When no external force is applied to the shaft member 450, the end member 430 is in this posture. In addition, since the rotating force receiving member 452 and the regulating member 360 are operated as described above with reference to FIGS. 41 and 42, the description thereof will be omitted. In addition, here, a case where the rotating force receiving member 452 and the regulating member 360 are in a posture of FIG. 41 is described as an example, but a case where the rotating force receiving member 452 and the regulating member 360 are in a posture of FIG. 42 also similarly acts.

In postures (the rotating force receiving member 452 and the regulating member 360 are in a posture of FIG. 41) illustrated in FIGS. 46 and 48, when the rotating force around the axis is applied to the rotating shaft 451 via the rotating force receiving member 452 as illustrated by an arrow $C_{46a}$ in FIGS. 46 and 48, the projection 451*c* also rotates in accordance with the rotating force. Then, the projection 451*c* presses the side wall of the spiral groove 447, the rotation is transmitted to the bearing member 440, and as illustrated by an arrow $C_{46b}$ in FIGS. 46 and 48, the bearing member 440 rotates. Accordingly, the photoreceptor drum 11 attached to the bearing member 440 also rotates around the axis.

In addition, since the projection 451*c* is inserted into the spiral groove 447, when the rotating shaft 451 rotates, as illustrated by an arrow $C_{47c}$ in FIG. 47B, the projection 451*c* also moves in the axial direction. Accordingly, the rotating shaft 451 to which the projection 451*c* is attached, and the rotating force receiving member 452 and the regulating member 360 which are attached to the rotating shaft 451 also move in the biasing direction against the biasing force of the rotating shaft elastic member 470 as illustrated by an arrow $C_{48c}$ in FIGS. 46 and 48.

Therefore, in the end member 430, by the rotation of the rotating force receiving member 452, the rotation around the axis of the end member 430 and the movement in the direction along the axis of the rotating shaft 451 are also possible.

Figure 49:
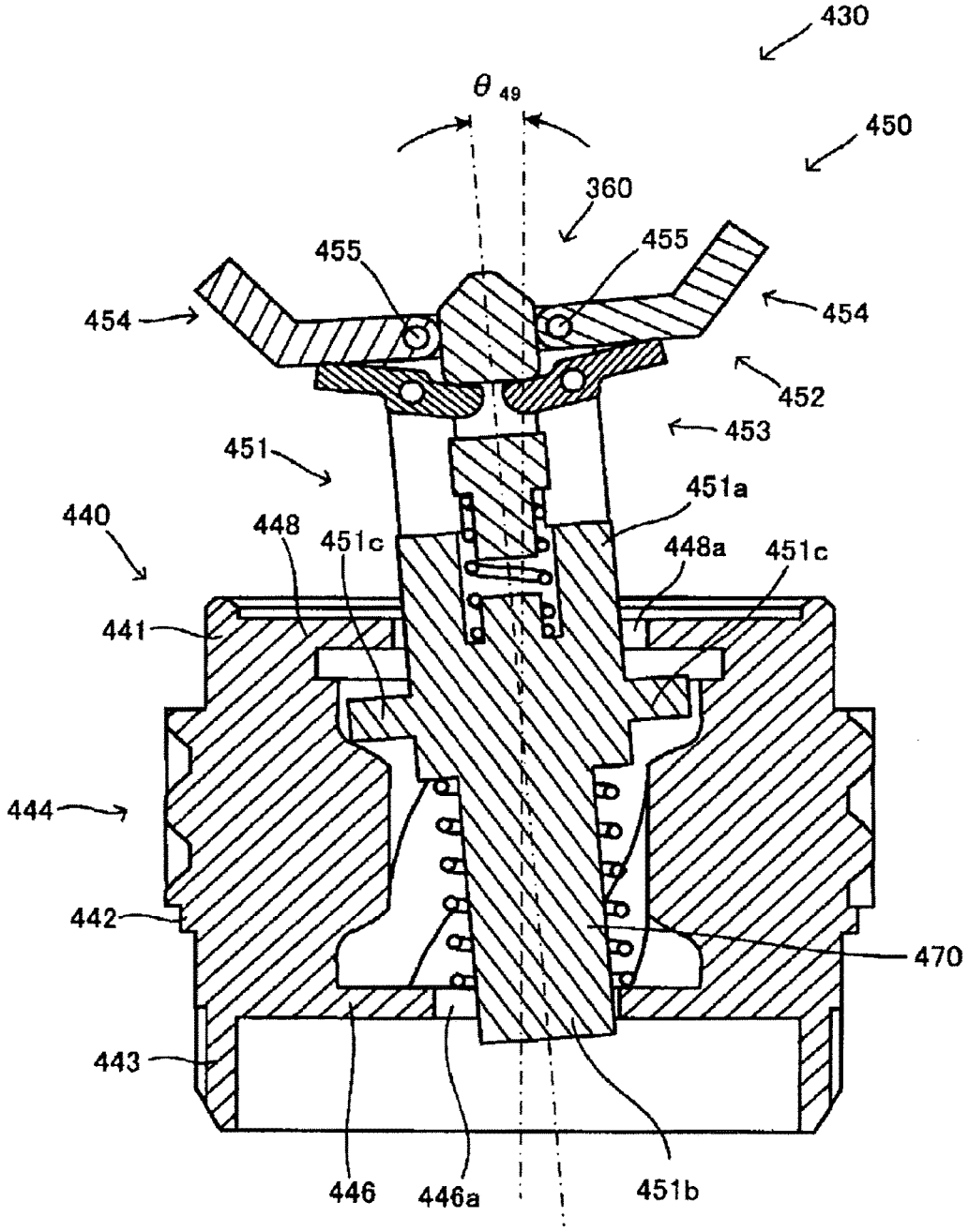
FIG. 49 is a sectional view of the end member 430.

Furthermore, in the end member 430, the diameter of the inner side of the tubular body 441 and the diameter of the through-hole 448*a* of the lid 448 are greater than the size of the diameter of the outer circumference of the first rotating shaft 451*a* of the rotating shaft 451, the diameter of the through-hole 446*a* of the bottom plate 446 is greater than the diameter of the outer circumference of the second rotating shaft 451*b*, and thus, as illustrated in FIG. 49, oscillation is possible such that the axis of the shaft member 450 is inclined by an angle of $\theta_{49}$ with respect to the axis of the bearing member 440. Accordingly, when the process cartridge is attached to and detached from the apparatus main body, it is possible to more smoothly perform the engagement and disengagement of the rotating force receiving member 452 and the driving shaft. It is preferable that the size of the inclination angle $\theta_{49}$ becomes 18° at the maximum. Accordingly, it is possible to reliably and smoothly attach and detach the process cartridge to and from the apparatus main body.

Figure 50:
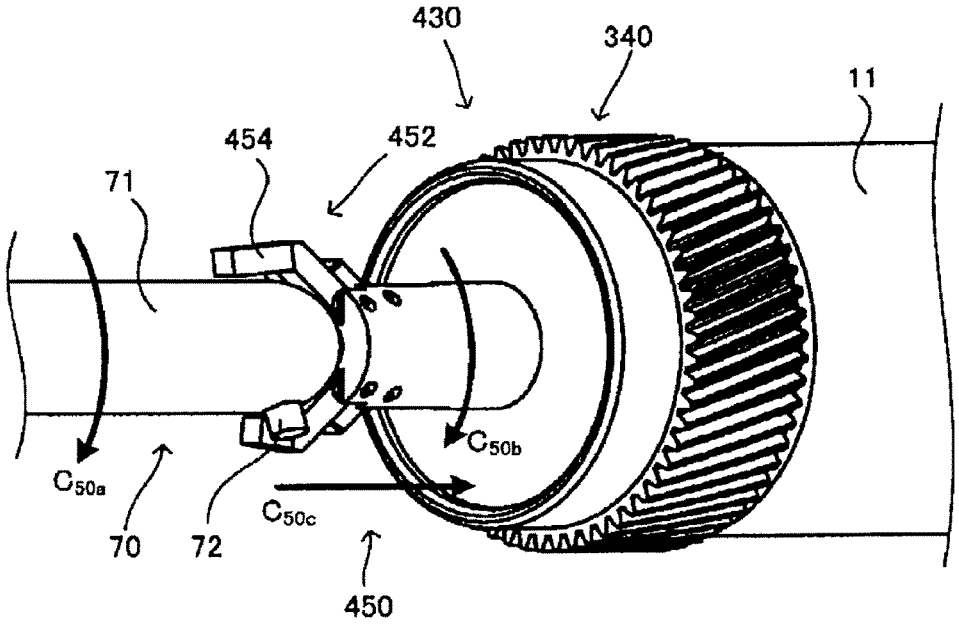
FIG. 50 is a perspective view illustrating a situation in which the end member 430 and the driving shaft 70 are engaged with each other.

In a posture in which the process cartridge 3 is mounted on the apparatus main body 2, the driving shaft 70 and the rotating force receiving member 452 provided in the shaft member 450 of the end member 430 are engaged with each other, and the rotating force is transmitted. FIG. 50 illustrates a perspective view in a situation in which the rotating force receiving member 452 of the end member 430 is engaged with the driving shaft 70.

As can be ascertained from FIG. 50, in a posture in which the driving shaft 70 and the rotating force receiving member 452 are engaged with each other, the axis of the driving shaft 70 and the axis of the shaft member 450 are disposed to abut against each other to match each other. At this time, the pin 72 of the driving shaft 70 is engaged to be hooked from the side surface of two engaging members 454 of the rotating force receiving member 452.

In the posture, as illustrated by an arrow $C_{50a}$ in FIG. 50, when the driving shaft 70 rotates in the rotating force transmitting direction, the pin 72 is hooked to the engaging member 454, and as illustrated by an arrow $C_{50b}$ in FIG. 50, the rotating force is transmitted to the rotating shaft 451. At this time, the rotating shaft 451 moves in the direction illustrated by an arrow $C_{50c}$ in FIG. 50 by an action of the spiral groove 447 and the projection 451*c* of the bearing member 440. However, since the pin 72 of the driving shaft 70 is engaged with the engaging member 454 of the rotating force receiving member 452, the engagement of both of the members is not released and stable linking is maintained. A force which moves in the direction illustrated by an arrow $C_{50c}$ becomes a force of pulling in the driving shaft 70, and the force acts to achieve more stable rotation. However, at this time, the pulling-in force by the spiral groove 447 is weaker than the force by which the engaging member 454 is engaged with the driving shaft 70. More specifically, it is preferable to configure as follows. In other words, it is preferable that the following established expression in a pulling-in force P by the engaging member, a biasing force Q of the rotating shaft elastic member, and a force R in the axial direction by the spiral groove, is the condition of the rotation driving.

$$R \leq P+Q$$

Here, P is a force which moves in the direction of approaching the driving shaft of the apparatus main body during the driving rotation by the shape of the engaging member of the tip end member, Q is a force which is generated by the rotating shaft elastic member, and moves in the direction of approaching the driving shaft of the apparatus main body, and R is a force which is generated by the spiral groove of the main body during the rotation driving, and is moved in the direction of separating the rotating shaft from the driving shaft of the apparatus main body.

Next, an example of operations of the driving shaft 70 and the photoreceptor drum unit when the process cartridge including the end member 430 is mounted on the apparatus main body 2 and is in a posture of FIG. 50, will be described. Description of a first example is illustrated in FIG. 51.

Regarding the first example, in FIG. 51, FIGS. 51A to 51C are perspective views following the order of a process in which the driving shaft 70 is engaged with the rotating force receiving member 452. In the example, an example in which the driving shaft 70 comes into contact with the engaging member 454 before the driving shaft 70 presses the regulating shaft 361 of the regulating member 360, is described.

Figure 51A:
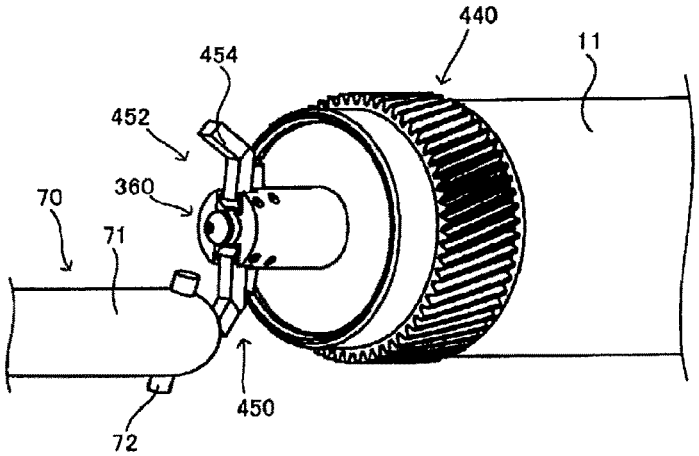
FIG. 51A is a perspective view illustrating a situation in which the driving shaft 70 and the photoreceptor drum unit are engaged with each other.
Figure 51B:
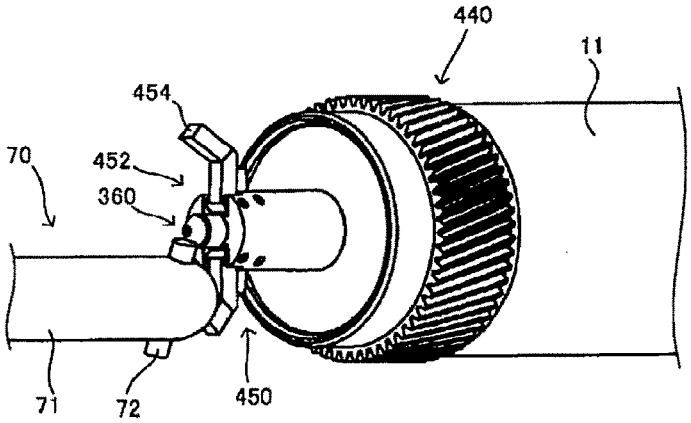
FIG. 51B is a perspective view illustrating another situation in which the driving shaft 70 and the photoreceptor drum unit are engaged with each other.
Figure 51C:
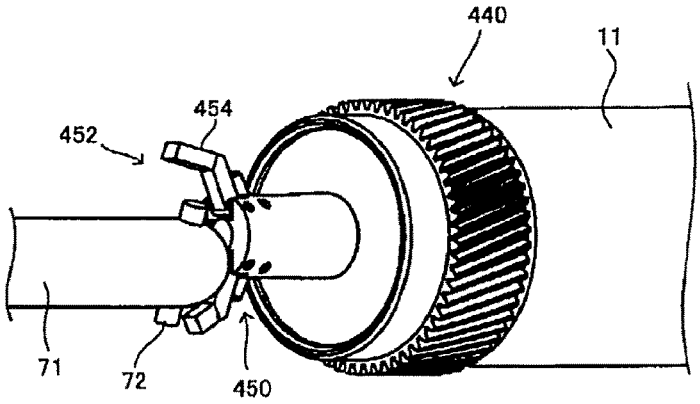
FIG. 51C is a perspective view illustrating still another situation in which the driving shaft 70 and the photoreceptor drum unit are engaged with each other.

First, from the direction orthogonal to the axial direction of the driving shaft 70 as illustrated in FIG. 51B from the state illustrated in FIG. 51A, the photoreceptor drum unit approaches. At this time, the end member 430 is oriented toward the driving shaft 70 side, the axis thereof has an orientation parallel to the axis of the driving shaft 70, and the photoreceptor drum unit approaches the driving shaft 70 while moving in the direction orthogonal to the axis. At this time, the shaft member 450 is in a posture illustrated in FIG. 46.

In the example, as illustrated in FIG. 51B, the driving shaft 70 presses the engaging member 454 of the rotating force receiving member 452. Accordingly, the shaft member 450 moves to the bearing member 440 side. The rotation around the axis is also generated by an action of the spiral groove 447 by the movement. In addition, as can be ascertained from FIG. 51C, as the driving shaft 70 climbs over the one engaging member 454, a posture of FIG. 50 can be achieved.

In a case of the example, the engagement and disengagement of the driving shaft 70 and the rotating force receiving member 452 can be performed by tracing back the description.

In the above-described example, since an example in which the driving shaft 70 comes into contact with the engaging member 454 before the driving shaft 70 presses the regulating shaft 361 of the regulating member 360, is described, it is necessary that the driving shaft 70 climbs over the engaging member 454. Meanwhile, as a second example, an example in which the driving shaft 70 does not come into contact with the engaging member 454 (including a slight contact to the extent that does not interrupt the engagement) and the regulating shaft 361 is pressed, is described. In the case, as the driving shaft 70 presses the regulating shaft 361, the engaging member 454 rises up and is smoothly engaged with the pin 72 of the driving shaft 70.

Figure 52A:
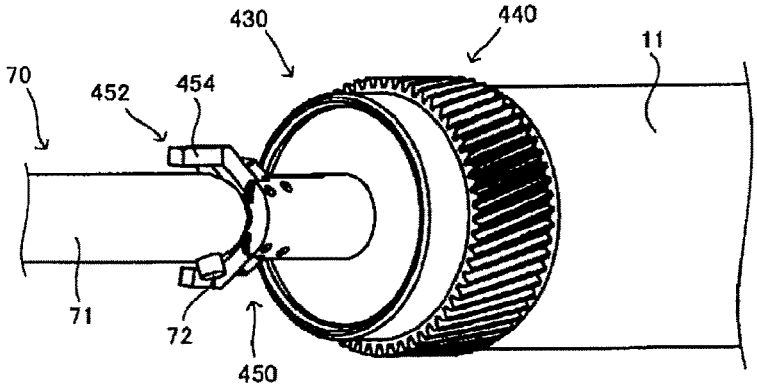
FIG. 52A is a perspective view illustrating a situation in which the driving shaft 70 and the photoreceptor drum unit are disengaged from each other.
Figure 52B:
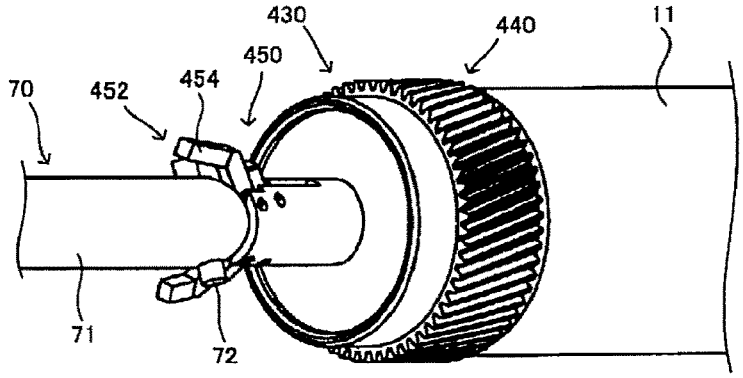
FIG. 52B is a perspective view illustrating another situation in which the driving shaft 70 and the photoreceptor drum unit are disengaged from each other.
Figure 52C:
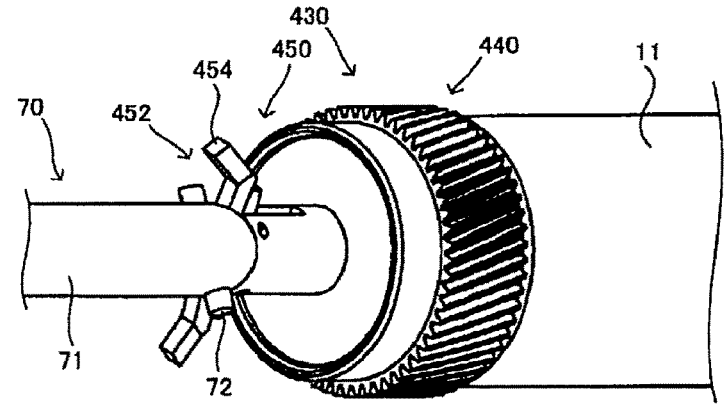
FIG. 52C is a perspective view illustrating still another situation in which the driving shaft 70 and the photoreceptor drum unit are disengaged from each other.

Meanwhile, when both of the driving shaft 70 and the rotating force receiving member 452 are disengaged from the posture in which the driving shaft 70 and the rotating force receiving member 452 are engaged with each other illustrated in FIG. 50, there is also a case where the disengagement is performed in the direction different from that of the first example. At this time, for example, the disengagement proceeds as follows. FIG. 52 is a view for the description. In FIG. 52, FIGS. 52A to 52C illustrate perspective views following an order of a process in which the rotating force receiving member 452 is disengaged from the driving shaft 70.

In the example, when the photoreceptor drum unit is disengaged from the driving shaft from the posture illustrated in FIG. 50, as illustrated in FIG. 52A, the pin 72 of the driving shaft 70 is hooked to the engaging member 454. In this case, as illustrated in FIG. 52B, the shaft member 450 is pressed by the hooked state, and as illustrated in FIG. 49, the shaft member 450 oscillates to be inclined with respect to the axial direction of the bearing member 440. Accordingly, the engagement of the pin 72 and the engaging member 454 is released, and both of the members can be smoothly disengaged as illustrated in FIG. 52C.

Otherwise, in a case where the hooked state is not released by the oscillation, the rotating shaft 451 rotates around the axis. Then, the rotating shaft 451 moves along the axial direction to the bearing member 440 side by the action of the spiral groove 447. In addition, as the regulating member 360 is disengaged from the shaft portion 71 of the driving shaft 70, the force of pressing the regulating shaft 361 of the regulating member 360 is also released, and the engaging member 454 is deformed to a posture illustrated in FIG. 46. Accordingly, the engagement of the pin 72 and the engaging member 454 is released, and as illustrated in FIG. 52C, both of the pin 72 and the engaging member 454 can be disengaged from each other.

As described above, according to the aspect, the engagement and disengagement of the driving shaft and the photoreceptor drum unit are more smoothly performed.

Figure 53:
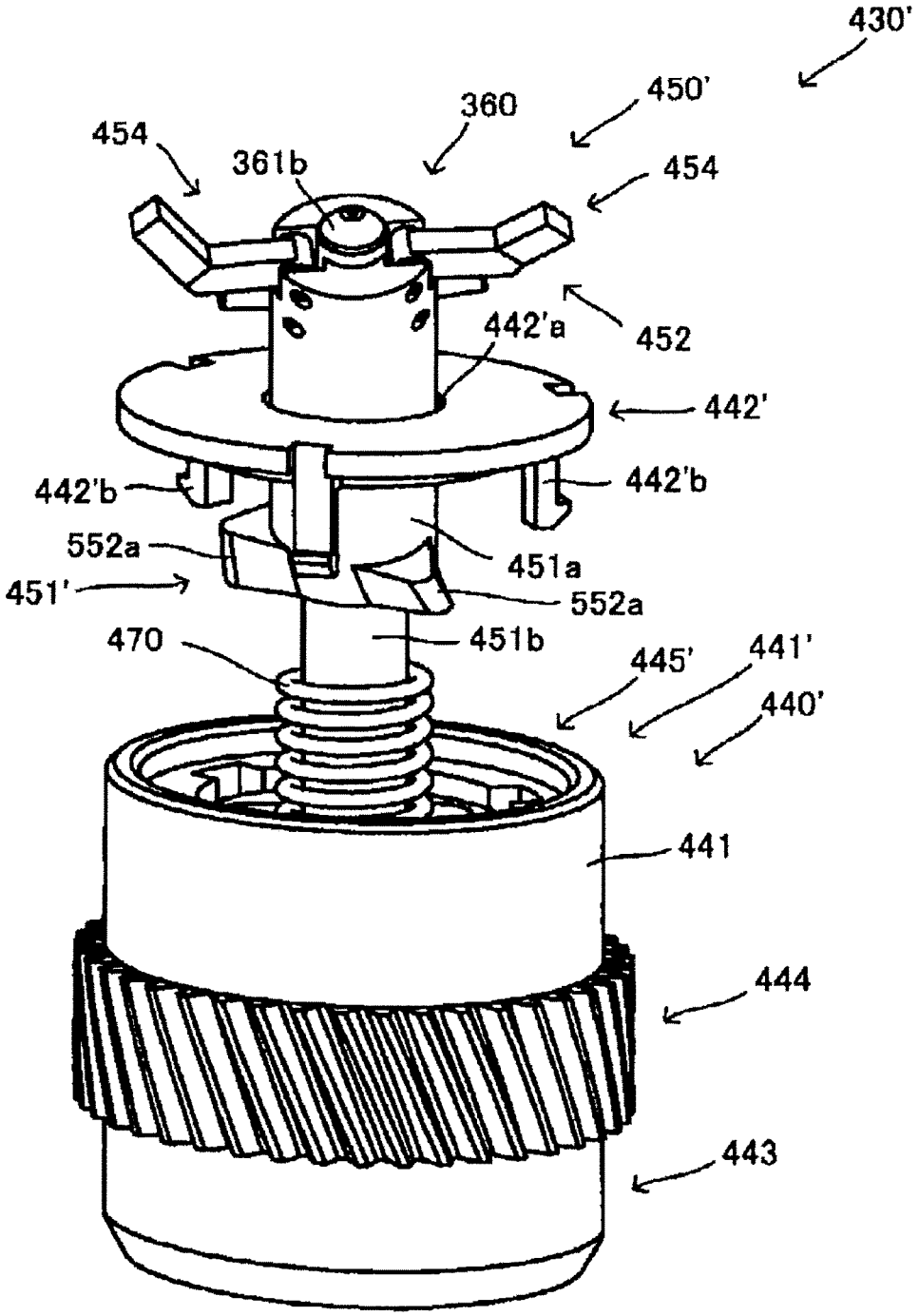
FIG. 53 is an exploded perspective view of an end member 430'.

Next, a modification example of the fifth aspect will be described. FIG. 53 is an exploded perspective view of an end member 430' included in the modification example. Similar to the end member 30, the end member 430' is a member attached to the end portion opposite to the lid member 20 in the end portion of the photoreceptor drum 11, and includes a bearing member 440' and a shaft member 450'.

Figure 54A:
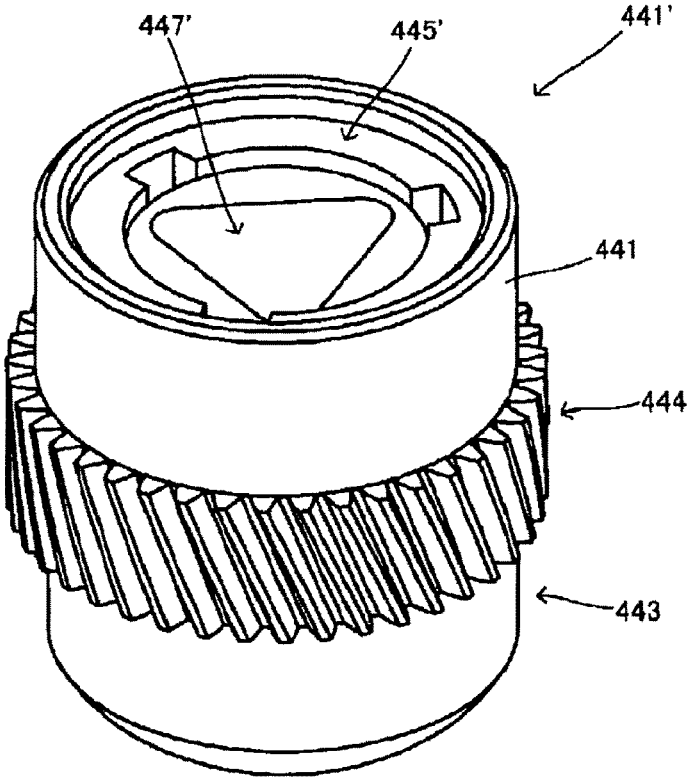
FIG. 54A is a perspective view of a main body 441'.
Figure 54B:
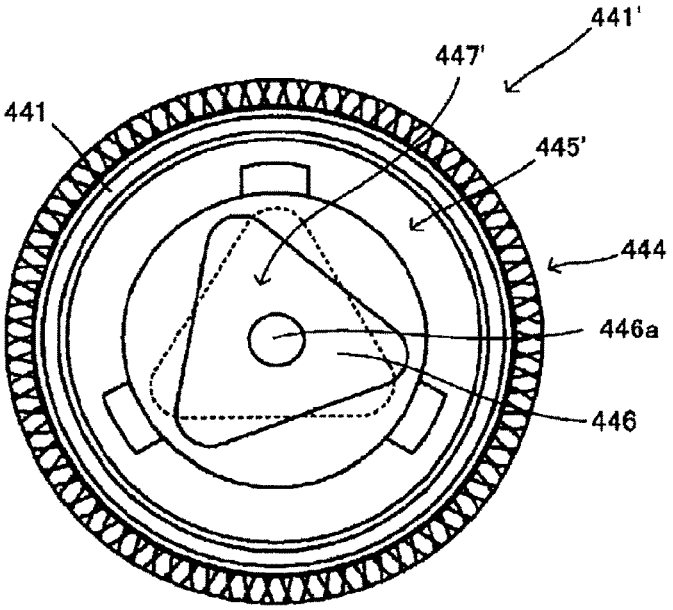
FIG. 54B is a plan view of the main body 441'.

The bearing member 440' is a member bonded to the end portion of the photoreceptor drum 11 in the end member 430'. FIG. 54A is a perspective view of a main body 441' of the bearing member 440', and FIG. 54B is a plan view of the main body 441'.

The bearing member 440' includes the main body 441' and a lid member 442', and as can be ascertained from FIGS. 53 and 54, the main body 441' is configured to include the tubular body 441, the fitting portion 443, the gear portion 444, and a shaft member holding portion 445'.

Since the tubular body 441, the fitting portion 443, and the gear portion 444 are similar to those of the above-described end member 430, the same reference numerals are given, and the description thereof will be omitted.

The shaft member holding portion 445' is a part which is formed on the inner side of the tubular body 441, and which has a function of holding the shaft member 450' in the bearing member 440' while ensuring a predetermined operation of the shaft member 450', and functions as one of means for moving and rotating the rotating force receiving member 452. The shaft member holding portion 445' includes the bottom plate 446 and a spiral portion 447' of which a section is twisted in the axial direction.

The bottom plate 446 is a disk-like member, and is disposed to block and partition at least a part of the inner side of the tubular body 441. Accordingly, the shaft member 450' is supported. In the aspect, the through-hole 446*a* is formed in the center portion thereof, and here, similar to the end member 430, the second rotating shaft 451*b* included in a rotating shaft 451' of the shaft member 450' is inserted (refer to FIG. 46). The attachment of the bottom plate 446 to the tubular body 441 can be performed by adhering or welding. In addition, the tubular body 441 and the bottom plate 446 may be integrally formed.

The spiral portion 447' is a space formed on the inner surface of the tubular body 441, and as can be ascertained from FIG. 54B, in the aspect, a section which is orthogonal to the axial direction is substantially triangular, and the section is formed to gradually rotate around the axis along the axial direction, and becomes a shape of a so-called twisted triangular prism (in FIG. 54B, an opening edge of the spiral portion is illustrated by a solid line, and one example of a section in the depth in the axial direction is illustrated by a dotted line). In addition, a part of one end of the spiral portion 447' in the longitudinal direction is blocked by the bottom plate 446, and a part of the other end opposite thereto is blocked by the lid member 442'.

The lid member 442' is a disk-like member which is disposed on the side opposite to the bottom plate 446 nipping the shaft member holding portion 445', and is provided with the through-hole 442'*a* at the center thereof. In the aspect, a claw 442'*b* is provided, is engaged with the main body 441', and is fixed in a so-called snap-fit manner. However, means of fixing the lid is not limited thereto, and the adhesive or welding by heat or ultrasound wave can be used as another means.

Figure 55:
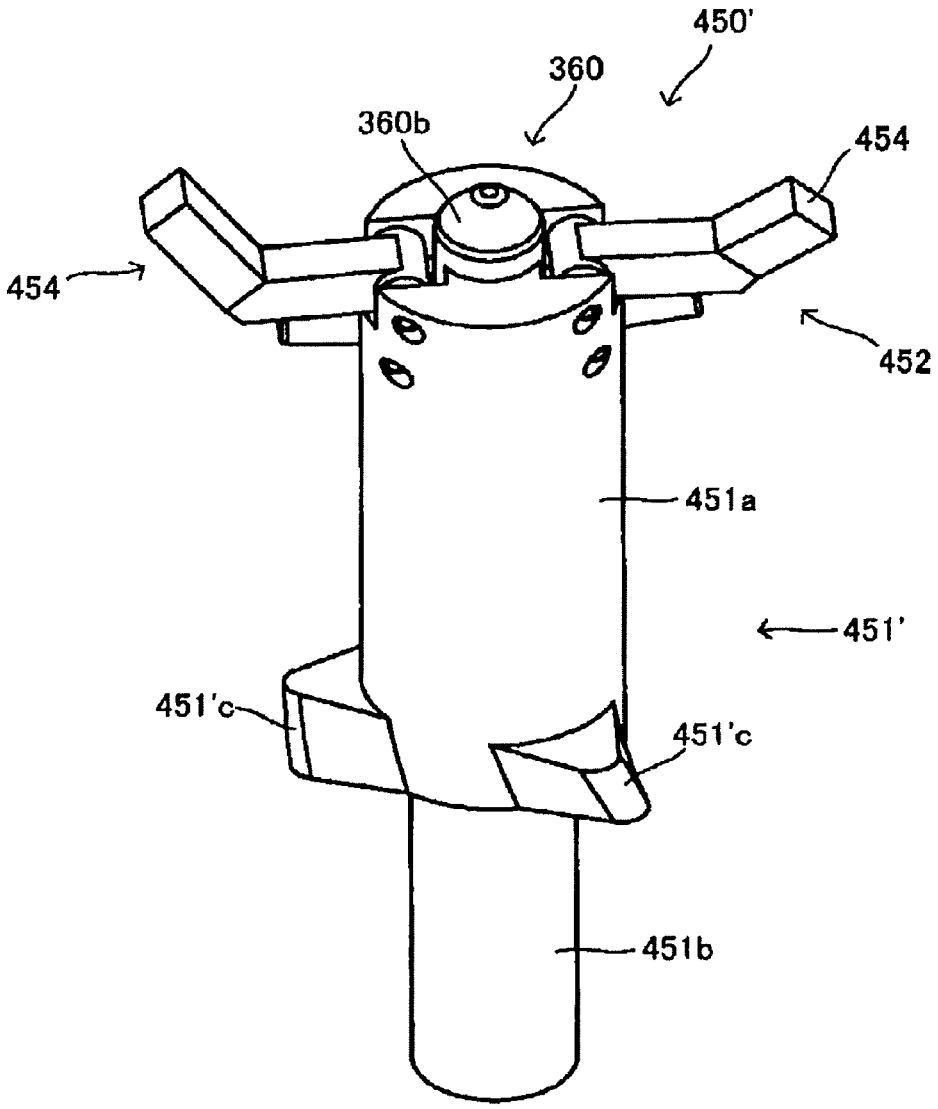
FIG. 55 is a perspective view of a shaft member 450'.

As can be ascertained from FIG. 53, the shaft member 450' is configured to include the rotating shaft 451', the rotating force receiving member 452, the regulating member 360, and the rotating shaft elastic member 470. Here, the rotating shaft elastic member 470 of the aspect is a coiled spring. Here, the rotating force receiving member 452, the regulating member 360, and the rotating shaft elastic member 470 are the same as those described above, the same reference numerals are given, and the description thereof will be omitted. FIG. 55 is a perspective view of the rotating shaft 451', the rotating force receiving member 452, and the regulating member 360.

The rotating shaft 451' is a member which transmits the rotating force from the rotating force receiving member 452 to the bearing member 440', and as can be ascertained from FIG. 55, includes the cylindrical first rotating shaft 451*a* and the columnar second rotating shaft 451*b* having a smaller outer diameter than that of the first rotating shaft 451*a*, and, has a structure in which the two rotating shafts are coaxially aligned and one ends are linked to each other. In the first rotating shaft 451*a*, on the side surface of the end portion on a side linked to the second rotating shaft 451*b*, three projections 451'*c* are disposed. Three projections 451'*c* are arranged at an equivalent interval (interval of 120°) around the cylindrical axis, in the outer circumferential portion of the cylinder of the first rotating shaft 451*a*. In addition, each of the projections 451'*c* has a twisted shape which corresponds to the shape of the above-described spiral portion 447'.

The above-described bearing member 440' and the shaft member 450' are also combined similar to the above-described end member 430. At this time, the projection 451'*c* is disposed in the spiral portion 447', and acts similar to the end member 430.

Figure 56:
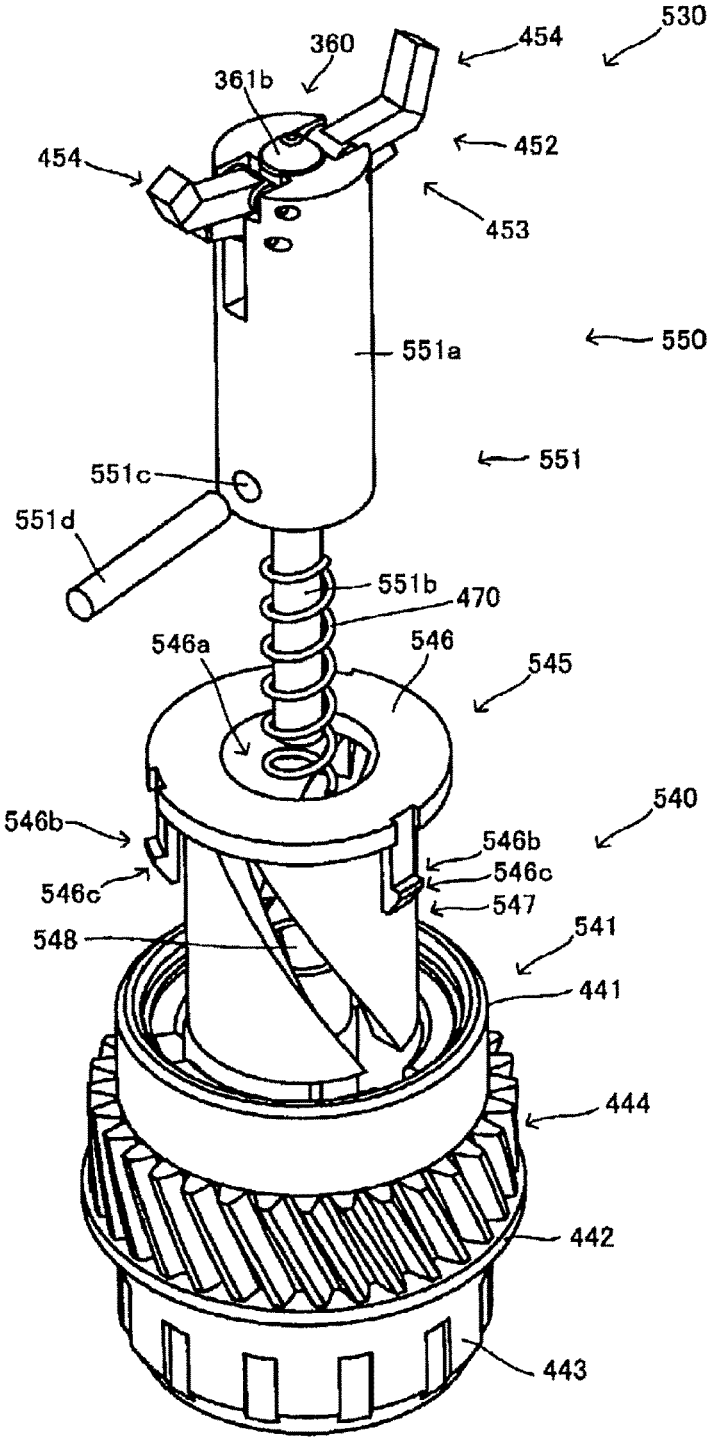
FIG. 56 is an exploded perspective view of an end member 530.

Next, a sixth aspect will be described. FIG. 56 illustrates an exploded perspective view of an end member 530 included in the sixth aspect. The sixth aspect is similar to the first aspect except for the end member 530, the description thereof will be omitted. The end member 530 is configured to include a bearing member 540 and a shaft member 550.

The bearing member 540 is a member which is bonded to the end portion of the photoreceptor drum 11 in the end member 530, and holds the shaft member 550. In the aspect, in the bearing member 540, a bearing member main body 541 and a shaft member holding member 545 are configured as separated members, and the members are connected to be attachable and detachable.

Figure 57A:
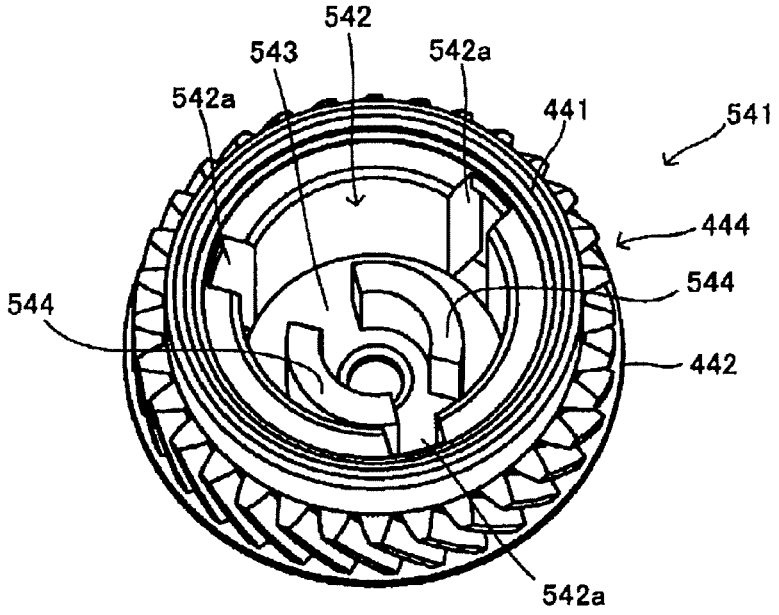
FIG. 57A is a perspective view of a bearing member main body 541.
Figure 57B:
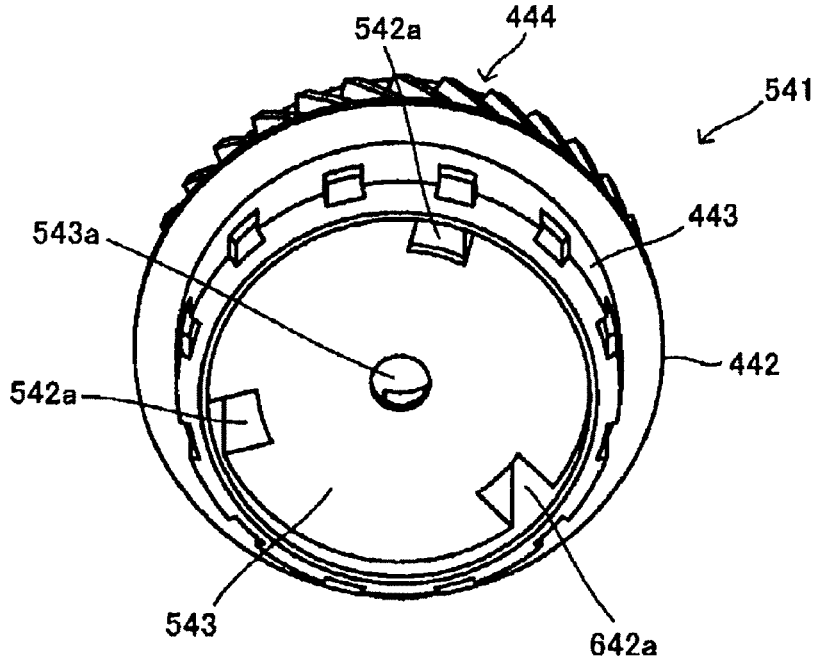
FIG. 57B is a perspective view from another viewpoint of the bearing member main body 541.
Figure 58A:
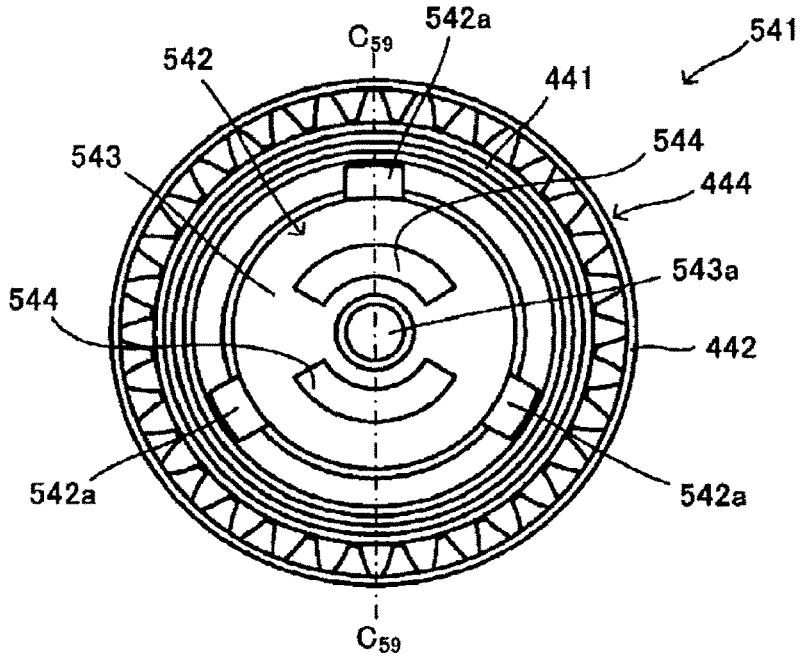
FIG. 58A is a plan view of the bearing member main body 541.
Figure 58B:
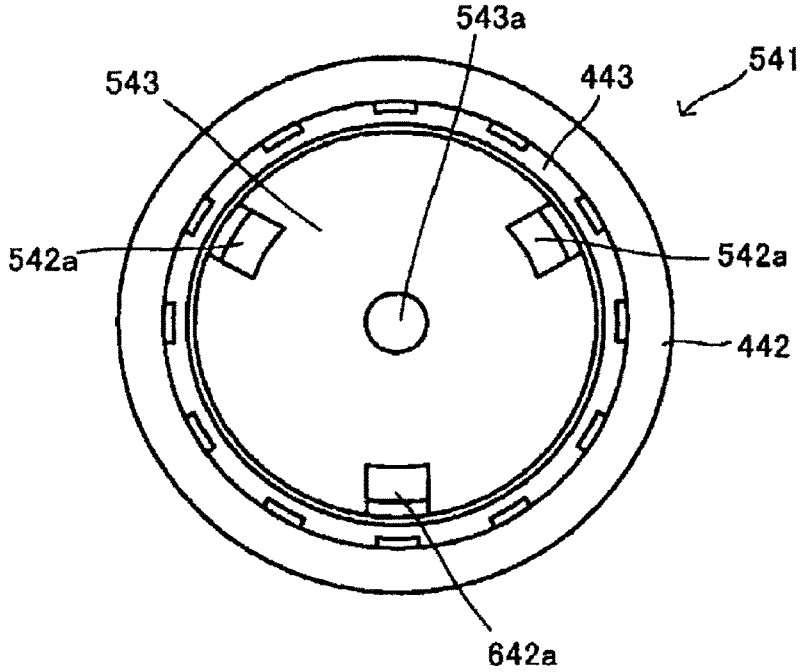
FIG. 58B is a bottom view from another viewpoint of the bearing member main body 541.
Figure 59:
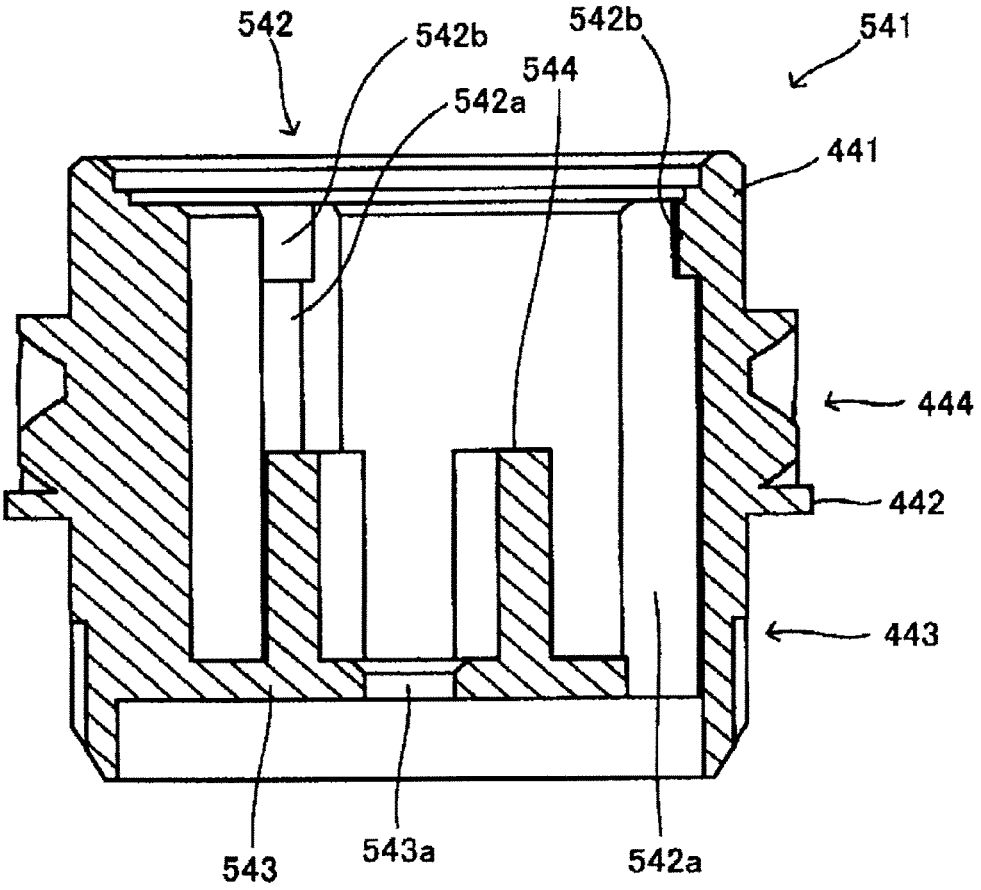
FIG. 59 is a sectional view of the bearing member main body 541.

FIG. 57A is a perspective view of the bearing member main body 541 when viewed from a side on which the shaft member holding member 545 is inserted, and FIG. 57B is a perspective view of the bearing member main body 541 when viewed from the opposite side. In addition, FIG. 58A is a plan view of the bearing member main body 541 when viewed from the side on which the shaft member holding member 545 is inserted, and FIG. 58B is a bottom view of the bearing member main body 541 when viewed from the opposite side. Furthermore, FIG. 59 is a sectional view along line illustrated by $C_{59}$-$C_{59}$ in FIG. 58A.

The bearing member main body 541 is configured to include the tubular body 441, the contact wall 442, the fitting portion 443, the gear portion 444, and a shaft member holding member attaching portion 542. Since the tubular body 441, the contact wall 442, the fitting portion 443, and the gear portion 444 are as described above, and here, the same reference numerals are given, and the description thereof will be omitted.

The shaft member holding member attaching portion 542 is a part which is formed on the inner side of the tubular body 441, and has a function of holding the shaft member holding member 545 on the inner side of the tubular body 441 of the bearing member main body 541. In addition, the shaft member holding member attaching portion 542 functions as one of means for moving and rotating the rotating force receiving member 452. The shaft member holding member attaching portion 542 in the aspect includes an engaging groove 542*a*, a bottom plate 543, and a protruding portion 544.

The engaging groove 542*a* is a groove provided on the inner surface of the tubular body 441, and extends along the entire length in the axial direction of the tubular body 441 considering the direction along the axis of the tubular body 441 as the longitudinal direction. Therefore, as can be ascertained from FIG. 57B, the engaging groove 542*a* is provided to penetrate the bottom plate 543. Accordingly, it becomes easy to manufacture the bearing member main body 541 by injection molding. The engaging groove 542*a* functions as a part of a so-called snap-fit structure in which an engaging claw 546*b* provided in the shaft member holding member 545 is engaged. Therefore, as can be ascertained from FIG. 59, a protruding portion 542*b* is provided on the bottom surface of the end portion opposite to the bottom plate 543 side in the engaging groove 542*a*. The engaging claw 546*b* is engaged with the protruding portion 542*b*. In addition, the protruding portion 542*b* is provided to protrude from the bottom surface of the engaging groove 542*a*, and is an aspect having an undercut portion.

As can be ascertained from FIGS. 57 and 59, the bottom plate 543 is disposed to block and partition the inner side of the tubular body 441 which is an annular member. A through-hole 543*a* is provided at the center thereof. The attachment of the bottom plate 543 to the tubular body 441 can be performed by adhering or welding. In addition, the tubular body 441 and the bottom plate 543 may be integrally formed.

The protruding portion 544 is an annular projection which stands from the surface that is a side of the shaft member holding member attaching portion 542 in the bottom plate 543. A protruding portion 564 is disposed such that the center shaft of the ring matches the axis of the tubular body 441. In addition, in the aspect, a part of the protruding portion 544 is cut out.

Figure 60:
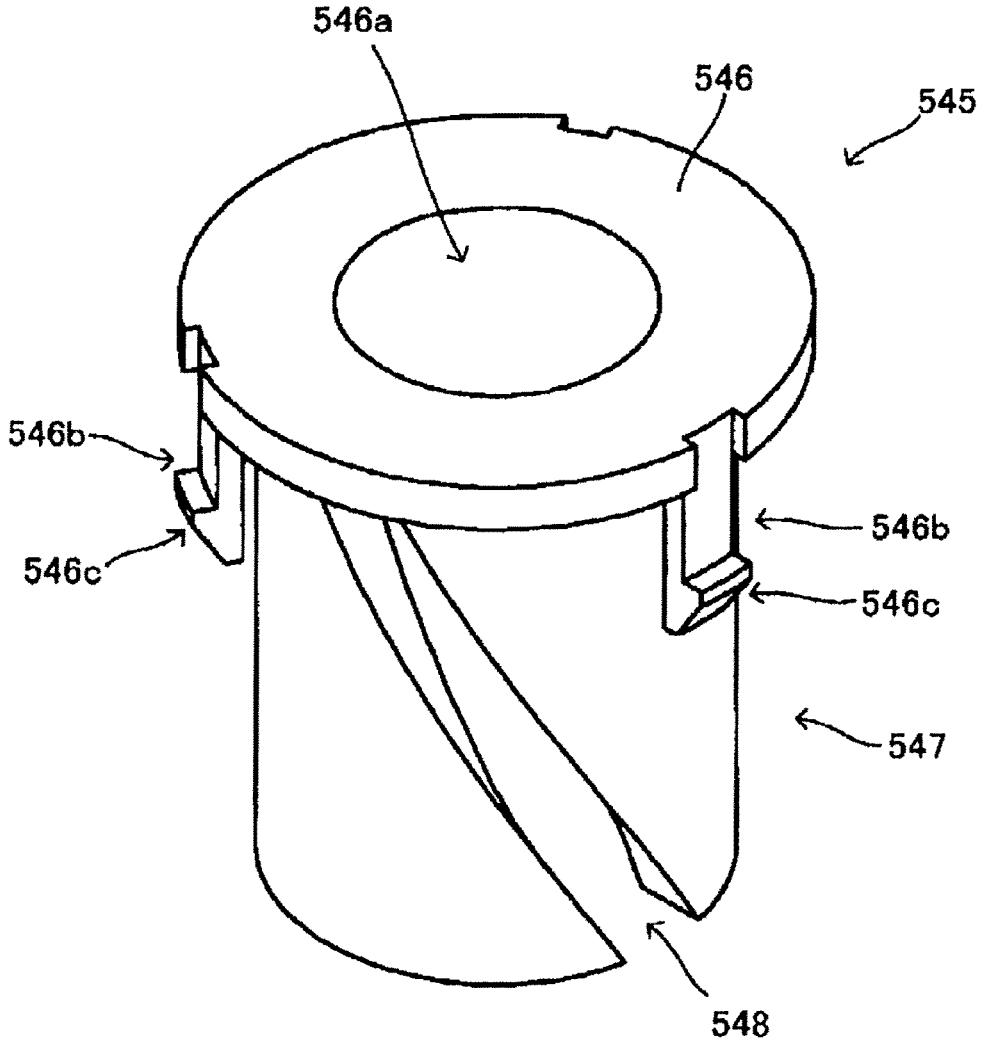
FIG. 60 is a perspective view of a shaft member holding member 545.
Figure 61A:
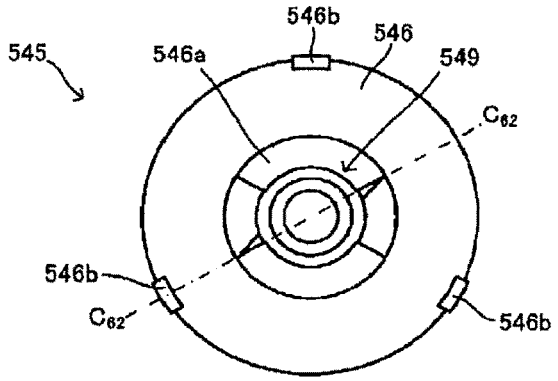
FIG. 61A is a plan view of the shaft member holding member 545.
Figure 61B:
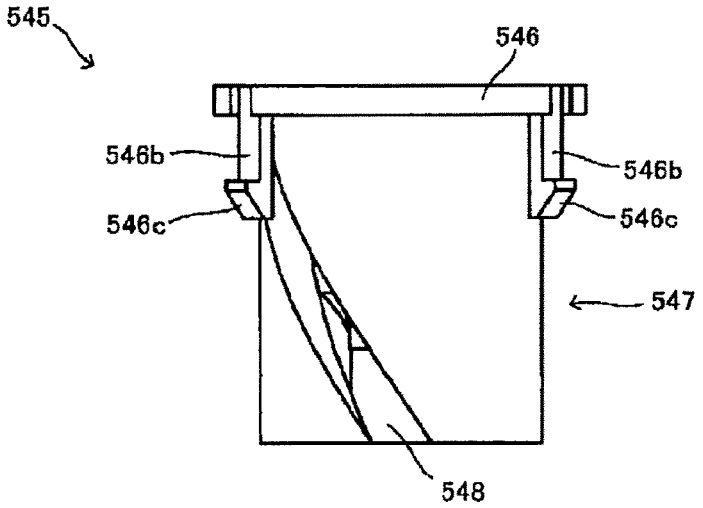
FIG. 61B is a front view of the shaft member holding member 545.
Figure 61C:
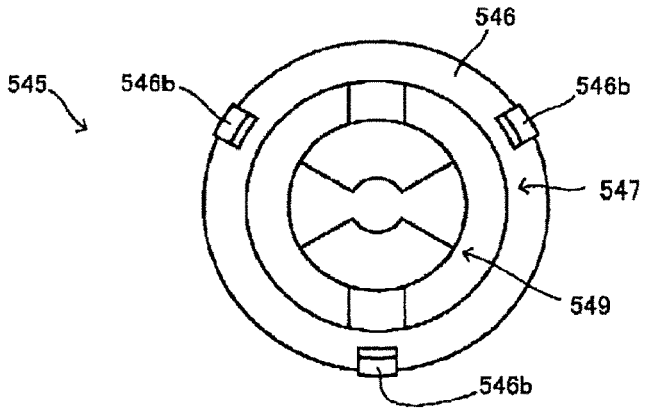
FIG. 61C is a bottom view of the shaft member holding member 545.

The shaft member holding member 545 is configured to include a lid 546 and a spiral portion 547. FIG. 60 is an appearance perspective view of the shaft member holding member 545, FIG. 61A is a plan view of the shaft member holding member 545, FIG. 61B is a front view of the shaft member holding member 545, and FIG. 61C is bottom view of the shaft member holding member 545. In addition, FIG. 62 is a sectional view along line illustrated by $C_{62}$-$C_{62}$ in FIG. 61A.

The lids 546 are annular members disposed at a predetermined interval in the axial direction with respect to the bottom plate 543 in a posture in which the shaft member holding member 545 is attached to the bearing member main body 541 (refer to FIG. 63), and are disposed to block and partition the inner side of the tubular body 441. Therefore, a through-hole 546*a* is provided at the center thereof. A first rotating shaft 551*a* in a rotating shaft 551 is inserted into the through-hole 546*a*. In addition, in the lid 546, the engaging claw 546*b* is provided for the attachment to the tubular body 441. The engaging claw 546*b* is inserted into the engaging groove 542*a* of the above-described bearing member main body 541, and is engaged with the protruding portion 542*b* (refer to FIG. 59) provided here. In the aspect, three engaging claws 546*b* are provided at the equivalent interval at the outer circumference of the lid 546, and as can be ascertained from FIG. 61B, a protruding portion 546*c* is provided at the tip end thereof. Accordingly, the protruding portion 546*c* of the engaging claw 546*b* is engaged to be hooked to the protruding portion 542*b* of the engaging groove 542*a*, and configures a so-called snap-fit structure. In addition, the protruding portion 546*c* of the engaging claw 546*b* is provided to protrude, and is an aspect having an undercut portion.

The spiral portion 547 is a cylindrical member for forming a spiral groove 548. In other words, the spiral portion 547 has a cylindrical shape disposed coaxially to the lid 546 from one surface of the lid 546, and extends in the axial direction to the wall and is twisted such that one end side and the other end side in the extending direction are shifted in the direction along the circumference, and two spiral grooves 548 which are slits formed in a spiral shape are provided. Two spiral grooves 548 of the aspect are formed at the position on the side opposite to each other nipping the axis. The concept of the spiral groove is the same as the above-described spiral groove 447.

Figure 62:
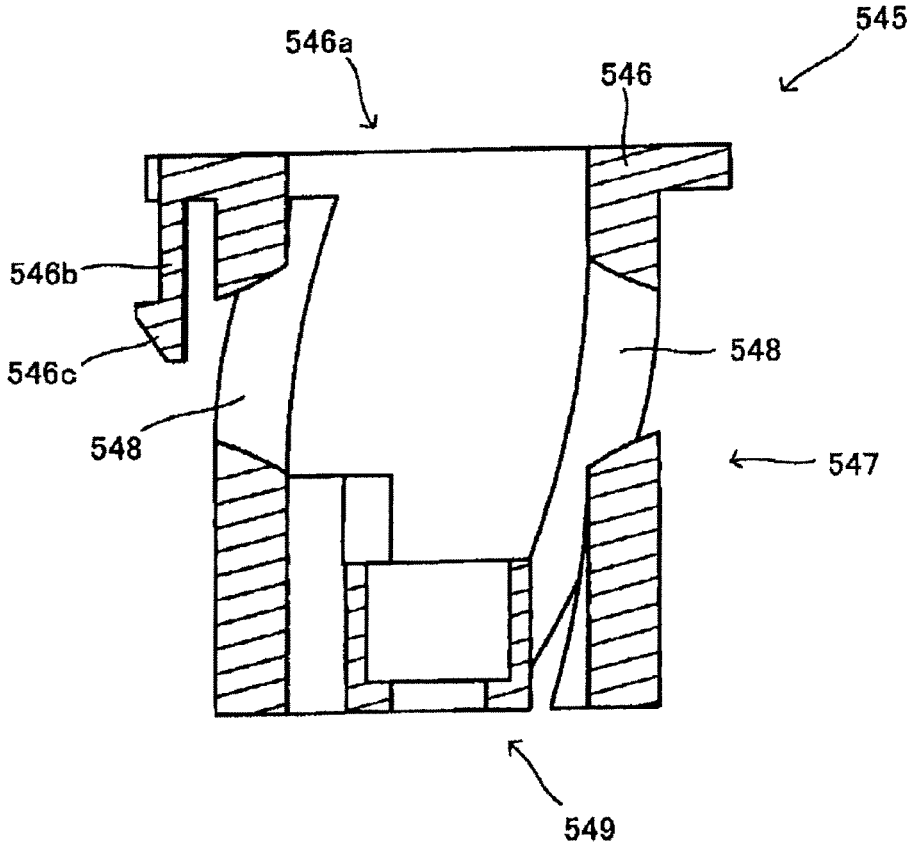
FIG. 62 is a sectional view of the shaft member holding member 545.

In addition, as can be ascertained from FIGS. 61A, 61C, and 62, in the spiral portion 547, a tube body 549 is disposed in the end portion on the inner side on the side opposite to the side on which the lid 546 is disposed. As can be ascertained from FIG. 69, the tube body 549 is coaxial with the spiral portion 547, and both ends in the axial direction are open. However, among the openings, the opening is narrow on the side opposite to the lid 546. In addition, as can be ascertained from FIG. 61C, a part of the wall of the tube body 549 is cut out. As will be described later, the rotating shaft elastic member 470 is held on the inner side of the tube body 549.

A material which configures the bearing member 540 can be considered as similar to the above-described bearing member 440.

Returning to FIG. 56, the shaft member 550 will be described. As can be ascertained from FIG. 56, the shaft member 550 is configured to include the rotating shaft 551, the rotating force receiving member 452, the regulating member 360, and the rotating shaft elastic member 470. Here, the rotating shaft elastic member 470 of the aspect is a coiled spring. In addition, since the regulating member 360, the rotating shaft elastic member 470, and the rotating force receiving member 452 are the same as those of the description above, the same reference numerals are given, and the description thereof will be omitted.

The rotating shaft 551 is a member which transmits the rotating force from the rotating force receiving member 452 to the bearing member 540, and as can be ascertained from FIG. 56, the tubular rotating shaft 551 includes the tubular first rotating shaft 551*a* and a tubular second rotating shaft 551*b* having a smaller outer diameter than that of the first rotating shaft 551*a*, and has a structure in which the two rotating shafts are coaxially aligned and one ends are linked to each other.

In the first rotating shaft 551*a*, on the side surface of the end portion on a side linked to the second rotating shaft 551*b*, a hole 551*c* which penetrates in the diameter direction is provided, and a pin 551*d* is inserted thereinto. The pin 551*d* is formed to be longer than the diameter of the first rotating shaft 551*a*, and in a posture in which the pin 551*d* is inserted into the hole 551*c* of the first rotating shaft 551*a*, both ends of the pin 551*d* protrude from the side surface of the first rotating shaft 551*a*, and the protrusion acts similar to the above-described two projections 451*c*.

Figure 63:
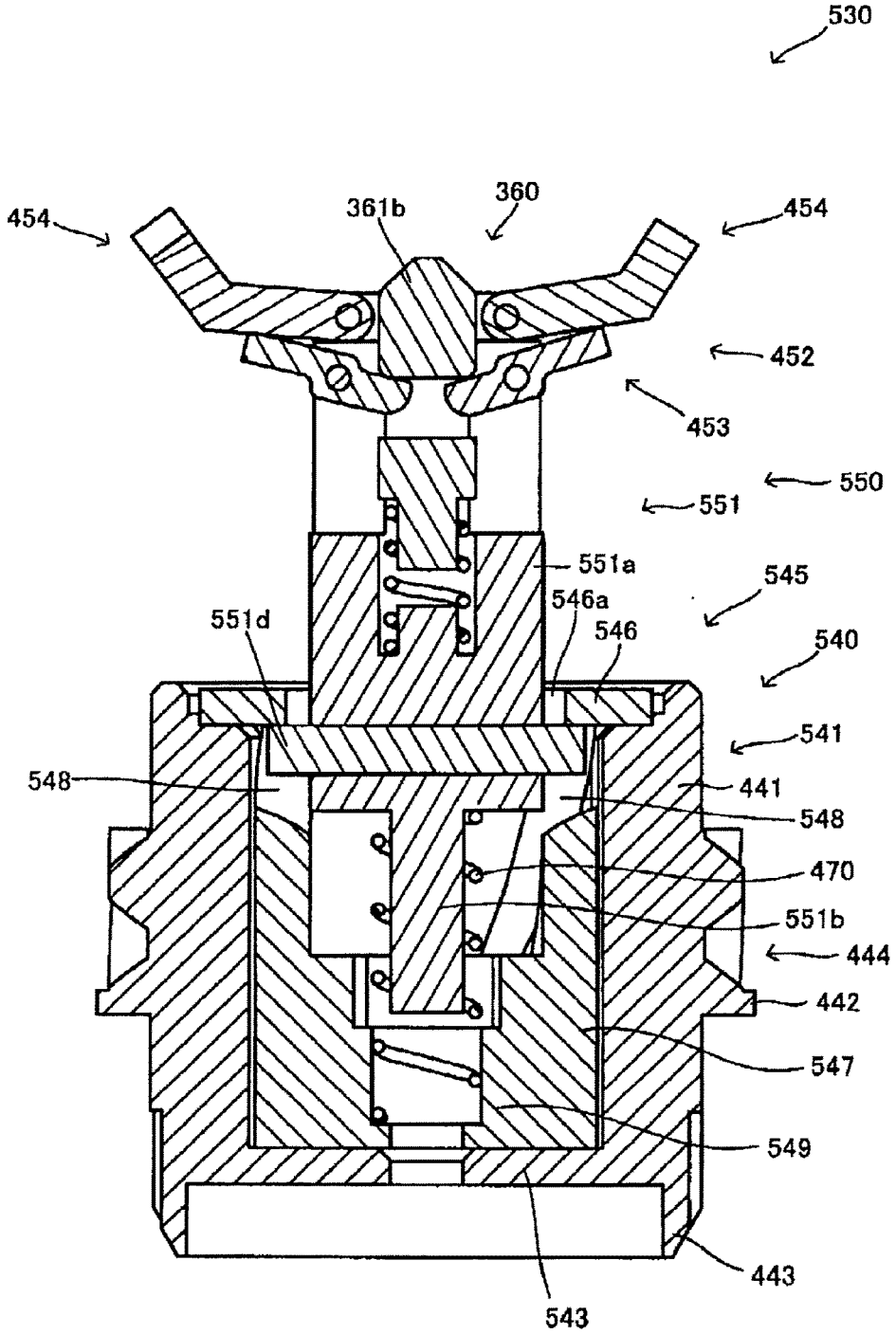
FIG. 63 is a sectional view of an end member 530.

By combining the bearing member 540 and the shaft member 550 with each other as follows, the end member 530 is made. In addition, by describing the combination, the size of each member and part, the structure, or the relationship of the sizes of the members and parts, are further understood. FIG. 63 is a sectional view along the axial direction of the end member 530.

As can be ascertained from FIG. 63, in the bearing member 540, the shaft member holding member 545 is inserted into the inner side of the bearing member main body 541. At this time, the lid 546 of the shaft member holding member 545 is inserted to be the side opposite to the bottom plate 543 of the bearing member main body 541, and the lid 546 is disposed to close the opening of the bearing member main body 541. At this time, the protruding portion 546*c* of the engaging claw 546*b* of the lid 546 is engaged with the protruding portion 542*b* inserted into the engaging groove 542*a* of the bearing member main body 541.

Meanwhile, in the rotating shaft 551, the second rotating shaft 551*b* is disposed on the inner side of the spiral portion 547 of the shaft member holding member 545. However, in the aspect, the second rotating shaft 551*b* has a length which does not reach the through-hole 543*a* provided in the bottom plate 543 of the bearing member main body 541. In addition, the first rotating shaft 551*a* passes through the through-hole 546*a* of the lid 546. Here, the diameter of the through-hole 546*a* is formed to be greater than the diameter of the outer circumference of the first rotating shaft 551*a*, and a space is formed between the first rotating shaft 551*a* and the through-hole 546*a*. According to this, the shaft member 550 can oscillate with respect to the axis of the bearing member 540. In addition, at this time, the projection configured of the pin 551*d* from the side surface of the first rotating shaft 551*a* is inserted into the spiral groove 548 formed in the spiral portion 547 of the shaft member holding member 545 as illustrated in FIG. 63. In addition, as can be ascertained from FIG. 63, on the inner side of the bearing member 540, the second rotating shaft 551*b* passes through the inner side of the rotating shaft elastic member 470, and the rotating shaft elastic member 470 is disposed between the edges at a part at which the opening becomes narrow in the tube body 549 of the shaft member holding member 545. Therefore, the rotating shaft elastic member 470 is held on the inner side of the tube body 549, and one of the rotating shaft elastic members 470 comes into contact with the first rotating shaft 551*a* and the other one comes into contact with the shaft member holding member 545. Accordingly, the rotating shaft elastic member 470 biases the rotating shaft 551, and the rotating shaft 551 is biased in the direction in which the rotating shaft 551 protrudes from the bearing member 540. However, since the projection formed by the pin 551*d* is inserted into the spiral groove 548 of the bearing member 540, and both ends of the spiral groove 548 are blocked by the bottom plate 543 and the lid 546, the rotating shaft 551 is held in a state of being biased without being shifted from the bearing member 540.

Above, in a posture in which each of the members is combined, the axes of the bearing member 540 and the rotating shaft 551 match each other.

Figure 64A:
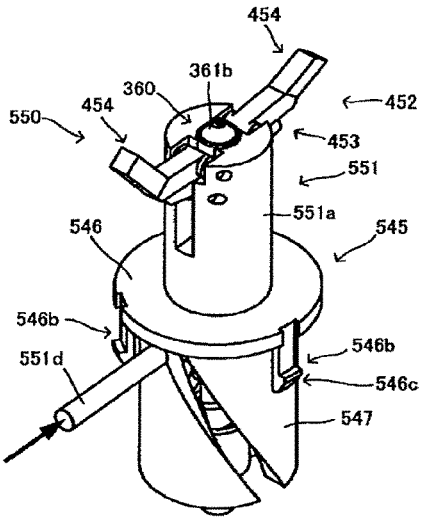
FIG. 64A is a view illustrating one situation of an example in which the end member 530 is assembled.
Figure 64B:
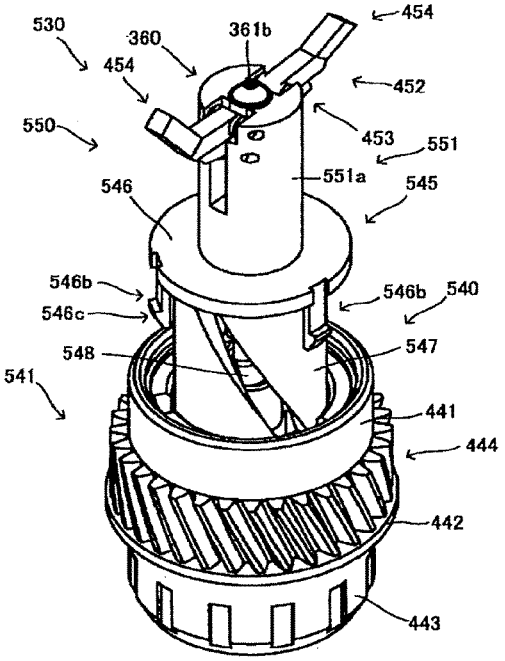
FIG. 64B is a view illustrating another situation of an example in which the end member 530 is assembled.

Here, the end member 530 can be made, for example, as follows. FIG. 64 is a perspective view for the description. FIG. 64A illustrates a situation in which the shaft member 550 is combined with the shaft member holding member 545, and FIG. 64B illustrates a situation in which the shaft member 550 and the shaft member holding member 545 are further combined with the bearing member main body 541. As can be ascertained from FIG. 64A, the shaft member 550 in a state where the pin 551*d* is disengaged is inserted into the shaft member holding member 545 together with the rotating shaft elastic member 470. At this time, the position of the hole 551*c* provided in the first rotating shaft 551*a* is positioned to match the position of the spiral groove 548 of the shaft member holding member 545. In addition, as illustrated by an arrow of a straight line in FIG. 64A, the pin 551*d* penetrates the spiral groove 548, and is inserted into the hole 551*c*. Accordingly, the shaft member 550 and the shaft member holding member 545 are combined with each other, and are not disengaged from each other. In addition, as can be ascertained from FIG. 64B, the combined shaft member 550 and the shaft member holding member 545, and the bearing member main body 541 are combined with each other. Above, it is possible to efficiently make the end member 530. In other words, it is possible to improve assembly properties.

The above-described end member 530 also operates similar to the above-described end member 430. Furthermore, according to the end member 530, by disengaging the shaft member holding member from the bearing member main body, it is possible to easily disengage the shaft member from the bearing member, and to achieve improvement of reuse properties.

Figure 65:
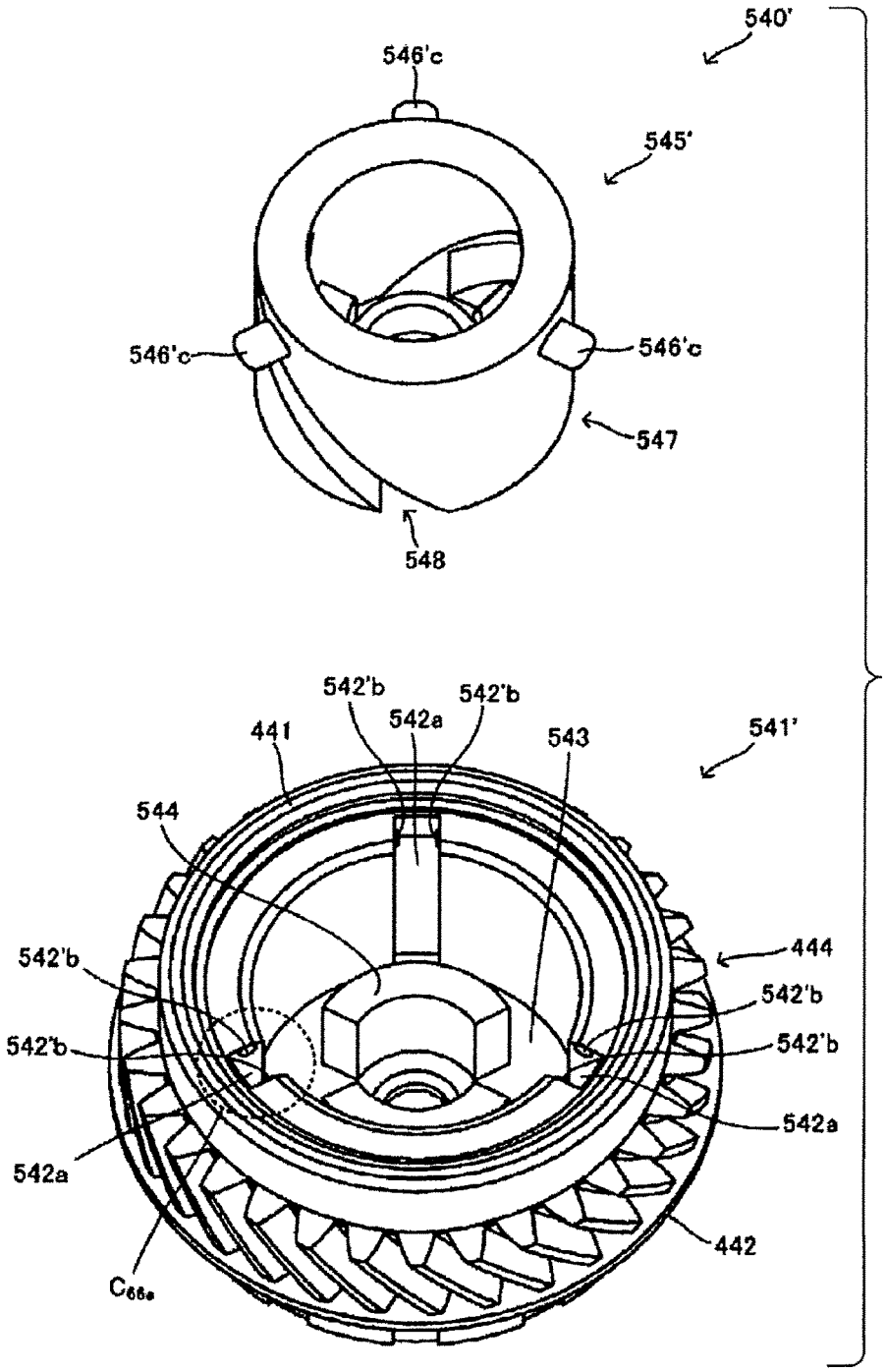
FIG. 65 is a view illustrating a first modification example of the end member 530, and is an appearance perspective view of a shaft member holding member 545' and a bearing member main body 541'.

FIG. 65 is an exploded perspective view of a bearing member 540', in the end member which is a first modification example of the end member 530. As can be ascertained from FIG. 65, the bearing member 540' includes a bearing member main body 541' and a shaft member holding member 545'. Since the shaft member is the same as the shaft member 550, the shaft member is not illustrated, and the description thereof will be omitted.

In the first modification example, in the bearing member main body 541', a protruding portion 542'*b* is provided instead of the protruding portion 542*b* provided in the engaging groove 542*a* of the bearing member main body 541. In addition, in the first modification example, in the shaft member holding member 545', instead of the protruding portion 546*c* of the shaft member holding member 545, a protruding portion 546'*c* is provided. Since it is possible to form other configurations similar to the example of the bearing member main body 541, here, the protruding portion 542'*b* and the protruding portion 546'*c* will be described.

Figure 66A:
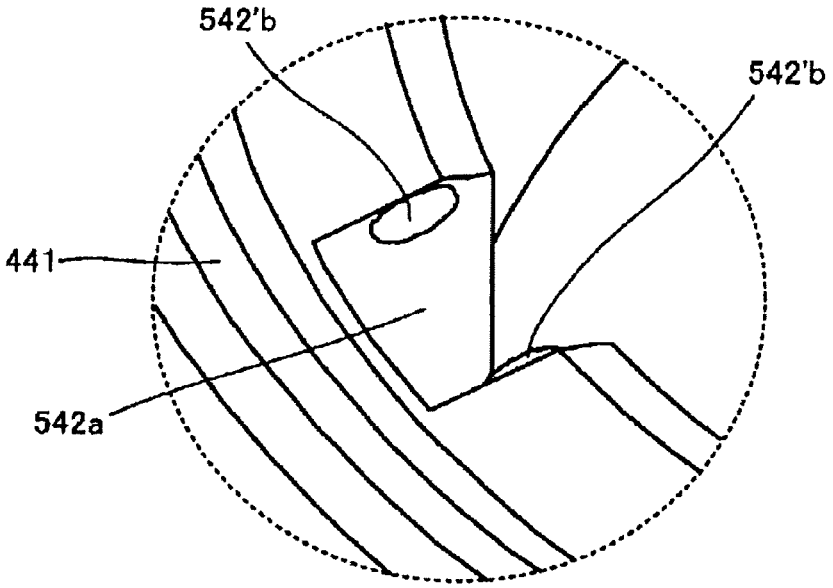
FIG. 66A is an enlarged view of a part of the bearing member main body 541'.

FIG. 66A is an enlarged view of a part illustrated by $C_{66a}$ in FIG. 65. As can be ascertained from FIG. 66A, in the bearing member main body 541', in the engaging groove 542*a*, two protruding portions 542'*b* are provided to oppose each of the walls of the groove side surface of the end portion opposite to the bottom plate 543, and the groove width of the engaging groove 542*a* is narrow. Accordingly, a part of the so-called snap-fit structure is configured. In addition, the protruding portion 542'*b* is provided to protrude from the side surface of the engaging groove 542*a*, and is an aspect having an undercut portion.

Meanwhile, as can be ascertained from FIG. 65, in the shaft member holding member 545', a protruding portion 546'*c* which is a projection that stands from the side surface of the spiral portion 547 is provided. The protruding portion 546'*c* is provided at a position of being inserted into the engaging groove 542*a* in a posture in which the shaft member holding member 545' is combined with the bearing member main body 541'. In addition, the thickness of the protruding portion 546'*c* is thinner than the engaging groove 542*a*, and is thicker than an interval between the protruding portions 542'*b* provided in the engaging groove 542*a*. Accordingly, the snap-fit structure is configured of the protruding portion 542'*b* and the protruding portion 546'*c*.

Figure 66B:
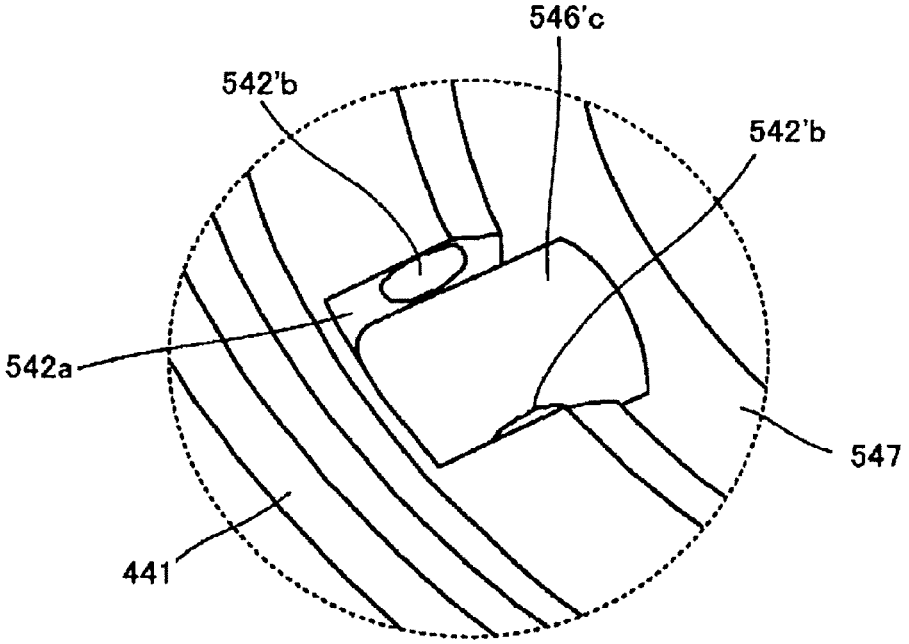
FIG. 66B is an enlarged view of a part of a situation in which the shaft member holding member 545' is combined with the bearing member main body 541'.

Combination of the shaft member holding member 545' and the bearing member main body 541' is similar to the above-described end member 530, but in the first modification example, as illustrated in FIG. 66B, the combination is performed as the protruding portion 546'*c* is engaged to be hooked to the protruding portion 542'*b*. The end member of the example also acts similar to the above-described end member 530.

Figure 67:
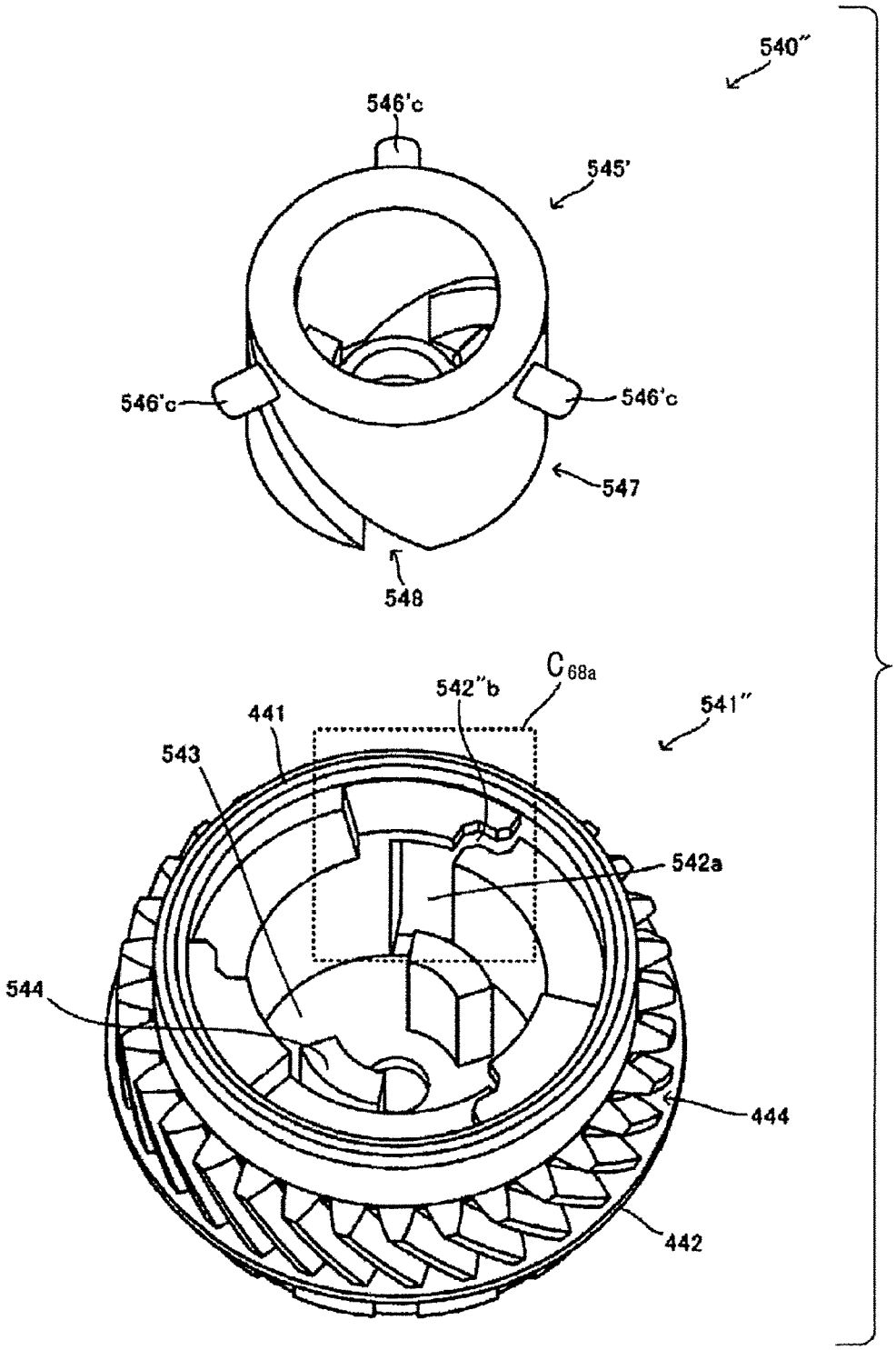
FIG. 67 is a view illustrating a second modification example of the end member 530, and is an appearance perspective view of the shaft member holding member 545' and a bearing member main body 541".

FIG. 67 is an exploded perspective view of a bearing member 540", in the end member which is the second modification example of the end member 530. As can be ascertained from FIG. 67, the bearing member 540" includes a bearing member main body 541" and the shaft member holding member 545'. As can be ascertained from FIG. 67, in the second modification example, the shaft member holding member 545' is the same aspect as that in the first modification example, and the bearing member main body is different from that of the first modification example. Therefore, here, the bearing member main body 541" will be described.

In the second modification example, in the bearing member main body 541", instead of the protruding portion 542*b* provided in the engaging groove 542*a* of the bearing member main body 541, a guiding groove 542"*b* which is a groove that is continuous from the end portion of the engaging groove 542*a* and extends along the inner circumferential direction of the tubular body 441, is provided. Since it is possible to form other configurations similar to the example of the bearing member main body 541, here, the guiding groove 542"*b* will be described.

Figure 68A:
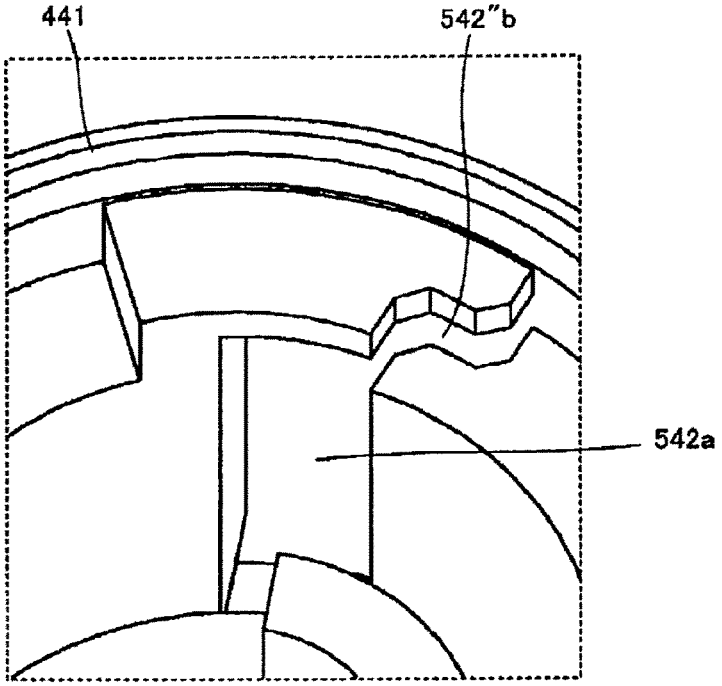
FIG. 68A is an enlarged view of a part of the bearing member main body 541"

FIG. 68A is an enlarged view of a part illustrated by $C_{68a}$ in FIG. 67. As can be ascertained from FIG. 68A, in the bearing member main body 541", in the engaging groove 542*a*, an end portion opposite to the bottom plate 543 is closed, and the guiding groove 542"*b* which is continuous from the side surface of the engaging groove 542*a* in the end portion and extends in the circumferential direction of the tubular body 441, is provided. In the guiding groove 542"*b*, the end portion opposite to the side continuous to the engaging groove 542*a* is open.

Figure 68B:
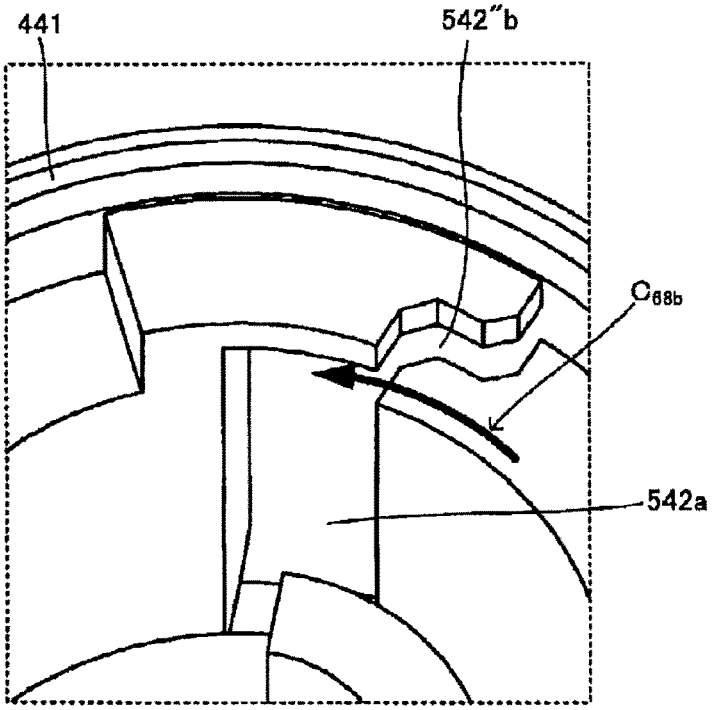
FIG. 68B is a view illustrating a situation in which the shaft member holding member 545' is combined with the bearing member main body 541".

When combining the shaft member holding member 545' with the bearing member main body 541", first, the protruding portion 546'*c* of the shaft member holding member 545' is disposed in the vicinity of the opening portion of the guiding groove 542"*b*. After this, by rotating the shaft member holding member 545' around the axis, the protruding portion 546'*c* is moved in the guiding groove 542"*b* as illustrated by an arrow $C_{68b}$ in FIG. 68B. Accordingly, the protruding portion 546'*c* moves in the guiding groove 542"*b* from the opening of the guiding groove 542"*b*, reaches the engaging groove 542*a*, and is disposed on the inner side of the engaging groove 542*a*. In the second modification example, since the end portion of the engaging groove 542*a* is closed, the protruding portion 546'*c* does not fall out from the axial direction of the bearing member main body 541", and the shaft member holding member 545' is held in the bearing member main body 541". The end member of the second modification example also acts similar to the above-described end member 530.

Figure 69A:
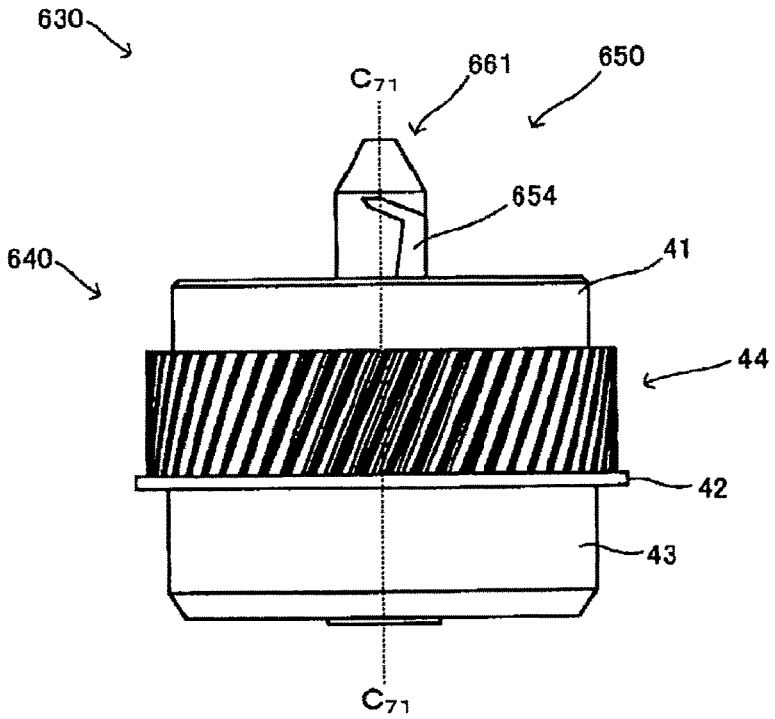
FIG. 69A is a front view of an end member 630.
Figure 69B:
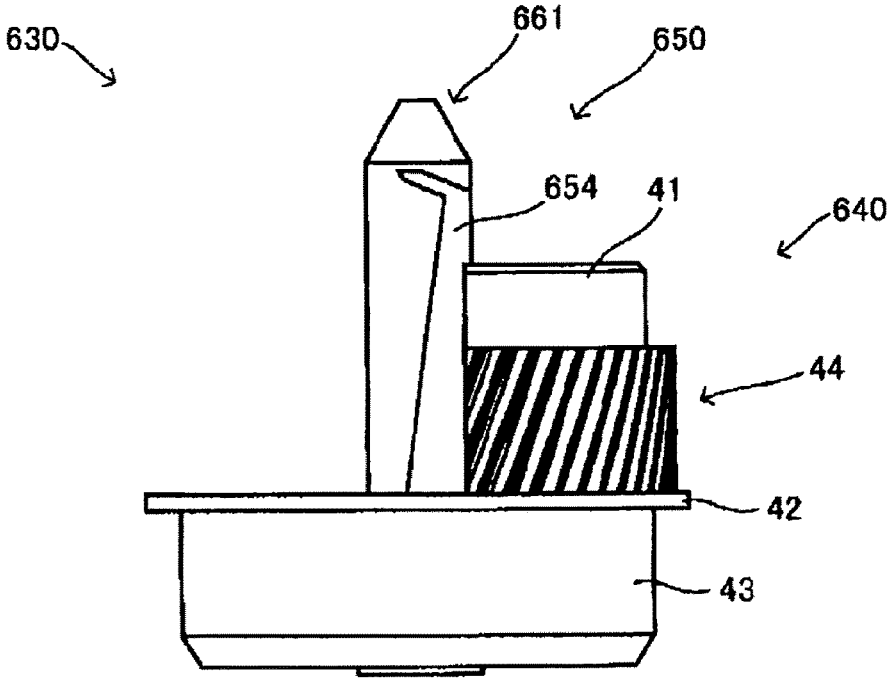
FIG. 69B is a front view in which a part of the end member 630 is cut out.
Figure 70:
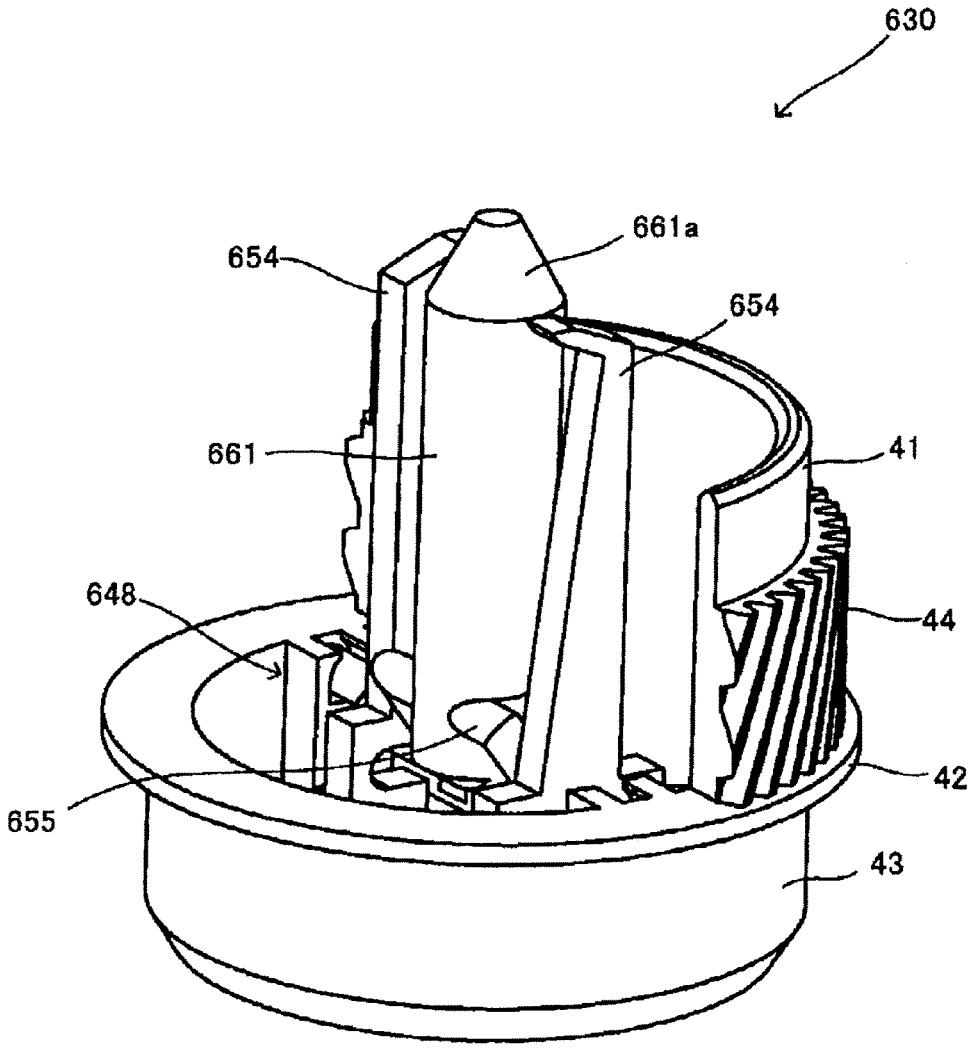
FIG. 70 is a perspective view in which a part of the end member 630 is cut out.
Figure 71:
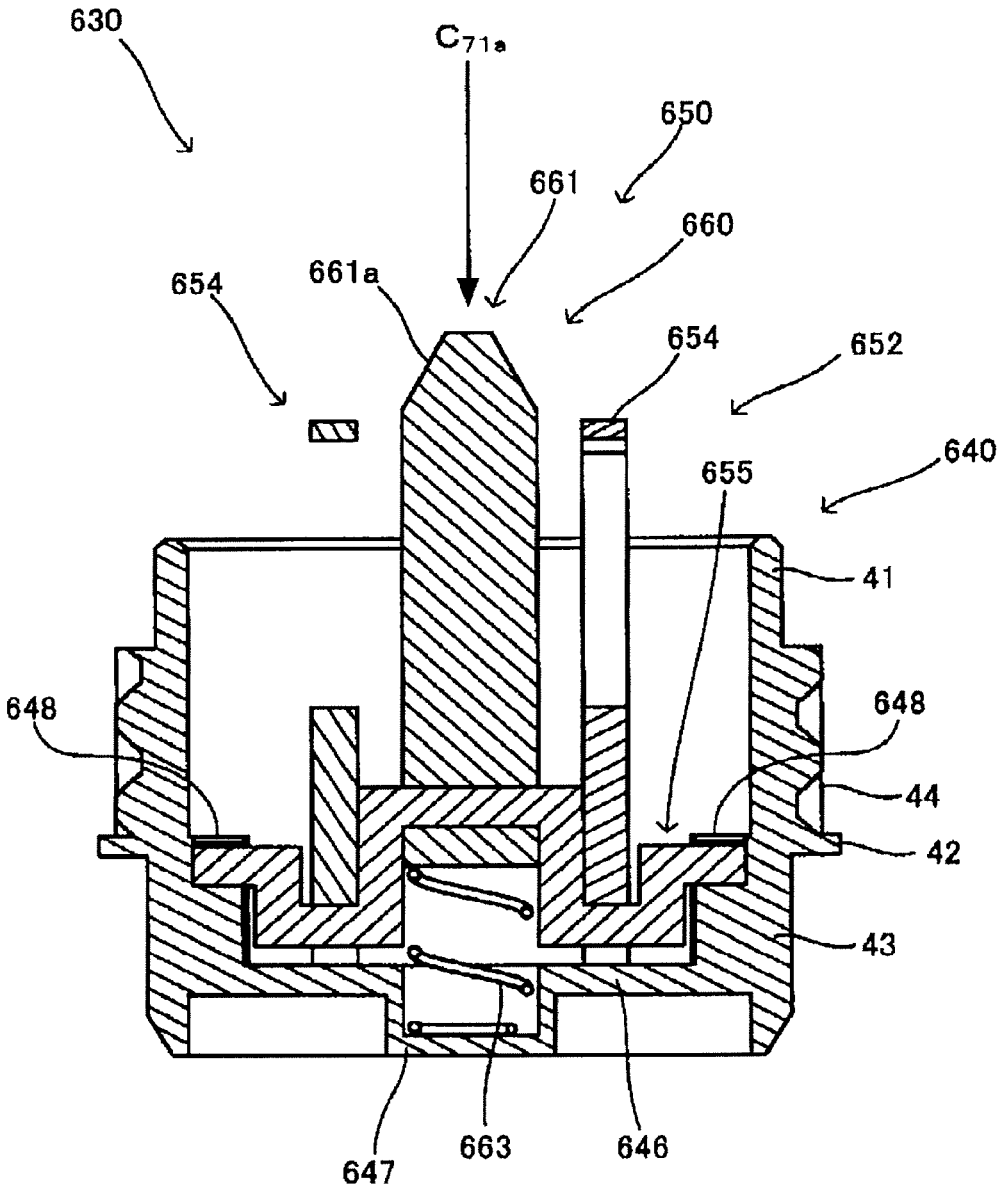
FIG. 71 is a sectional view of the end member 630.

Next, a seventh aspect will be described. FIG. 69A is a front view of an end member 630, and FIG. 69B is a front view illustrated by cutting out a part of the end member 630. FIG. 70 is a perspective view illustrated by cutting out a part of the end member 630, and FIG. 71 is an arrow sectional view illustrated by $C_{71}$-$C_{71}$ in FIG. 69A. The end member 630 of the aspect includes a bearing member 640 and a shaft member 650.

Figure 72:
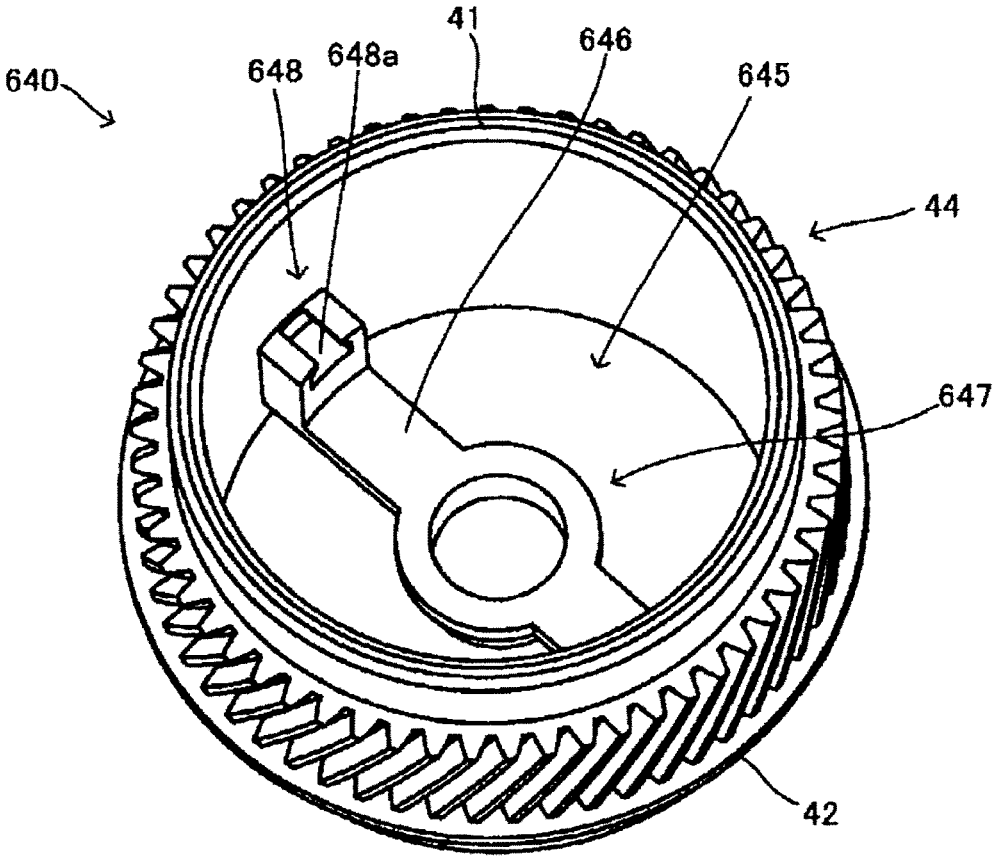
FIG. 72 is a perspective view of a bearing member 640.

The bearing member 640 is a member which is bonded to the end portion of the photoreceptor drum 11 in the end member 630. FIG. 72 is a perspective view of the bearing member 640.

As can be ascertained from FIGS. 69 to 72, the bearing member 640 is configured to include the tubular body 41, the contact wall 42, the fitting portion 43, the gear portion 44, and a shaft member holding portion 645.

The shaft member holding portion 645 is a part which is formed on the inner side of the tubular body 41 and has a function of holding the shaft member 650 by the bearing member 640. As can be ascertained from FIGS. 71 and 72, the shaft member holding portion 645 in the aspect is configured to include a bottom plate 646, a holding tube body 647, and a holding groove 648.

The bottom plate 646 is a plate-like member disposed to block at least a part of the inner side of the tubular body 41. The holding tube body 647 is a bottomed cylindrical member provided at a part of the axis of the tubular body 41 in the bottom plate 646. The holding tube body 647 is provided coaxially to the tubular body 41, is open to the side opposite to the fitting portion 43, and is configured to include a bottom on the fitting portion 43 side. The holding groove 648 is a member which protrudes from the inner surface of the tubular body 41, and a groove 648*a* is formed here. As can be ascertained from FIG. 72, the groove 648*a* is a groove in which a direction parallel to the axial direction of the tubular body 41 is a depth direction, a diameter direction of the tubular body 41 is a length direction, and an inner circumferential direction of the tubular body 41 is a width direction, and is open to the side opposite to the fitting portion 43 and to a surface which opposes the axis. The groove width of the opening portion on the side opposite to the fitting portion 43 is narrow, and a so-called snap-fit structure is achieved. As can be ascertained from FIG. 71, two holding grooves 648 are provided, and two holding grooves 648 are disposed on each of one side and the other side nipping the axis on one diameter of the tubular body 41.

As can be ascertained from FIGS. 69 to 71, the shaft member 650 is configured to include a rotating force receiving member 652 and a regulating member 660.

The rotating force receiving member 652 is a member which receives the rotation driving force from the apparatus main body 2 (refer to FIG. 1) and transmits the driving force to the bearing member 640 when the end member 630 is in a predetermined posture. The rotating force receiving member 652 in the aspect is configured to include two engaging members 654 and a crank shaft 655.

Figure 73:
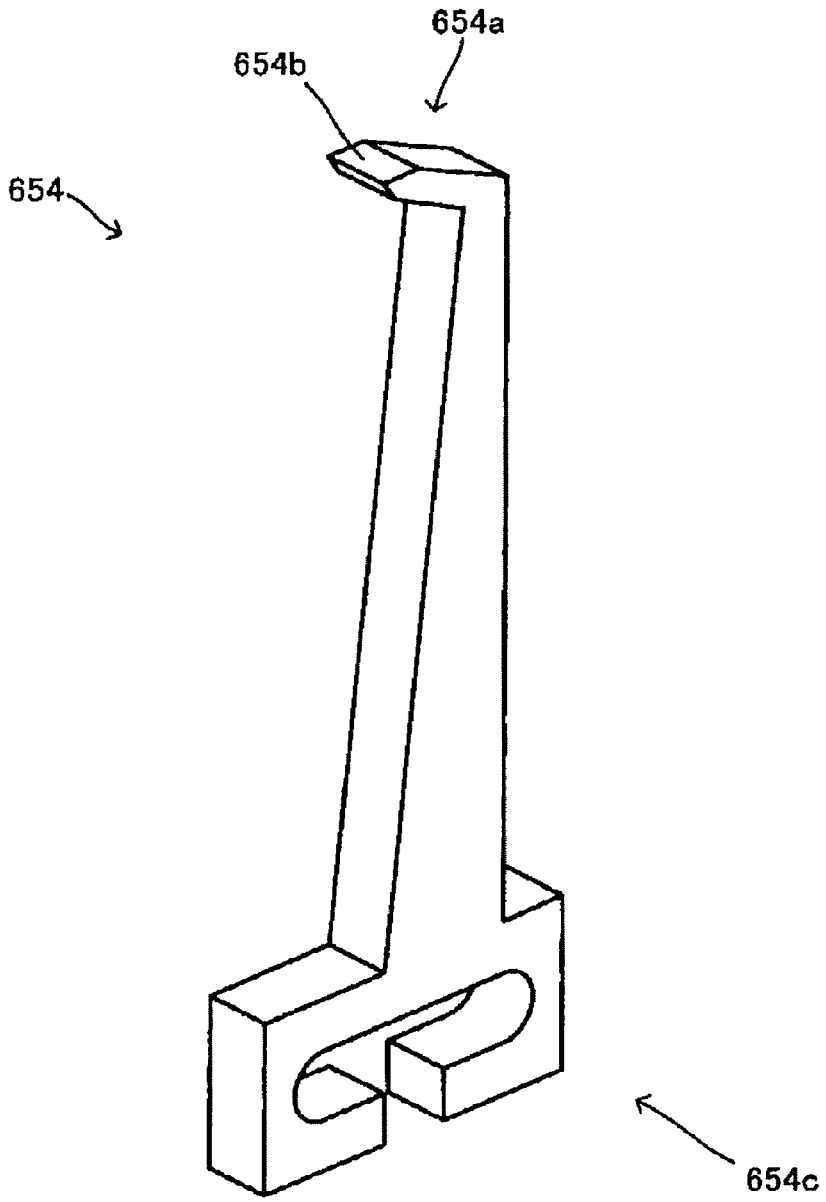
FIG. 73 is a perspective view of an engaging member 654.

The engaging member 654 is a rod-like member, and is a part engaged to and disengaged from the driving shaft 70 of the apparatus main body 2. FIG. 73 is a perspective view of the engaging member 654. The engaging member 654 is a rod-like member as a whole, but a claw portion 654*a* bent at one end portion is provided. The claw portion 654*a* is preferably in a reversely tapered shape or in a shape of a hook. Accordingly, it is possible to more stably transmit the rotation. In the aspect, an inclined portion 654*b* is provided such that the tip end of the claw portion 654*a* becomes tapered. In the engaging member 654, a slit 654*c* which passes through the crank shaft 655 is provided in the other end portion in the engaging member 654. The slit 654*c* is a slit having the longitudinal direction in the direction orthogonal to the direction in which the engaging member 654 extends, and this is substantially the same direction as the direction in which the claw portion 654*a* is bent.

Figure 74:
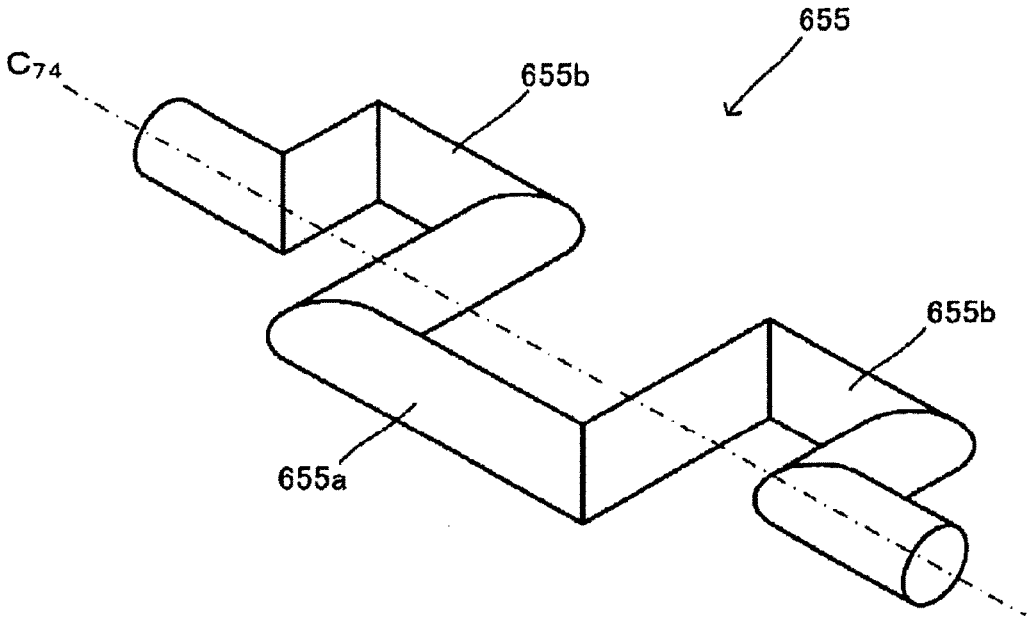
FIG. 74 is a perspective view of a crank shaft 655.

The crank shaft 655 is a member which holds the engaging member 654 by the bearing member 640, and which associates the engaging member 654 with the posture of the regulating member 660. FIG. 74 is a perspective view of the crank shaft 655. The crank shaft 655 is similar to a so-called known crank shaft, and has a shape obtained by bending a rod-like member. More specifically, a center protruding portion 655*a* in which a center part in the axial direction with respect to the axis (illustrated by $C_{74}$ in FIG. 74) that links both end portions protrudes to one part, and end portion protruding portions 655*b* which protrude to the side opposite to the center protruding portion 655*a* are respectively provided between the center protruding portion 655*a* and both ends.

Figure 75:
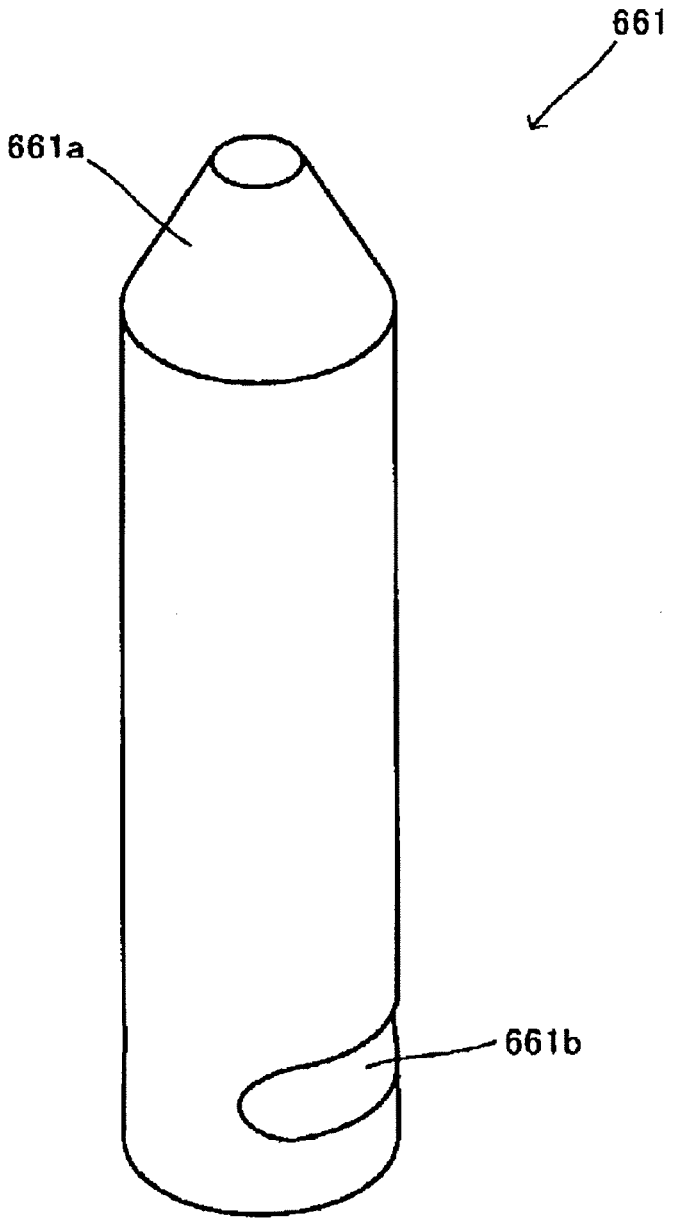
FIG. 75 is a perspective view of a regulating shaft 661.

The regulating member 660 is configured to include a regulating shaft 661 and an elastic member 663. The regulating shaft 661 is a columnar member. FIG. 75 is an appearance perspective view of the regulating shaft 661. One end portion of the regulating shaft 661 is a conical part (truncated conical), and an inclined surface 661*a* is formed. Accordingly, by converting the pressing force from the driving shaft 70 into a pressing force in the longitudinal direction of the shape of a rod of the regulating shaft 661, it is possible to more smoothly attach to and detach from the driving shaft 70. In addition, among the end portions of the regulating shaft 661, a slit 661*b* which passes through the crank shaft 655 is provided on a side opposite to the inclined surface 661*a*. The slit 661*b* extends in the direction orthogonal to the axis of the regulating shaft 661. The elastic member 663 is a coiled spring.

By combining each of the above-described members with each other as follows, the end member 630 is made. In addition, by describing the combination, the size of each member and part, the structure, or the relationship of the sizes of the members and parts, are further understood. As can be ascertained from FIGS. 69 and 71, each of both ends of the crank shaft 655 is held by the holding groove 648 disposed on the inner side of the tubular body 41, and the crank shaft 655 is held to across two holding grooves 648 to be rotatable around the axis (line illustrated by $C_{74}$ in FIG. 74). At this time, the center protruding portion 655*a* of the crank shaft 655 passes through the slit 661*b* of the regulating shaft 661. In addition, the end portion on the inclined surface 661*a* side of the regulating shaft 661 protrudes to the side opposite to the fitting portion 43 of the tubular body 41. In addition, the elastic member 663 is disposed between the end portion on the slit 661*b* side of the regulating shaft 661 and the holding tube body 647 of the bearing member 640, and the regulating shaft 661 is biased in the direction opposite to the fitting portion 43.

Meanwhile, the slit 654*c* of the engaging member 654 passes through each of two end portion protruding portions 655*b* of the crank shaft 655. In addition, the claw portion 654*a* side of the engaging member 654 protrudes in the direction opposite to the fitting portion 43 of the tubular body 41.

Figure 76:
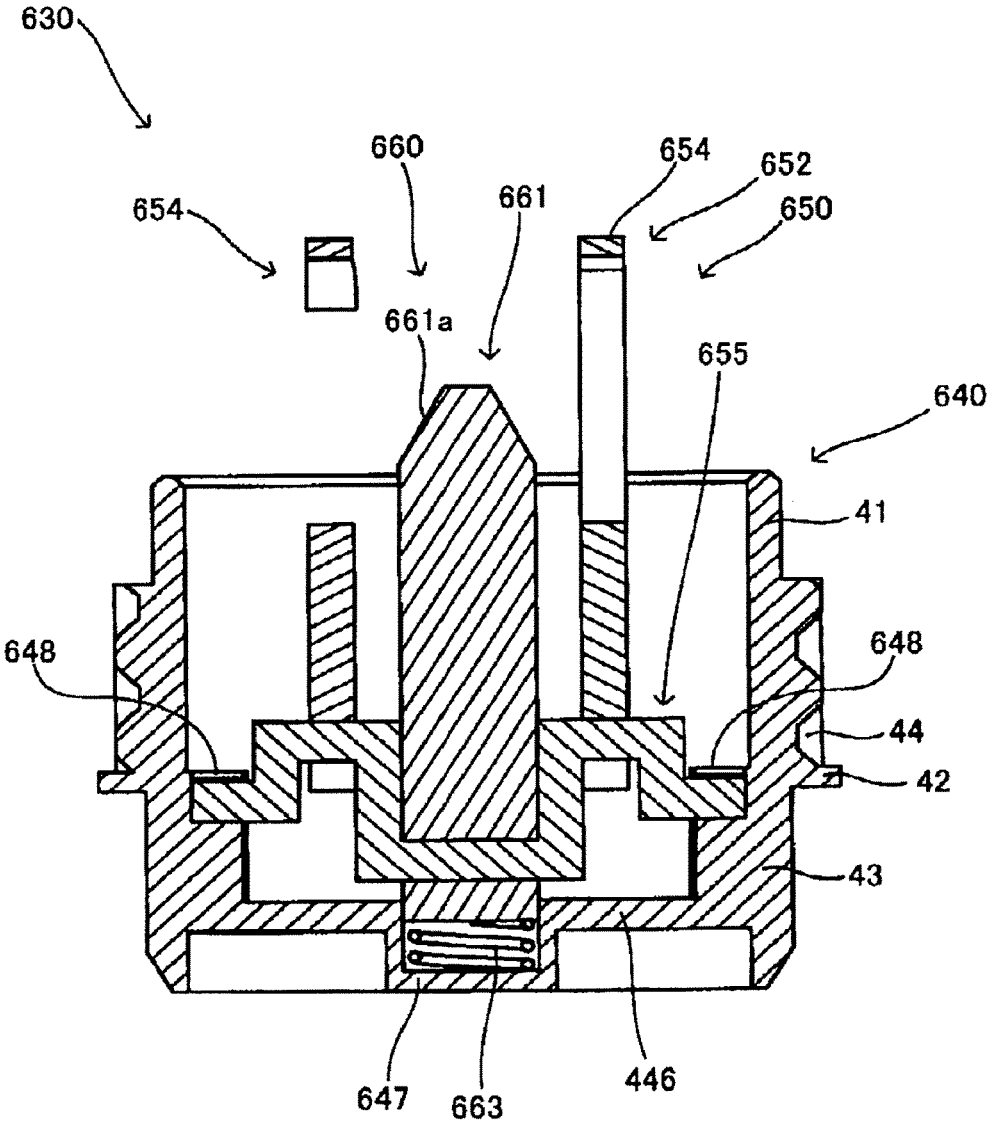
FIG. 76 is a sectional view in a posture in which the end member 630 is deformed.

The end member 630 combined as described above can obtain an aspect similar to FIG. 71 as one posture. In other words, the regulating shaft 661 protrudes by the biasing force of the elastic member 663, and by the action of the crank shaft 655, the engaging member 654 retreats to the fitting portion 43 side. Meanwhile, as illustrated by an arrow $C_{71a}$ in FIG. 71, when pressing the regulating shaft 661 to the fitting portion 43 side (lower part of the paper surface of FIG. 71), the regulating shaft 661 moves to the fitting portion 43 side. Accordingly, as illustrated in FIG. 76, by the action of the crank shaft 655, the engaging member 654 protrudes to the side opposite to the fitting portion 43.

In other words, the end member 630 also can switch the posture in which the engaging member 654 protrudes and the posture in which the engaging member 654 is caved (retreats). Accordingly, the end member 630 can also act similar to the example of the end member 230.

Figure 77A:
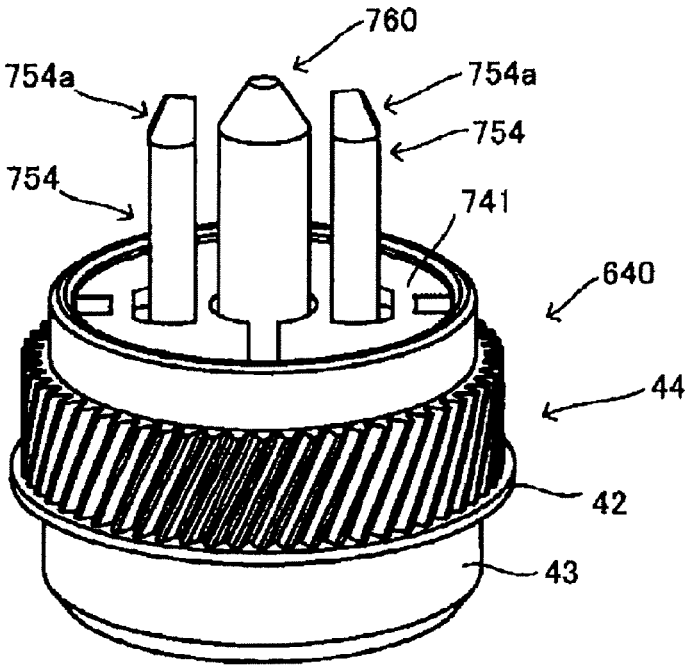
FIG. 77A is a perspective view of an end member 730.
Figure 77B:
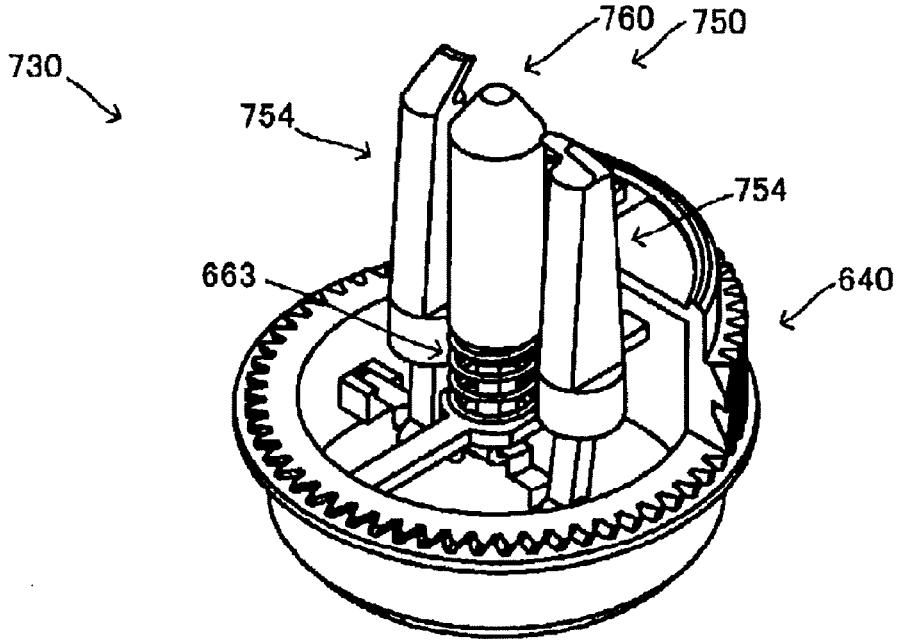
FIG. 77B is a perspective view in which a part of the end member 730 is cut out.
Figure 78:
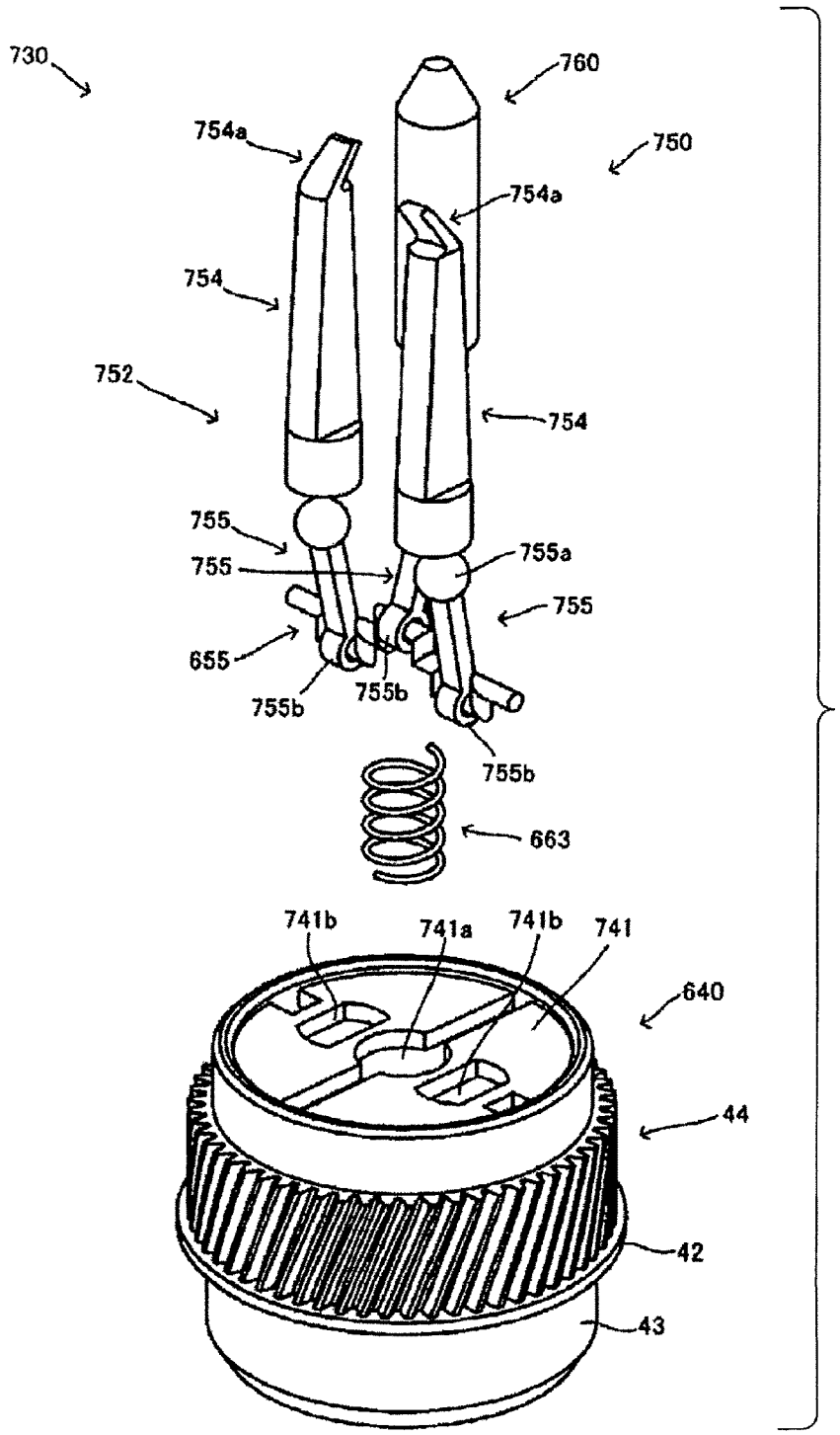
FIG. 78 is an exploded perspective view of the end member 730.

Next, an eighth aspect will be described. FIG. 77A is a perspective view of an end member 730, and FIG. 77B is a perspective view in which a part of the end member 730 is cut out. In addition, FIG. 78 is an exploded perspective view of the end member 730. The end member 730 of the aspect includes the bearing member 640, a lid 741, and a shaft member 750.

Since the bearing member 640 is the same as the above-described bearing member 640 of the end member 630, the description thereof will be omitted here.

The lid 741 is an annular member disposed at a predetermined interval in the axial direction with respect to the bottom plate 646, and is disposed to block and partition the inner side of the tubular body 441. In addition, a through-hole 741*a* is provided at the center thereof. The lid 741 is disposed such that the regulating shaft 661 passes through the through-hole 741*a*. In addition, in the lid 741, engaging member through-holes 741*b* are provided in each of one side and the other side nipping the through-hole 741*a*. In the engaging member through-hole 741*b*, an engaging member 754 is disposed to penetrate. In addition, the engaging member through-hole 741*b* is formed to be greater than the outer shape of the engaging member 754 in order to oscillate such that the engaging member 754 is inclined with respect to the axis of the bearing member 640.

The attachment of the lid 741 to the tubular body 41 may be performed by being attachable and detachable by a claw or the like, or by fixing by adhering or welding. In addition, the tubular body 41 and the lid 741 may be integrally formed.

As can be ascertained from FIGS. 77 and 78, the shaft member 750 is configured to include a rotating force receiving member 752 and a regulating member 760.

The rotating force receiving member 752 is a member which receives the rotation driving force from the apparatus main body 2 (refer to FIG. 1) and transmits the driving force to the bearing member 640 when the end member 730 is in a predetermined posture. The rotating force receiving member 752 in the aspect is configured to include two engaging members 754, a linking member 755, and the crank shaft 655.

Figure 79A:
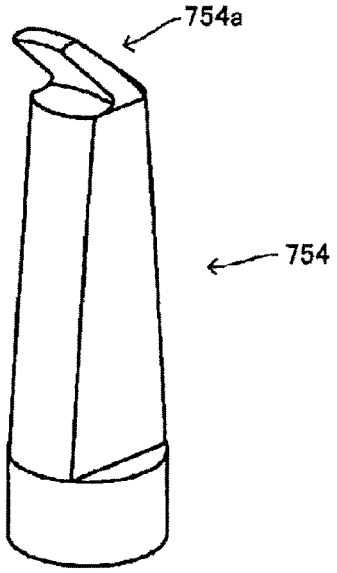
FIG. 79A is a perspective view of an engaging member 754.
Figure 79B:
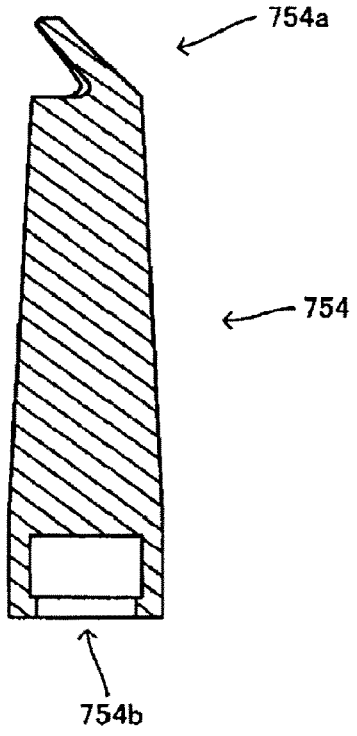
FIG. 79B is a sectional view of the engaging member 754.

The engaging member 754 is a rod-like member, and is a part engaged to and disengaged from the driving shaft 70 of the apparatus main body 2. FIG. 79A is a perspective view of the engaging member 754, and FIG. 79B is a sectional view along the longitudinal direction of the engaging member 754. The engaging member 754 is a rod-like member as a whole, but a claw portion 754*a* bent at one end portion is provided. The claw portion 754*a* is preferably in a reversely tapered shape or in a shape of a hook. Accordingly, it is possible to more stably transmit the rotation. Meanwhile, as can be ascertained from FIG. 79B, a recessed portion 754*b* is provided in the other end portion in the engaging member 754. The end portion of the linking member 755 is inserted into the recessed portion 754*b*, and the engaging member 754 and the linking member 755 can relatively rotate around here. In the aspect, the opening portion of the recessed portion 754*b* is narrow, and the snap-fit structure is configured with respect to the end portion of the linking member 755.

Figure 80:
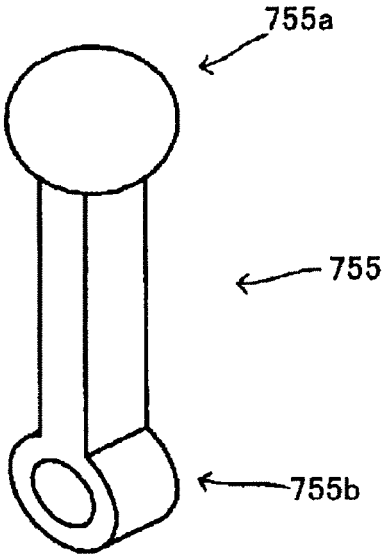
FIG. 80 is a perspective view of a linking member 755.

The linking member 755 is a member linked to an engaging member 754 and the crank shaft 655 such that the engaging member 754 can oscillate as will be described later. In addition, the linking member 755 is used in linking the regulating member 760 which will be described later and the crank shaft 655. FIG. 80 is a perspective view of the linking member 755. As can be ascertained here, the linking member 755 is a rod-like member. A spherical portion 755*a* which is a part having a spherical surface is formed on one end side of the linking member 755, and the part is configured to be thick. By inserting the spherical portion 755*a* into the recessed portion 754*b* of the above-described engaging member 754, the engaging member 754 and the linking member 755 can relatively rotate around here. An annular portion 755*b* formed in an annular shape is formed on the other end side of the linking member 755. As the crank shaft 655 passes through the inner side having an annular shape, the linking member 755 and the engaging member 754 act based on the rotation of the crank shaft 655.

Since the crank shaft 655 can be considered similar to the above-described crank shaft 655 of the end member 630, the description thereof will be omitted.

Figure 81A:
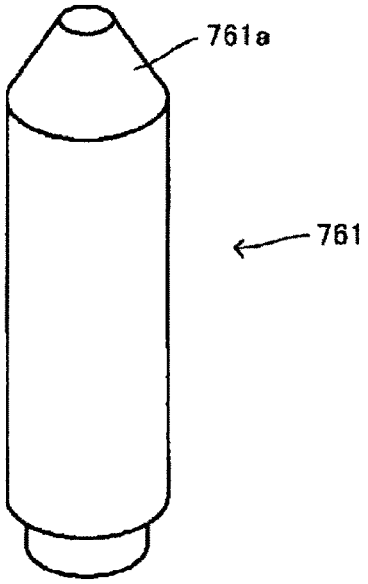
FIG. 81A is a perspective view of a regulating shaft 761.
Figure 81B:
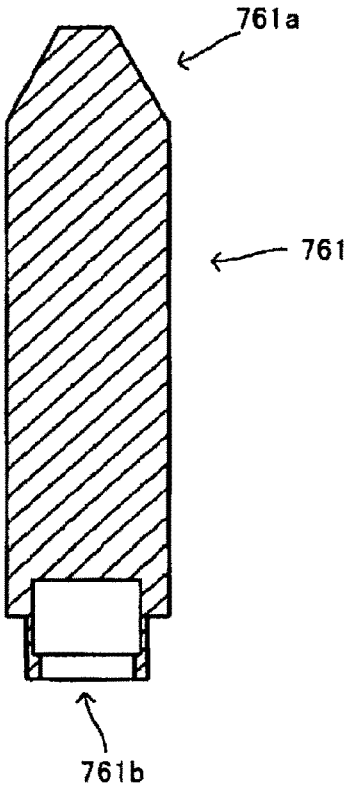
FIG. 81B is a sectional view of the regulating shaft 761.

The regulating member 760 is configured to include a regulating shaft 761, the linking member 755, and the elastic member 663. The regulating shaft 761 is a columnar member. FIG. 81A is an appearance perspective view of the regulating shaft 761, and FIG. 81B is a sectional view in the direction along the axis of the regulating shaft 761.

One end portion of the regulating shaft 761 is a conical part (truncated conical), and an inclined surface 761*a* is formed. Accordingly, by converting the pressing force from the driving shaft 70 into a pressing force in the longitudinal direction of the shape of a rod of the regulating shaft 761, it is possible to more smoothly attach to and detach from the driving shaft 70. Meanwhile, among the end portions of the regulating shaft 761, as can be ascertained from FIG. 81B, a recessed portion 761*b* is provided in the end portion opposite to the inclined surface 761*a*. The end portion of the linking member 755 is inserted into the recessed portion 761*b*, and the regulating shaft 761 and the linking member 755 are linked to each other. In the aspect, the opening portion of the recessed portion 761*b* is narrow, and the snap-fit structure is configured with respect to the end portion of the linking member 755.

The linking member 755 is as described above. In addition, the elastic member 663 is a coiled spring.

By combining each of the above-described members with each other as follows, the end member 730 is made. In addition, by describing the combination, the size of each member and part, the structure, or the relationship of the sizes of the members and parts, are further understood. As can be ascertained from FIGS. 77 and 78, each of both ends of the crank shaft 655 is held by the holding groove 648 disposed on the inner side of the tubular body 41, and the crank shaft 655 is held to across two holding grooves 648 to be rotatable around the axis (line illustrated by $C_{74}$ in FIG. 74). At this time, the linking member 755 is disposed in each of the center protruding portion 655*a* of the crank shaft 655 and the two end portion protruding portions 655*b*, and the crank shaft 655 passes through the annular portion 755*b* of the linking member 755. In addition, the spherical portion 755*a* of the linking member 755 disposed in the center protruding portion 655*a* is inserted into the recessed portion 761*b* of the regulating shaft 761. The end portion on the inclined surface 761*a* side of the regulating shaft 761 passes through the through-hole 741*a* of the lid 741, and protrudes to the side opposite to the fitting portion 43 of the tubular body 41. In addition, the elastic member 663 is disposed between the end portion on the slit 661*b* side of the regulating shaft 761 and the holding tube body 647 of the bearing member 640, and the regulating shaft 761 is biased in the direction opposite to the fitting portion 43.

Meanwhile, the recessed portion 754*b* of the engaging member 754 is inserted into the spherical portion 755*a* of the linking member 755 disposed in each of the two end portion protruding portions 655*b* of the crank shaft 655. In addition, the claw portion 754*a* side of the engaging member 754 penetrates the engaging member through-hole 741*b* of the lid 741, and protrudes in the direction opposite to the fitting portion 43 of the tubular body 41.

Figure 82:
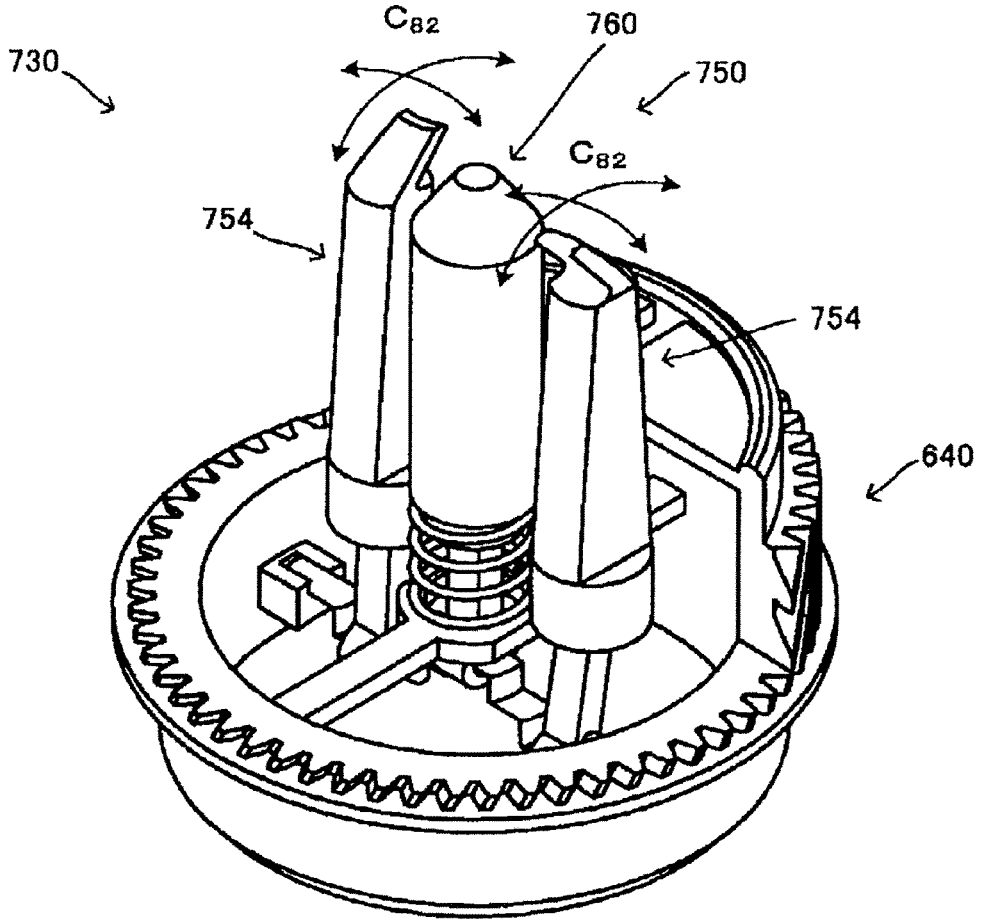
FIG. 82 is a view illustrating oscillation of the engaging member 754.

According to the end member 730 combined as described above, in addition to the action similar to the above-described end member 630, as illustrated by an arrow $C_{82}$ in FIG. 82, the engaging member 754 oscillates to be inclined with respect to the axis of the bearing member 640 within a range regulated by the engaging member through-hole 741*b*. Accordingly, the engagement and disengagement of the process cartridge and the apparatus main body are more smoothly performed. It is preferable that the size of the inclination angle becomes 18° at the maximum. Accordingly, it is possible to reliably and smoothly attach and detach the process cartridge to and from the apparatus main body.

In any of the end members of each aspect described above, according to the posture of the regulating member, it is possible to achieve an aspect (the engaging member revolves, the engaging member is tilted, or the engaging member retreats) in which the engaging member is not engaged with the driving shaft. In addition, the engaging member is engaged with the driving shaft when the transmission of the rotating force from the driving shaft is necessary. According to this, it is possible to substantially reduce interruption of the engagement caused by unnecessary interference in the process of engagement between the driving shaft and the engaging member, and smooth engagement is possible. In particular, considering that the driving shaft is engaged in a state where the shaft member is pressed finally, according to the mechanism that acts as the driving shaft presses the regulating member, since the engagement is automatically performed in a general process of mounting the process cartridge, additional operations are not necessary and convenience also increases.

Figure 83:
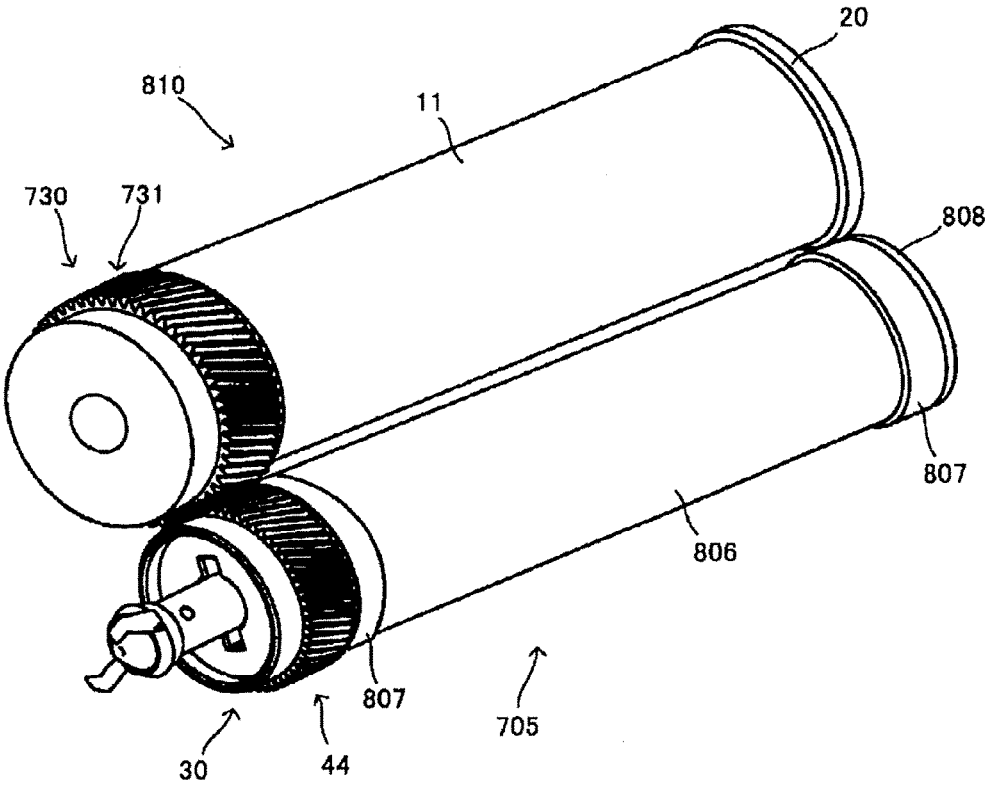
FIG. 83 is a view illustrating an aspect in which the end member 30 is provided in a developing roller unit 705.

Until here, an aspect in which all of the above-described end members are disposed in the end portion of the photoreceptor drum 11, and accordingly, the photoreceptor drum unit is formed, is described. Meanwhile, as described using FIG. 2, the developing roller unit or the charging roller unit which is provided with the columnar rotating body is additionally provided in the process cartridge. Here, all of the end members according to the above-described aspects and the modification examples can receive the rotation driving force from the apparatus main body being employed in the developing roller unit or the charging roller unit instead of being disposed in the photoreceptor drum. FIG. 83 illustrates a developing roller unit 805 provided with the end member 30 as one aspect. FIG. 83 is also a perspective view of a photoreceptor drum unit 810 disposed to be adjacent to the developing roller unit 805 being combined with the developing roller unit 805.

The developing roller unit 805 includes a developing roller 806, a spacer ring 807, a lid member 808, a magnetic roller (not illustrated), and the end member 30. The end member 30 is as described above. In addition, as other members, known members can be employed, but for example, the following configuration is provided.

The developing roller 806 is a member which covers a developing layer on the outer circumferential surface of the columnar rotating body. The developing roller 806 is a conductive cylinder made of aluminum or the like in the aspect, and here, the developing roller 806 is configured to be coated with the material which configures the developing layer.

The spacer ring 807 is an annular member which is disposed to be wound around the outer circumferential surface of each of both ends of the developing roller 806, and accordingly, a void between the developing roller 806 and the photoreceptor drum 11 is held to be constant. The thickness of the spacer ring 807 is approximately 200 μm to 400 μm.

Similar to the above-described lid member 20, the lid member 808 is disposed on one end side of the developing roller 806, and becomes a bearing for making the developing roller 806 rotate around the axis at one end of the developing roller unit 805.

The magnetic roller is not illustrated in FIG. 83 since the magnetic roller is disposed on the inner side of the developing roller 806, but a plurality of magnetic poles are disposed along the axis by a roller formed of a resin, including a magnetic body or a non-magnetic body. Accordingly, by using magnetism, the developer can be adsorbed to a surface of the developing roller 806.

The end member 30 is as the description above, but the end member 30 is disposed in the end portion opposite to the end portion in which the lid member 808 is disposed among the end portions of the developing roller 806. Here, an example in which the end member 30 is employed is illustrated, but the invention is not limited thereto, and any other end members which are generally described can also be employed.

In addition, at this time, the photoreceptor drum unit 810 can be configured, for example, as follows. In other words, the photoreceptor drum unit 810 is provided with the photoreceptor drum 11, the lid members 20 and 830 which become a bearing for rotating the photoreceptor drum 11 around the axis at each of both ends of the photoreceptor drum 11. At this time, a gear portion 731 which receives the rotating force being meshed with the gear portion 44 of the end member 30 disposed in the developing roller unit 805 is provided in one lid member 830.

Above, each end member may be a configuration member included in the developing roller unit, and even in this case, each end member acts similar to those when the end members are provided in the photoreceptor drum unit.

Until here, a plurality of aspects of the end member are described. Hereinafter, other aspects of a housing of the process cartridge will be described. In the housing which will be described hereinafter, it is also possible to employ the photoreceptor drum unit provided with any of the above-described end members.

Figure 84:
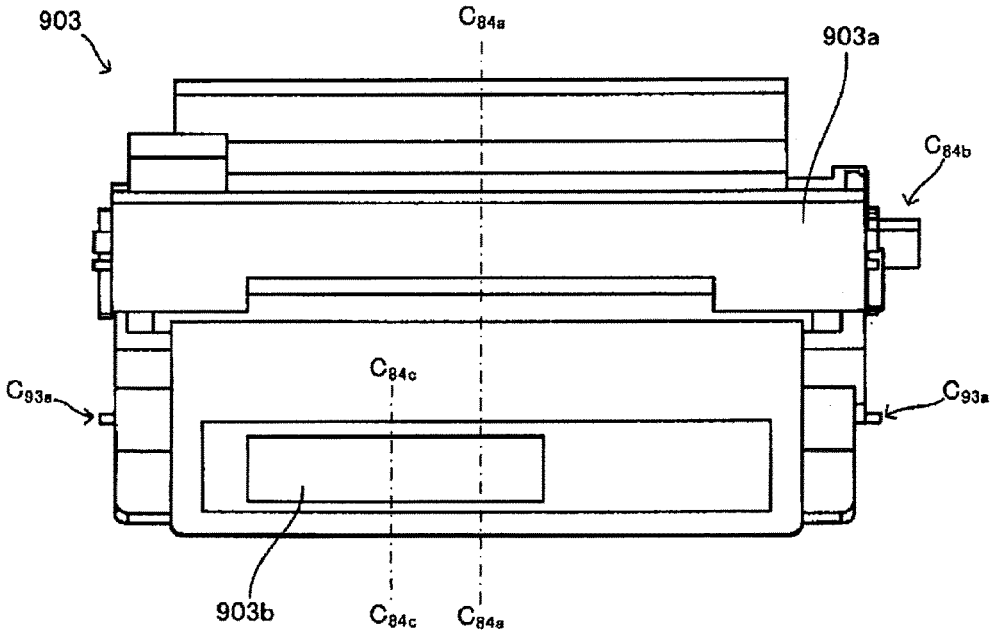
FIG. 84 is a plan view of a process cartridge 903.

FIG. 84 is a plan view of a process cartridge 703 provided with a housing 703*a* of a first example. FIG. 84 illustrates a position of the end member on the side engaged with the driving shaft 70 of the apparatus main body 2 by an arrow $C_{84b}$. In the aspect, the center position in the width direction (the leftward-and-rightward direction on a paper surface, that is, the direction in which the photoreceptor drum unit extends) of an operating portion 903*b* illustrated by $C_{84c}$-$C_{84c}$, is disposed to be more shifted to the side opposite to the end member on the driving shaft side (there is a case of being written as "non-driving side part") than the center in the width direction (the leftward-and-rightward direction on a paper surface, that is, the direction in which the photoreceptor drum unit extends) of a process cartridge 903 illustrated by $C_{84a}$-$C_{84a}$, and this functions as incliningly pulling means. In other words, in the example, the incliningly pulling means which encourages a user to perform an operation with the non-driving side part is employed.

Figure 85:
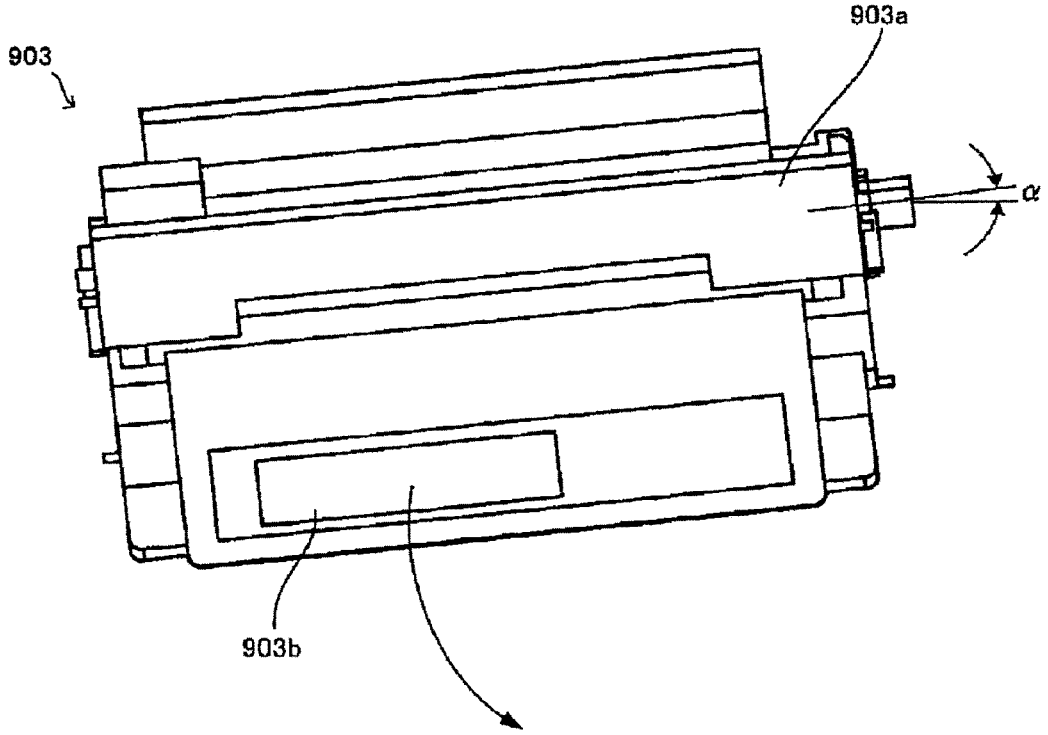
FIG. 85 is a view illustrating a situation in which the process cartridge 903 is disengaged.

As illustrated in FIG. 85, according to the process cartridge 903, by pulling the center of the operating portion 903*b* when disengaging the process cartridge 903 from the apparatus main body 2, it is possible to pull out the side opposite to the side to which the driving shaft 70 is engaged further to the near side. According to this, it is possible to incline the process cartridge 903 as illustrated by an angle α (an angle α made by the axis of the photoreceptor drum unit and the axis of the driving shaft of the apparatus main body) in FIG. 85, and the disengagement of the end member from the driving shaft becomes easy. It is preferable that the angle of α is 1.5° to 10°. In addition, the angle is more preferably 2° or more. Accordingly, it is possible to smoothly disengage the end member.

Figure 86:
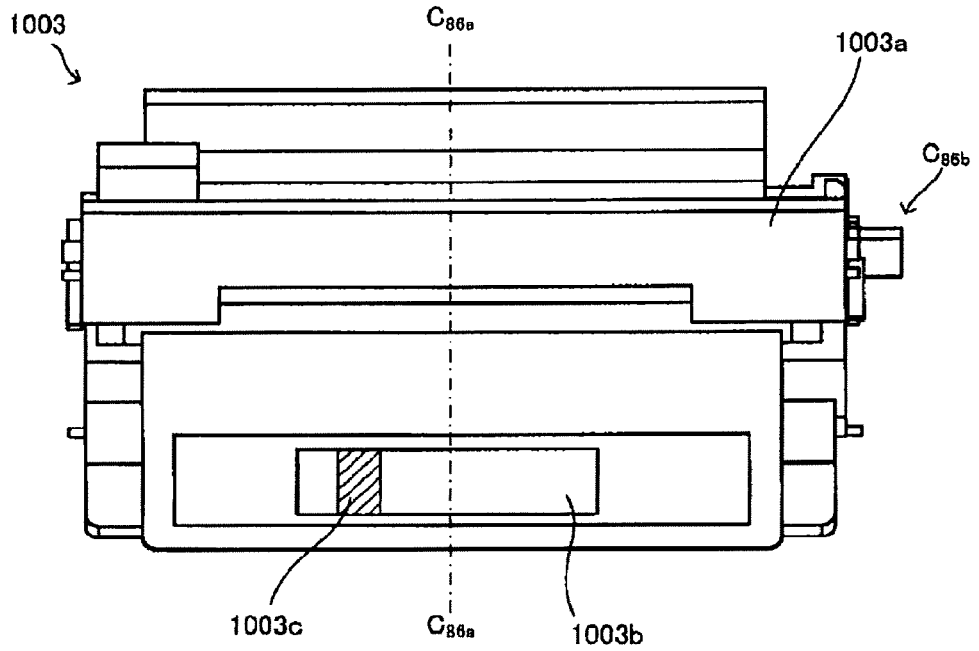
FIG. 86 is a plan view of a process cartridge 1003.

FIG. 86 is a plan view of a process cartridge 1003 provided with a housing 1003*a* of a second example. FIG. 86 illustrates a position of the end member on the side engaged with the driving shaft 70 of the apparatus main body 2 by an arrow $C_{86b}$. In the aspect, a mark 1003*c* is disposed further at the non-driving side part than the center in the width direction (the leftward-and-rightward direction on a paper surface, that is, the direction in which the photoreceptor drum unit extends) of a process cartridge 1003 illustrated by $C_{86a}$-$C_{86a}$ in an operating portion 1003*b* and this functions as the incliningly pulling means. A specific aspect of the mark 1003*c* is not particularly limited, and examples thereof can include sealing, printing, or forming of unevenness. Furthermore, explanatory description may be illustrated. According to the housing 1003*a* provided with the incliningly pulling means, actions similar to those described above are also achieved. In addition, in the example, the incliningly pulling means which encourages the user to perform the operation with the non-driving side part is employed.

Figure 87:
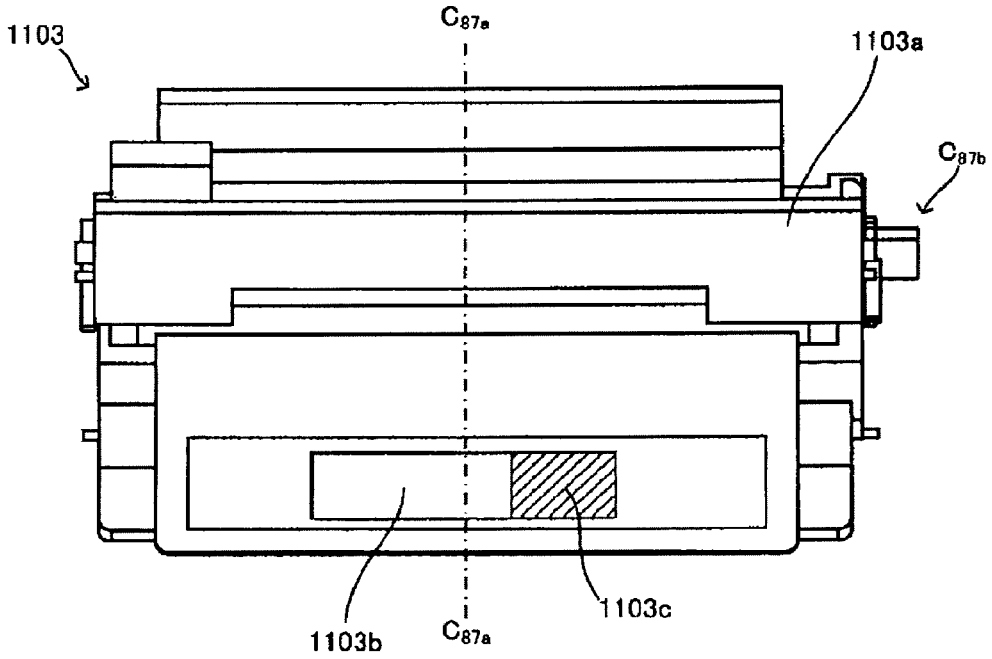
FIG. 87 is a plan view of a process cartridge 1103.

FIG. 87 is a plan view of a process cartridge 1103 provided with a housing 1103*a* of a third example. FIG. 87 illustrates a position of the end member on the side engaged with the driving shaft 70 of the apparatus main body 2 by $C_{87b}$. In the example, an operating portion 1103*b* is formed in a recessed shape, means 1103*c* for blocking at least a part of the operating portion 1103*b* is disposed on the end member side further on the driving shaft side than the center in the width direction (the leftward-and-rightward direction on a paper surface, that is, the direction in which the photoreceptor drum unit extends) of the process cartridge 1103 illustrated by $C_{87a}$-$C_{87a}$, and this functions as the incliningly pulling means. The means for blocking the operating portion 1103*b* is not particularly limited, and it is possible to perform adhering by sealing, to fill the recessed portion with a resin or metal, or to use a tool that performs fitting. According to the housing 1103*a* provided with the incliningly pulling means, actions similar to those described above are also achieved. In addition, in the example, the incliningly pulling means which encourages the user to perform the operation with the non-driving side part is employed.

Figure 88A:
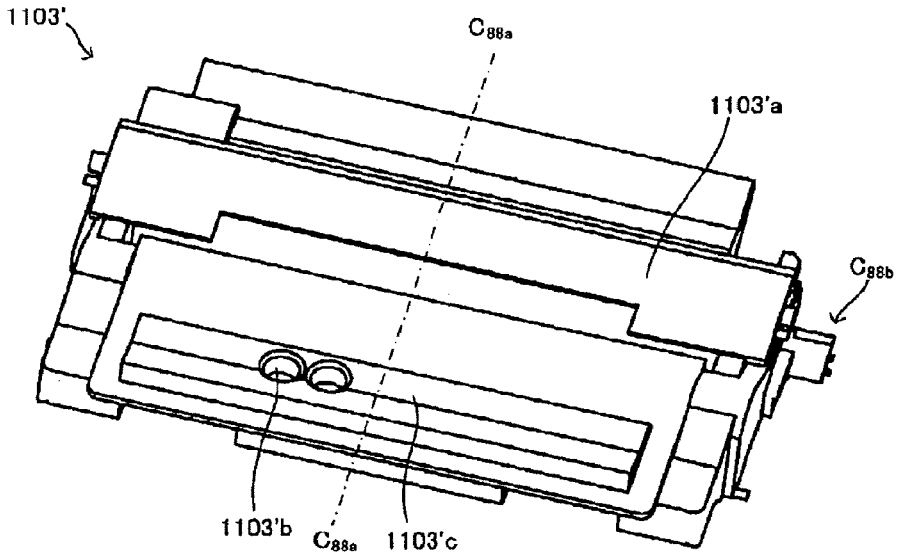
FIG. 88A is a perspective view from a plan view side of a process cartridge 1103'.
Figure 88B:
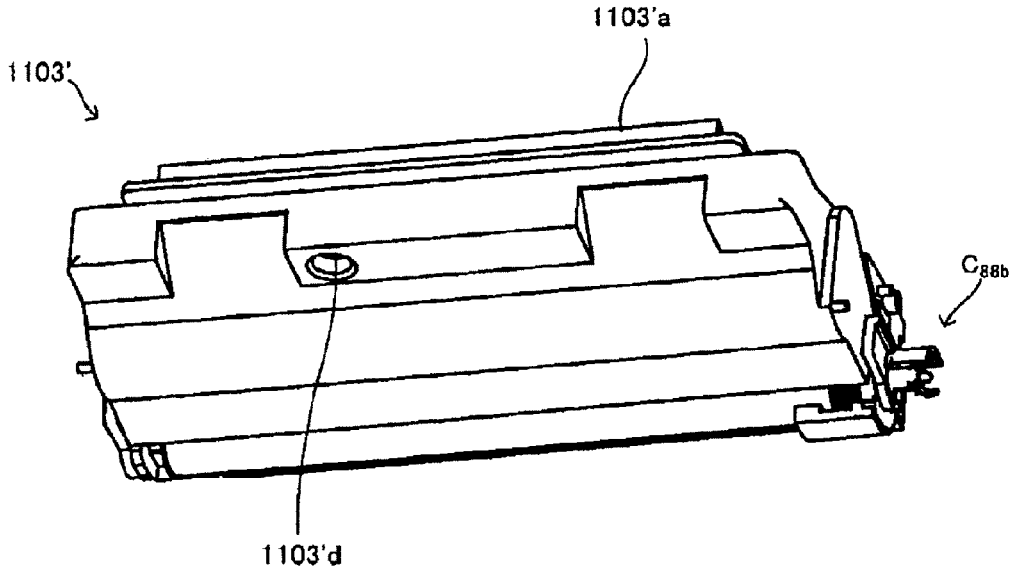
FIG. 88B is a perspective view from a bottom view side of the process cartridge 1103'.

FIG. 88A is a perspective view when viewed from a plan view side of a process cartridge 1103' provided with a housing 1103'*a* in a modification example of a third example. FIG. 88B is a perspective view when viewed from the bottom surface direction. FIG. 88 illustrates the position of the end member on a side engaged with the driving shaft 70 of the apparatus main body 2 by an arrow $C_{88b}$. In the example, an operating portion 1103'*b* is formed in a recessed shape, the means 1103*c* for blocking at least a part of the operating portion 1103*b* is disposed on the end member side further on the driving shaft side than the center in the width direction (the leftward-and-rightward direction on a paper surface, that is, the direction in which the photoreceptor drum unit extends) of the process cartridge 1103 illustrated by $C_{88a}$-$C_{88a}$, and finally, two hole-like operating portions 1103'*b* into which the fingers can be inserted at the non-driving side part are formed. In other words, blocking means 1103'*c* functions as the incliningly pulling means. A forming method of the means for blocking the operating portion 1103*b* is not particularly limited, and it is possible to perform adhering by sealing, to fill the recessed portion with a resin or metal, or to use a tool that performs fitting. In addition, in the example, as can be ascertained from FIG. 88B, an operating hole 1103'*d* into which the fingers can be inserted is provided on the bottom surface side. Accordingly, it is possible to further improve operability. However, the hole 1103'*d* is not necessarily provided. According to the housing 1103'*a* provided with the incliningly pulling means, actions similar to those described above are also achieved. In addition, in the example, the incliningly pulling means which encourages the user to perform the operation with the non-driving side part is employed.

Figure 89:
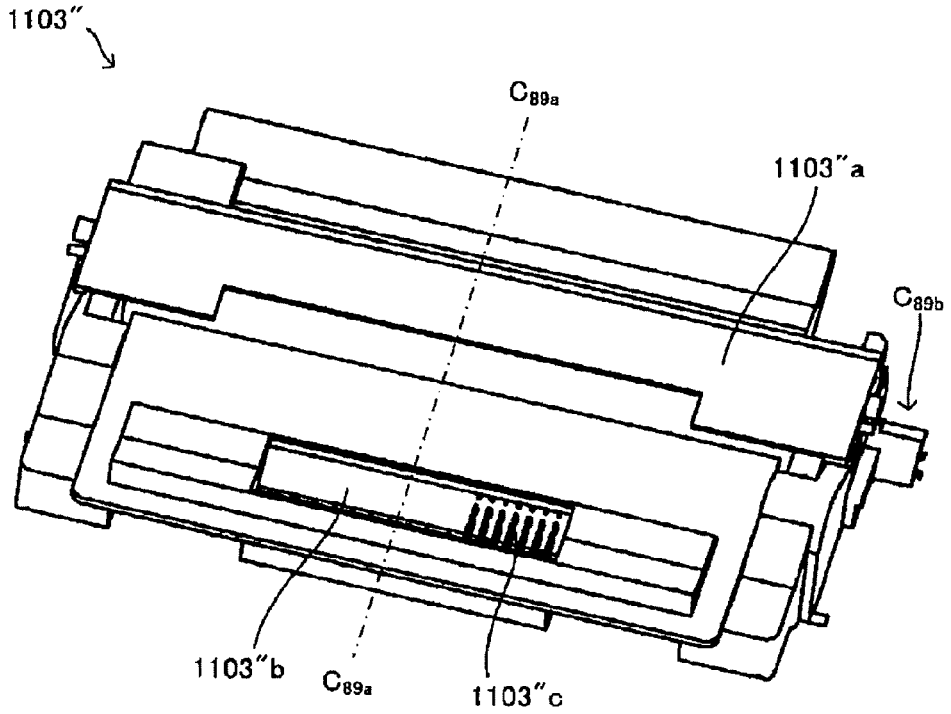
FIG. 89 is a perspective view from a plan view side of a process cartridge 1103".

FIG. 89 is a perspective view when viewed from a plan view side of a process cartridge 1103" provided with a housing 1103"*a* of another modification example of the third example. FIG. 89 illustrates a position of the end member on the side engaged with the driving shaft 70 of the apparatus main body 2 by an arrow $C_{89b}$. In the example, an operating portion 1103'*b* is formed in a recessed shape, a projection 1103"*c* is disposed at least at a part of the operating portion 1103"*b* on the end member side further on the driving shaft side than the center in the width direction (the leftward-and-rightward direction on a paper surface, that is, the direction in which the photoreceptor drum unit extends) of the process cartridge 1103"*b* illustrated by $C_{89a}$-$C_{89a}$, and this functions as the incliningly pulling means. In the example, the projection 1103"*c* is an aspect in which a plurality of projection-like members stand from the bottom of the operating portion 1103". The projection-like member is a projection that is not dangerous to the user, and may be formed of a resin or metal, or seal having a projection may be adhered. According to the housing 1103"*a* provided with the incliningly pulling means, actions similar to those described above are also achieved. In addition, in the example, the incliningly pulling means which encourages the user to perform the operation with the non-driving side part is employed.

Figure 90:
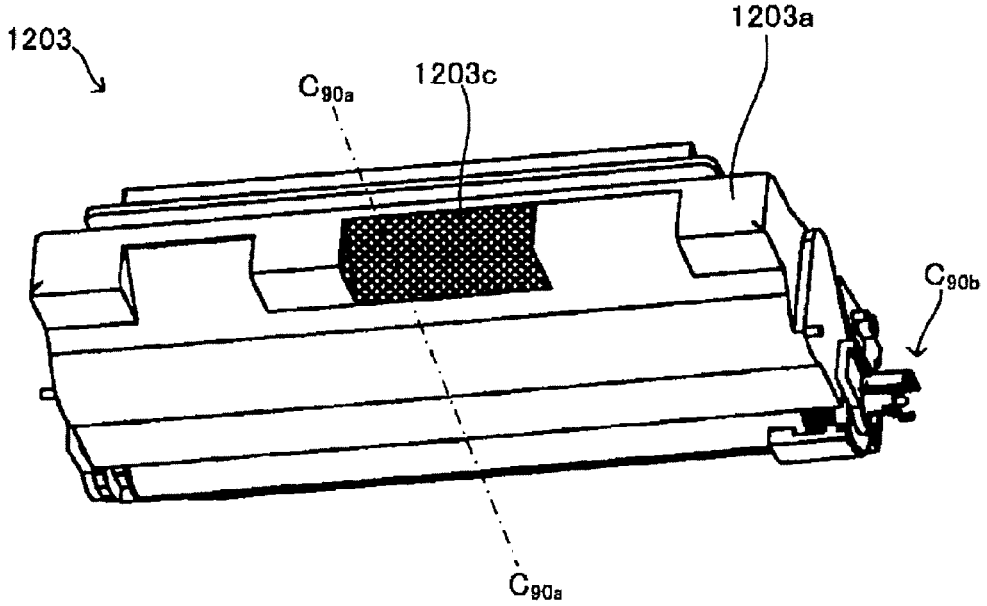
FIG. 90 is a perspective view from a bottom view side of a process cartridge 1203.

FIG. 90 is a perspective view when viewed from the bottom surface side of a process cartridge 1203 provided with a housing 1203*a* of a fourth example. FIG. 90 illustrates a position of the end member on the side engaged with the driving shaft 70 of the apparatus main body 2 by an arrow $C_{90b}$. In the example, a member 1203*c* which interrupts grabbing of the user is formed in an operating portion (the shape thereof is not particularly limited and not illustrated) on the plan view side, and is disposed on the end member side further on the driving shaft side than the center in the width direction (the leftward-and-rightward direction on a paper surface, that is, the direction in which the photoreceptor drum unit extends) of the process cartridge 1203 illustrated by $C_{90a}$-$C_{90a}$ on the bottom surface side as can be ascertained from FIG. 90, and this functions as the inclingly pulling means. Accordingly, since the user grabs the housing 1203*a* avoiding the interrupting member 1203*c*, it is possible to grab the position at which the process cartridge 1203 spontaneously falls out inclingly. The means for blocking an operating portion 1203*b* is not particularly limited, and it is possible to perform adhering by sealing, to fill the recessed portion with a resin or metal, or to use a tool that performs fitting. According to the housing 1203*a* provided with the inclingly pulling means, actions similar to those described above are also achieved. In addition, in the example, the inclingly pulling means which encourages the user to perform the operation with the non-driving side part is employed.

Figure 91A:
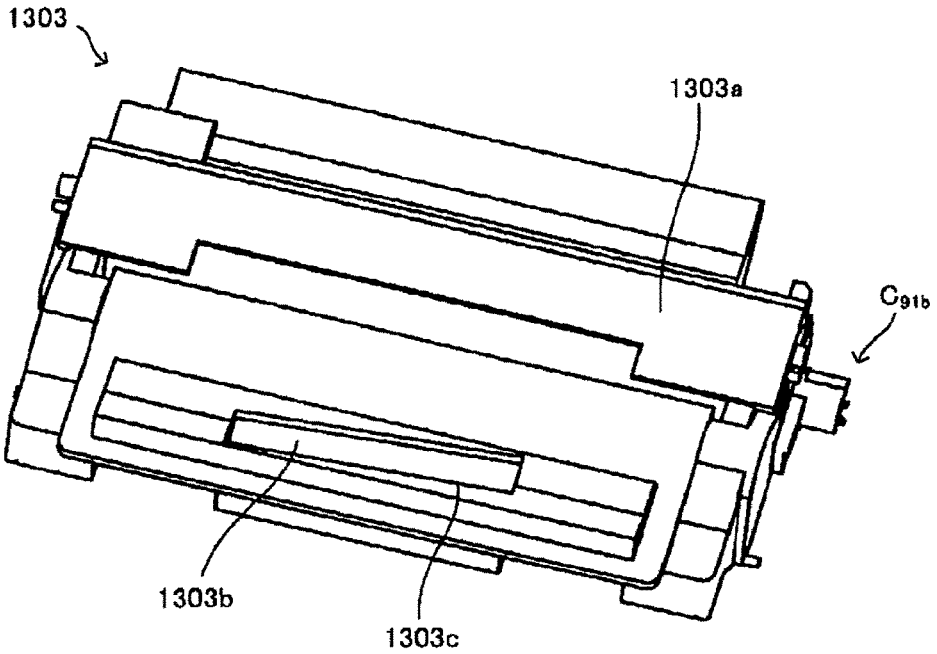
FIG. 91A is a perspective view from a plan view side of a process cartridge 1303.
Figure 91B:
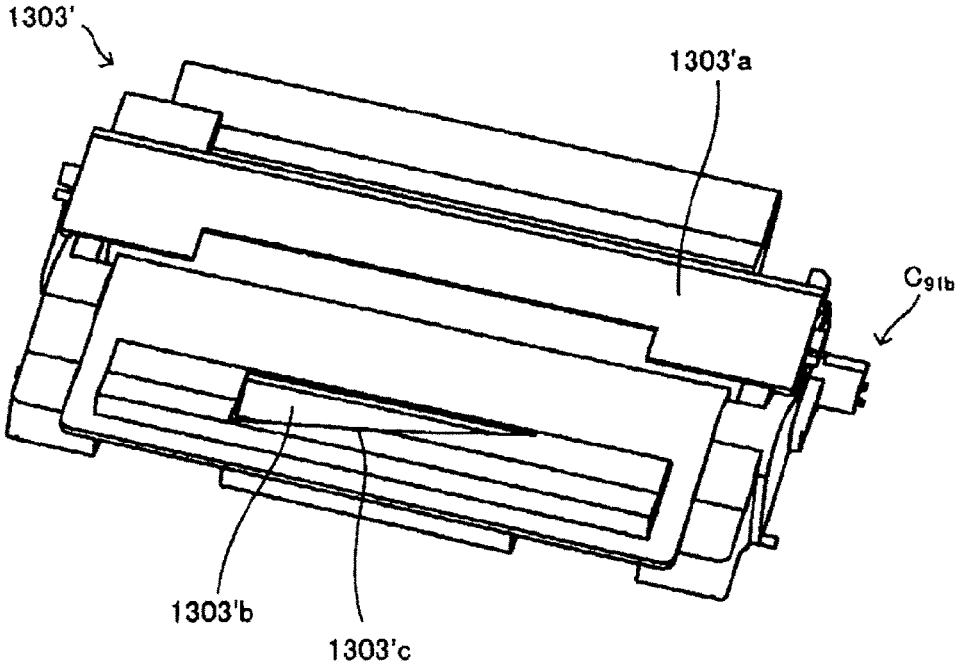
FIG. 91B is a perspective view from a plan view side of a process cartridge 1303'.

FIGS. 91A and 91B are perspective views when viewed from the plan view of process cartridges 1303 and 1303' provided with housings 1303*a* and 1303' of a fifth example and a modification example thereof. FIGS. 91A and 91B illustrate a position of the end member (there is a case of being written as "driving side end member") on the side engaged with the driving shaft 70 of the apparatus main body 2 by an arrow $C_{91b}$. In the example, among operating portions 1303*b* and 1303'*b*, operating surfaces 1303*c* and 1303'*c* which are surfaces touched when the user pulls out the process cartridges 1303 and 1303', are formed. The operating surfaces 1303*c* and 1303'*c* are inclined to be close to the side (lower part of the paper surface) pulled out as being separated from the driving side end member (disposed at a position of $C_{91b}$), and this functions as the inclingly pulling means. The means for forming the operating surface is not particularly limited, and it is possible to form the inclined surface by using a resin or metal with respect to the operating portion that is not inclined, or to attach a tool. In an example of FIG. 91A, the operating portion 1303*b* when viewed from the plan view of the process cartridge 1303 is a parallelogram, and in an example of FIG. 91B, the operating portion 1303'*b* when viewed from the plan view of the process cartridge 1303' is a triangle. However, the shape when viewed from a plan view is not particularly limited. According to the housings 1303*a* and 1303' provided with the inclingly pulling means, actions similar to those described above are also achieved. In addition, in the example, the inclingly pulling means which is configured to encourage the process cartridge spontaneously to fall out inclingly only by the pulling-out operation of the user, is employed.

Figure 92:
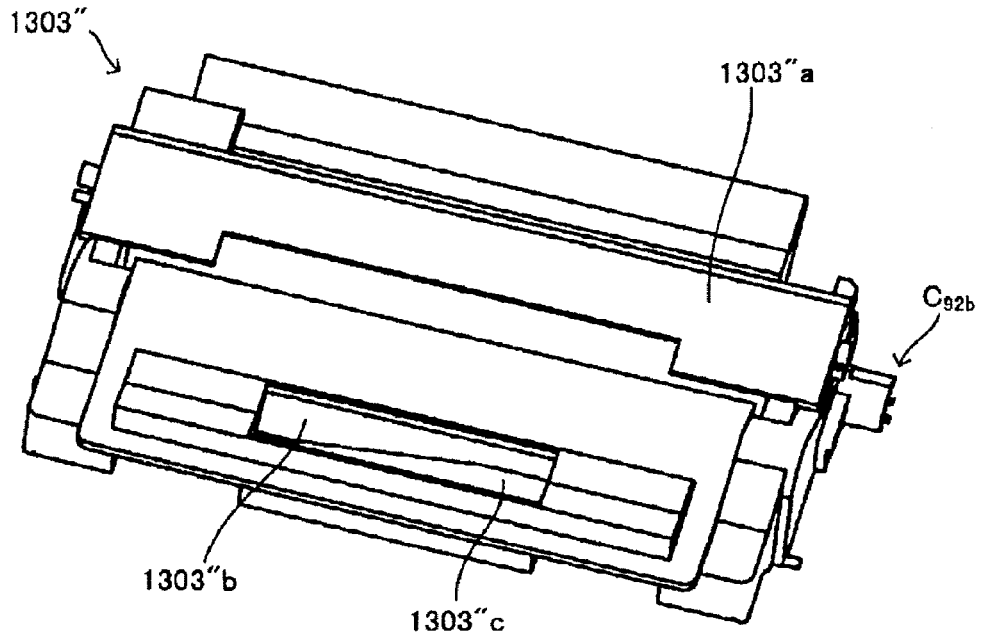
FIG. 92 is a perspective view from a plan view side of a process cartridge 1303".

FIG. 92 is a perspective view when viewed from the plan view of the process cartridge 1303" provided with the housing 1303"*a* in another modification example of the fifth example. FIG. 92 illustrates a position of the end member on the side engaged with the driving shaft 70 of the apparatus main body 2 by an arrow $C_{92b}$. In the example, on the inner side of the operating portion 1303"*b* of which a plan view is formed in rectangular recessed shape, an operating surface 1303"*c* which is a surface touched when the user pulls out the process cartridges 1303", is formed. In addition, the operating surface 1303"*c* is inclined to be close to the side (lower part of the paper surface) pulled out as being separated from the driving side end member, and this functions as the inclingly pulling means. According to the housings 1303"*a* provided with the inclingly pulling means, actions similar to those described above are also achieved. In addition, in the example, the inclingly pulling means which is configured to encourage the process cartridge spontaneously to fall out inclingly only by the pulling-out operation of the user, is employed.

Figure 93:
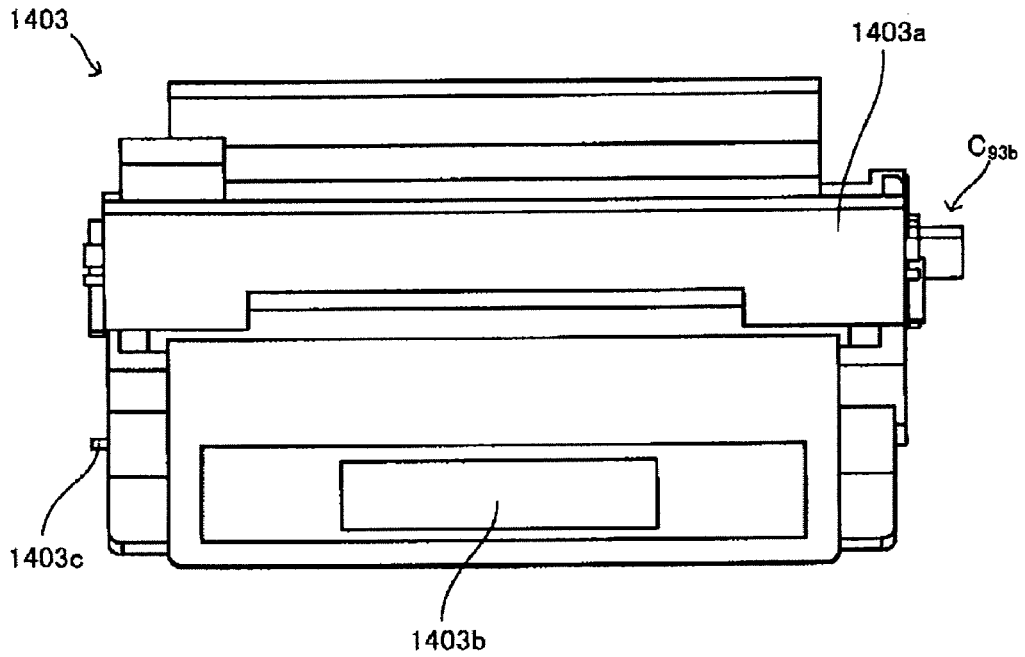
FIG. 93 is a plan view of a process cartridge 1403.

FIG. 93 is a plan view of a process cartridge 1403 provided with a housing 1403*a* of a sixth example. FIG. 93 illustrates a position of the end member (there is a case of being written as "driving side end member") on the side engaged with the driving shaft 70 of the apparatus main body 2 by an arrow $C_{93b}$. In the example, an operating portion 1403*b* is provided (the aspect of the operating portion is not particularly limited), and a positioning projection 1403*c* of the process cartridge 1403 is disposed only at the non-driving side part, and is not provided on the side on which the driving side end member opposite thereto is disposed. In the example, this functions as the inclingly pulling means. Generally, as illustrated by $C_{93a}$ in FIG. 84, the positioning projections are disposed on both sides. Since the inclingly pulling means does not interrupt inclining of the process cartridge when the user pulls out the process cartridge, smooth inclining is possible.

Figure 94:
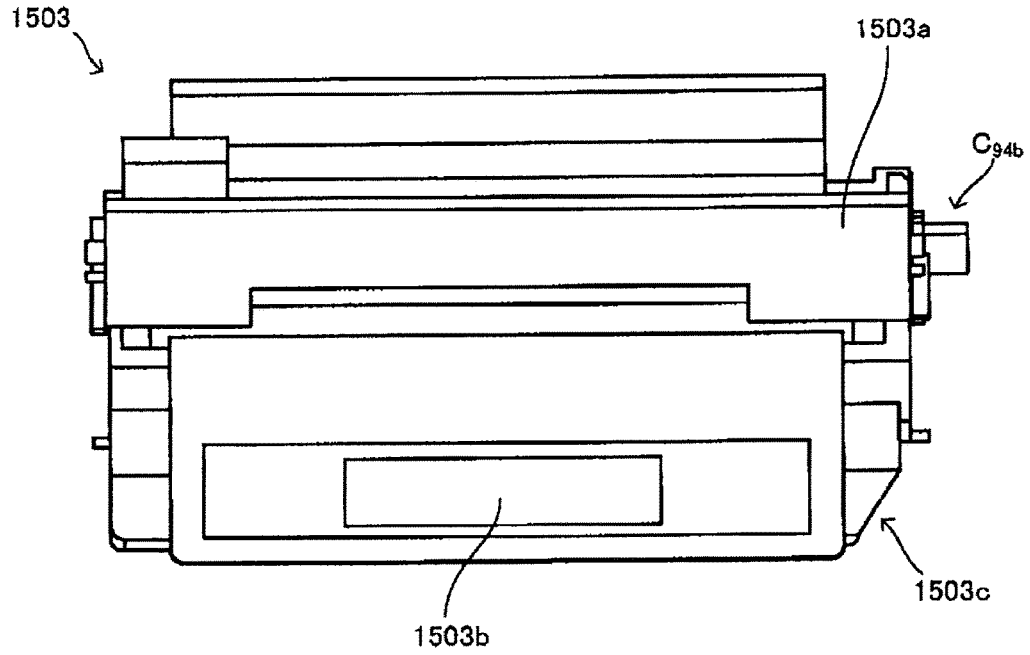
FIG. 94 is a plan view of a process cartridge 1503.

FIG. 94 is a plan view of a process cartridge 1503 provided with a housing 1503*a* of a seventh example. FIG. 94 illustrates a position of the end member (there is a case of being written as "driving side end member") on the side engaged with the driving shaft 70 of the apparatus main body 2 by an arrow $C_{94b}$. In the example, an operating portion 1503*b* is provided (the aspect of the operating portion is not particularly limited), and in the process cartridge 1503, an angle portion on the pulled-out side (lower part of the paper surface) on the driving side end member side includes a cutout 1503*c*. In the example, this functions as the inclingly pulling means. In the example, the cutout 1503*c* having an inclined surface is employed, but a step-like rectangular cutout may be employed. Since the inclingly pulling means does not interrupt inclining of the process cartridge when the user pulls out the process cartridge, smooth inclining is possible.

Above, by employing the process cartridge provided with the inclingly pulling means, the inclining pulling with the above-described inclination is likely to be performed. However, even when the inclingly pulling means is not provided, by a method of pulling the side opposite to the end member further on the driving shaft side than the center position in the width direction of the process cartridge illustrated by $C_{84a}$-$C_{84a}$ in FIG. 84, it is also similarly possible to tilt and inclingly pull out the process cartridge.

This application is based upon and claims the benefit of priority from Japanese Patent Application No. 2015-25819, filed Feb. 12, 2015, the content of which is incorporated herein by reference.

REFERENCE SIGNS LIST

1 IMAGE FORMING APPARATUS
2 IMAGE FORMING APPARATUS MAIN BODY
3 PROCESS CARTRIDGE
10 PHOTORECEPTOR DRUM UNIT
11 PHOTORECEPTOR DRUM (COLUMNAR ROTATING BODY)
20 LID MEMBER
30, 130, 230, 330, 430, 530, 630, 730 END MEMBER
40, 140, 240 BEARING MEMBER
50, 150, 250, 350, 450 SHAFT MEMBER
51, 151, 251 ROTATING SHAFT
55, 155, 252 ROTATING FORCE RECEIVING MEMBER
59, 159, 260, 360, 460 REGULATING MEMBER

The invention claimed is:

1. An end member which is disposed in an end portion of a columnar rotating body mounted on an image forming apparatus main body, comprising:

a tubular bearing member; and a shaft member held by the bearing member, wherein the shaft member comprises: a rotating shaft which oscillates within a range of 18° or less with respect to a direction along an axis of rotation of the bearing member; a rotating force receiving member which is disposed in one end portion of the rotating shaft and is provided with an engaging member which is engaged with a driving shaft of the image forming apparatus main body; and a regulating member which is engaged with or disengaged from the rotating shaft or the rotating force receiving member by pressing, and switches a posture in which the engaging member is engaged with the driving shaft and a posture in which the engaging member is not engaged with the driving shaft.

2. The end member according to claim 1, wherein the rotating shaft and the rotating force receiving member have a shape of a tube, and at least a part of the regulating member is disposed on an inner side of the shape of a tube of the rotating shaft and the rotating force receiving member.

3. The end member according to claim 1, wherein a posture in which relative rotation with respect to the bearing member is freely performed and a posture in which relative rotation with respect to the bearing member is regulated, are switched to each other in the rotating force receiving member by the regulating member.

4. The end member according to claim 1, wherein a posture in which the engaging member of the rotating force receiving member protrudes and a posture in which the engaging member of the rotating force receiving member is caved are switched to each other by the regulating member.

5. A photoreceptor drum unit, comprising:

a photoreceptor drum which is a columnar rotating body; and the end member according to claim 1 which is attached to at least one end portion in the axial direction of the photoreceptor drum.

6. A process cartridge comprising:

a housing; and the photoreceptor drum unit according to claim 5 which is held by the housing.

7. The process cartridge according to claim 6, wherein inclininglyy pulling means which is means for inclining the housing with respect to the pulling-out direction when pulling out the housing is provided in the housing.

8. The process cartridge according to claim 7, wherein the inclininglyy pulling means is means disposed being deviated to a side opposite to the end member to be engaged with the driving shaft of the image forming apparatus main body, from the center in a width direction of the housing.

9. The process cartridge according to claim 8, wherein the inclininglyy pulling means, which is disposed being deviated to the side opposite to the side on which the end member to be engaged with the driving shaft of the image forming apparatus main body, from the center in the width direction of the housing, is a recessed operating portion provided in the housing.

10. The process cartridge according to claim 7, wherein the inclininglyy pulling means is means which is disposed being deviated to the same side as the end member to be engaged with the driving shaft of the image forming apparatus main body, from the center in the width direction of the housing.

11. The process cartridge according to claim 10, wherein the inclininglyy pulling means is means which blocks a part of the recessed operating portion provided in the housing.

12. The process cartridge according to claim 7, wherein the inclininglyy pulling means is a mark which encourages to operate a part to be operated and is provided in the housing.

13. The process cartridge according to claim 7, wherein the inclininglyy pulling means has a surface which is for operating when pulling out the housing and is inclined with respect to the width direction of the housing.

14. A developing roller unit, comprising:

a developing roller which is a columnar rotating body; and the end member according to claim 1 which is attached to at least one end portion in the axial direction of the developing roller.

15. A process cartridge comprising:

a housing; and the developing roller unit according to claim 14 which is held by the housing.

16. A process cartridge which is mounted on an image forming apparatus main body, comprising:

a housing; and a photoreceptor drum unit which is disposed in the housing, wherein the photoreceptor drum unit includes a photoreceptor drum and an end member disposed in at least one end portion of the photoreceptor drum, wherein the end member includes a tubular bearing member and a shaft member held by the bearing member, wherein the shaft member includes a rotating shaft which oscillates within a range of 18° or less with respect to a direction along an axis of rotation of the bearing member, and is movable in the axial direction, wherein the housing includes a recessed operating portion which is used when a user pulls out the process cartridge from the image forming apparatus main body, and wherein the operating portion is provided being deviated to a side opposite to the end member side to be engaged with a driving shaft of the image forming apparatus main body, from the center in a width direction that is a direction in which the axis of the photoreceptor drum unit extends.

17. A process cartridge which is mounted on an image forming apparatus main body, comprising:

a housing; and a photoreceptor drum unit which is disposed in the housing, wherein the photoreceptor drum unit includes a photoreceptor drum and an end member disposed in at least one end portion of the photoreceptor drum, wherein the end member includes a tubular bearing member and a shaft member held by the bearing member, wherein the shaft member includes a rotating shaft which oscillates within a range of 18° or less with respect to a direction along an axis of rotation of the bearing member, and is movable in the axial direction, wherein the housing includes a recessed operating portion which is used when a user pulls out the process cartridge from the image forming apparatus main body, and wherein the operating portion is provided while blocking a pan of the recessed operating portion which is the end member side to be engaged with a driving shaft of the image forming apparatus main body rather than the center in a width direction that is a direction in which the axis of the photoreceptor drum unit extends.

* * * * *